US008146492B2

(12) United States Patent
Ikeda

(10) Patent No.: US 8,146,492 B2
(45) Date of Patent: Apr. 3, 2012

(54) PRINTING STATE AUTOMATIC SWITCHING APPARATUS AND METHOD

(75) Inventor: Hiroshi Ikeda, Ibaraki (JP)

(73) Assignee: Komori Corporation, Tokyo (JP)

( * ) Notice: Subject to any disclaimer, the term of this patent is extended or adjusted under 35 U.S.C. 154(b) by 916 days.

(21) Appl. No.: 11/804,629

(22) Filed: May 17, 2007

(65) Prior Publication Data

US 2007/0277692 A1 Dec. 6, 2007

(30) Foreign Application Priority Data

Jun. 5, 2006 (JP) ..... 2006-155998

(51) Int. Cl.
*B41F 21/10* (2006.01)
*B41F 21/00* (2006.01)
*B41F 33/00* (2006.01)

(52) U.S. Cl. ..... 101/229; 101/231; 101/484

(58) Field of Classification Search ..... 101/229, 101/230, 231, 483, 484
See application file for complete search history.

(56) References Cited

U.S. PATENT DOCUMENTS

| | | | | |
|---|---|---|---|---|
| 4,014,261 | A * | 3/1977 | Becker | 101/230 |
| 5,076,164 | A * | 12/1991 | Becker | 101/183 |
| 6,684,778 | B2 * | 2/2004 | Sasaki | 101/229 |
| 6,848,363 | B2 * | 2/2005 | Becker | 101/222 |
| 7,104,194 | B2 * | 9/2006 | Aoki | 101/230 |
| 7,228,799 | B2 * | 6/2007 | Maruyama et al. | 101/230 |
| 2002/0174785 | A1 | 11/2002 | Sasaki | |

FOREIGN PATENT DOCUMENTS

| | | | |
|---|---|---|---|
| JP | 04-085041 | A | 3/1992 |
| JP | 04-371835 | | 12/1992 |
| JP | 09-123421 | | 5/1997 |
| JP | 10-058654 | A | 3/1998 |
| JP | 2000-052535 | A | 2/2000 |
| JP | 2003-039634 | | 2/2003 |
| JP | 2005-081779 | A | 3/2005 |
| JP | 2005-088450 | A | 4/2005 |
| JP | 2005-088451 | A | 4/2005 |
| JP | 2005-089174 | A | 4/2005 |
| JP | 2005-089175 | A | 4/2005 |
| JP | 2005-090670 | A | 4/2005 |
| JP | 2006-155959 | | 6/2006 |

* cited by examiner

*Primary Examiner* — Judy Nguyen
*Assistant Examiner* — Leo T Hinze
(74) *Attorney, Agent, or Firm* — Blakely, Sokoloff, Taylor & Zafman

(57) ABSTRACT

A printing state automatic switching apparatus includes a printing state switching unit, abnormal end detection unit, and error recovery unit. The printing state switching unit automatically switches the printing state of a printing press from a first printing state to a second printing state through a plurality of switching steps. The abnormal end detection unit detects an abnormal end of each switching step of automatic switching from the first printing state to the second printing state. When the abnormal end detection unit detects an abnormal end of a switching step, the error recovery unit receives an error recovery instruction and eliminates the error of the switching step. A printing state automatic switching method is also disclosed.

12 Claims, 112 Drawing Sheets

PRINTING STATE AUTOMATIC SWITCHING APPARATUS AND METHOD

BACKGROUND OF THE INVENTION

The present invention relates to a printing state automatic switching apparatus and method which automatically switch the printing state of a printing press from a first printing state to a second printing state.

Along with diversification of printing, various kinds of sheet-fed offset printing presses equipped with a convertible press mechanism have been proposed and put into practical use. A single sheet-fed offset printing press equipped with a convertible press mechanism can selectively perform single-sided printing and double-sided printing. Reference 1 (Japanese Patent Laid-Open No. 10-58654) and reference 2 (Japanese Patent Laid-Open No. 4-85041) describe examples.

A conventional sheet-fed offset printing press equipped with a convertible press mechanism displays the progress of automatic switching from a single-sided printing state to a double-sided printing state, automatic switching from a double-sided printing state to a single-sided printing state, or automatic change of the paper size in a double-sided printing state. If something unusual occurs during an operation, an operator manually returns the mode to the single-sided printing state while checking the display.

For this reason, the conventional sheet-fed offset printing press equipped with a convertible press mechanism requires an enormous labor and a very long time to return to the single-sided printing state. Additionally, the operation of returning to the single-sided printing state is very complex. Any operator of the print shop cannot do the operation. Instead, the shop must request the maker of the printing press to dispatch a serviceman for the operation. It is impossible to print during that time, resulting in very low level of capacity utilization.

SUMMARY OF THE INVENTION

The present invention has been made to solve the above-described problems, and has as its object to allow even an inexperienced operator to easily and quickly deal with an error that has occurred during automatic switching of a printing state.

In order to achieve the above object, according to the present invention, there is provided a printing state automatic switching apparatus comprising printing state switching means for automatically switching a printing state of a printing press from a first printing state to a second printing state through a plurality of switching steps, abnormal end detection means for detecting an abnormal end of each switching step of automatic switching from the first printing state to the second printing state by the printing state switching means, and error recovery means for, when the abnormal end detection means detects an abnormal end of a switching step, receiving an error recovery instruction and eliminating the error of the switching step with the detected abnormal end.

There is also provided a printing state automatic switching method comprising the steps of automatically switching a printing state of a printing press from a first printing state to a second printing state through a plurality of switching steps, detecting an abnormal end of each switching step of automatic switching from the first printing state to the second printing state, and when an abnormal end of a switching step is detected, receiving an error recovery instruction and eliminating the error of the switching step with the detected abnormal end.

BRIEF DESCRIPTION OF THE DRAWINGS

FIGS. 9A to 9J are flowcharts for explaining an error recovery operation (including part of retry and automatic return) during automatic switching from a single-sided printing state to a double-sided printing state;

DESCRIPTION OF THE PREFERRED EMBODIMENT

The present invention will be described below in detail with reference to the accompanying drawings.

[Arrangement of Sheet-Fed Offset Printing Press Equipped with Convertible Press Mechanism]

Figure 1:
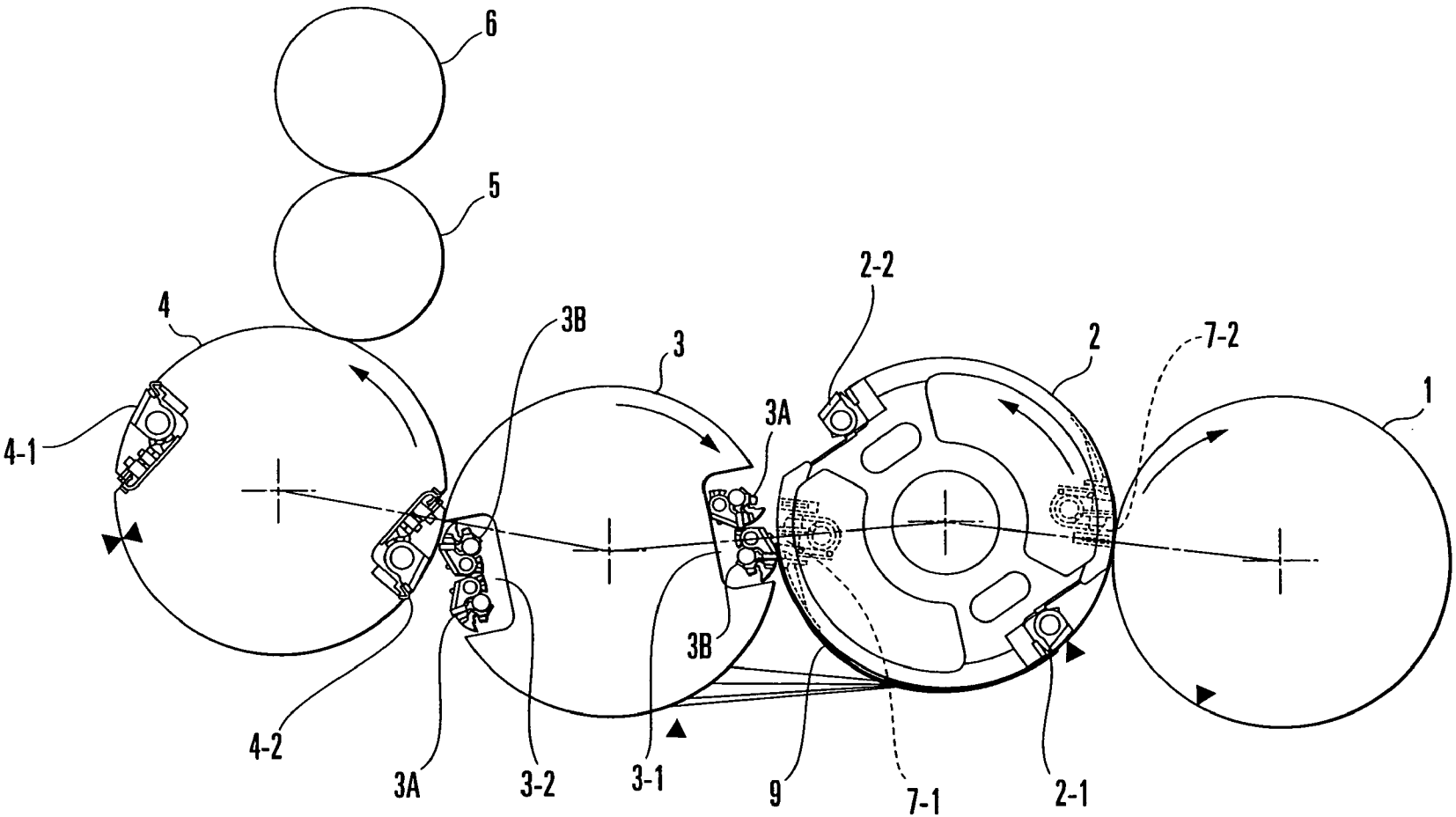
FIG. 1 is a view showing an example of the cylinder arrangement of a sheet-fed offset printing press equipped with a convertible press mechanism.

A sheet-fed offset printing press equipped with a convertible press mechanism shown in FIG. 1 includes a transfer cylinder 1, suction cylinder 2, convertible cylinder 3, and impression cylinder 4 from upstream to downstream in the paper transport direction. Their circumferential surfaces are in contact with each other. A plate cylinder 6 is provided with respect to the impression cylinder 4 while sandwiching a blanket cylinder 5. The transfer cylinder 1, suction cylinder 2, convertible cylinder 3, impression cylinder 4, blanket cylinder 5, and plate cylinder 6 are connected to each other via gears and rotatably driven by a drive motor.

The suction cylinder 2 has gripper units (to be referred to as suction grippers hereinafter) 2-1 and 2-2 including grippers and gripper pads at positions to halve the circumferential surface. The suction cylinder 2 also has air inlets (to be referred to as suckers hereinafter) 7-1 and 7-2 at positions separated from the suction grippers 2-1 and 2-2 by a predetermined rotation angle. A plurality of suckers 7-1 and 7-2 are juxtaposed in the axial direction of the suction cylinder 2. It is possible to adjust the positions of the suckers 7-1 and 7-2 with respect to the suction grippers 2-1 and 2-2 in the circumferential direction of the suction cylinder 2.

Figure 2:
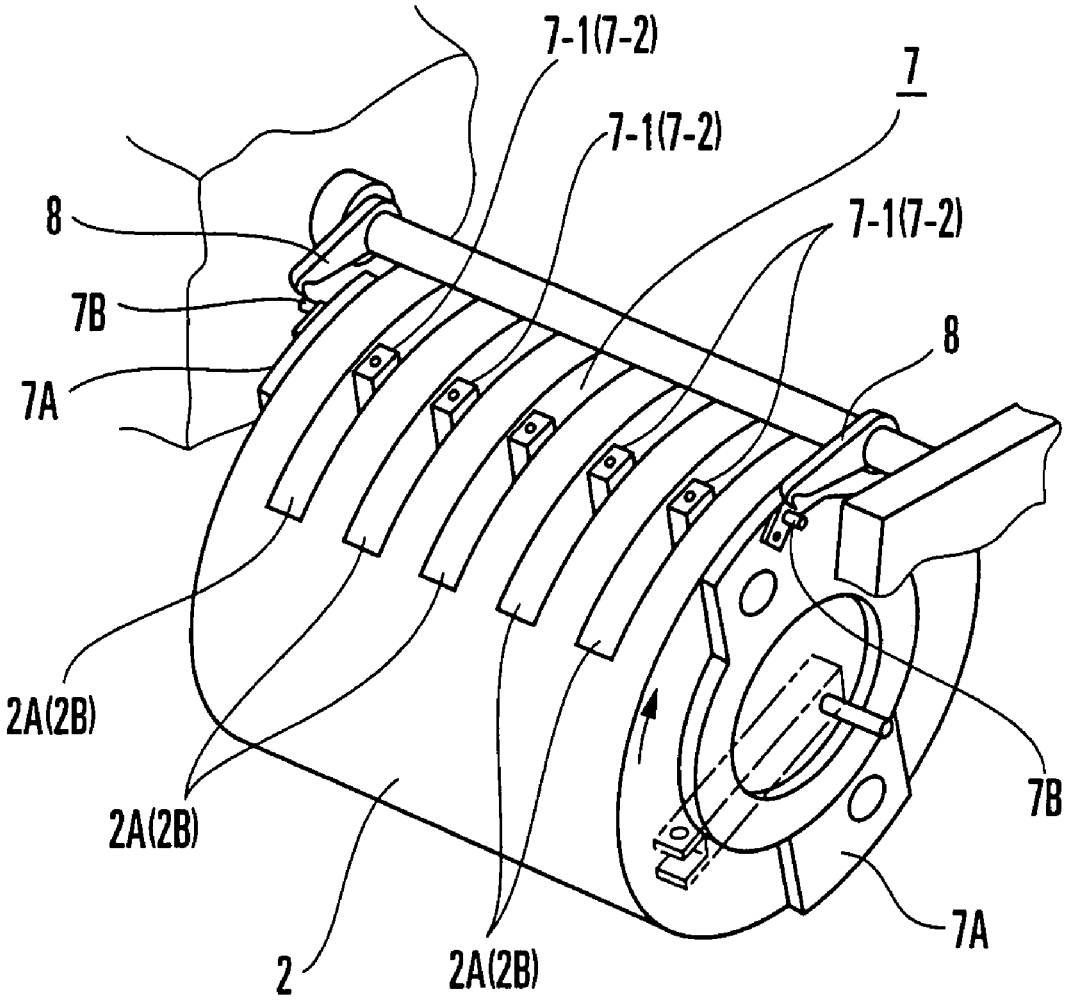
FIG. 2 is a view showing an installation example of a suction head in a suction cylinder.

As shown in FIG. 2, the suction cylinder 2 has a plurality of grooves 2A circumferentially formed in part of the cylinder. The suction cylinder 2 also has similar grooves 2B on the opposite side of the grooves 2A. The suckers 7-1 and 7-2 whose positions in the circumferential direction are adjustable are provided in the grooves 2A and 2B. The suckers 7-1 and 7-2 pivot together with support members 7A located on both sides of the suction cylinder 2. The support members 7A and suckers 7-1 and 7-2 form a suction head 7.

The suction cylinder 2 has suction head hooks 8 above it on the frame side. Pins 7B of the support members 7A catch the suction head hooks 8. In this state, the fixed state between the suction cylinder 2 and the support members 7A is canceled to make the suction cylinder 2 pivot, thereby adjusting the circumferential positional relationship (phase) between the suction grippers 2-1 and 2-2 and the suckers 7-1 and 7-2.

As shown in FIG. 1, the convertible cylinder 3 has notches 3-1 and 3-2 at positions to halve the circumferential surface. Each of the notches 3-1 and 3-2 incorporates first gripper units (to be referred to as A-grippers hereinafter) 3A and second gripper units (to be referred to as B-grippers hereinafter) 3B. The gripper units including grippers and gripper pads are arranged adjacent to each other in the circumferential direction. In this example, the A-grippers 3A and B-grippers 3B in the notch 3-1 will be referred to as A-grippers and B-grippers on an A surface. The A-grippers 3A and B-grippers 3B in the notch 3-2 will be referred to as A-grippers and B-grippers on a B surface.

The impression cylinder 4 gripper units (to be referred to as impression cylinder grippers hereinafter) 4-1 and 4-2 including grippers and gripper pads are disposed at positions to halve the circumferential surface. The impression cylinder grippers 4-1 face the A-grippers 3A on the A surface of the convertible cylinder 3 as the cylinder rotates. The impression cylinder grippers 4-2 face the A-grippers 3A on the B surface of the convertible cylinder 3 as the cylinder rotates.

The suction grippers 2-1 and 2-2 of the suction cylinder 2 and the impression cylinder grippers 4-1 and 4-2 of the impression cylinder 4 have cam mechanisms that open/close the grippers interlockingly with rotation of the machine. The A-grippers 3A and B-grippers 3B on the A and B surfaces of the convertible cylinder 3 have cam mechanisms that open/close or turn the grippers interlockingly with rotation of the machine.

In the example shown in FIG. 1, the printing state has switched to a double-sided printing state. In this sheet-fed offset printing press equipped with a convertible press mechanism, a paper sheet (sheet) 9 moves from the transfer cylinder 1 to the suction cylinder 2. The suction grippers 2-1 grip the leading edge of the paper sheet, and the suckers 7-1 suck the trailing edge to apply a tension to the paper sheet 9 in the circumferential and lateral directions and accurately position it. As indicated by the bold line in FIG. 1, the paper sheet 9 is transported with its first surface (obverse surface) facing up until the trailing edge reaches the contact point between the suction cylinder 2 and the convertible cylinder 3.

At this time, the suckers 7-1 release the sheet, and the B-grippers 3B on the A surface of the convertible cylinder 3 open and grip the trailing edge of the paper sheet 9. Simultaneously, the suction grippers 2-1 release the paper sheet 9. The convertible cylinder 3 transports the paper sheet 9 with its trailing edge ahead. Halfway through the transportation, the B-grippers 3B on the A surface turn and transfer the trailing edge of the paper sheet 9 to the A-grippers 3A on the A surface on standby. When the A-grippers 3A on the A surface turn, rise, and face the impression cylinder grippers 4-1 of the impression cylinder 4, the impression cylinder grippers 4-1 grip the trailing edge of the paper sheet 9 to transport it. The paper sheet 9 gripped by the impression cylinder grippers 4-1 passes between the blanket cylinder 5 and the impression cylinder 4 while making its second surface (reverse surface) contact the blanket cylinder 5. Hence, the reverse surface is printed. The paper sheet with both surfaces printed is fed downstream.

[Switching from Double-Sided Printing State to Single-Sided Printing State]

To switch the printing state from double-sided printing to single-sided printing in this sheet-fed offset printing press equipped with a convertible press mechanism, the rotation phase of the upstream cylinder group including the suction cylinder 2 with respect to the convertible cylinder 3 is adjusted without making the convertible cylinder 3 pivot. With this adjustment, the state wherein the B-grippers 3B on the A surface of the convertible cylinder 3 correspond to the suckers 7-1 of the suction cylinder 2 changes to a state wherein the A-grippers 3A on the A surface of the convertible cylinder 3 correspond to the suction grippers 2-1 of the suction cylinder 2. Other related parts are also adjusted. W gears are used to adjust the rotation phase of the upstream cylinder group including the suction cylinder 2 with respect to the convertible cylinder 3. The W gears include a first gear and a second gear. The first gear is disengaged from the second gear to disconnect the convertible cylinder 3 from the suction cylinder 2. In the state wherein the W gears are disengaged, the rotation phase of the upstream cylinder group including the suction cylinder 2 with respect to the convertible cylinder 3 is adjusted. After that, the W gears are engaged to connect the suction cylinder 2 to the convertible cylinder 3.

[Switching from Single-Sided Printing State to Double-Sided Printing State]

Switching from a single-sided printing state to a double-sided printing state is done in the same way as in "switching from the double-sided printing state to the single-sided printing state". To change the paper size in the double-sided printing state, the relative phase between the suction grippers 2-1 and 2-2 and the suckers 7-1 and 7-2 on the suction cylinder 2 is adjusted.

In the above-described reference 1, switching of the printing state (switching from the single-sided printing state to the double-sided printing state, switching from the double-sided printing state to the single-sided printing state, and paper size change in the double-sided printing state) is automatically done. This allows even an inexperienced operator to easily switch the printing state in a shorter operation time.

In association with the arrangement of the above-described convertible switching mechanism, reference 3 (Japanese Patent Laid-Open No. 2000-52535) discloses "gripper open/close cam of suction cylinder and phase adjusting method of upstream cylinders". Reference 4 (Japanese Patent Laid-Open No. 2005-81779) discloses "moving mechanism of gripper open/close cam of suction cylinder". Reference 5 (Japanese Patent Laid-Open No. 2005-88450) discloses "mechanism for adjusting positions of suckers (suction head) of suction cylinder in accordance with paper size in single- and double-sided printing". Reference 6 (Japanese Patent Laid-Open No. 2005-88451) and reference 7 (Japanese Patent Laid-Open No. 2005-90670) disclose "W gear engaging/disengaging mechanism for phase adjustment of upstream cylinders". Reference 8 (Japanese Patent Laid-Open No. 2005-89174) and reference 9 (Japanese Patent Laid-Open No. 2005-89175) disclose "convertible grippers (A- and B-grippers) of convertible cylinder".

Outline of Embodiment

Figure 3:
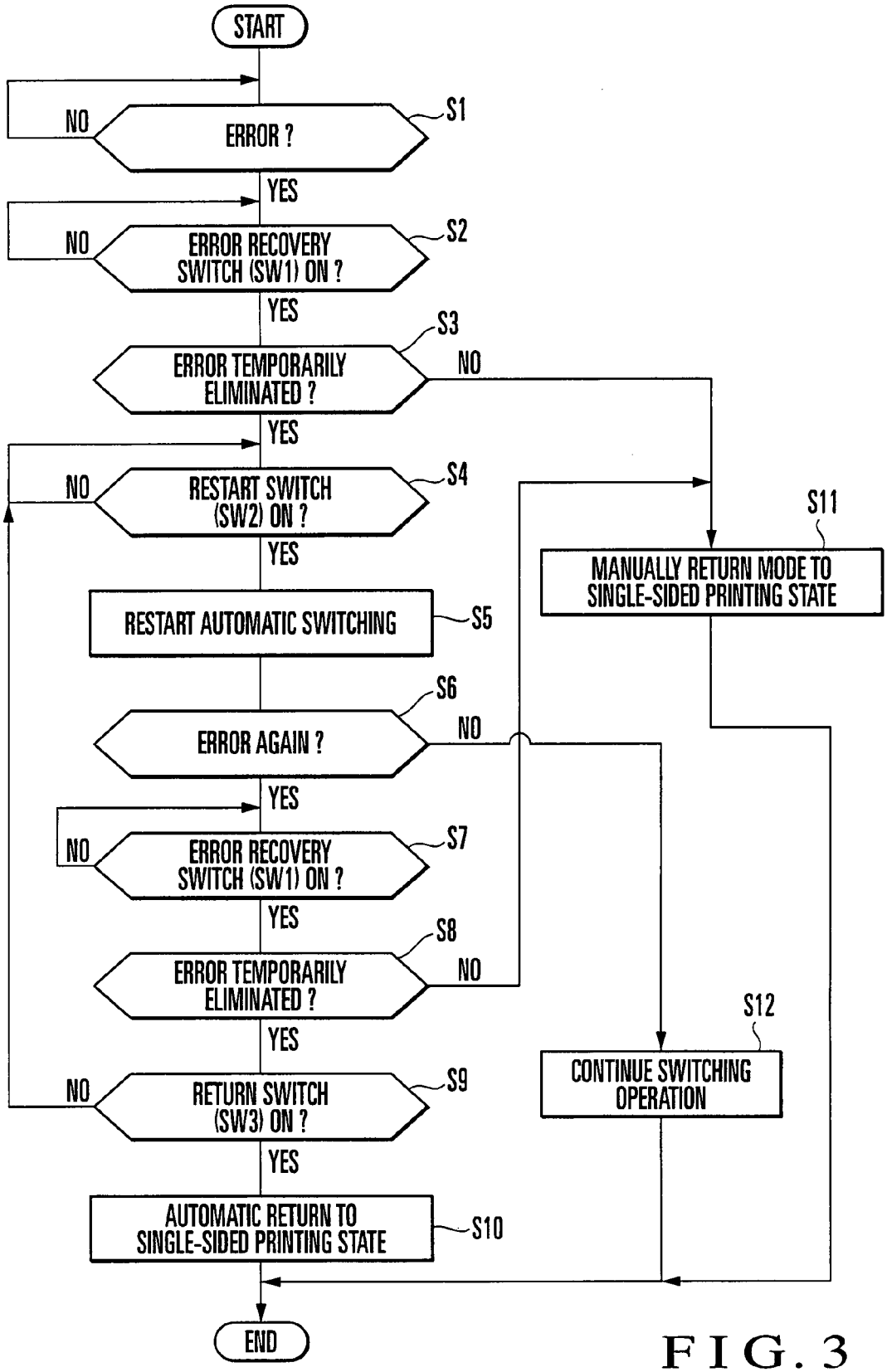
FIG. 3 is a flowchart for explaining the outline of an embodiment of the present invention.

The outline of an embodiment of the present invention will be described next with reference to the flowchart shown in FIG. 3.

Assume that the single-sided printing state automatically switches to the double-sided printing state in the sheet-fed offset printing press equipped with a convertible press mechanism shown in FIG. 1. Automatic switching from the single-sided printing state to the double-sided printing state is done through a plurality of switching steps. If an error occurs during automatic switching (YES in step S1), the switching step with the error finishes halfway (abnormal end), and the error is displayed.

Seeing this error display, the operator turns on an error recovery switch (SW1) (YES in step S2). The error display is turned off. Simultaneously, the error of the abnormally ended switching step is eliminated to return the switching step to the initial state. Depending on the contents of the error, it is impossible to eliminate the error of the abnormally ended switching step. In step S3, it is checked whether error recovery of the abnormally ended switching step has succeeded, i.e., the error is temporarily eliminated. If error recovery has failed, the operator manually returns the mode to the single-sided printing state (step S11).

If error recovery has succeeded, the operator turns on a restart switch SW2 (YES in step S4). Automatic switching to the double-sided printing state restarts from the switching step that has undergone error recovery (the switching step returned to the initial state) (step S5). With the restart (retry) of automatic switching, the abnormally ended switching step is executed again. If no error occurs (NO in step S6), the switching operation to the next switching step starts (step S12).

If an error has occurred again in step S6, the operator turns on the error recovery switch SW1 (YES in step S7) to eliminate the error again. In this case, the operator can repeatedly retry automatic switching to the double-sided printing state by operating the restart switch SW2 (repeat of steps S4 to S9).

Upon determining that there is no probability that the switching step will normally finish even in retry, the operator turns on a return switch SW3 (YES in step S9). The printing state of the printing press automatically returns to the state before the start of automatic switching to the double-sided printing state, i.e., the single-sided printing state (step S10).

Embodiment

Figure 4A:
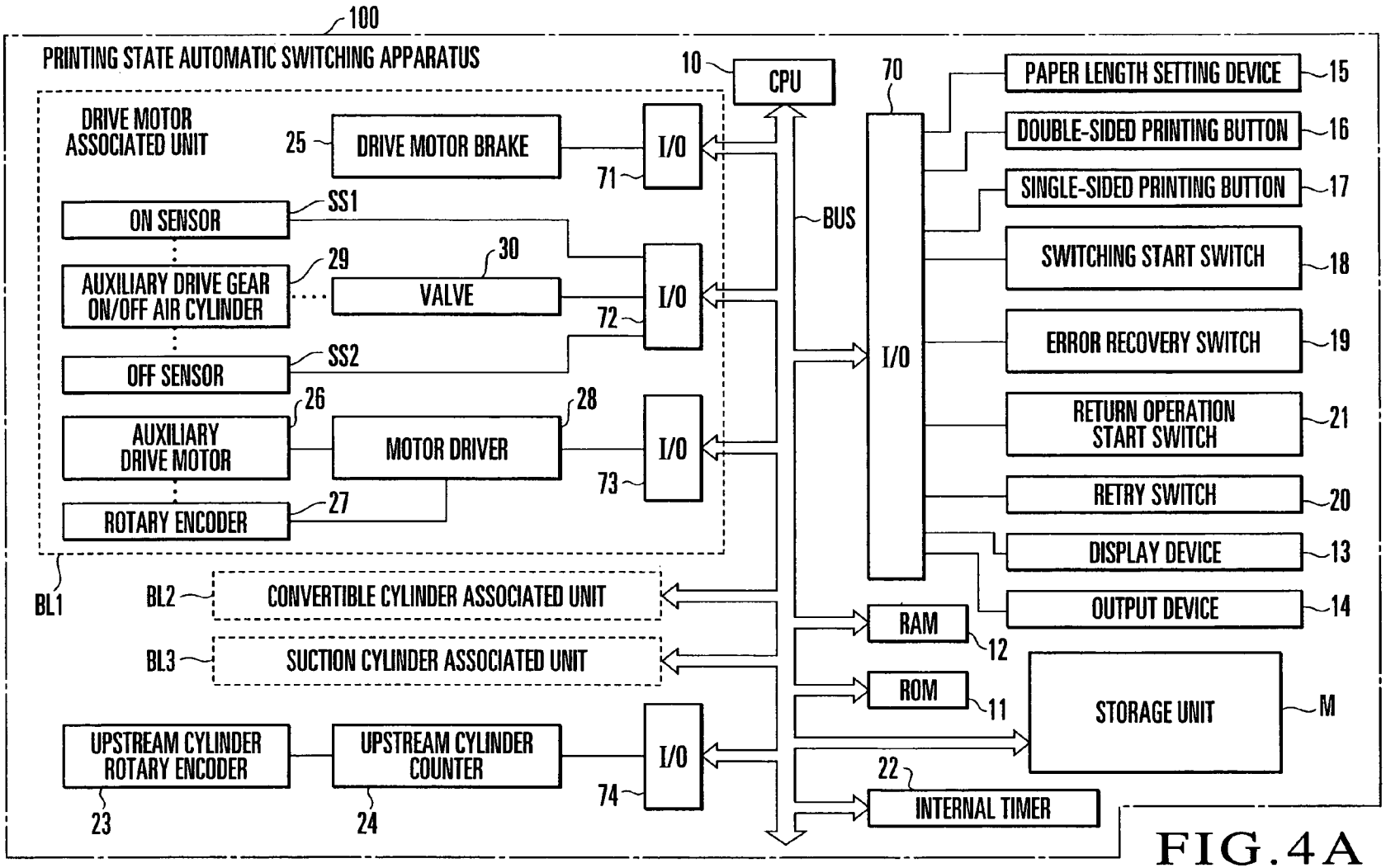
FIG. 4A is a block diagram showing a printing state automatic switching apparatus according to an embodiment of the present invention.

FIG. 4A shows a printing state automatic switching apparatus according to an embodiment of the present invention. A printing state automatic switching apparatus 100 is provided for the sheet-fed offset printing press equipped with a convertible press mechanism shown in FIG. 1 and automatically switches the printing state of the sheet-fed offset printing press equipped with a convertible press mechanism, including automatic switching from the single-sided printing state to the double-sided printing state, automatic switching from the double-sided printing state to the single-sided printing state, and automatic change of the paper size in the double-sided printing state.

The printing state automatic switching apparatus 100 includes a CPU 10, a ROM 11, a RAM 12, a storage unit M to store various set values and data, a display device 13, an output device (e.g., flexible disk drive or printer) 14, a paper length setting device 15 for setting the length of a paper sheet to be printed, buttons 16 and 17, switches 18 to 21, an internal timer 22, a rotary encoder 23, a counter 24, and an input/output interface (I/O) 74.

The button 16 is a double-sided printing button to instruct automatic switching to the double-sided printing state. The button 17 is a single-sided printing button to instruct automatic switching to the single-sided printing state.

The switch 18 is a switching start switch to instruct the start of automatic switching of the printing state. The switch 19 is an error recovery switch (SW1) to eliminate an error of an abnormally ended switching step. The switch 20 is a retry switch (SW2) to restart printing state automatic switching from a switching step that is abnormally ended and returned to the initial state. The switch 21 is a return operation start switch (SW3) to return a switching step that is abnormally ended and returned to the initial state to the printing state before the start of automatic switching.

The rotary encoder 23 detects the position of a cylinder upstream of the convertible cylinder 3. The counter 24 is an upstream cylinder position detection counter that counts a clock pulse from the rotary encoder 23. In this embodiment, the rotary encoder 23 is attached to the axial end of the transfer cylinder 1 located upstream of the suction cylinder 2.

Figure 4B:
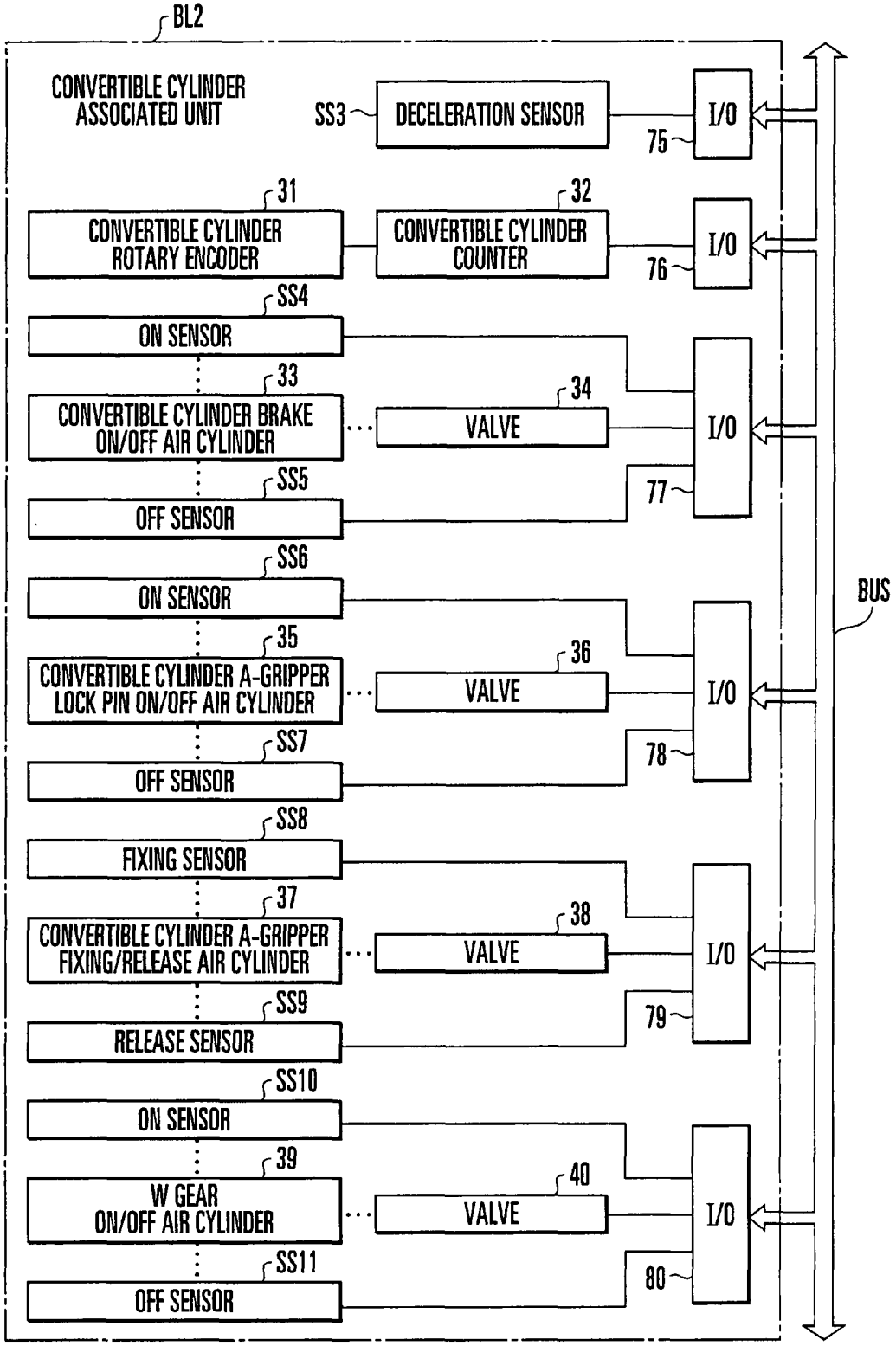
FIG. 4B is a block diagram showing the arrangement in a convertible cylinder associated unit in FIG. 4A.
Figure 4C:
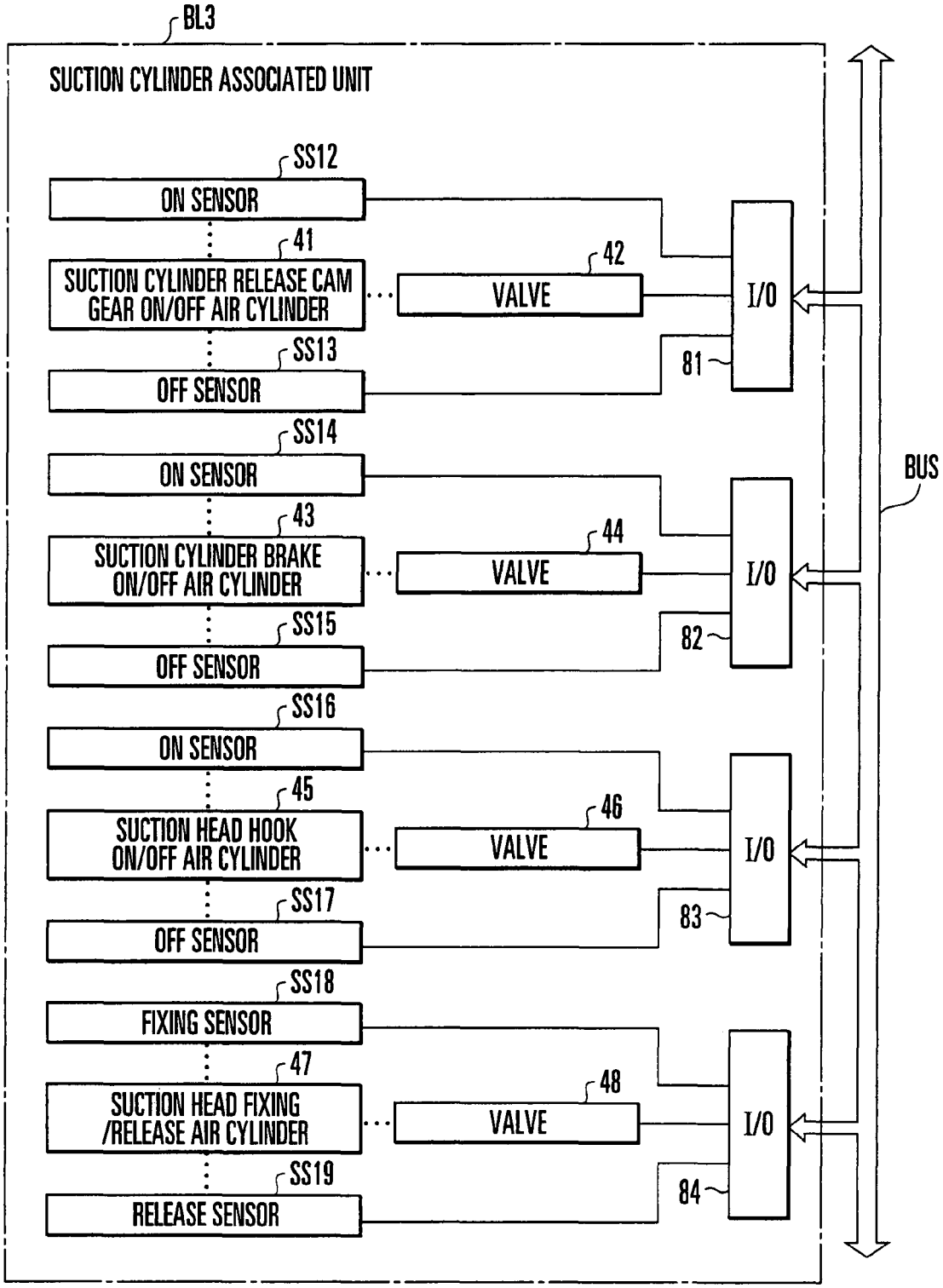
FIG. 4C is a block diagram showing the arrangement in a suction cylinder associated unit in FIG. 4A.

The printing state automatic switching apparatus 100 also has a drive motor associated unit BL1, convertible cylinder associated unit BL2, and suction cylinder associated unit BL3. The arrangement of the convertible cylinder associated unit BL2 is shown in FIG. 4B, and the arrangement of the suction cylinder associated unit BL3 is shown in FIG. 4C, as the space is limited.

[Drive Motor Associated Unit]

As shown in FIG. 4A, the drive motor associated unit BL1 includes a drive motor brake 25, auxiliary drive motor 26, rotary encoder 27, motor driver 28, air cylinder 29, valve 30, sensors SS1 and SS2, and input/output interfaces (I/Os) 71 to 73.

The rotary encoder (rotary encoder for auxiliary drive motor) 27 generates a clock pulse as the auxiliary drive motor 26 rotates. The motor driver (motor driver for auxiliary drive motor) 28 drives the auxiliary drive motor 26.

The air cylinder (auxiliary drive gear ON/OFF air cylinder) 29 engages/disengages an auxiliary drive gear that connects the auxiliary drive motor 26 to the machine. The valve (auxiliary drive gear ON/OFF air cylinder valve) 30 turns on/off compressed air to the air cylinder 29. The sensor (auxiliary drive gear ON sensor) SS1 confirms the ON state of the auxiliary drive gear. The sensor (auxiliary drive gear OFF sensor) SS2 confirms the OFF state of the auxiliary drive gear.

[Convertible Cylinder Associated Unit]

As shown in FIG. 4B, the convertible cylinder associated unit BL2 includes sensors SS3 to SS11, rotary encoder 31, counter 32, air cylinders 33, 35, 37 and 39, valves 34, 36, 38, and 40, and input/output interfaces (I/Os) 75 to 80.

The sensor (convertible cylinder home position determination deceleration sensor) SS3 detects a deceleration position when the convertible cylinder 3 stops at the home position (convertible cylinder home position).

The rotary encoder (convertible cylinder rotary encoder) 31 generates a clock pulse as the convertible cylinder 3 rotates. The counter (convertible cylinder position detection counter) 32 counts a clock pulse from the rotary encoder 31.

The air cylinder (convertible cylinder brake ON/OFF air cylinder) 33 applies/releases a brake on the convertible cylinder 3. The valve (convertible cylinder brake ON/OFF air cylinder valve) 34 turns on/off compressed air to the air cylinder 33. The sensor (convertible cylinder brake ON sensor) SS4 detects the ON state of the brake on the convertible cylinder 3. The sensor (convertible cylinder brake OFF sensor) SS5 detects the OFF state of the brake on the convertible cylinder 3.

The air cylinder (convertible cylinder A-gripper lock pin ON/OFF air cylinder) 35 engages/disengages lock pins with/from the A-grippers 3A of the convertible cylinder 3. The valve (convertible cylinder A-gripper lock pin ON/OFF air cylinder valve) 36 turns on/off compressed air to the air cylinder 35. The sensor (convertible cylinder A-gripper lock pin ON sensor) SS6 detects the ON state of the lock pins on the A-grippers 3A of the convertible cylinder 3. The sensor (convertible cylinder A-gripper lock pin OFF sensor) SS7 detects the OFF state of the lock pins on the A-grippers 3A of the convertible cylinder 3.

The air cylinder (convertible cylinder A-gripper fixing/release air cylinder) 37 fixes/releases the A-grippers 3A of the convertible cylinder 3. The valve (convertible cylinder A-gripper fixing/release air cylinder valve) 38 turns on/off compressed air to the air cylinder 37. The sensor (convertible cylinder A-gripper fixing sensor) SS8 detects the fixed state of the A-grippers 3A of the convertible cylinder 3. The sensor (convertible cylinder A-gripper release sensor) SS9 detects the release state of the A-grippers 3A of the convertible cylinder 3. A mechanism that causes the air cylinder 35 to engage/disengage the lock pins with/from the A-grippers 3A and a mechanism that causes the air cylinder 37 to fix/release the A-grippers 3A will be described later.

The air cylinder (W gear ON/OFF air cylinder) 39 engages/disengages the W gears that connect the convertible cylinder 3 to the suction cylinder 2. The valve (W gear ON/OFF air cylinder valve) 40 turns on/off compressed air to the air cylinder 39. The sensor (W gear ON sensor) SS10 detects engagement of the W gears. The sensor (W gear OFF sensor) SS11 detects disengagement of the W gears. The W gears are described in detail in references 6 and 7 above, and a description thereof will not be repeated here.

[Suction Cylinder Associated Unit]

As shown in FIG. 4C, the suction cylinder associated unit BL3 includes air cylinders 41, 43, 45 and 47, valves 42, 44, 46, and 48, sensors SS12 to SS19, and input/output interfaces (I/Os) 81 to 84.

The air cylinder (suction cylinder release cam gear ON/OFF air cylinder) 41 engages/disengages a clutch gear (to be referred to as a suction cylinder release cam gear hereinafter) provided in a driving path to move a cam that opens the suction grippers 2-1 and 2-2 of the suction cylinder 2. The valve (suction cylinder release cam gear ON/OFF air cylinder valve) 42 turns on/off compressed air to the air cylinder 41. The sensor (suction cylinder release cam gear ON sensor) SS12 detects the ON state of the suction cylinder release cam gear. The sensor (suction cylinder release cam gear OFF sensor) SS13 detects the OFF state of the suction cylinder release cam gear.

The air cylinder (suction cylinder brake ON/OFF air cylinder) 43 applies/releases a brake to/from the suction cylinder 2. The valve (suction cylinder brake ON/OFF air cylinder valve) 44 turns on/off compressed air to the air cylinder 43. The sensor (suction cylinder brake ON sensor) SS14 detects the ON state of the brake on the suction cylinder 2. The sensor (suction cylinder brake OFF sensor) SS15 detects the OFF state of the brake on the suction cylinder 2.

The air cylinder (suction head hook ON/OFF air cylinder) 45 engages/disengages the suction head hooks 8 with/from the pins 7B of the suction head 7 (FIG. 2). The valve (suction head hook ON/OFF air cylinder valve) 46 turns on/off compressed air to the air cylinder 45. The sensor (suction head hook ON sensor) SS16 detects the ON state of the suction head hook 8. The sensor (suction head hook OFF sensor) SS17 detects the OFF state of the suction head hook 8.

The air cylinder (suction head fixing/release air cylinder) 47 fixes/releases the suction head 7 on/from the suction cylinder 2. The valve (suction head fixing/release air cylinder valve) 48 turns on/off compressed air to the air cylinder 47. The sensor (suction head fixing sensor) SS18 detects the fixed state of the suction head 7 on the suction cylinder 2. The sensor (suction head release sensor) SS19 detects the release state of the suction head 7 from the suction cylinder 2.

Referring to FIGS. 4A to 4C, the CPU 10 connects to the units via a bus BUS. The CPU 10 operates in accordance with programs stored in the ROM 11 while obtaining various kinds of information received via the interfaces 70 to 84 and accessing the RAM 12 and storage unit M. The ROM 11 stores a printing state automatic switching program to automatically switch the printing state as a program specific to the embodiment. The printing state automatic switching program may be provided as a program recorded on a recording medium such as a CD-ROM. In this case, the program is read out from the recording medium and installed in the hard disk.

Figure 5A:
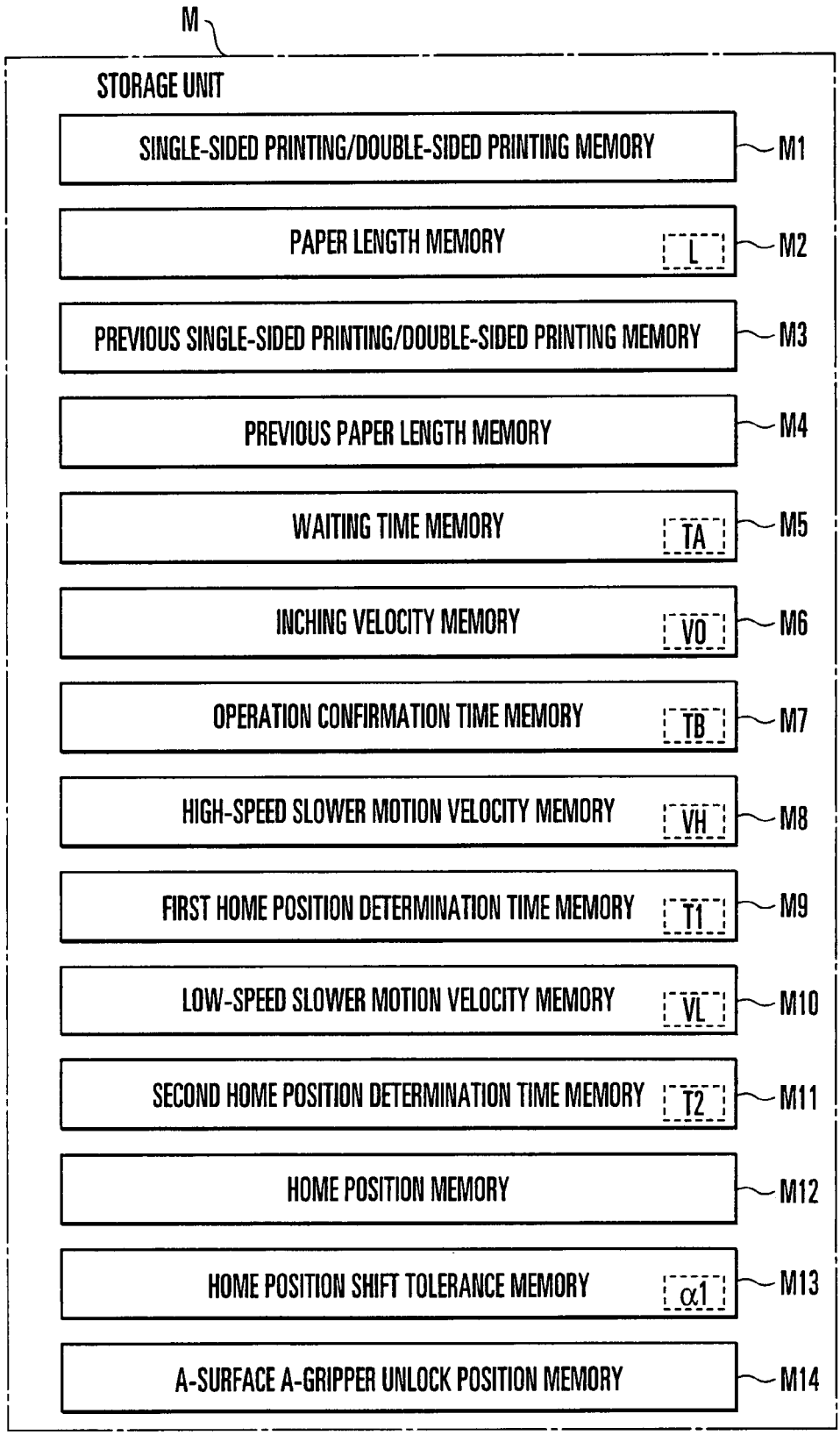
FIG. 5A is a block diagram divisionally showing the contents of memories in a storage unit in FIG. 4A.
Figure 5B:
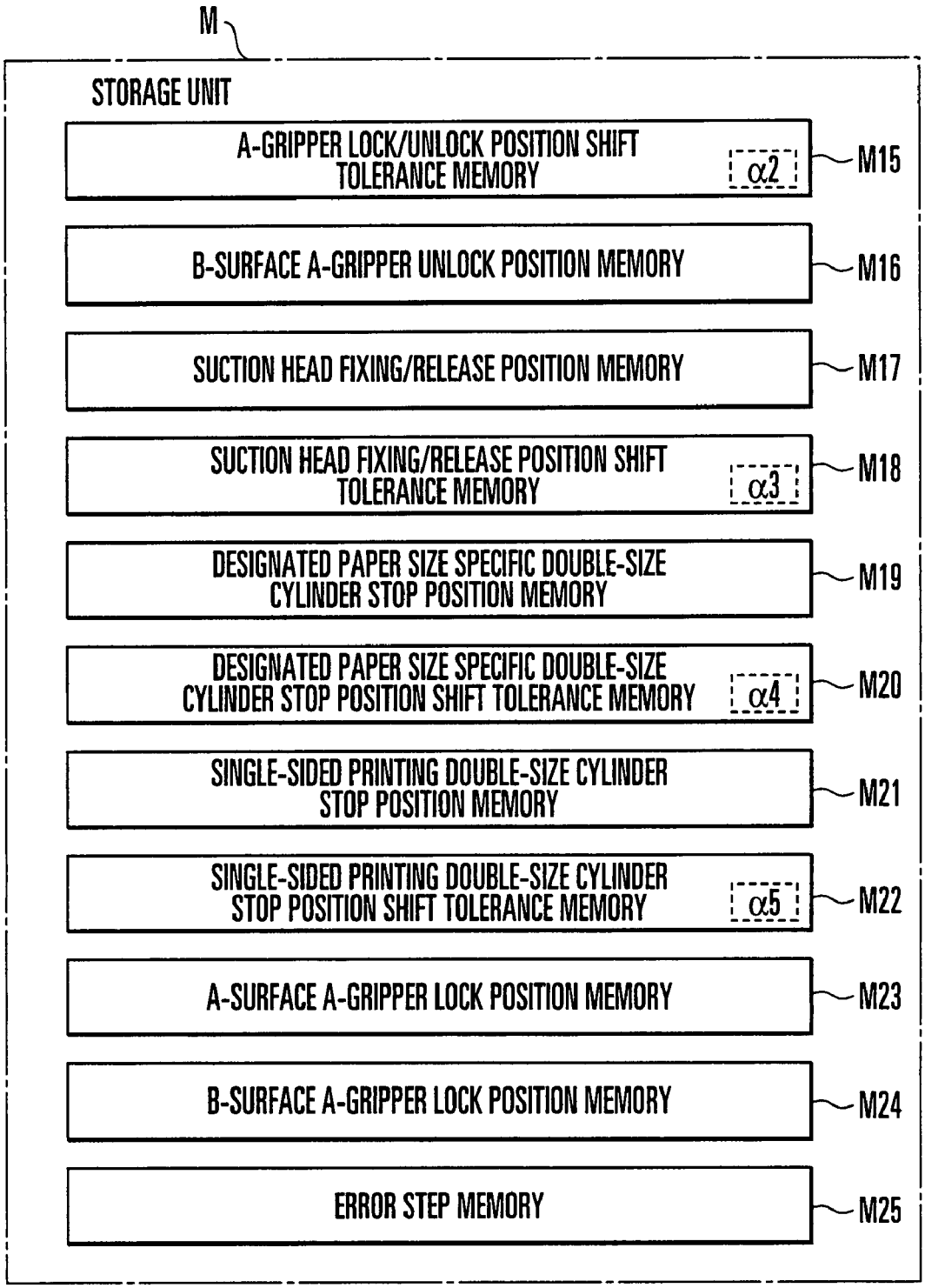
FIG. 5B is a block diagram divisionally showing the contents of memories in the storage unit in FIG. 4A.

The storage unit M includes memories M1 to M25 whose contents are divisionally shown in FIGS. 5A and 5B. The memory M1 is a single-sided printing/double-sided printing memory. The memory M2 is a paper length memory. The memory M3 is a previous single-sided printing/double-sided printing memory. The memory M4 is a previous paper length memory. The memory M5 is an auxiliary drive gear ON waiting time memory. The memory M6 is an auxiliary drive motor inching velocity memory. The memory M7 is an auxiliary drive gear ON sensor operation confirmation time memory. The memory M8 is an auxiliary drive motor high-speed slower motion velocity memory. The memory M9 is a first convertible cylinder home position determination time memory. The memory M10 is an auxiliary drive motor low-speed slower motion velocity memory. The memory M11 is a second convertible cylinder home position determination time memory. The memory M12 is a convertible cylinder home position memory. The memory M13 is a convertible cylinder home position shift tolerance memory. The memory M14 is a convertible cylinder A-surface A-gripper unlock position memory.

The memory M15 is a convertible cylinder A-gripper lock/unlock position shift tolerance memory. The memory M16 is a convertible cylinder B-surface A-gripper unlock position memory. The memory M17 is a suction head fixing/release position memory. The memory M18 is a suction head fixing/release position shift tolerance memory. The memory M19 is a designated paper size specific double-size cylinder stop position memory. The memory M20 is a designated paper size specific double-size cylinder stop position shift tolerance memory. The memory M21 is a single-sided printing double-size cylinder stop position memory. The memory M22 is a single-sided printing double-size cylinder stop position shift tolerance memory. The memory M23 is a convertible cylinder A-surface A-gripper lock position memory. The memory M24 is a convertible cylinder B-surface A-gripper lock position memory. The memory M25 is an error step memory.

An auxiliary drive gear ON waiting time TA is set in the memory M5. An inching velocity V0 of the auxiliary drive motor 26 is set in the memory M6. An auxiliary drive gear ON sensor operation confirmation time TB is set in the memory M7. A high-speed slower motion velocity VH of the auxiliary drive motor is set on the memory M8. A first convertible cylinder home position determination time T1 is set in the memory M9. A low-speed slower motion velocity VL of the auxiliary drive motor is set in the memory M10. A second convertible cylinder home position determination time T2 is set in the memory M11.

The home position of the convertible cylinder (convertible cylinder home position) is set in the memory M12. A tolerance (convertible cylinder home position shift tolerance) $\alpha 1$ for the home position of the convertible cylinder is set in the memory M13. The unlock position of the A-grippers on the A surface of the convertible cylinder is set in the memory M14. A tolerance (convertible cylinder A-gripper lock/unlock position shift tolerance) $\alpha 2$ for the lock/unlock position of the A-grippers of the convertible cylinder is set in the memory M15. The unlock position of the A-grippers on the B surface of the convertible cylinder is set in the memory M16.

The fixing/release position of the suction head (suction head fixing/release position) is set in the memory M17. A tolerance (suction head fixing/release position shift tolerance) $\alpha 3$ for the fixing/release position of the suction head is set in the memory M18. A tolerance (designated paper size specific double-size cylinder stop position shift tolerance) $\alpha 4$ for the double-size cylinder stop position (the stop position of the transfer cylinder 1) corresponding to a designated paper size is set in the memory M20. A single-sided printing double-size cylinder stop position is set in the memory M21. A tolerance (single-sided printing double-size cylinder stop position shift tolerance) $\alpha 5$ for a single-sided printing double-size cylinder stop position is set in the memory M22. The lock position of the A-grippers on the A surface of the convertible cylinder 3 is set in the memory M23. The lock position of the A-grippers on the B surface of the convertible cylinder 3 is set in the memory M24.

[ON/OFF Mechanism and Fixing/Release Mechanism of Lock Pins for A-Grippers of Convertible Cylinder]

Figure 6:
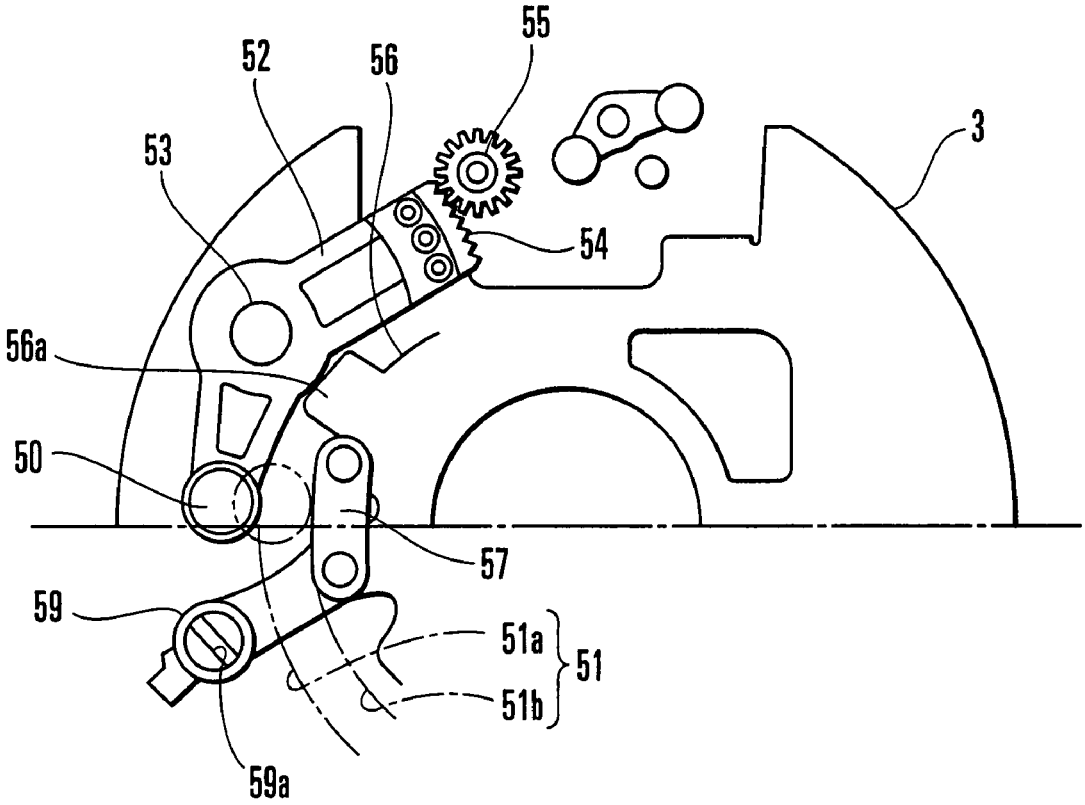
FIG. 6 is a view showing an example of a mechanism to turn the A-grippers of a convertible cylinder.

FIG. 6 shows an example of a mechanism to turn the A-grippers of the convertible cylinder 3. In this mechanism, when a cam follower 50 contacts a large diameter portion 51*a* of a convertible cam 51, a cam lever 52 pivots clockwise in FIG. 6 about a cam lever shaft 53. A pinion 55 meshing with a segment gear 54 pivots counterclockwise. The A-grippers 3A in FIG. 1 turn and rise. On the other hand, when the cam follower 50 contacts a small diameter portion 51*b* of the convertible cam 51, the cam lever 52 pivots counterclockwise in FIG. 6 about the cam lever shaft 53. The pinion 55 meshing with the segment gear 54 pivots clockwise. The A-grippers 3A turn and fall.

In this embodiment, in addition to the mechanism to turn the A-grippers 3A of the convertible cylinder 3, a mechanism to fix the A-grippers 3A in the rise state is provided. In this example, a stop cam 56 is provided. A projecting portion 56*a* of the stop cam 56 is brought into contact with the cam follower 50 by adjusting the position of the stop cam 56 via a link mechanism 57, thereby fixing the A-grippers 3A in the rise state.

Figure 7A:
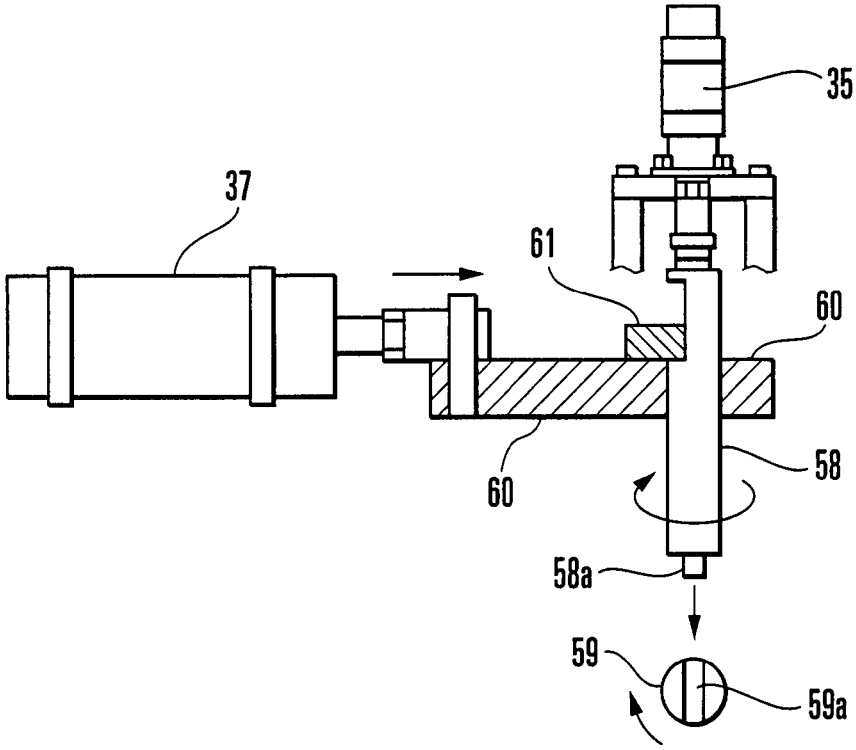
FIG. 7A is a side view showing the main part of a mechanism to adjust the position of a stop cam.
Figure 7B:
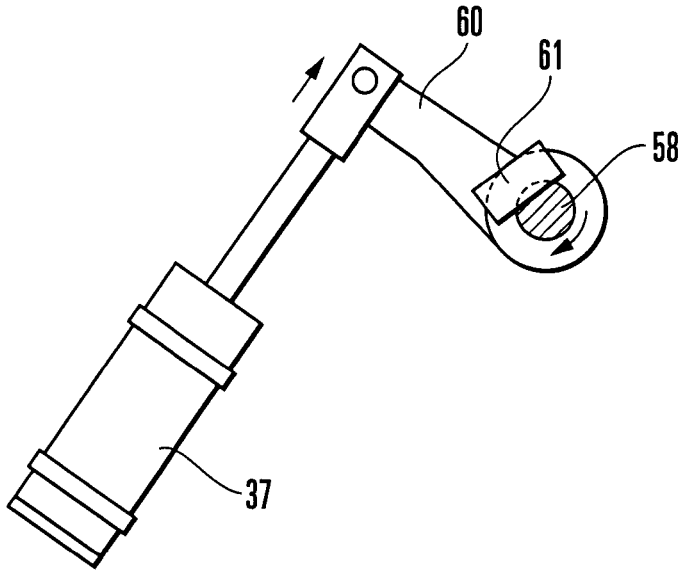
FIG. 7B is a plan view showing the main part of a mechanism to adjust the position of a stop cam.

FIG. 7A shows the main part of a mechanism to adjust the position of the stop cam 56. This mechanism uses the convertible cylinder A-gripper lock pin ON/OFF air cylinder 35 and the convertible cylinder A-gripper fixing/release air cylinder 37. A lock pin 58 to adjust the position of the stop cam 56 is attached to the convertible cylinder A-gripper lock pin ON/OFF air cylinder 35. FIG. 7B shows a plan view of the main part in FIG. 7A.

A distal end 58*a* of the lock pin 58 enters an engaging groove 59*a* of a position adjusting unit 59 connected to the link mechanism 57 and rotates to adjust the position of the stop cam 56 so that the A-grippers 3A in a turn enable state (A-gripper release state) can be fixed in the rise state (A-grippers fixed state). In this operation, the convertible cylinder A-gripper lock pin ON/OFF air cylinder 35 serves as a means for moving the lock pin 58 to/from the engaging groove 59*a* of the position adjusting unit 59. The convertible cylinder A-gripper fixing/release air cylinder 37 serves as a means for rotating the lock pin 58.

In this embodiment, when a release signal is given to the convertible cylinder A-gripper fixing/release air cylinder valve 38 (FIG. 4B), an arm 60 attached to the convertible cylinder A-gripper fixing/release air cylinder 37 shown in FIG. 7B pivots clockwise. The lock pin 58 pushed by a block 61 fixed on the arm 60 pivots clockwise so that the rotation angular position of the lock pin 58 changes to a position (A-gripper release position) to release the A-grippers. When a fixing signal is given to the convertible cylinder A-gripper fixing/release air cylinder valve 38 (FIG. 4B), the arm 60 attached to the convertible cylinder A-gripper fixing/release air cylinder 37 pivots counterclockwise. The lock pin 58 pushed by the block 61 fixed on the arm 60 pivots counterclockwise so that the rotation angular position of the lock pin 58 changes to a position (A-gripper fixing position) to fix the A-grippers.

When an ON signal is given to the convertible cylinder A-gripper lock pin ON/OFF air cylinder valve 36 (FIG. 4B), the lock pin 58 attached to the convertible cylinder A-gripper lock pin ON/OFF air cylinder 35 shown in FIG. 7A moves toward the position adjusting unit 59. When an OFF signal is given to the convertible cylinder A-gripper lock pin ON/OFF air cylinder valve 36 (FIG. 4B), the lock pin 58 attached to the convertible cylinder A-gripper lock pin ON/OFF air cylinder 35 moves backward from the position adjusting unit 59.

The process operation of the CPU 10 according to the printing state automatic switching program will be described below with reference to a series of flowcharts divisionally shown in FIGS. 8A to 8T, 9A to 9J, 10A to 10M, 11A to 11Q, 12A to 12I, 13A to 13L, 14A to 14J, 15A to 15F, and 16A to 16D. The description will be done with reference to Tables 1 to 9 below as needed.

Table 1 shows the relationship between switching steps in automatic switching from the single-sided printing state to the double-sided printing state and the error contents and error numbers in the switching operation.

TABLE 1

| Switching Step | Convertible Switching Operation (step name) | Error Contents in Switching Operation |
|---|---|---|
| 1 | auxiliary drive gear ON operation | |
| 2 | auxiliary motor inching rotation | auxiliary drive gear operation error |
| 3 | home position determination | convertible cylinder home position stop position error |
| 4 | convertible cylinder brake ON | convertible cylinder brake operation error |
| 5 | convertible cylinder brake OFF | convertible cylinder brake operation error |
| 6 | convertible cylinder A-surface A-gripper unlock position determination | convertible cylinder A-gripper fixing/release position error |
| 7 | convertible cylinder brake ON | convertible cylinder brake operation error |
| 8 | convertible cylinder A-gripper lock pin ON | convertible cylinder A-gripper lock pin operation error |
| 9 | convertible cylinder A-gripper unlock | convertible cylinder A-gripper fixing/release operation error |
| 10 | convertible cylinder A-gripper lock pin OFF | convertible cylinder A-gripper lock pin operation error |
| 11 | convertible cylinder brake OFF | convertible cylinder brake operation error |
| 12 | convertible cylinder B-surface A-gripper unlock position determination | convertible cylinder A-gripper fixing/release position error |
| 13 | convertible cylinder brake ON | convertible cylinder brake operation error |
| 14 | convertible cylinder A-gripper fixing operation (return) | convertible cylinder A-gripper fixing/release operation error |
| 15 | convertible cylinder A-gripper lock pin ON | convertible cylinder A-gripper lock pin operation error |
| 16 | convertible cylinder A-gripper unlock | convertible cylinder A-gripper fixing/release operation error |
| 17 | convertible cylinder A-gripper lock pin OFF | convertible cylinder A-gripper lock pin operation error |
| 18 | convertible cylinder brake OFF | convertible cylinder brake operation error |
| 19 | home position determination | convertible cylinder home position stop position error |
| 20 | convertible cylinder brake ON | convertible cylinder brake operation error |
| 21 | W gear OFF | W gear ON/OFF operation error |
| 22 | release cam gear ON | suction cylinder release cam gear operation error |
| 23 | suction head fixing/release position determination | double-size cylinder stop position error |
| 24 | suction cylinder brake ON | suction cylinder brake operation error |
| 25 | suction head hook ON | suction head hook operation error |
| 26 | suction head release | suction head fixing/release operation error |
| 27 | suction cylinder brake OFF | suction cylinder brake operation error |
| 28 | double-size cylinder phase determination (designated paper size position) | double-size cylinder stop position error<br>suction cylinder release cam position error |

TABLE 1-continued

| | | |
|---|---|---|
| 29 | W gear ON | W gear ON/OFF operation error |
| 30 | release cam gear OFF | suction cylinder release cam gear operation error |
| 31 | suction head fixing | suction head fixing/release operation error |
| 32 | suction head hook OFF | suction head hook operation error |
| 33 | convertible cylinder brake OFF | convertible cylinder brake operation error |
| 34 | auxiliary drive gear OFF operation | auxiliary drive gear operation error |

| Switching Step | Operation Upon Operating Error Recovery Switch | Single-Side Return Starting Step | Error Number | Flow Step Return | Flow Step Retry |
|---|---|---|---|---|---|
| 1 | | | | | |
| 2 | elimination of auxiliary drive gear operation error | R1-25 | 22 | AA | DA |
| 3 | stop position error elimination | R1-25 | 21 | AB | DB |
| 4 | convertible brake OFF | R1-25 | 20 | AC | DC |
| 5 | convertible brake ON | manual single-side return | | | |
| 6 | stop position error elimination | R1-25 | 19 | AD | DD |
| 7 | convertible brake OFF | R1-25 | 18 | AE | DE |
| 8 | pin OFF | R1-24 | 17 | AF | DF |
| 9 | A-gripper lock | R1-23 | 16 | AG | DG |
| 10 | pin ON | R1-22 | 15 | AH | DH |
| 11 | convertible brake ON | manual single-side return | | | |
| 12 | stop position error elimination | R1-19 | 14 | AI | DI |
| 13 | convertible brake OFF | R1-19 | 13 | AJ | DJ |
| 14 | A-gripper unlock | R1-18 | 12 | AK | DK |
| 15 | pin OFF | R1-17 | 11 | AL | DL |
| 16 | A-gripper lock | R1-16 | 10 | AM | DM |
| 17 | pin ON | R1-15 | 9 | AN | DN |
| 18 | convertible brake ON | manual single-side return | | | |
| 19 | stop position error elimination | manual single-side return | | | |
| 20 | convertible brake OFF | R1-12 | 8 | AO | DO |
| 21 | W gear ON | R1-10 | 7 | AP | DP |
| 22 | release cam gear OFF | R1-8 | 6 | AQ | DQ |
| 23 | stop position error elimination | R1-6 | 5 | AR | DR |
| 24 | suction brake OFF | R1-6 | 4 | AS | DS |
| 25 | hook OFF | R1-5 | 3 | AT | DT |
| 26 | head fixing | R1-4 | 2 | AU | DU |
| 27 | suction brake ON | manual single-side return | | | |
| 28 | stop position error elimination | R1-1 | 1 | AV | DV |
| | elimination disabled | manual single-side return | | | |
| 29 | W gear OFF | R1-F | 106 | AZ | |
| 30 | release cam gear ON | R1-F | 105 | AZ | |
| 31 | suction head release | R1-F | 104 | AZ | |
| 32 | hook ON | R1-F | 103 | AZ | |
| 33 | convertible brake ON | R1-F | 102 | AZ | |
| 34 | auxiliary drive gear ON | R1-F | 101 | AZ | |

Table 2 shows single-side return operation steps in automatic switching from the single-sided printing state to the double-sided printing state. When the final step in Table 2 finishes, the single-side return operation is ended.

TABLE 2

| | Single-Side Return Operation Step |
|---|---|
| suction head fixing/release position determination | R1-1 |
| suction cylinder brake ON | R1-2 |
| suction head fixing | R1-3 |
| suction head hook OFF | R1-4 |
| suction cylinder brake OFF | R1-5 |
| single-side position determination | R1-6 |
| suction cylinder brake ON | R1-7 |
| W gear ON | R1-8 |
| release cam gear OFF | R1-9 |
| convertible cylinder brake OFF | R1-10 |
| suction cylinder brake OFF | R1-11 |
| convertible cylinder B-surface A-gripper lock position determination | R1-12 |
| convertible cylinder brake ON | R1-13 |
| A-gripper pin ON | R1-14 |
| A-gripper lock | R1-15 |
| A-gripper pin OFF | R1-16 |
| A-gripper unlock | R1-17 |
| convertible cylinder brake OFF | R1-18 |
| convertible cylinder A-surface A-gripper lock position determination | R1-19 |
| convertible cylinder brake ON | R1-20 |
| A-gripper pin ON | R1-21 |
| A-gripper lock | R1-22 |
| A-gripper pin OFF | R1-23 |

TABLE 2-continued

| | Single-Side Return Operation Step |
|---|---|
| convertible cylinder brake OFF | R1-24 |
| auxiliary drive gear OFF | R1-25 |

Table 3 shows the termination sequence from the single-side return starting step to do double-side forced termination during automatic switching from the single-sided printing state to the double-sided printing state. When the final step in Table 3 finishes, the double-side forced termination is ended.

TABLE 3

| | Single-Side Return Operation Step |
|---|---|
| W gear ON<br>release cam gear OFF<br>suction head fixing<br>suction head hook OFF<br>convertible cylinder brake OFF<br>auxiliary drive gear OFF | R1-F<br>turn OFF in order |

Table 4 shows the relationship between switching steps in automatic switching from the double-sided printing state to the single-sided printing state and the error contents and error numbers in the switching operation.

TABLE 4

| Switching Step | Convertible Switching Operation (step name) | Error Contents in Switching Operation |
|---|---|---|
| 1 | auxiliary drive gear ON operation | |
| 2 | auxiliary motor inching rotation | auxiliary drive gear operation error |
| 3 | home position determination | convertible cylinder home position stop position error |
| 4 | convertible cylinder brake ON | convertible cylinder brake operation error |
| 5 | release cam gear ON | suction cylinder release cam gear operation error |
| 6 | suction head hook ON | suction head hook operation error |
| 7 | suction head release | suction head fixing/release operation error |
| 8 | W gear OFF | W gear ON/OFF operation error |
| 9 | suction head fixing/release position determination | double-size cylinder stop position error |
| 10 | suction cylinder brake ON | suction cylinder brake operation error |
| 11 | suction head fixing | suction head fixing/release operation error |
| 12 | suction head hook OFF | suction head hook operation error |
| 13 | suction cylinder brake OFF | suction cylinder brake operation error |
| 14 | double-size cylinder phase determination (designated paper size position) | double-size cylinder stop position error<br>release cam gear position error |
| 15 | suction cylinder brake ON | suction cylinder brake operation error |
| 16 | W gear ON | W gear ON/OFF operation error |
| 17 | release cam gear OFF | suction cylinder release cam gear operation error |
| 18 | convertible cylinder brake OFF | convertible cylinder brake operation error |

TABLE 4-continued

| | | |
|---|---|---|
| 19 | suction cylinder brake OFF | suction cylinder brake operation error |
| 20 | convertible cylinder A-surface A-gripper lock position determination | convertible cylinder A-gripper fixing/release position error |
| 21 | convertible cylinder brake ON | convertible cylinder brake operation error |
| 22 | convertible cylinder A-gripper lock pin OFF | convertible cylinder A-gripper lock pin operation error |
| 23 | convertible cylinder A-gripper lock | convertible cylinder A-gripper fixing/release operation error |
| 24 | convertible cylinder lock pin OFF | convertible cylinder A-gripper lock pin operation error |
| 25 | convertible cylinder brake OFF | convertible cylinder brake operation error |
| 26 | convertible cylinder B-surface A-gripper lock position determination | convertible cylinder A-gripper fixing/release position error |
| 27 | convertible cylinder brake ON | convertible cylinder brake operation error |
| 28 | convertible cylinder A-gripper release operation (return) | convertible cylinder A-gripper fixing/release operation error |
| 29 | convertible cylinder A-gripper lock pin ON | convertible cylinder A-gripper lock pin operation error |
| 30 | convertible cylinder A-gripper lock | convertible cylinder A-gripper fixing/release operation error |
| 31 | convertible cylinder A-gripper lock pin OFF | convertible cylinder A-gripper lock pin operation error |
| 32 | convertible cylinder brake OFF | convertible cylinder brake operation error |
| 33 | auxiliary drive gear OFF operation | auxiliary drive gear operation error |

| Switching | Operation Upon Operating Error | Double-Side Return | Error | Flow Step | |
|---|---|---|---|---|---|
| Step | Recovery Switch | Starting Step | Number | Return | Retry |
| 1 | | | | | |
| 2 | elimination of auxiliary drive gear operation error | R2-27 | 22 | BA | EA |
| 3 | stop position error elimination | R2-27 | 21 | BB | EB |
| 4 | convertible brake OFF | R2-27 | 20 | BC | EC |
| 5 | release cam gear OFF | R2-26 | 19 | BD | ED |
| 6 | hook OFF | R2-25 | 18 | BE | EE |
| 7 | head fixing | R2-24 | 17 | BF | EF |
| 8 | W gear ON | R2-23 | 16 | BG | EG |
| 9 | stop position error elimination | R2-21 | 15 | BH | EH |
| 10 | suction brake OFF | R2-21 | 14 | BI | EI |
| 11 | suction head release | manual single-side return | | | |
| 12 | hook ON | manual single-side return | | | |
| 13 | section brake ON | manual single-side return | | | |
| 14 | stop position error elimination elimination disabled | R2-16 manual single-side return | 13 | BJ | EJ |
| 15 | suction brake OFF | R2-16 | 12 | BK | EK |
| 16 | W gear OFF | manual single-side return | | | |
| 17 | release cam gear ON | manual single-side return | | | |

TABLE 4-continued

| | | | | | |
|---|---|---|---|---|---|
| 18 | convertible brake ON | manual single-side return | | | |
| 19 | suction brake ON | manual single-side return | | | |
| 20 | stop position error elimination | R2-11 | 11 | BL | EL |
| 21 | convertible brake OFF | R2-11 | 10 | BM | EM |
| 22 | pin OFF | R2-10 | 9 | BN | EN |
| 23 | A-gripper unlock | R2-9 | 8 | BO | EO |
| 24 | pin ON | R2-8 | 7 | BP | EP |
| 25 | convertible brake ON | | | | |
| 26 | stop position error elimination | R2-5 | 6 | BQ | EQ |
| 27 | convertible brake OFF | R2-5 | 5 | BR | ER |
| 28 | A-gripper lock | R2-4 | 4 | BS | ES |
| 29 | pin OFF | R2-3 | 3 | BT | ET |
| 30 | A-gripper unlock | R2-2 | 2 | BU | EU |
| 31 | pin ON | R2-1 | 1 | BV | EV |
| 32 | convertible brake ON | R2-F | 102 | BZ | |
| 33 | auxiliary drive gear ON | R2-F | 101 | BZ | |

Table 5 shows double-side return operation steps in automatic switching from the double-sided printing state to the single-sided printing state. When the final step in Table 5 finishes, the double-side return operation is ended.

TABLE 5

| | Double-Side Return Operation Step |
|---|---|
| A-gripper unlock | R2-1 |
| A-gripper pin OFF | R2-2 |
| A-gripper lock fixing | R2-3 |
| convertible cylinder brake OFF | R2-4 |
| convertible cylinder A-surface A-gripper unlock position determination | R2-5 |
| convertible cylinder brake ON | R2-6 |
| A-gripper pin ON | R2-7 |
| A-gripper unlock | R2-8 |
| A-gripper pin OFF | R2-9 |
| convertible cylinder brake OFF | R2-10 |
| home position determination | R2-11 |
| convertible cylinder brake ON | R2-12 |
| W gear OFF | R2-13 |
| release cam gear ON | R2-14 |
| suction cylinder brake OFF | R2-15 |
| suction head fixing/release position determination | R2-16 |
| suction cylinder brake ON | R2-17 |
| suction head hook ON | R2-18 |
| suction head release | R2-19 |
| suction cylinder brake OFF | R2-20 |
| paper size position determination before change | R2-21 |

TABLE 5-continued

| | Double-Side Return Operation Step |
|---|---|
| W gear ON | R2-22 |
| suction head fixing | R2-23 |
| suction head hook OFF | R2-24 |
| release cam gear OFF | R2-25 |
| convertible cylinder brake OFF | R2-26 |
| auxiliary drive gear OFF | R2-27 |

Table 6 shows the termination sequence from the double-side return starting step to do single-side forced termination during automatic switching from the double-sided printing state to the single-sided printing state. When the final step in Table 6 finishes, the single-side forced termination is ended.

TABLE 6

| | Double-Side Return Operation Step |
|---|---|
| convertible cylinder brake OFF auxiliary drive gear OFF | R2-F turn OFF in order |

Table 7 shows the relationship between switching steps in automatic change of the paper size in the double-sided printing state and the error contents and error numbers in the switching operation.

TABLE 7

| Switching Step | Convertible Switching Operation (step name) | Error Contents in Switching Operation |
|---|---|---|
| 1 | auxiliary drive gear ON operation | |
| 2 | auxiliary motor inching rotation | auxiliary drive gear operation error |
| 3 | home position determination | convertible cylinder home position stop position error |
| 4 | convertible cylinder brake ON | convertible cylinder brake operation error |
| 5 | W gear OFF | W gear ON/OFF operation error |
| 6 | release cam gear ON | suction cylinder release cam gear operation error |

TABLE 7-continued

| | | |
|---|---|---|
| 7 | suction head hook ON | suction head hook operation error |
| 8 | suction head release | suction head fixing/release operation error |
| 9 | double-size cylinder phase determination (designated paper size position) | double-size cylinder stop position error<br>suction cylinder release cam position error |
| 10 | W gear ON | W gear ON/OFF operation error |
| 11 | release cam gear OFF | suction cylinder release cam gear operation error |
| 12 | suction head fixing | suction head fixing/release operation error |
| 13 | suction head hook OFF | suction head hook operation error |
| 14 | convertible cylinder brake OFF | convertible cylinder brake operation error |
| 15 | auxiliary drive gear OFF operation | auxiliary drive gear operation error |

| Switching Step | Operation Upon Operating Error Recovery Switch | Paper Size Return Starting Step | Error Number | Flow Step Return | Flow Step Retry |
|---|---|---|---|---|---|
| 1 | | | | | |
| 2 | elimination of auxiliary drive gear operation error | R3-6 | 8 | CA | FA |
| 3 | stop position error elimination | R3-6 | 7 | CB | FB |
| 4 | convertible brake OFF | R3-6 | 6 | CC | FC |
| 5 | W gear ON | R3-5 | 5 | CD | FD |
| 6 | release cam gear OFF | R3-1 | 4 | CE | FE |
| 7 | hook OFF | R3-1 | 3 | CF | FF |
| 8 | head fixing | R3-1 | 2 | CG | FG |
| 9 | stop position error elimination | R3-1 | 1 | CH | FH |
| | elimination disabled | manual single-side return | | | |
| 10 | W gear OFF | R3-F | 106 | CZ | |
| 11 | release cam gear ON | R3-F | 105 | CZ | |
| 12 | suction head release | R3-F | 104 | CZ | |
| 13 | hook ON | R3-F | 103 | CZ | |
| 14 | convertible brake ON | R3-F | 102 | CZ | |
| 15 | auxiliary drive gear ON | R3-F | 101 | CZ | |

Table 8 shows paper size return operation steps in automatic change of the paper size in the double-sided printing state. When the final step in Table 8 finishes, the paper size return operation is ended.

TABLE 8

| | Paper Size Return Operation Step |
|---|---|
| W gear ON | R3-1 |
| release cam gear OFF | R3-2 |
| suction head fixing | R3-3 |
| suction head hook OFF | R3-4 |
| convertible cylinder brake OFF | R3-5 |
| auxiliary drive gear OFF | R3-6 |

Table 9 shows the termination sequence from the paper size return starting step to do paper size forced termination during automatic change of the paper size in the double-sided printing state. When the final step in Table 9 finishes, the paper size forced termination is ended.

TABLE 9

| | Paper Size Return Operation Step |
|---|---|
| W gear ON<br>release cam gear OFF<br>suction head fixing<br>suction head hook OFF<br>convertible cylinder brake OFF<br>auxiliary drive gear OFF | R3-F<br>turn OFF in order |

In step S101 (FIG. 8A), the CPU 10 writes "1" in the previous single-sided printing/double-sided printing memory M3 and "0" in the paper length memory M2. When a paper length L is input via the paper length setting device 15 (step S102), the input paper length L is read and stored in the paper length memory M2 (step S103). When the operator turns on the double-sided printing button 16 (YES in step S104), the CPU 10 writes "2" in the single-sided printing/double-sided printing memory M1 (step S105). When the operator turns on the single-sided printing button 17 (YES in step S106), the CPU 10 writes "1" in the single-sided printing/double-sided printing memory M1 (step S107).

[Automatic Switching from Single-Sided Printing State to Double-Sided Printing State]

Assume that the current single-sided printing state should automatically switch to double-sided printing. In this case, the operator turns on the double-sided printing button 16 and then turns on the switching start switch 18. In this example, the length L of the paper sheet to be printed in double-sided printing is the same as in single-sided printing and is already written in the paper length memory M2.

When the operator turns on the switching start switch 18 (YES in step S108), the CPU 10 reads out the contents of the memory M1 (step S109). In this case, the CPU 10 reads out, from the memory M1, "2" written in step S105. Since YES in step S110, the CPU 10 advances to step S113 to confirm whether the previous single-sided printing/double-sided printing memory M3 stores "1" (step S114).

In this case, the memory M3 stores "1" (YES in step S114). The process advances to step S115 (FIG. 8B) to read out, from the memory M2, the length L of the paper sheet to be printed. If the memory M2 stores "0" or less (NO in step S116), a paper length uninput error is displayed (step S117). In this example, the paper length L is input as L>0. Hence, the process advances to step S118.

[Auxiliary Drive Gear ON Operation: Switching Step 1]

In step S118, an ON signal is sent to the brake 25 of the drive motor to release the break on the drive motor. An ON signal is output to the auxiliary drive gear ON/OFF air cylinder valve 30 (step S119) to actuate the auxiliary drive gear ON/OFF air cylinder 29. Simultaneously, the CPU 10 outputs a reset signal and an enable signal to the internal timer 22 (step S120) to start time counting from zero.

[Auxiliary Motor Inching Rotation: Switching Step 2]

The CPU 10 reads out the auxiliary drive gear ON waiting time TA from the memory M5 (step S121). If the count value of the internal timer 22 is equal to or more than the auxiliary drive gear ON waiting time TA (YES in step S123), the CPU 10 reads out the inching velocity V0 of the auxiliary drive motor from the memory M6 (step S124) and outputs a forward rotation signal and an inching velocity command to the motor driver 28 for the auxiliary drive motor (step S125). The auxiliary motor 26 starts slowly rotating in the forward direction.

Simultaneously, the CPU 10 outputs a reset signal and an enable signal to the internal timer 22 (FIG. 8C: step S126) to start time counting from zero. The CPU 10 reads out the auxiliary drive gear ON sensor operation confirmation time TB from the memory M7 (step S127). If the ON state of the auxiliary drive gear ON sensor SS1 is not confirmed even when the count value of the internal timer 22 exceeds the operation confirmation time TB (YES in step S129), the CPU 10 determines it as auxiliary drive gear operation error, displays it, and writes "22" in the error step memory M25 as an error number (step S132, Table 1: "switching step 2").

[Home Position Determination: Switching Step 3]

Figure 8A:
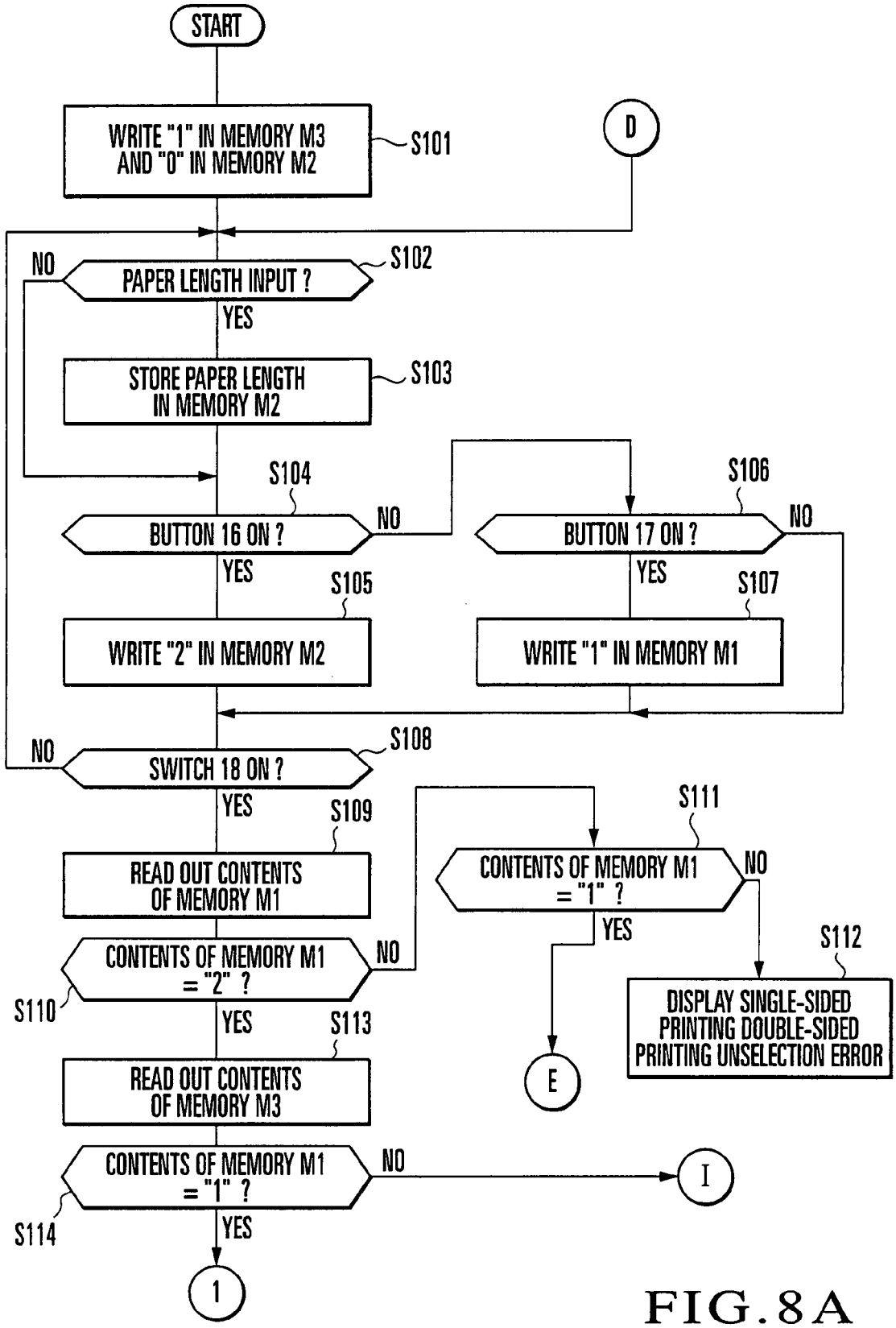
FIG. 8A is a flowchart for explaining an operation common to various kinds of automatic switching in process operations according to a printing state automatic switching program by the printing state automatic switching apparatus shown in FIG. 4A.

If the ON state of the auxiliary drive gear ON sensor SS1 is confirmed before the count value of the internal timer 22 reaches the operation confirmation time TB (YES in step S131), the CPU 10 reads out the auxiliary drive motor high-speed slower motion velocity VH from the memory M8 (FIG. 8D: step S133) and outputs a forward rotation signal and a high-speed slower motion velocity command to the motor driver 28 for the auxiliary drive motor (step S134). The velocity of the auxiliary drive motor 26 switches from the inching velocity V0 to the high-speed slower motion velocity VH.

Simultaneously, the CPU 10 outputs a reset signal and an enable signal to the internal timer 22 (step S135) to start time counting from zero. The CPU 10 reads out the convertible cylinder home position determination time T1 from the memory M9 (step S136). If the ON state of the convertible cylinder home position determination deceleration sensor SS3 is not confirmed even when the count value of the internal timer 22 exceeds the convertible cylinder home position determination time T1 (YES in step S138), the CPU 10 determines it as a convertible cylinder home position stop position error, displays it, and writes "21" in the error step memory M25 as an error number (step S141, Table 1: "switching step 3").

If the ON state of the convertible cylinder home position determination deceleration sensor SS3 is confirmed before the count value of the internal timer 22 reaches the convertible cylinder home position determination time T1 (YES in step S140), the CPU 10 reads out the auxiliary drive motor low-speed slower motion velocity VL from the memory M10 (step S142) and outputs a forward rotation signal and a low-speed slower motion velocity command to the motor driver 28 for the auxiliary drive motor (step S143). The rotation velocity of the auxiliary drive motor 26 switches from the high-speed slower motion velocity VH to the low-speed slower motion velocity VL.

Simultaneously, the CPU 10 outputs a reset signal and an enable signal to the internal timer 22 (FIG. 8E: step S144) to start time counting from zero. The CPU 10 reads out the convertible cylinder home position determination time T2 from the memory M11 (step S145). If the value of the convertible cylinder position detection counter 32 does not reach the convertible cylinder home position read out from the memory M12 even when the count value of the internal timer 22 exceeds the convertible cylinder home position determination time T2 (YES in step S147), the CPU 10 determines it as a convertible cylinder home position stop position error, displays it, and writes "21" in the error step memory M25 as an error number (step S151, Table 1: "switching step 3").

If the value of the convertible cylinder position detection counter 32 reaches the convertible cylinder home position before the count value of the internal timer 22 reaches the convertible cylinder home position determination time T2 (YES in step S150), the CPU 10 outputs a stop command to the motor driver 28 for the auxiliary drive motor (step S152) to stop rotating the auxiliary drive motor 26. The CPU 10 reads the value of the convertible cylinder position detection counter 32 (step S153) and reads out the convertible cylinder home position shift tolerance $\alpha$1 from the memory M13 (step S154). If the absolute value of the difference between the value of the convertible cylinder position detection counter 32 and the convertible cylinder home position is equal to or larger than the convertible cylinder home position shift tolerance $\alpha$1 (YES in step S155), the CPU 10 determines it as a convertible cylinder home position stop position error, displays it, and writes "21" in the error step memory M25 as an error number (step S156, Table 1: "switching step 3").

[Convertible Cylinder Brake ON: Switching Step 4]

If the absolute value of the difference between the value of the convertible cylinder position detection counter 32 and the convertible cylinder home position is smaller than the convertible cylinder home position shift tolerance $\alpha$1 (NO in step S155), the CPU 10 outputs an ON signal to the convertible cylinder brake ON/OFF air cylinder valve 34 (FIG. 8F: step S157) and reads the output from the convertible cylinder brake ON sensor SS4 (step S158). If the ON state of the output from the convertible cylinder brake ON sensor SS4 is not confirmed (NO in step S159), the CPU 10 determines it as a convertible cylinder brake operation error, displays it, and writes "20" in the error step memory M25 as an error number (step S160, Table 1: "switching step 4").

[Convertible Cylinder Brake OFF: Switching Step 5]

If the output from the convertible cylinder brake ON sensor SS4 is ON (YES in step S159), the CPU 10 outputs an OFF signal to the convertible cylinder brake ON/OFF air cylinder valve 34 (step S161) and reads the output from the convertible cylinder brake OFF sensor SS5 (step S162). If the ON state of the output from the convertible cylinder brake OFF sensor SS5 is not confirmed (NO in step S163), the CPU 10 determines it as a convertible cylinder brake operation error, displays it, and locks the switching operation (step S164). In this case, the operator manually returns the mode to the single-sided printing state (Table 1: "switching step 5").

[Convertible Cylinder A-Surface A-Gripper Unlock Position Determination Switching Step 6]

If the output from the convertible cylinder brake OFF sensor SS5 is ON (YES in step S163), the CPU 10 reads out the auxiliary drive motor high-speed slower motion velocity VH from the memory M8 (step S165) and outputs a forward rotation signal and a high-speed slower motion velocity command to the motor driver 28 for the auxiliary drive motor (step S166). The auxiliary drive motor 26 starts rotating at a high speed. The CPU 10 reads out the convertible cylinder A-surface A-gripper unlock position from the memory M14 (step S167) and reads the value of the upstream cylinder position detection counter 24 (step S168). The auxiliary drive motor 26 continues to rotate until the value of the upstream cylinder position detection counter 24 equals the convertible cylinder A-surface A-gripper unlock position (YES in step S169).

If the value of the upstream cylinder position detection counter 24 equals the convertible cylinder A-surface A-gripper unlock position (YES in step S169), the CPU 10 outputs a stop command to the motor driver 28 for the auxiliary drive motor (FIG. 8G: step S170) to stop rotating the auxiliary drive motor 26. The CPU 10 reads the value of the upstream cylinder position detection counter 24 (step S171) and reads out the convertible cylinder A-gripper lock/unlock position shift tolerance $\alpha$2 from the memory M15 (step S172). If the absolute value of the difference between the value of the upstream cylinder position detection counter 24 and the convertible cylinder A-surface A-gripper unlock position is equal to or larger than the convertible cylinder A-gripper lock/unlock position shift tolerance $\alpha$2 (YES in step S173), the CPU 10 determines it as a convertible cylinder A-gripper lock/unlock error, displays it, and writes "19" in the error step memory M25 as an error number (step S174, Table 1: "switching step 6").

[Convertible Cylinder Brake ON: Switching Step 7]

If the absolute value of the difference between the value of the upstream cylinder position detection counter 24 and the convertible cylinder A-surface A-gripper unlock position is smaller than the convertible cylinder A-gripper lock/unlock position shift tolerance a2 (NO in step S173), the CPU 10 outputs an ON signal to the convertible cylinder brake ON/OFF air cylinder valve 34 (step S175) and reads the output from the convertible cylinder brake ON sensor SS4 (step S176). If the ON state of the output from the convertible cylinder brake ON sensor SS4 is not confirmed (NO in step S177), the CPU 10 determines it as a convertible cylinder brake operation error, displays it, and writes "18" in the error step memory M25 as an error number (step S178, Table 1: "switching step 7").

[Convertible Cylinder A-Gripper Lock Pin ON: Switching Step 8]

If the output from the convertible cylinder brake ON sensor SS4 is ON (YES in step S177), the CPU 10 outputs an ON signal to the convertible cylinder A-gripper lock pin ON/OFF air cylinder valve 36 (step S179) and reads the output from the convertible cylinder A-gripper lock pin ON sensor SS6 (step S180). If the ON state of the output from the convertible cylinder A-gripper lock pin ON sensor SS6 is not confirmed (FIG. 8H: NO in step S181), the CPU 10 determines it as a convertible cylinder A-gripper lock pin operation error, displays it, and writes "17" in the error step memory M25 as an error number (step S182, Table 1: "switching step 8").

[Convertible Cylinder A-Gripper Unlock: Switching Step 9]

If the output from the convertible cylinder A-gripper lock pin ON sensor SS6 is ON (YES in step S181), the CPU 10 determines that the distal end 58*a* of the lock pin 58 has entered the engaging groove 59*a* of the position adjusting unit 59 in FIG. 7A and outputs a release signal to the convertible cylinder A-gripper fixing/release air cylinder valve 38 (step S183). In a normal state, the lock pin 58 rotates with the distal end 58*a* being fitted in the engaging groove 59*a* of the position adjusting unit 59 so as to unlock the A-grippers 3A.

The CPU 10 reads the output from the convertible cylinder A-gripper release sensor SS9 (step S184). If the ON state of the output from the convertible cylinder A-gripper release sensor SS9 is not confirmed (NO in step S185), the CPU 10 determines that the A-grippers 3A are kept unlocked due to some error (determines it as a convertible cylinder A-gripper fixing/release operation error), displays it, and writes "16" in the error step memory M25 as an error number (step S186, Table 1: "switching step 9").

[Convertible Cylinder A-Gripper Lock Pin OFF: Switching Step 10]

If the output from the convertible cylinder A-gripper release sensor SS9 is ON (YES in step S185), the CPU 10 determines that the A-grippers 3A are unlocked and outputs an OFF signal to the convertible cylinder A-gripper lock pin ON/OFF air cylinder valve 36 (step S187). In a normal state, the lock pin 58 moves backward from the position adjusting unit 59 so that the distal end 58*a* of the lock pin 58 disengages from the engaging groove 59*a* of the position adjusting unit 59. The rotation angular position of the lock pin 58 remains at the A-gripper release position until a fixing signal is input to the convertible cylinder A-gripper fixing/release air cylinder 37.

The CPU 10 reads the output from the convertible cylinder A-gripper lock pin OFF sensor SS7 (step S188). If the ON state of the output from the convertible cylinder A-gripper lock pin OFF sensor SS7 is not confirmed (NO in step S189), the CPU 10 determines it as a convertible cylinder A-gripper lock pin operation error, displays it, and writes "15" in the error step memory M25 as an error number (step S190, Table 1: "switching step 10").

[Convertible Cylinder Brake OFF: Switching Step 11]

If the output from the convertible cylinder A-gripper lock pin OFF sensor SS7 is ON (YES in step S189), the CPU 10 outputs an OFF signal to the convertible cylinder brake ON/OFF air cylinder valve 34 (step S191) and reads the output from the convertible cylinder brake OFF sensor SS5 (step S192). If the ON state of the output from the convertible cylinder brake OFF sensor SS5 is not confirmed (NO in step S193), the CPU 10 determines it as a convertible cylinder brake operation error, displays it, and locks the switching operation (step S194). In this case, the operator manually returns the mode to the single-sided printing state (Table 1: "switching step 11").

[Convertible Cylinder B-Surface A-Gripper Unlock Position Determination Switching Step 12]

If the output from the convertible cylinder brake OFF sensor SS5 is ON (YES in step S193), the CPU 10 reads out the auxiliary drive motor high-speed slower motion velocity VH from the memory M8 (FIG. 8I: step S195) and outputs a forward rotation signal and a high-speed slower motion velocity command to the motor driver 28 for the auxiliary drive motor (step S196). The auxiliary drive motor 26 starts rotating at the high-speed slower motion velocity VH.

The CPU 10 reads out the convertible cylinder B-surface A-gripper unlock position from the memory M16 (step S197) and reads the value of the upstream cylinder position detection counter 24 (step S198). The auxiliary drive motor 26 continues to rotate until the value of the upstream cylinder position detection counter 24 equals the convertible cylinder B-surface A-gripper unlock position (YES in step S199).

If the value of the upstream cylinder position detection counter 24 equals the convertible cylinder B-surface A-gripper unlock position (YES in step S199), the CPU 10 outputs a stop command to the motor driver 28 for the auxiliary drive motor (step S200) to stop rotating the auxiliary drive motor 26. The CPU 10 reads the value of the upstream cylinder position detection counter 24 (step S201) and reads out the convertible cylinder A-gripper lock/unlock position shift tolerance $\alpha 2$ from the memory M15 (step S202). If the absolute value of the difference between the value of the upstream cylinder position detection counter 24 and the convertible cylinder B-surface A-gripper unlock position is equal to or larger than the convertible cylinder A-gripper lock/unlock position shift tolerance $\alpha 2$ (YES in step S203), the CPU 10 determines it as a convertible cylinder A-gripper lock/unlock error, displays it, and writes "14" in the error step memory M25 as an error number (step S204, Table 1: "switching step 12").

[Convertible Cylinder Brake ON: Switching Step 13]

If the absolute value of the difference between the value of the upstream cylinder position detection counter 24 and the convertible cylinder B-surface A-gripper unlock position is smaller than the convertible cylinder A-gripper lock/unlock position, shift tolerance $\alpha 2$ (NO in step S203), the CPU 10 outputs an ON signal to the convertible cylinder brake ON/OFF air cylinder valve 34 (FIG. 8J: step S205) and reads the output from the convertible cylinder brake ON sensor SS4 (step S206). If the ON state of the output from the convertible cylinder brake ON sensor SS4 is not confirmed (NO in step S207), the CPU 10 determines it as a convertible cylinder brake operation error, displays it, and writes "13" in the error step memory M25 as an error number (step S208, Table 1: "switching step 13").

[Convertible Cylinder A-Gripper Fixing Operation (Return): Switching Step 14]

If the output from the convertible cylinder brake ON sensor SS4 is ON (YES in step S207), the CPU 10 outputs a fixing signal to the convertible cylinder A-gripper fixing/release air cylinder valve 38 (step S209) and reads the output from the convertible cylinder A-gripper fixing sensor SS8 (step S210). If the ON state of the output from the convertible cylinder A-gripper fixing sensor SS8 is not confirmed (NO in step S211), the CPU 10 determines it as a convertible cylinder A-gripper fixing/release operation error, displays it, and writes "12" in the error step memory M25 as an error number (step S212, Table 1: "switching step 14").

[Convertible Cylinder A-Gripper Lock Pin ON: Switching Step 15]

If the output from the convertible cylinder A-gripper fixing sensor SS8 is ON (YES in step S211), the CPU 10 determines that the rotation angular position of the lock pin 58 has returned to the A-gripper fixing position and outputs an ON signal to the convertible cylinder A-gripper lock pin ON/OFF air cylinder valve 36 (step S213). The CPU 10 reads the output from the convertible cylinder A-gripper lock pin ON sensor SS6 (step S214). If the ON state of the output from the convertible cylinder A-gripper lock pin ON sensor SS6 is not confirmed (FIG. 8K: NO in step S215), the CPU 10 determines it as a convertible cylinder A-gripper lock pin operation error, displays it, and writes "11" in the error step memory M25 as an error number (step S216, Table 1: "switching step 15").

[Convertible Cylinder A-Gripper Unlock: Switching Step 16]

If the output from the convertible cylinder A-gripper lock pin ON sensor SS6 is ON (YES in step S215), the CPU 10 determines that the distal end 58*a* of the lock pin 58 has entered the engaging groove 59*a* of the position adjusting unit 59 and outputs a release signal to the convertible cylinder A-gripper fixing/release air cylinder valve 38 (step S217). The CPU 10 reads the output from the convertible cylinder A-gripper release sensor SS9 (step S218). If the ON state of the output from the convertible cylinder A-gripper release sensor SS9 is not confirmed (NO in step S219), the CPU 10 determines it as a convertible cylinder A-gripper fixing/release operation error, displays it, and writes "10" in the error step memory M25 as an error number (step S220, Table 1: "switching step 16").

[Convertible Cylinder A-Gripper Lock Pin OFF: Switching Step 17]

If the output from the convertible cylinder A-gripper release sensor SS9 is ON (YES in step S219), the CPU 10 outputs an OFF signal to the convertible cylinder A-gripper lock pin ON/OFF air cylinder valve 36 (step S221) and reads the output from the convertible cylinder A-gripper lock pin OFF sensor SS7 (step S222). If the ON state of the output from the convertible cylinder A-gripper lock pin OFF sensor SS7 is not confirmed (NO in step S223), the CPU 10 determines it as a convertible cylinder A-gripper lock pin operation error, displays it, and writes "9" in the error step memory M25 as an error number (step S224, Table 1: "switching step 17").

[Convertible Cylinder Brake OFF: Switching Step 18]

If the output from the convertible cylinder A-gripper lock pin OFF sensor SS7 is ON (YES in step S223), the CPU 10 outputs an OFF signal to the convertible cylinder brake ON/OFF air cylinder valve 34 (step S225) and reads the output from the convertible cylinder brake OFF sensor SS5 (step S226). If the ON state of the output from the convertible cylinder brake OFF sensor SS5 is not confirmed (NO in step S227), the CPU 10 determines it as a convertible cylinder brake operation error, displays it, and locks the switching operation (step S228). In this case, the operator manually returns the mode to the single-sided printing state (Table 1: "switching step 18").

[Home Position Determination: Switching Step 19]

If the output from the convertible cylinder brake OFF sensor SS5 is ON (YES in step S227), the CPU 10 reads out the auxiliary drive motor high-speed slower motion velocity VH from the memory M8 (FIG. 8I: step S229) and outputs a forward rotation signal and a high-speed slower motion velocity command to the motor driver 28 for the auxiliary drive motor (step S230). The auxiliary drive motor 26 starts rotating at the high-speed slower motion velocity VH.

Simultaneously, the CPU 10 outputs a reset signal and an enable signal to the internal timer 22 (step S231) to start time counting from zero. The CPU 10 reads out the convertible cylinder home position determination time T1 from the memory M9 (step S232). If the ON state of the convertible cylinder home position determination deceleration sensor SS3 is not confirmed even when the count value of the internal timer 22 exceeds the convertible cylinder home position determination time T1 (YES in step S234), the CPU 10 determines it as a convertible cylinder home position stop position error, displays it, and locks the switching operation (step S237). In this case, the operator manually returns the mode to the single-sided printing state (Table 1: "switching step 19").

If the ON state of the convertible cylinder home position determination deceleration sensor SS3 is confirmed before the count value of the internal timer 22 reaches the convertible cylinder home position determination time T1 (YES in step S236), the CPU 10 reads out the auxiliary drive motor low-speed slower motion velocity VL from the memory M10 (step S238) and outputs a forward rotation signal and a low-speed slower motion velocity command to the motor driver 28 for the auxiliary drive motor (step S239). The rotation velocity of the auxiliary drive motor 26 switches from the high-speed slower motion velocity VH to the low-speed slower motion velocity VL.

Simultaneously, the CPU 10 outputs a reset signal and an enable signal to the internal timer 22 (step S240) to start time counting from zero. The CPU 10 reads out the convertible cylinder home position determination time T2 from the memory M11 (FIG. 8M: step S241). If the value of the convertible cylinder position detection counter 32 does not reach the convertible cylinder home position read out from the memory M12 even when the count value of the internal timer 22 exceeds the convertible cylinder home position determination time T2 (YES in step S243), the CPU 10 determines it as a convertible cylinder home position stop position error, displays it, and locks the switching operation (step S247). In this case, the operator manually returns the mode to the single-sided printing state (Table 1: "switching step 19").

If the value of the convertible cylinder position detection counter 32 reaches the convertible cylinder home position before the count value of the internal timer 22 reaches the convertible cylinder home position determination time T2 (YES in step S246), the CPU 10 outputs a stop command to the motor driver 28 for the auxiliary drive motor (step S248) to stop rotating the auxiliary drive motor 26. The CPU 10 reads the value of the convertible cylinder position detection counter 32 (step S249) and reads out the convertible cylinder home position shift tolerance $\alpha 1$ from the memory M13 (step S250). If the absolute value of the difference between the value of the convertible cylinder position detection counter 32 and the convertible cylinder home position is equal to or larger than the convertible cylinder home position shift tolerance $\alpha 1$ (YES in step S251), the CPU 10 determines it as a convertible cylinder home position stop position error, displays it, and locks the switching operation (step S252). In this case, the operator manually returns the mode to the single-sided printing state (Table 1: "switching step 19").

[Convertible Cylinder Brake ON: Switching Step 20]

If the absolute value of the difference between the value of the convertible cylinder position detection counter 32 and the convertible cylinder home position is smaller than the convertible cylinder home position shift tolerance $\alpha 1$ (NO in step S251), the CPU 10 outputs an ON signal to the convertible cylinder brake ON/OFF air cylinder valve 34 (FIG. 8N: step S253) and reads the output from the convertible cylinder brake ON sensor SS4 (step S254). If the ON state of the output from the convertible cylinder brake ON sensor SS4 is not confirmed (NO in step S225), the CPU 10 determines it as a convertible cylinder brake operation error, displays it, and writes "8" in the error step memory M25 as an error number (step S256, Table 1: "switching step 20").

[W Gear OFF: Switching Step 21]

If the output from the convertible cylinder brake ON sensor SS4 is ON (YES in step S255), the CPU 10 outputs an OFF signal to the W gear ON/OFF air cylinder valve 40 (step S257) and reads the output from the W gear OFF sensor SS11 (step S258). If the ON state of the output from the W gear OFF sensor SS11 is not confirmed (NO in step S259), the CPU 10 determines it as a W gear ON/OFF operation error, displays it, and writes "7" in the error step memory M25 as an error number (step S260, Table 1: "switching step 21").

[Release Cam Gear ON: Switching Step 22]

If the output from the W gear OFF sensor SS11 is ON (YES in step S259), the CPU 10 outputs an ON signal to the suction cylinder release cam gear ON/OFF air cylinder valve 42 (step S261) and reads the output from the suction cylinder release cam gear ON sensor SS12 (step S262). If the ON state of the output from the suction cylinder release cam gear ON sensor SS12 is not confirmed (NO in step S263), the CPU 10 determines it as a suction cylinder release cam gear operation error, displays it, and writes "6" in the error step memory M25 as an error number (step S264, Table 1: "switching step 22").

[Suction Head Fixing/Release Position Determination: Switching Step 23]

If the output from the suction cylinder release cam gear ON sensor SS12 is ON (YES in step S263), the CPU 10 reads out the auxiliary drive motor high-speed slower motion velocity VH from the memory M8 (FIG. 8O: step S265) and outputs a forward rotation signal and a high-speed slower motion velocity command to the motor driver 28 for the auxiliary drive motor (step S266). The auxiliary drive motor 26 starts rotating at the high-speed slower motion velocity VH.

The CPU 10 reads out the suction head fixing/release position from the memory M17 (step S267), the convertible cylinder home position from the memory M12 (step S268), and the convertible cylinder home position shift tolerance $\alpha 1$ from the memory M13 (step S269). The CPU 10 confirms that the absolute value of the difference between the value of the convertible cylinder position detection counter 32 and the convertible cylinder home position is smaller than the convertible cylinder home position shift tolerance $\alpha 1$. When the value of the upstream cylinder position detection counter 24 matches the suction head fixing/release position (YES in step S273), the CPU 10 outputs a stop command to the motor driver 28 for the auxiliary drive motor (step S275) to stop rotating the auxiliary drive motor 26.

If it is confirmed in step S271 that the absolute value of the difference between the value of the convertible cylinder position detection counter 32 and the convertible cylinder home position is equal to or larger than the convertible cylinder home position shift tolerance $\alpha 1$, the CPU 10 determines that a positional shift has occurred due to the drag of the convertible cylinder. The CPU 10 determines it as a convertible cylinder home position stop position error, displays it, and locks the switching operation (step S274). In this case, the operator manually returns the mode to the single-sided printing state.

After the auxiliary drive motor 26 stops, the CPU 10 reads the value of the upstream cylinder position detection counter 24 (step S276) and reads out the suction head fixing/release position shift tolerance $\alpha 3$ from the memory M18 (step S278). If the absolute value of the difference between the value of the upstream cylinder position detection counter 24 and the suction head fixing/release position is equal to or larger than the suction head fixing/release position shift tolerance $\alpha 3$ (FIG. 8P: YES in step S279), the CPU 10 determines it as a suction head fixing/release position error, displays it, and writes "5" in the error step memory M25 as an error number (step S280, Table 1: "switching step 23").

[Suction Cylinder Brake ON: Switching Step 24]

If the absolute value of the difference between the value of the upstream cylinder position detection counter 24 and the suction head fixing/release position is smaller than the suction head fixing/release position shift tolerance $\alpha 3$ (NO in step S279), the CPU 10 outputs an ON signal to the suction cylinder brake ON/OFF air cylinder valve 44 (step S281) and reads the output from the suction cylinder brake ON sensor SS14 (step S282). If the ON state of the output from the suction cylinder brake ON sensor SS14 is not confirmed (NO in step S283), the CPU 10 determines it as a suction cylinder brake operation error, displays it, and writes "4" in the error step memory M25 as an error number (step S284, Table 1: "switching step 24").

[Suction Head Hook ON: Switching Step 25]

If the output from the suction cylinder brake ON sensor SS14 is ON (YES in step S283), the CPU 10 outputs an ON signal to the suction head hook ON/OFF air cylinder valve 46 (step S285) and reads the output from the suction head hook ON sensor SS16 (step S286). If the ON state of the output from the suction head hook ON sensor SS16 is not confirmed (NO in step S287), the CPU 10 determines it as a suction head hook operation error, displays it, and writes "3" in the error step memory M25 as an error number (step S288, Table 1: "switching step 25").

[Suction Head Release: Switching Step 26]

If the output from the suction head hook ON sensor SS16 is ON (YES in step S287), the CPU 10 outputs a release signal to the suction head fixing/release air cylinder valve 48 (step S289) and reads the output from the suction head release sensor SS19 (step S290). If the ON state of the output from the suction head release sensor SS19 is not confirmed (FIG. 8Q: NO in step S291), the CPU 10 determines it as a suction head fixing/release operation error, displays it, and writes "2" in the error step memory M25 as an error number (step S292, Table 1: "switching step 26").

[Suction Cylinder Brake OFF: Switching Step 27]

If the output from the suction head release sensor SS19 is ON (YES in step S291), the CPU 10 outputs an OFF signal to the suction cylinder brake ON/OFF air cylinder valve 44 (step S293) and reads the output from the suction cylinder brake OFF sensor SS15 (step S294). If the ON state of the output from the suction cylinder brake OFF sensor SS15 is not confirmed (NO in step S295), the CPU 10 determines it as a suction cylinder brake operation error, displays it, and locks the switching operation (step S296). In this case, the operator manually returns the mode to the single-sided printing state (Table 1: "switching step 27").

[Double-Size Cylinder Phase Determination: Switching Step 28]

If the output from the suction cylinder brake OFF sensor SS15 is ON (YES in step S295), the CPU 10 reads out the paper length L from the memory M2 (step S297). The CPU 10 calculates the designated paper size specific double-size cylinder stop position (the stop position of the transfer cylinder 1) on the basis of the readout paper length L and stores it in the memory M19 (step S298). The CPU 10 reads out the auxiliary drive motor high-speed slower motion velocity VH from the memory M8 (step S299) and outputs a forward rotation signal and a high-speed slower motion velocity command to the motor driver 28 for the auxiliary drive motor (step S300). The auxiliary drive motor 26 starts rotating at the high-speed slower motion velocity VH.

The CPU 10 reads out the designated paper size specific double-size cylinder stop position from the memory M19 (step S301), the convertible cylinder home position from the memory M12 (FIG. 8R: step S302), and the convertible cylinder home position shift tolerance α1 from the memory M13 (step S303). The CPU 10 confirms that the absolute value of the difference between the value of the convertible cylinder position detection counter 32 and the convertible cylinder home position is smaller than the convertible cylinder home position shift tolerance α1. When the value of the upstream cylinder position detection counter 24 matches the designated paper size specific double-size cylinder stop position (YES in step S308), the CPU 10 outputs a stop command to the motor driver 28 for the auxiliary drive motor (step S309) to stop rotating the auxiliary drive motor 26.

If it is confirmed in step S305 that the absolute value of the difference between the value of the convertible cylinder position detection counter 32 and the convertible cylinder home position is equal to or larger than the convertible cylinder home position shift tolerance α1, the CPU 10 determines that a positional shift has occurred due to the drag of the convertible cylinder. The CPU 10 determines it as a convertible cylinder home position stop position error, displays it, and locks the switching operation (step S306). In this case, the operator manually returns the mode to the single-sided printing state.

After the auxiliary drive motor 26 stops, the CPU 10 reads the value of the upstream cylinder position detection counter 24 (step S310) and reads out the designated paper size specific double-size cylinder stop position shift tolerance α4 from the memory M20 (step S311). If the absolute value of the difference between the value of the upstream cylinder position detection counter 24 and the designated paper size specific double-size cylinder stop position is equal to or larger than the designated paper size specific double-size cylinder stop position shift tolerance α4 (YES in step S312), the CPU 10 determines it as a double-size cylinder stop position error, displays it, and writes "1" in the error step memory M25 as an error number (step S313, Table 1: "switching step 28").

[W Gear ON: Switching Step 29]

If the absolute value of the difference between the value of the upstream cylinder position detection counter 24 and the designated paper size specific double-size cylinder stop position is smaller than the designated paper size specific double-size cylinder stop position shift tolerance α4 (NO in step S312), the CPU 10 outputs an ON signal to the W gear ON/OFF air cylinder valve 40 (FIG. 8S: step S314) and reads the output from the W gear ON sensor SS10 (step S315). If the ON state of the output from the W gear ON sensor SS10 is not confirmed (NO in step S316), the CPU 10 determines it as a W gear ON/OFF operation error, displays it, and writes "106" in the error step memory M25 as an error number (step S317, Table 1: "switching step 29").

[Release Cam Gear OFF: Switching Step 30]

If the output from the W gear ON sensor SS10 is ON (YES in step S316), the CPU 10 outputs an OFF signal to the suction cylinder release cam gear ON/OFF air cylinder valve 42 (step S318) and reads the output from the suction cylinder release cam gear OFF sensor SS13 (step S319). If the ON state of the output from the suction cylinder release cam gear OFF sensor SS13 is not confirmed (NO in step S320), the CPU 10 determines it as a suction cylinder release cam gear operation error, displays it, and writes "105" in the error step memory M25 as an error number (step S321, Table 1: "switching step 30").

[Suction Head Fixing: Switching Step 31]

If the output from the suction cylinder release cam gear OFF sensor SS13 is ON (YES in step S320), the CPU 10 outputs a fixing signal to the suction head fixing/release air cylinder valve 48 (step S322) and reads the output from the suction head fixing sensor SS18 (step S323). If the ON state of the output from the suction head fixing sensor SS18 is not confirmed (NO in step S324), the CPU 10 determines it as a suction head fixing/release operation error, displays it, and writes "104" in the error step memory M25 as an error number (step S325, Table 1: "switching step 31").

[Suction Head Hook OFF: Switching Step 32]

If the output from the suction head fixing sensor SS18 is ON (YES in step S324), the CPU 10 outputs an OFF signal to the suction head hook ON/OFF air cylinder valve 46 (FIG. 8T: step S326) and reads the output from the suction head hook OFF sensor SS17 (step S327). If the ON state of the output from the suction head hook OFF sensor SS17 is not confirmed (NO in step S328), the CPU 10 determines it as a suction head hook operation error, displays it, and writes "103" in the error step memory M25 as an error number (step S329, Table 1: "switching step 32").

[Convertible Cylinder Brake OFF: Switching Step 33]

If the output from the suction head hook OFF sensor SS17 is ON (YES in step S328), the CPU 10 outputs an OFF signal to the convertible cylinder brake ON/OFF air cylinder valve 34 (step S330) and reads the output from the convertible cylinder brake OFF sensor SS5 (step S331). If the ON state of the output from the convertible cylinder brake OFF sensor SS5 is not confirmed (NO in step S332), the CPU 10 determines it as a convertible cylinder brake operation error, displays it, and writes "102" in the error step memory M25 as an error number (step S333, Table 1: "switching step 33").

[Auxiliary Drive Gear OFF Operation: Switching Step 34]

If the output from the convertible cylinder brake OFF sensor SS5 is ON (YES in step S332), the CPU 10 outputs an OFF signal to the auxiliary drive gear ON/OFF air cylinder valve 30 (step S334) and reads the output from the auxiliary drive gear OFF sensor SS2 (step S335). If the ON state of the output from the auxiliary drive gear OFF sensor SS2 is not confirmed (NO in step S336), the CPU 10 determines it as an auxiliary drive gear operation error, displays it, and writes "101" in the error step memory M25 as an error number (step S337, Table 1: "switching step 34").

If the output from the auxiliary drive gear OFF sensor SS2 is ON (YES in step S336), the CPU 10 rewrites the contents of the previous single-sided printing/double-sided printing memory M3 to "2" (step S338). The CPU 10 reads out the paper length L from the memory M2 (step S339) and overwrites the readout paper length L in the previous paper length memory M4 (step S340).

[Error Recovery During Automatic Switching from Single-Sided Printing State to Double-Sided Printing State]

If an error is displayed during the above-described automatic switching from the single-sided printing state to the double-sided printing state, the operator turns on the error recovery switch 19. When the error recovery switch 19 is turned on (FIG. 9A: YES in step S341), the CPU 10 turns off the error display (step S342), reads out the contents of the single-sided printing/double-sided printing memory M1 (step S343), and checks the contents of the memory M1 (step S344).

In this case, the memory M1 stores "2". Since YES in step S344, the process advances to step S345 to read out the contents of the previous single-sided printing/double-sided printing memory M3 and check whether the memory M3 stores "1" (step S346). In this case, the memory M3 stores "1", and the process advances to step S347. That is, it is determined on the basis of the determination in steps S344 and S346 that the error recovery switch 19 is turned on during automatic switching from single-sided printing to double-sided printing, and the process advances to step S347.

[Error in Switching Step 26]

In step S347, the CPU 10 reads out the contents of the error step memory M25. If the memory M25 stores "2" (YES in step S348), indicating an abnormal end of "switching step 26", the CPU 10 outputs a fixing signal to the suction head fixing/release air cylinder valve 48 (step S349). This eliminates the error in "switching step 26" so that the initial state is restored.

[Error in Switching Step 25]

Figure 9A:
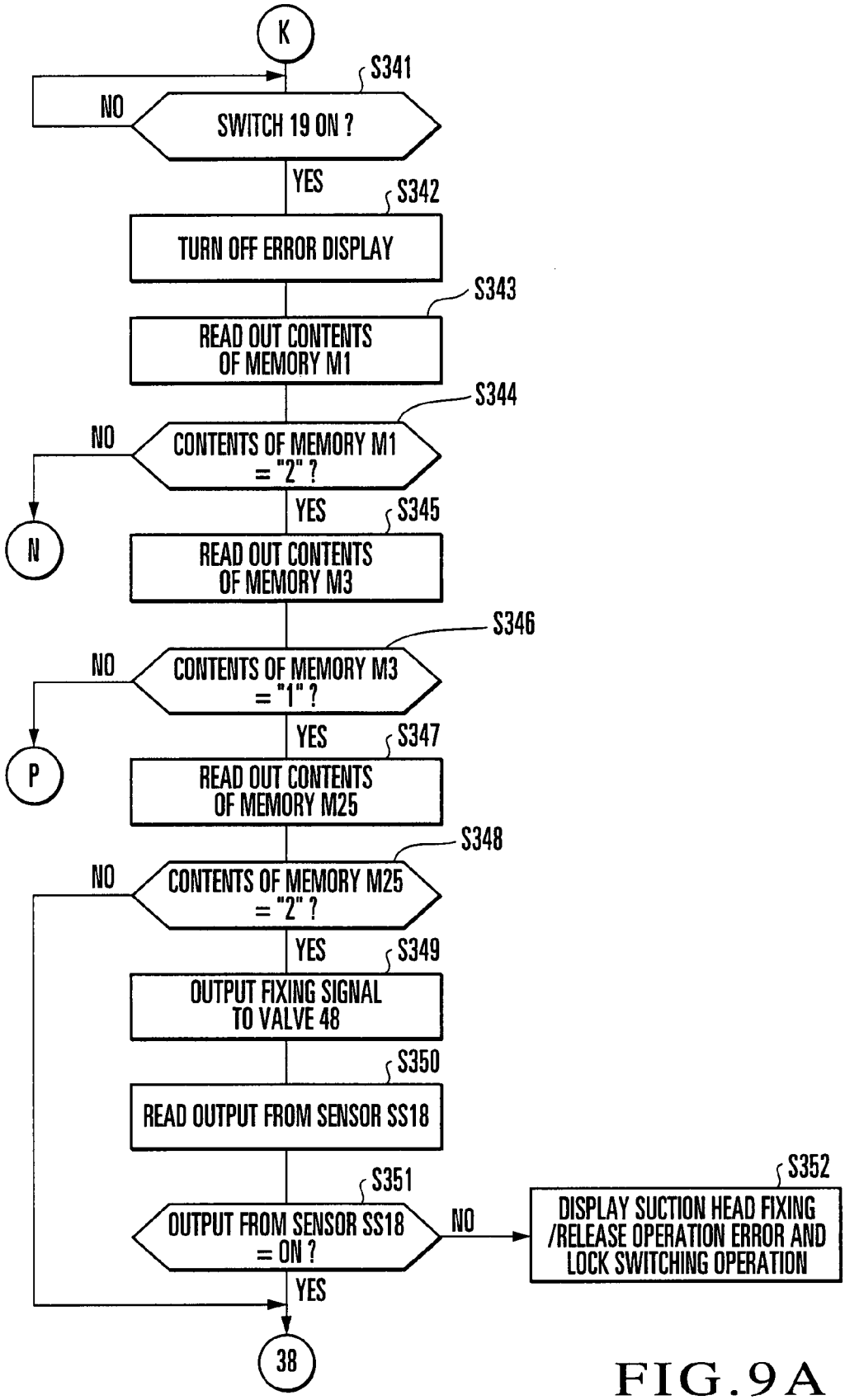
Figure 9B:
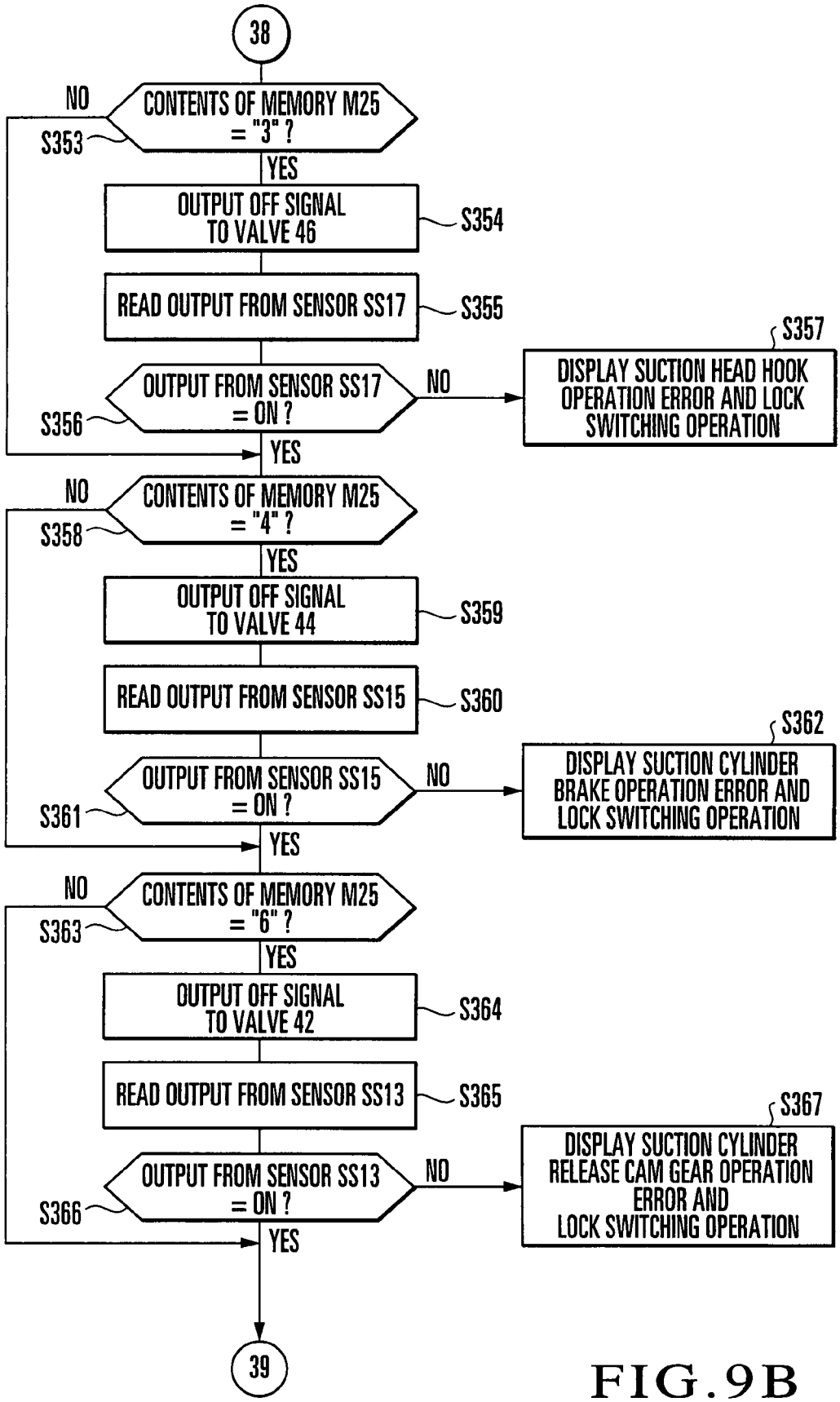

If the memory M25 stores "3" (FIG. 9B: YES in step S353), indicating an abnormal end of "switching step 25", the CPU 10 outputs an OFF signal to the suction head hook ON/OFF air cylinder valve 46 (step S354) to eliminate the error in "switching step 25".

[Error in Switching Step 24]

If the memory M25 stores "4" (YES in step S358), indicating an abnormal end of "switching step 24", the CPU 10 outputs an OFF signal to the suction cylinder brake ON/OFF air cylinder valve 44 (step S359) to eliminate the error in "switching step 24".

[Error in Switching Step 22]

If the memory M25 stores "6" (YES in step S363), indicating an abnormal end of "switching step 22", the CPU 10 outputs an OFF signal to the suction cylinder release cam gear ON/OFF air cylinder valve 42 (step S364) to eliminate the error in "switching step 22".

[Error in Switching Step 21]

Figure 9C:
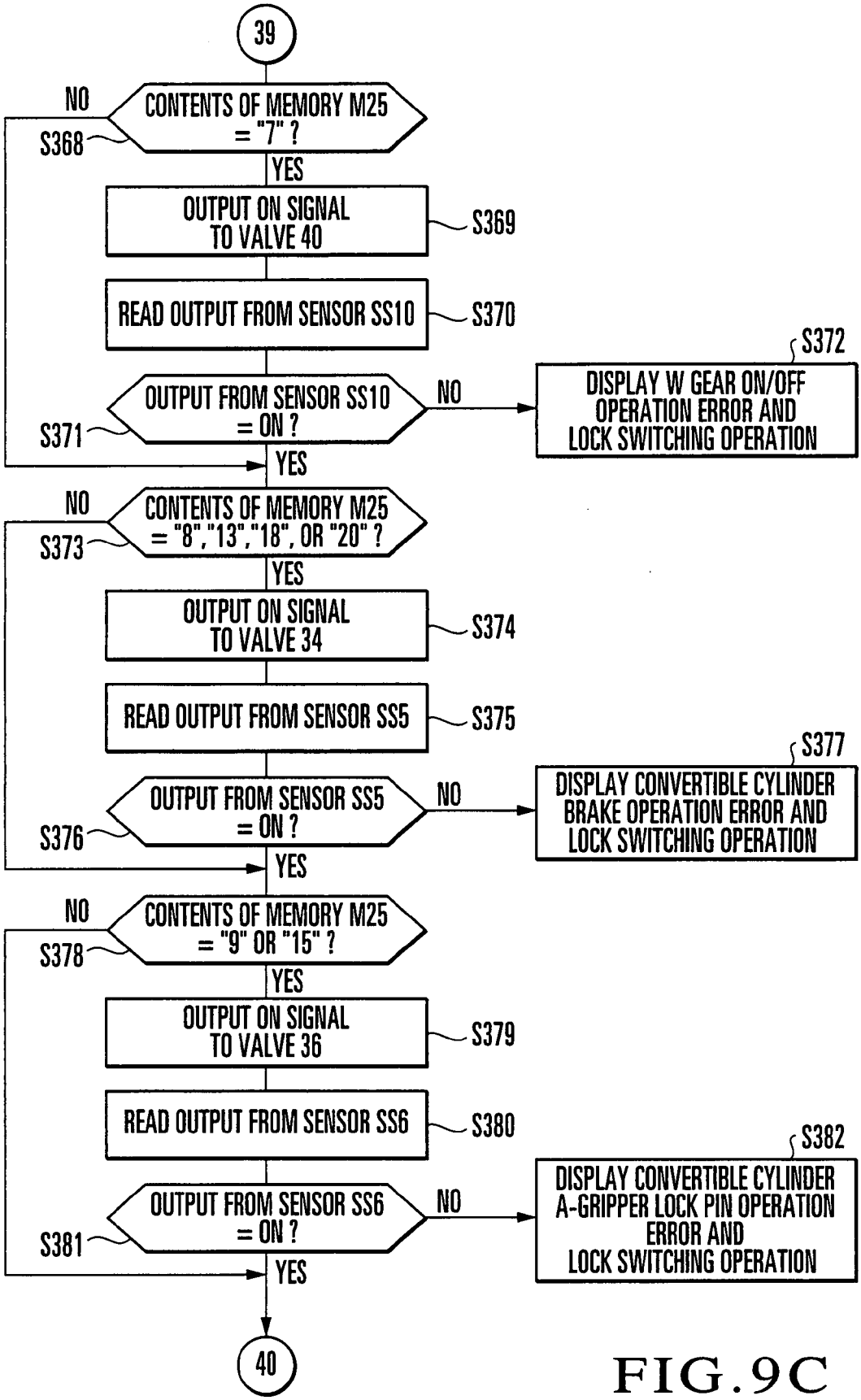

If the memory M25 stores "7" (FIG. 9C: YES in step S368), indicating an abnormal end of "switching step 21", the CPU 10 outputs an ON signal to the W gear ON/OFF air cylinder valve 40 (step S369) to eliminate the error in "switching step 21".

[Error in Switching Step 20, Switching Step 13, Switching Step 7, and Switching Step 4]

If the memory M25 stores "8" (YES in step S373), indicating an abnormal end of "switching step 20", the CPU 10 outputs an OFF signal to the convertible cylinder brake ON/OFF air cylinder valve 34 (step S374) to eliminate the error in "switching step 20". If the memory M25 stores "13", indicating an abnormal end of "switching step 13", the CPU 10 eliminates the error in "switching step 13" in a similar way. If the memory M25 stores "18", indicating an abnormal end of "switching step 7", the CPU 10 eliminates the error in "switching step 7". If the memory M25 stores "20", indicating an abnormal end of "switching step 4", the CPU 10 eliminates the error in "switching step 4".

[Error in Switching Step 17 and Switching Step 10]

If the memory M25 stores "9" (YES in step S378), indicating an abnormal end of "switching step 17", the CPU 10 outputs an ON signal to the convertible cylinder A-gripper lock pin ON/OFF air cylinder valve 36 (step S379) to eliminate the error in "switching step 17". If the memory M25 stores "15", indicating an abnormal end of "switching step 10", the CPU 10 eliminates the error in "switching step 10" in a similar way.

[Error in Switching Step 16 and Switching Step 9]

Figure 9D:
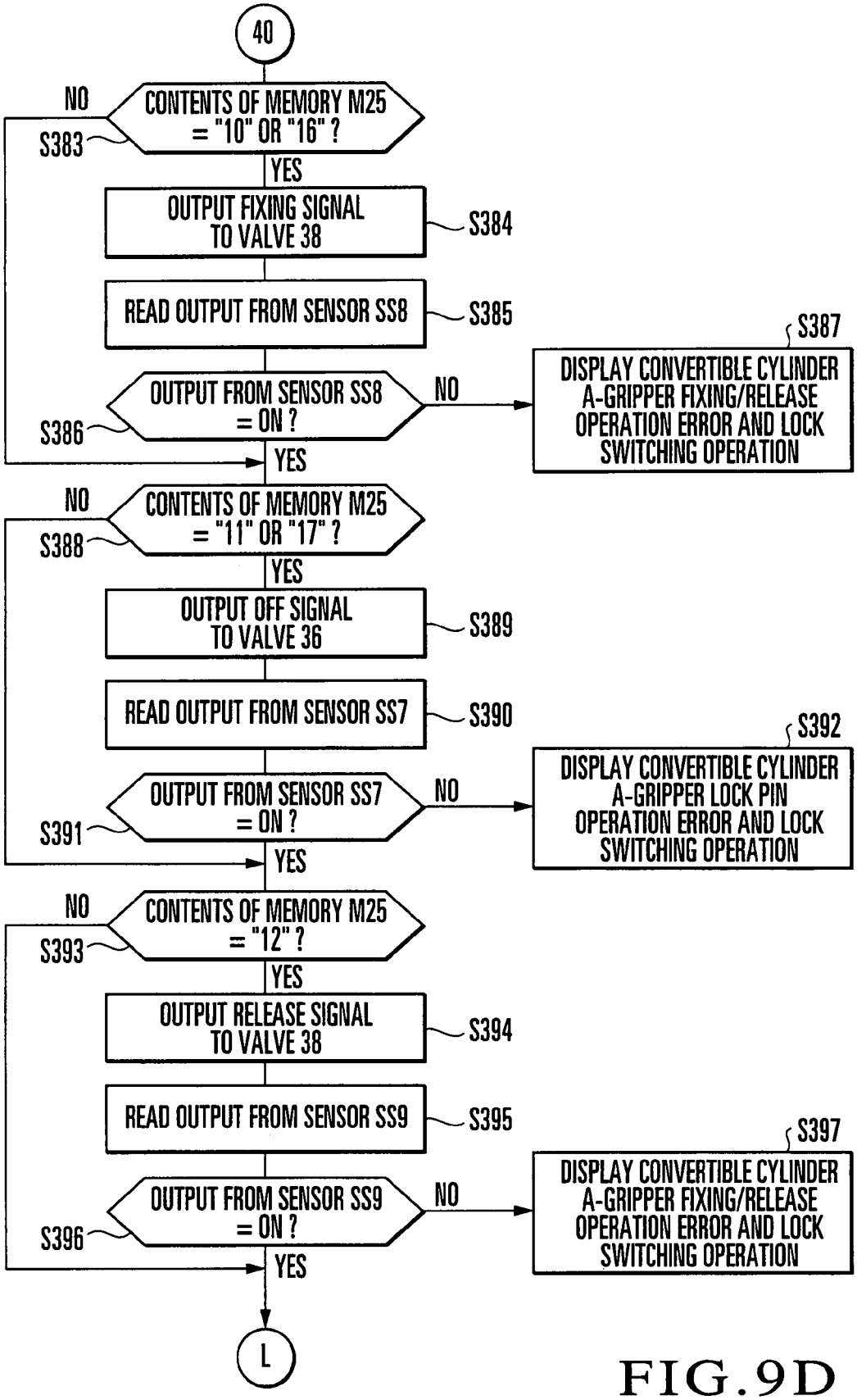

If the memory M25 stores "10" (FIG. 9D: YES in step S383), indicating an abnormal end of "switching step 16", the CPU 10 outputs a fixing signal to the convertible cylinder A-gripper fixing/release air cylinder valve 38 (step S384) to eliminate the error in "switching step 16". If the memory M25 stores "16", indicating an abnormal end of "switching step 9", the CPU 10 eliminates the error in "switching step 9" in a similar way.

[Error in Switching Step 15 and Switching Step 8]

If the memory M25 stores "11" (YES in step S388), indicating an abnormal end of "switching step 15", the CPU 10 outputs an OFF signal to the convertible cylinder A-gripper lock pin ON/OFF air cylinder valve 36 (step S389) to eliminate the error in "switching step 15". If the memory M25 stores "17", indicating an abnormal end of "switching step 8", the CPU 10 eliminates the error in "switching step 8" in a similar way.

[Error in Switching Step 14]

If the memory M25 stores "12" (YES in step S393), indicating an abnormal end of "switching step 14", the CPU 10 outputs a release signal to the convertible cylinder A-gripper fixing/release air cylinder valve 38 (step S394) to eliminate the error in "switching step 14".

[Error in Switching Step 34]

Figure 9E:
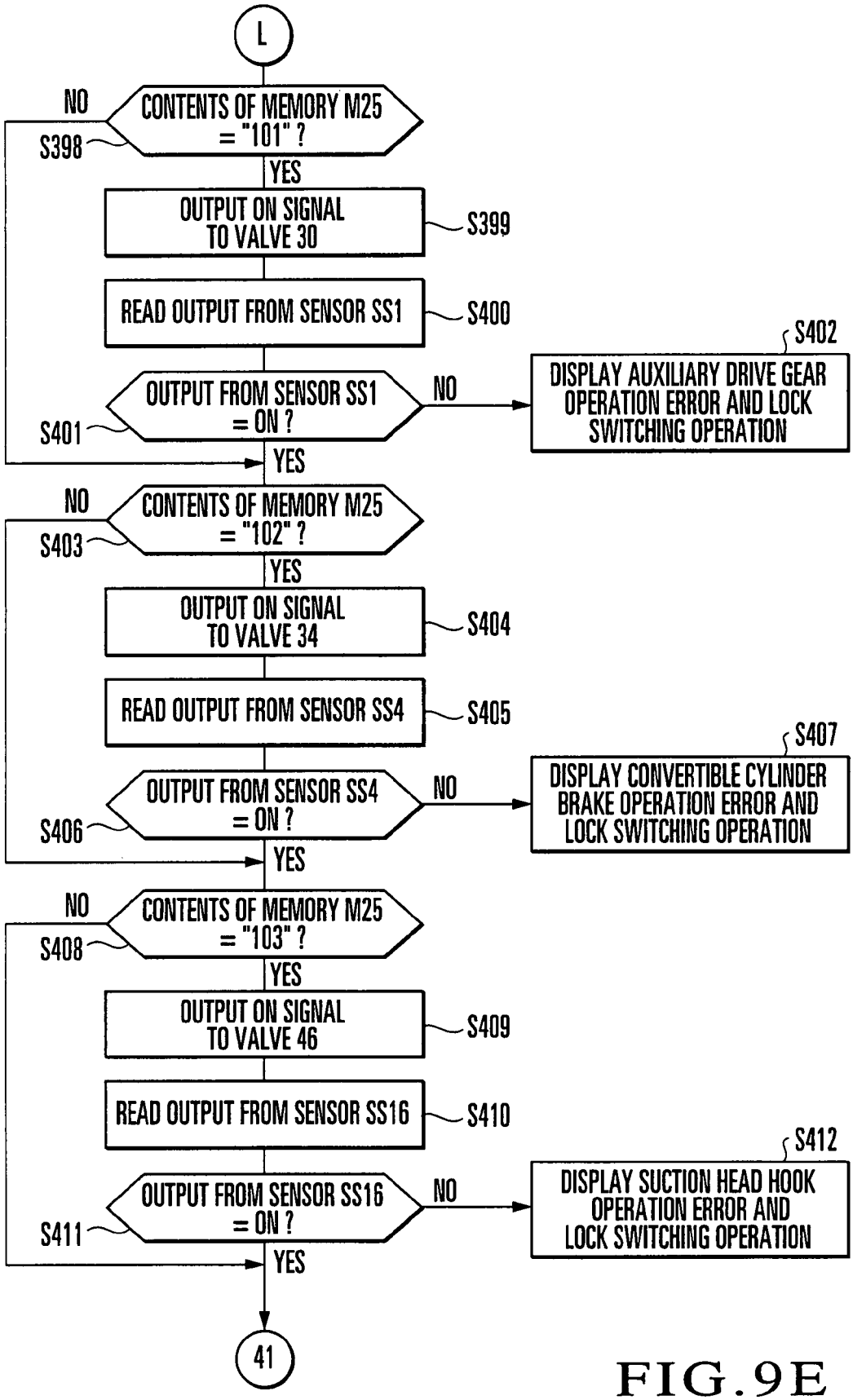

If the memory M25 stores "101" (FIG. 9E: YES in step S398), indicating an abnormal end of "switching step 34", the CPU 10 outputs an ON signal to the auxiliary drive gear ON/OFF air cylinder valve 30 (step S399) to eliminate the error in "switching step 34".

[Error in Switching Step 33]

If the memory M25 stores "102" (YES in step S403), indicating an abnormal end of "switching step 33", the CPU 10 outputs an ON signal to the convertible cylinder brake ON/OFF air cylinder valve 34 (step S404) to eliminate the error in "switching step 33".

[Error in Switching Step 32]

If the memory M25 stores "103" (YES in step S408), indicating an abnormal end of "switching step 32", the CPU 10 outputs an ON signal to the suction head hook ON/OFF air cylinder valve 46 (step S409) to eliminate the error in "switching step 32".

[Error in Switching Step 31]

Figure 9F:
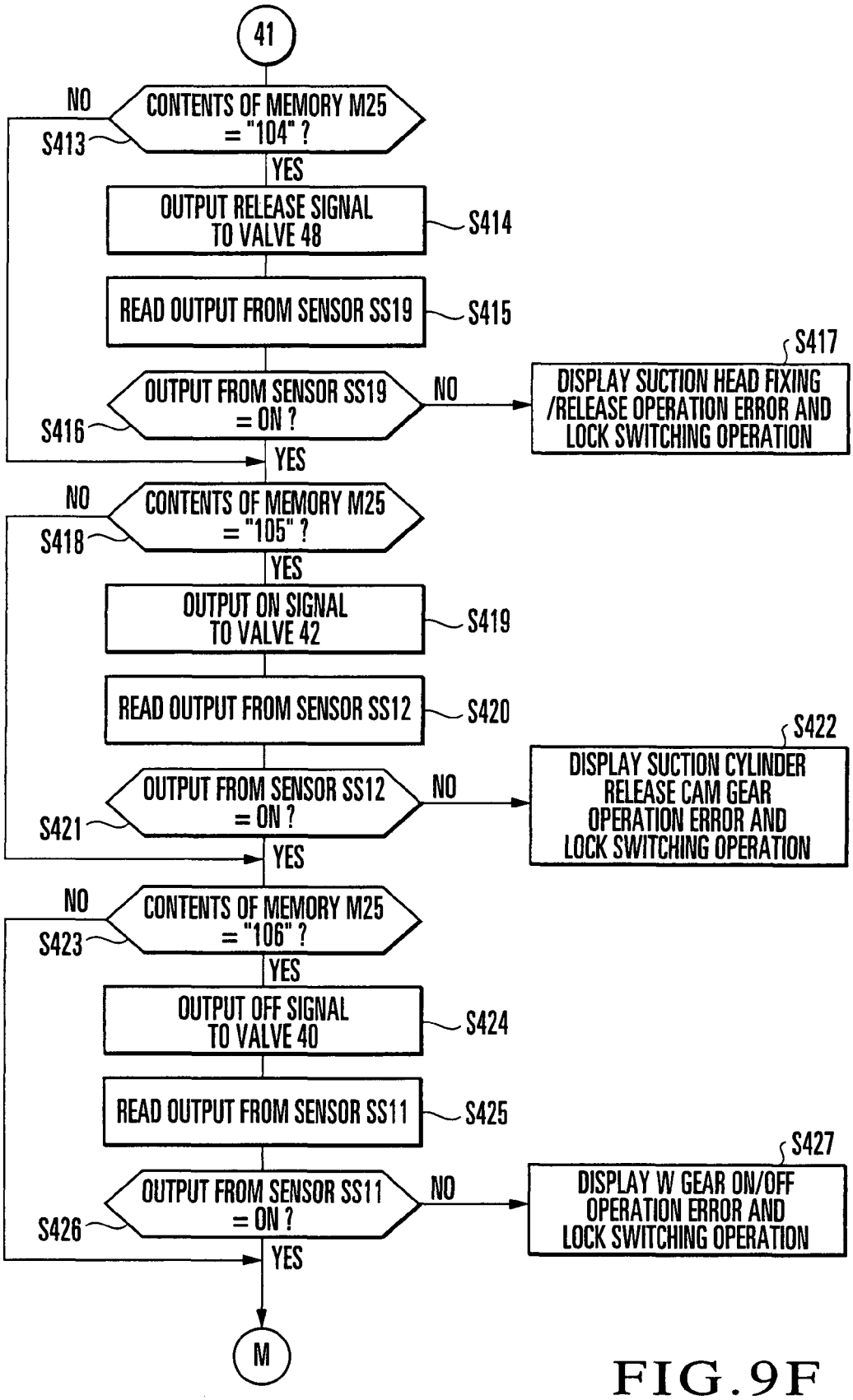
Figure 9G:
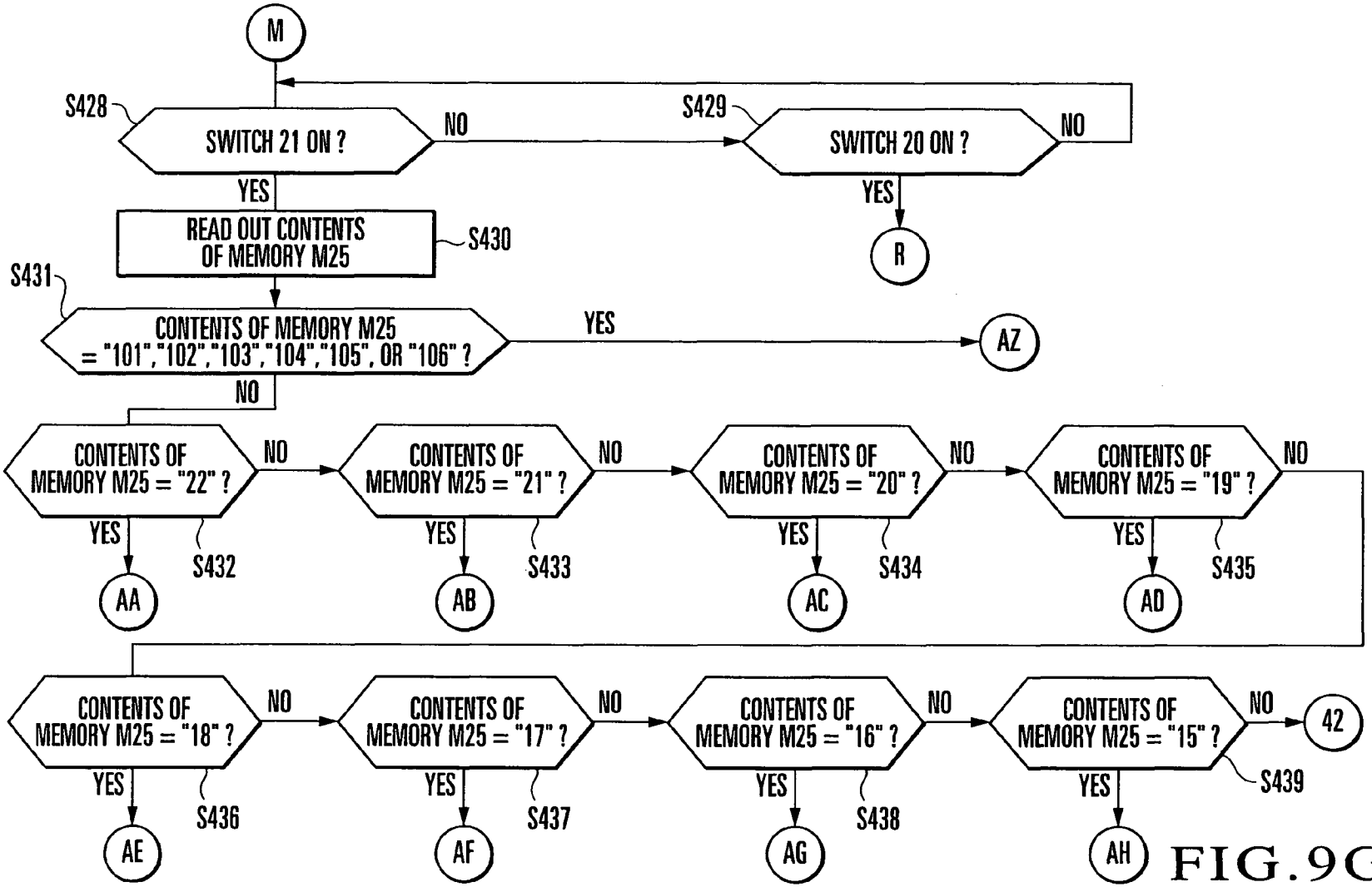
Figure 9H:
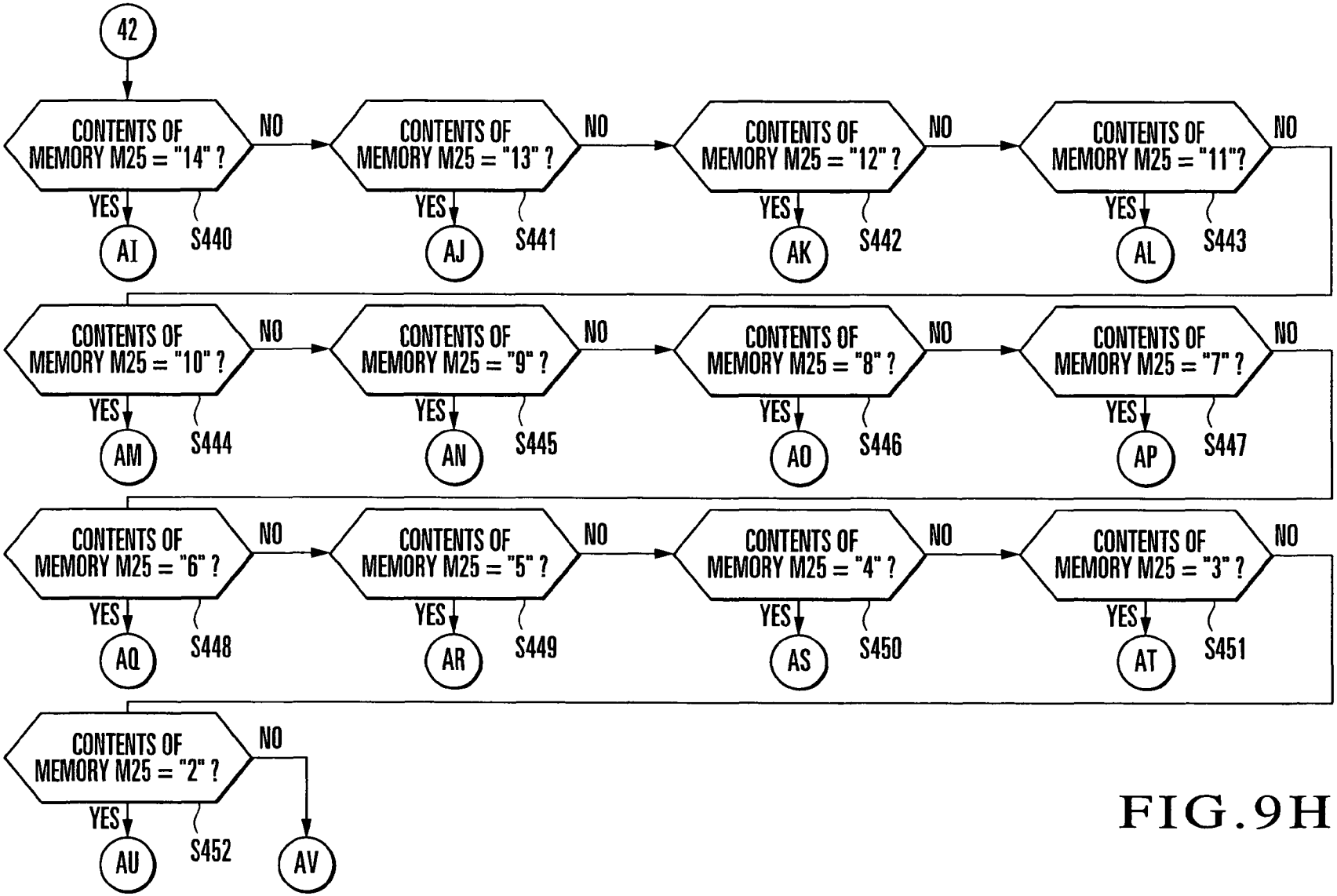
Figure 91:
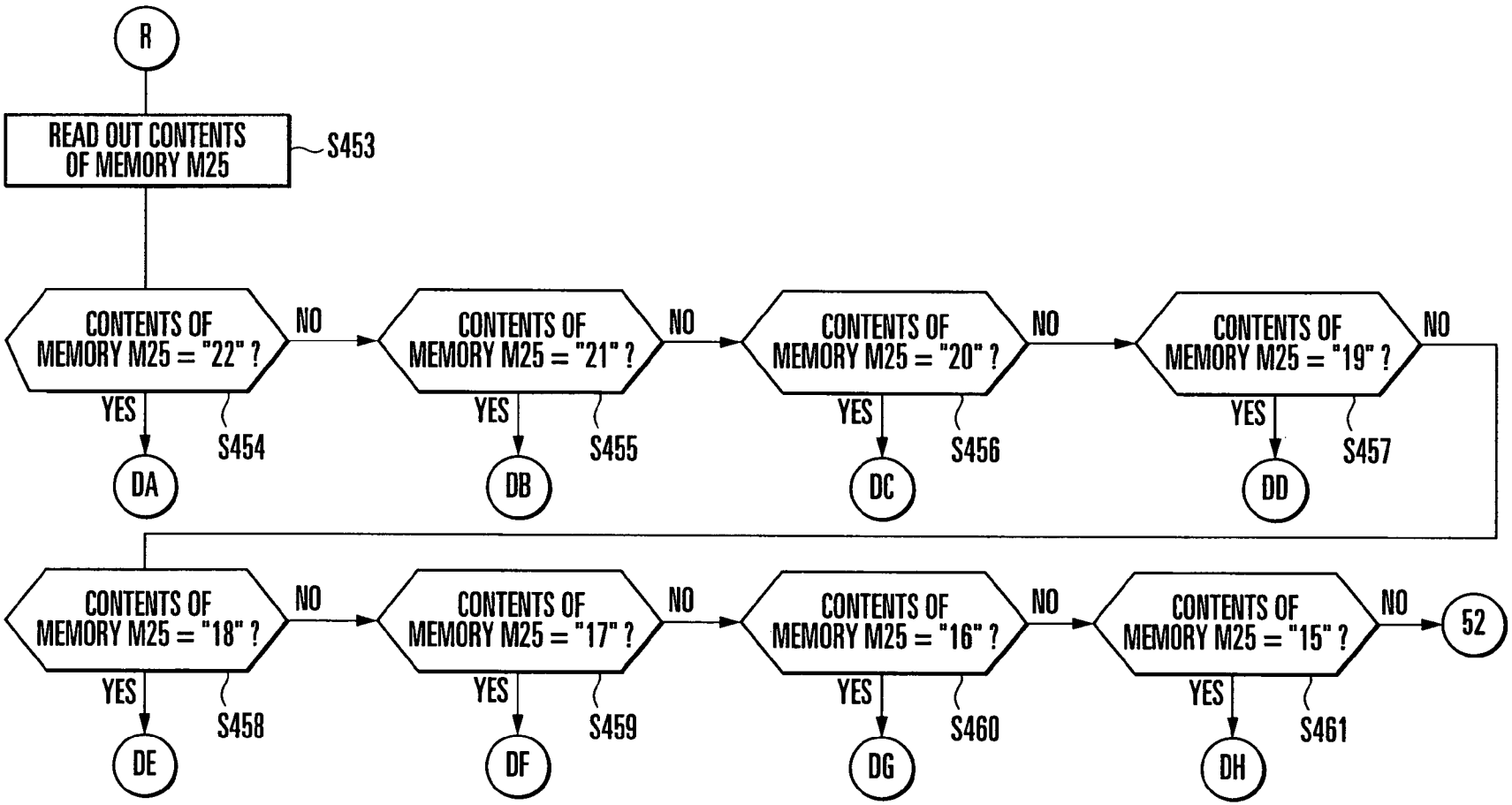
Figure 9J:
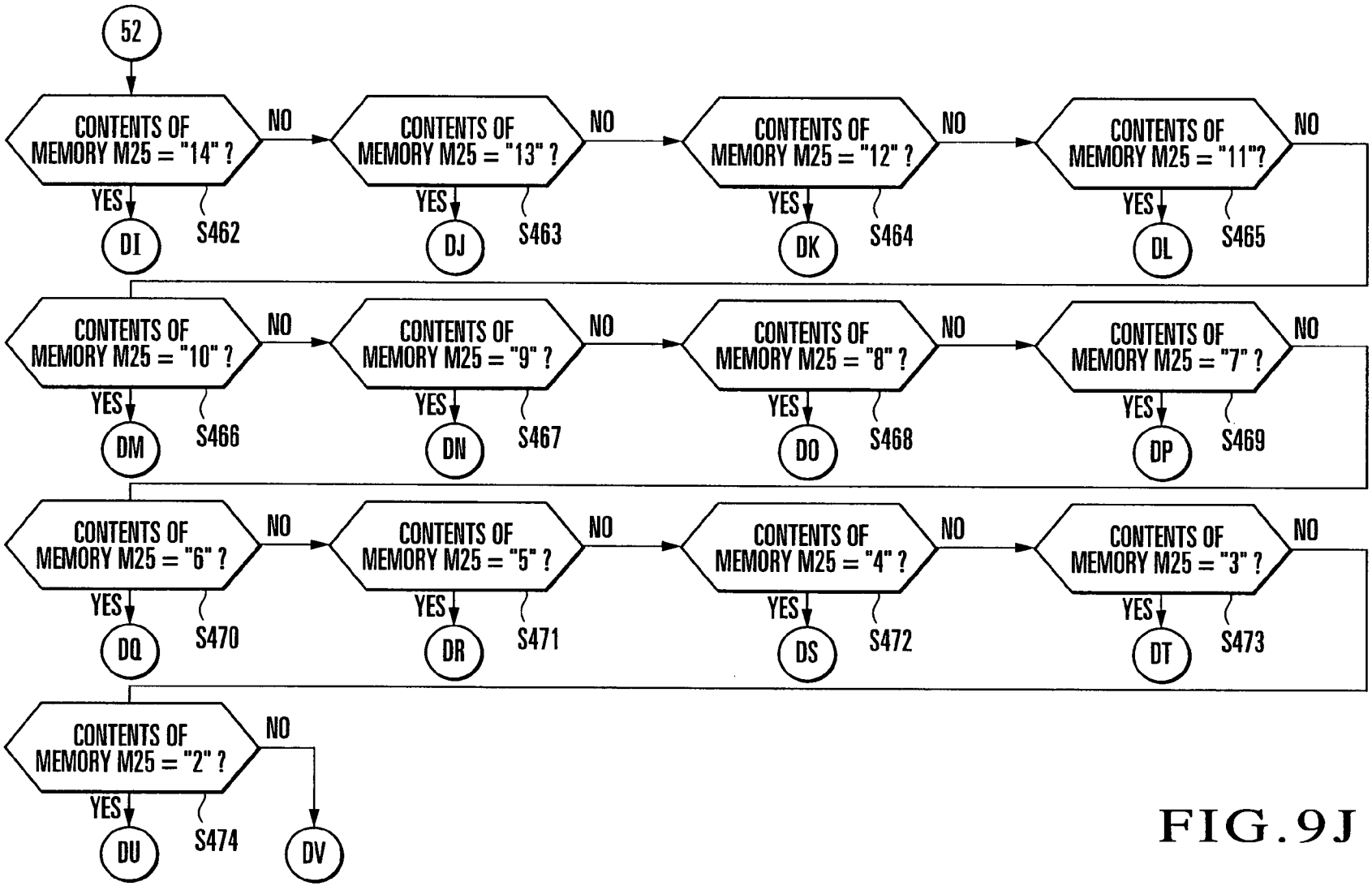

If the memory M25 stores "104" (FIG. 9F: YES in step S413), indicating an abnormal end of "switching step 31", the CPU 10 outputs a release signal to the suction head fixing/release air cylinder valve 48 (step S414) to eliminate the error in "switching step 31".

[Error in Switching Step 30]

If the memory M25 stores "105" (YES in step S418), indicating an abnormal end of "switching step 30", the CPU 10 outputs an ON signal to the suction cylinder release cam gear ON/OFF air cylinder valve 42 (step S419) to eliminate the error in "switching step 30".

[Error in Switching Step 29]

If the memory M25 stores "106" (YES in step S423), indicating an abnormal end af "switching step 29", the CPU 10 outputs a release signal to the W gear ON/OFF air cylinder valve 40 (step S424) to eliminate the error in "switching step 29".

In the above-described operation, if the ON state of the output from the suction head fixing sensor SS18 is not confirmed, i.e., if error recovery has failed even though a fixing signal is output to the suction head fixing/release air cylinder valve 48 in step S351 (FIG. 9A), the CPU 10 displays it and locks the switching operation (step S352). Similarly, if error recovery has failed in any other step, the CPU 10 displays it and locks the switching operation. In this case, the operator manually returns the mode to the single-sided printing state.

[Retry After Error Recovery]

If error recovery has succeeded, the operator turns on the retry switch 20. Since YES in step S429 (FIG. 9G), the CPU 10 advances to step S453 (FIG. 9I) to read out the contents of the error step memory M25. On the basis of the error number written in the memory M25, the CPU 10 restarts automatic switching to the double-sided printing state from the switching step that has undergone error recovery and restored the initial state.

Figure 8B:
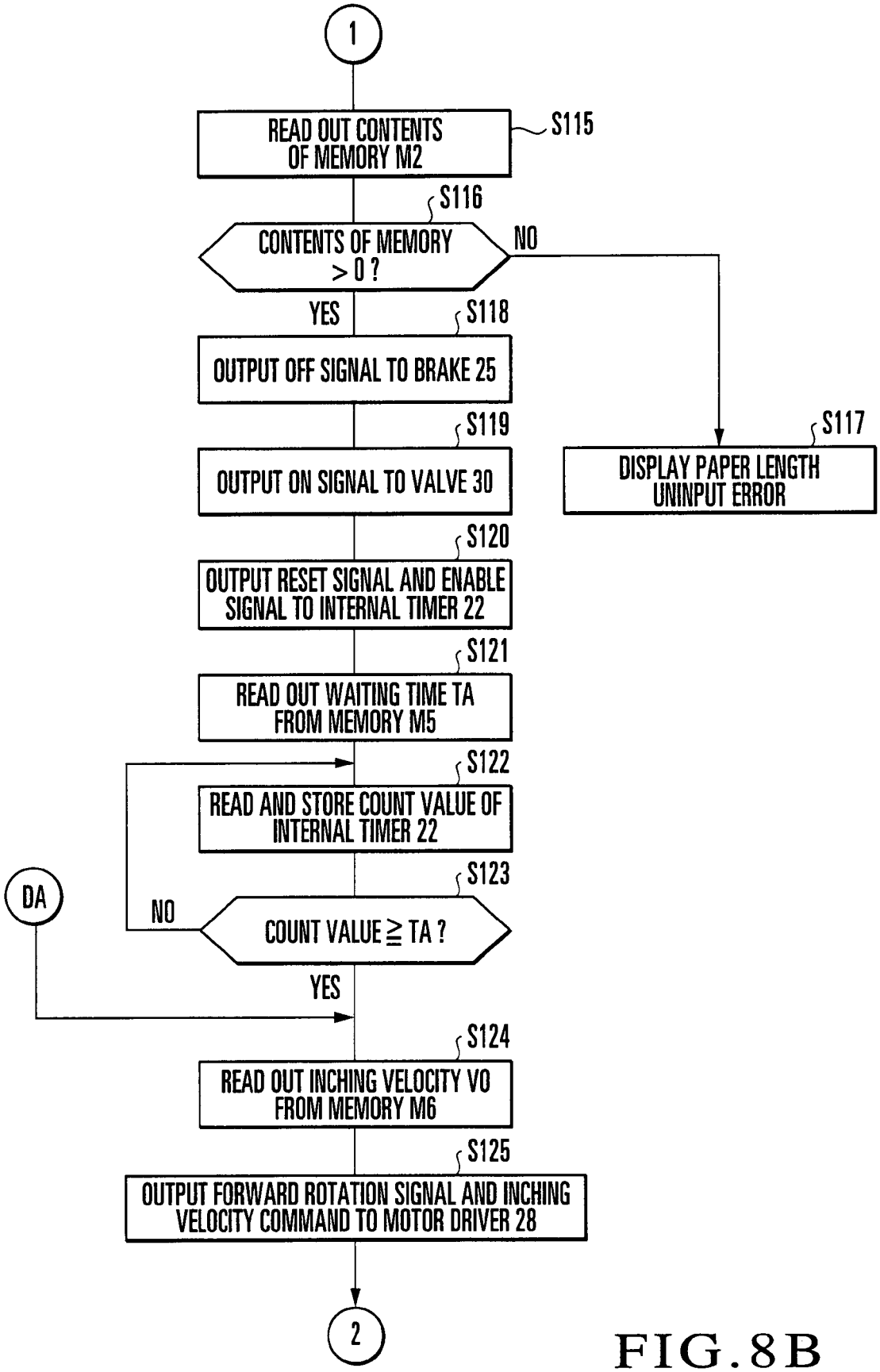
FIGS. 8B to 8T are flowcharts for explaining an automatic switching operation from a single-sided printing state to a double-sided printing state and an abnormal end detection operation following FIG. 8A.
Figure 8C:
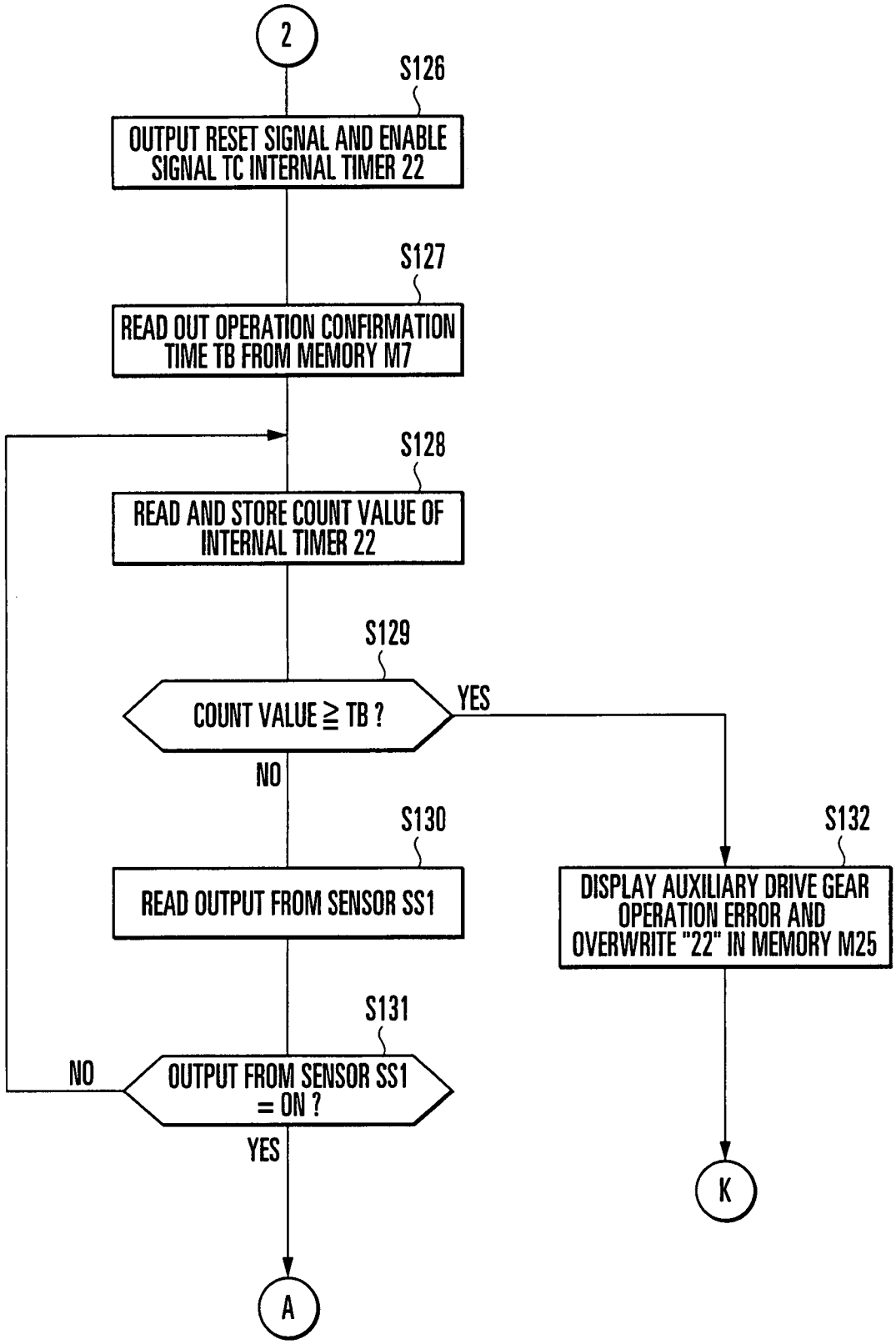
Figure 8D:
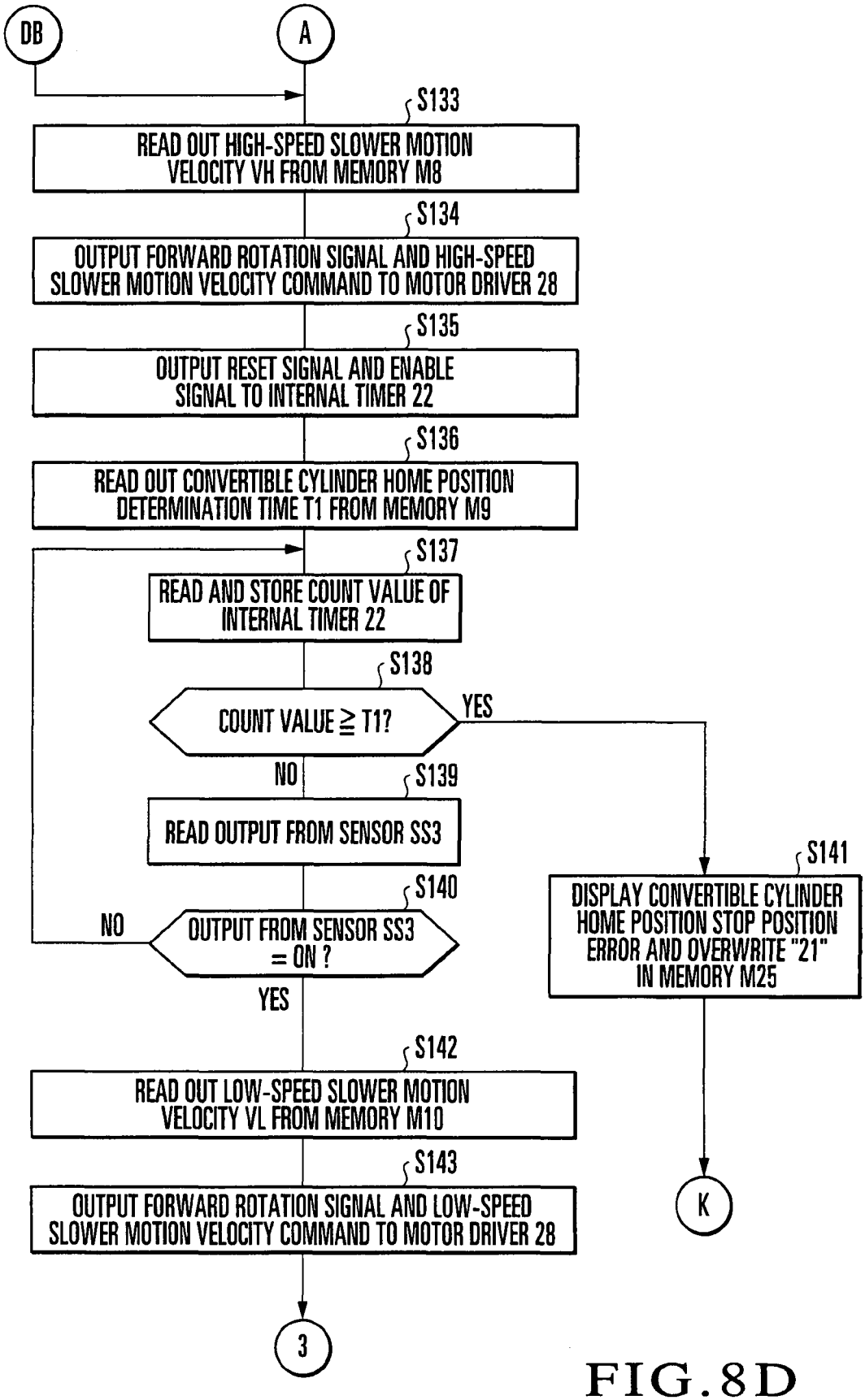
Figure 8E:
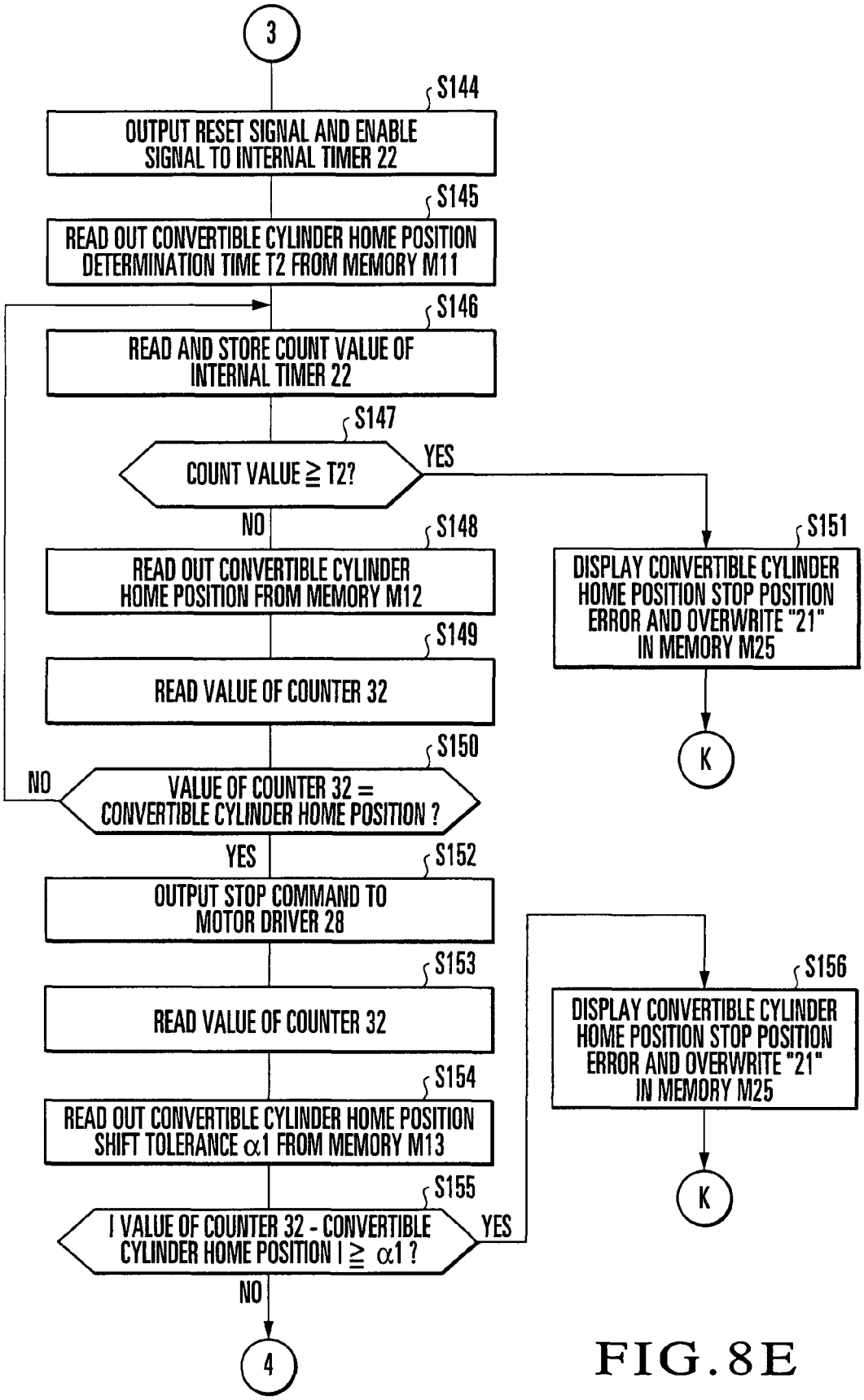

If the memory M25 stores, e.g., "22" (YES in step S454), automatic switching restarts from step S124 in the flowchart in FIG. 8B. If the memory M25 stores "21" (YES in step S455), automatic switching restarts from step S133 in the flowchart in FIG. 8D. If the memory M25 stores "20" (YES in step S456), automatic switching restarts from step S157 in the flowchart in FIG. 8F.

Figure 8F:
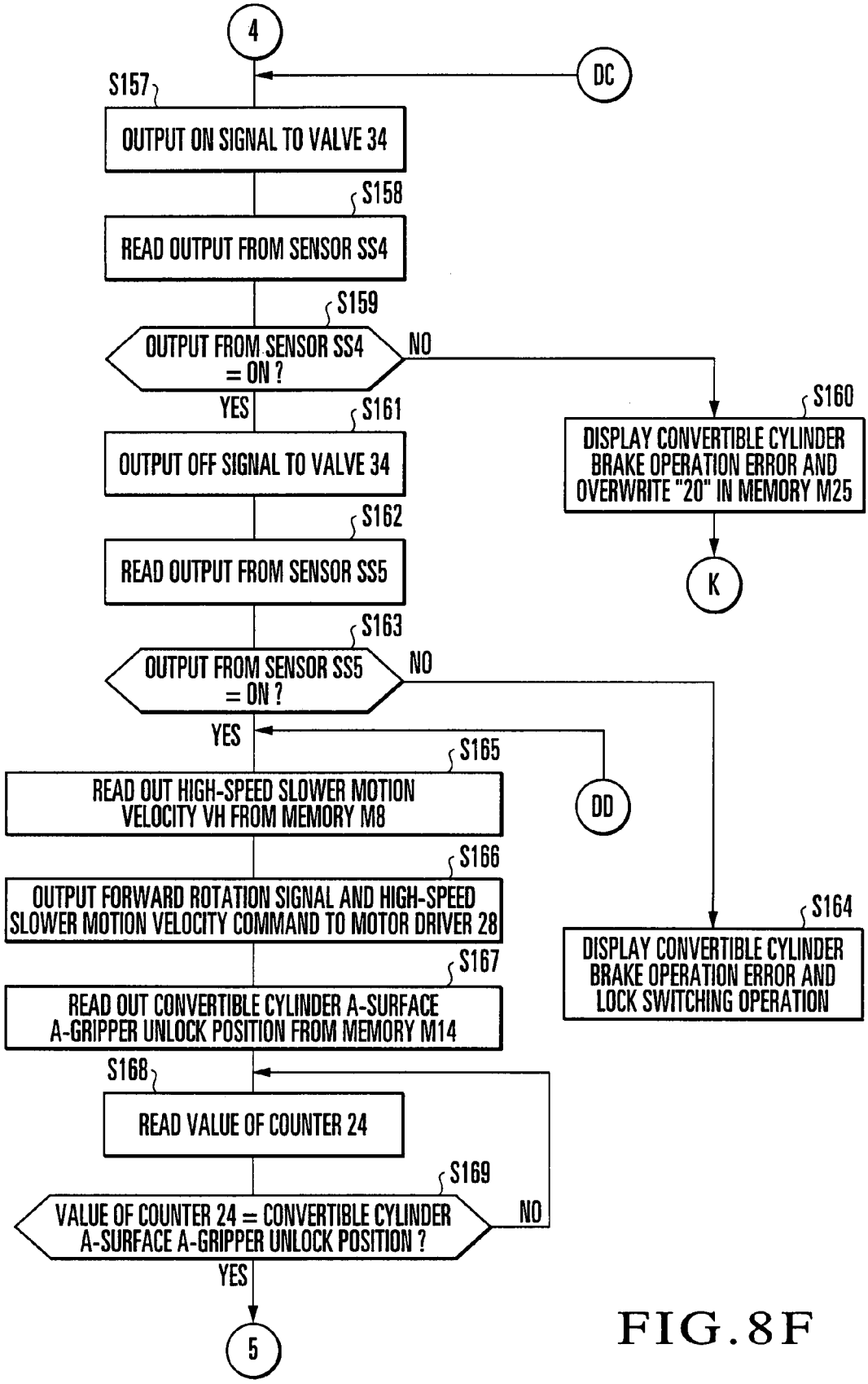
Figure 8G:
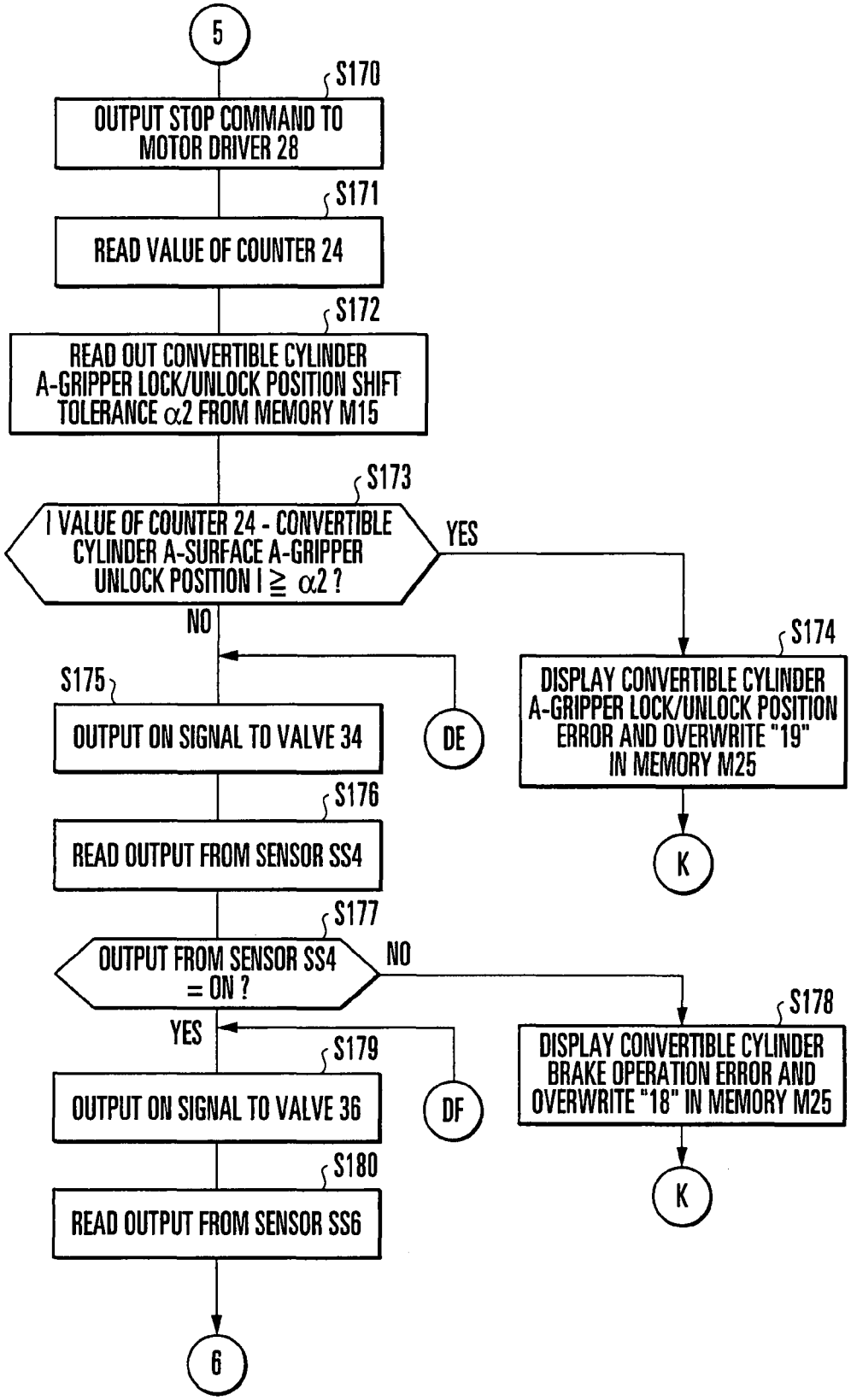

If the memory M25 stores "19" (YES in step S457), automatic switching restarts from step S165 in the flowchart in FIG. 8F. If the memory M25 stores "18" (YES in step S458), automatic switching restarts from step S175 in the flowchart in FIG. 8G. If the memory M25 stores "17" (YES in step S459), automatic switching restarts from step S179 in the flowchart in FIG. 8G. If the memory M25 stores "16" (YES in step S460), automatic switching restarts from step S183 in the flowchart in FIG. 8H.

Figure 8H:
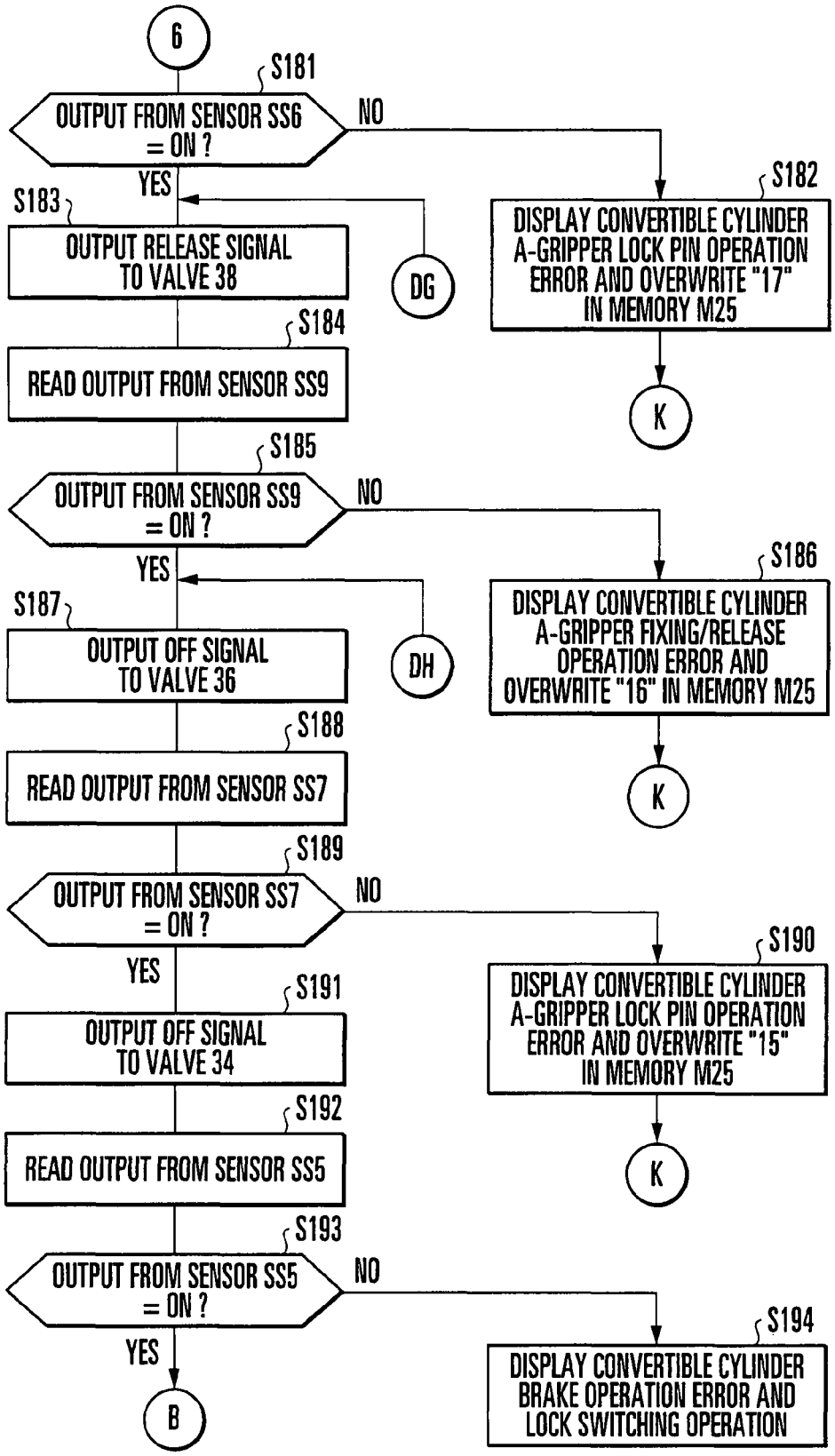
Figure 8I:
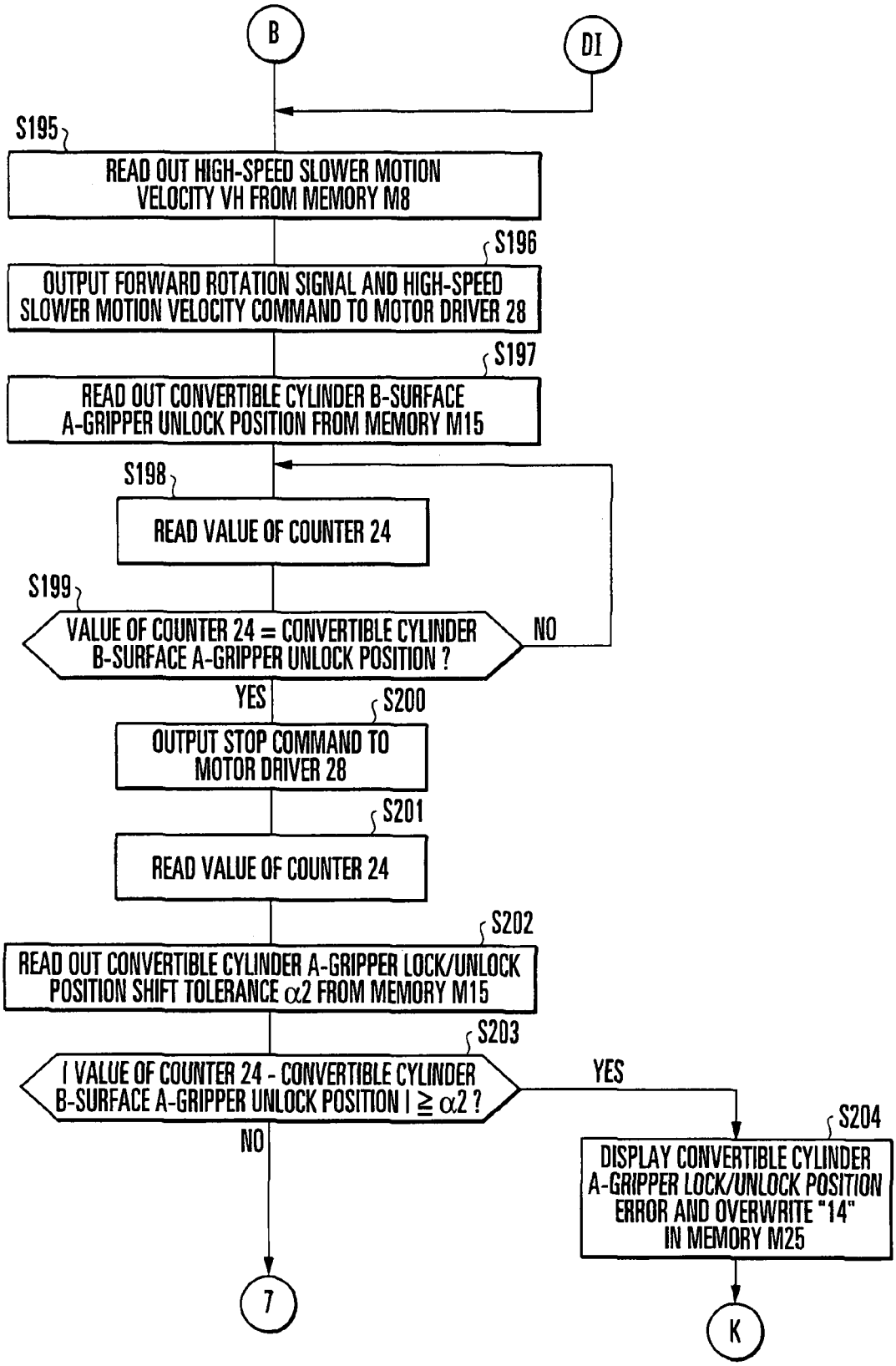

If the memory M25 stores "15" (YES in step S461), automatic switching restarts from step S187 in the flowchart in FIG. 8H. If the memory M25 stores "14" (FIG. 9J: YES in step S462), automatic switching restarts from step S195 in the flowchart in FIG. 8I. If the memory M25 stores "13" (YES in step S463), automatic switching restarts from step S205 in the flowchart in FIG. 8J. If the memory M25 stores "12" (YES in step S464), automatic switching restarts from step S209 in the flowchart in FIG. 8J.

Figure 8J:
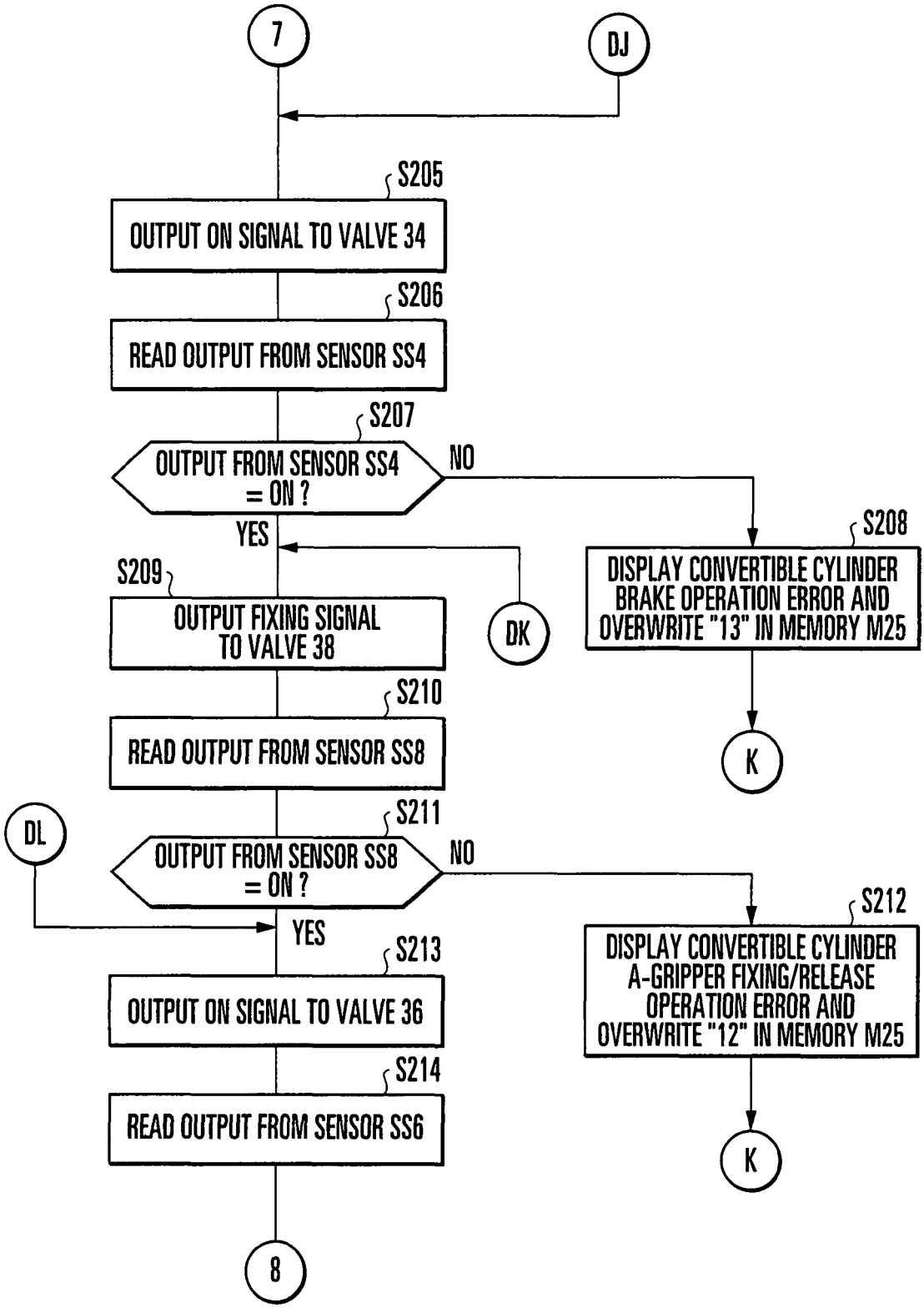
Figure 8K:
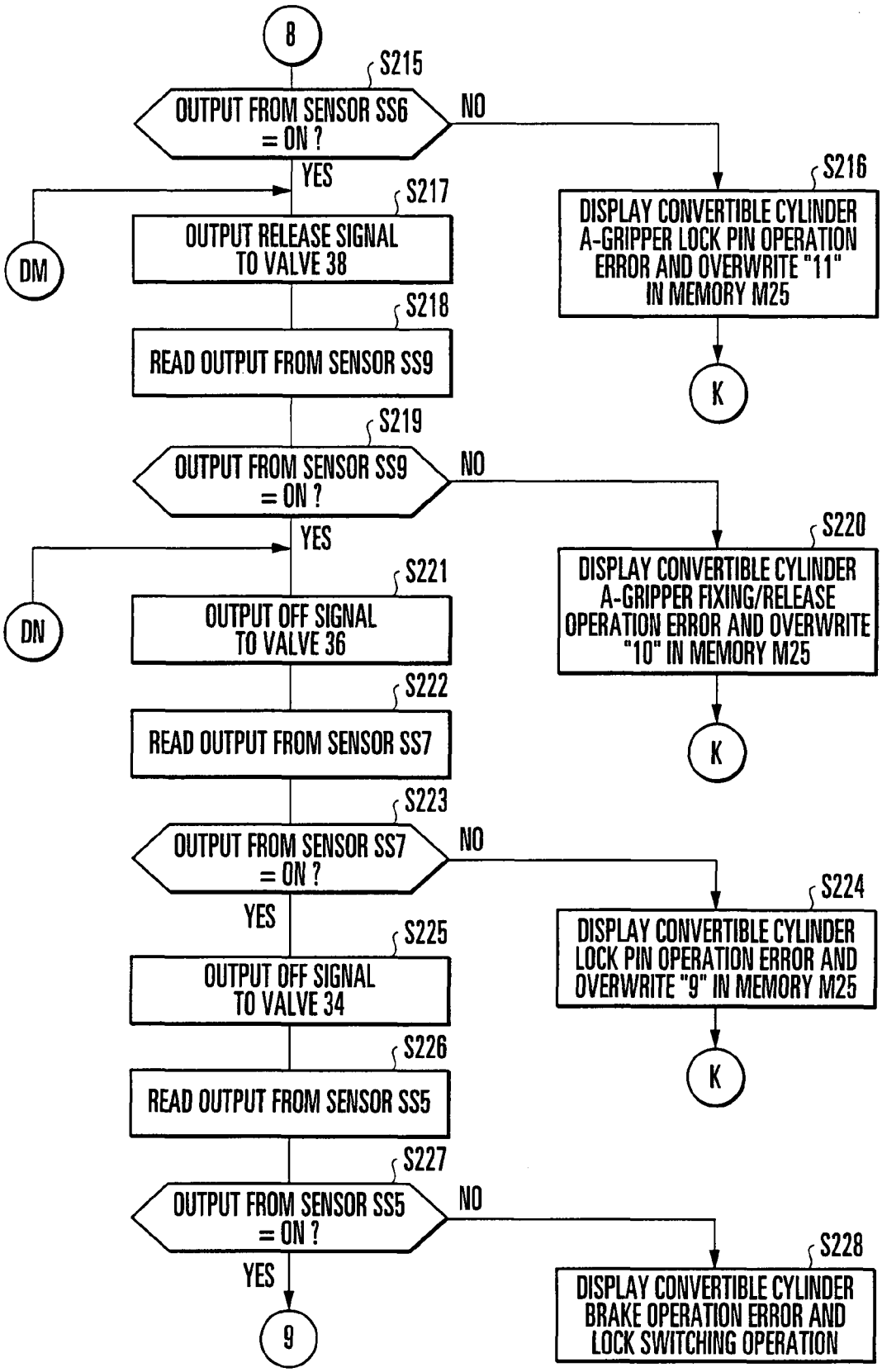
Figure 8L:
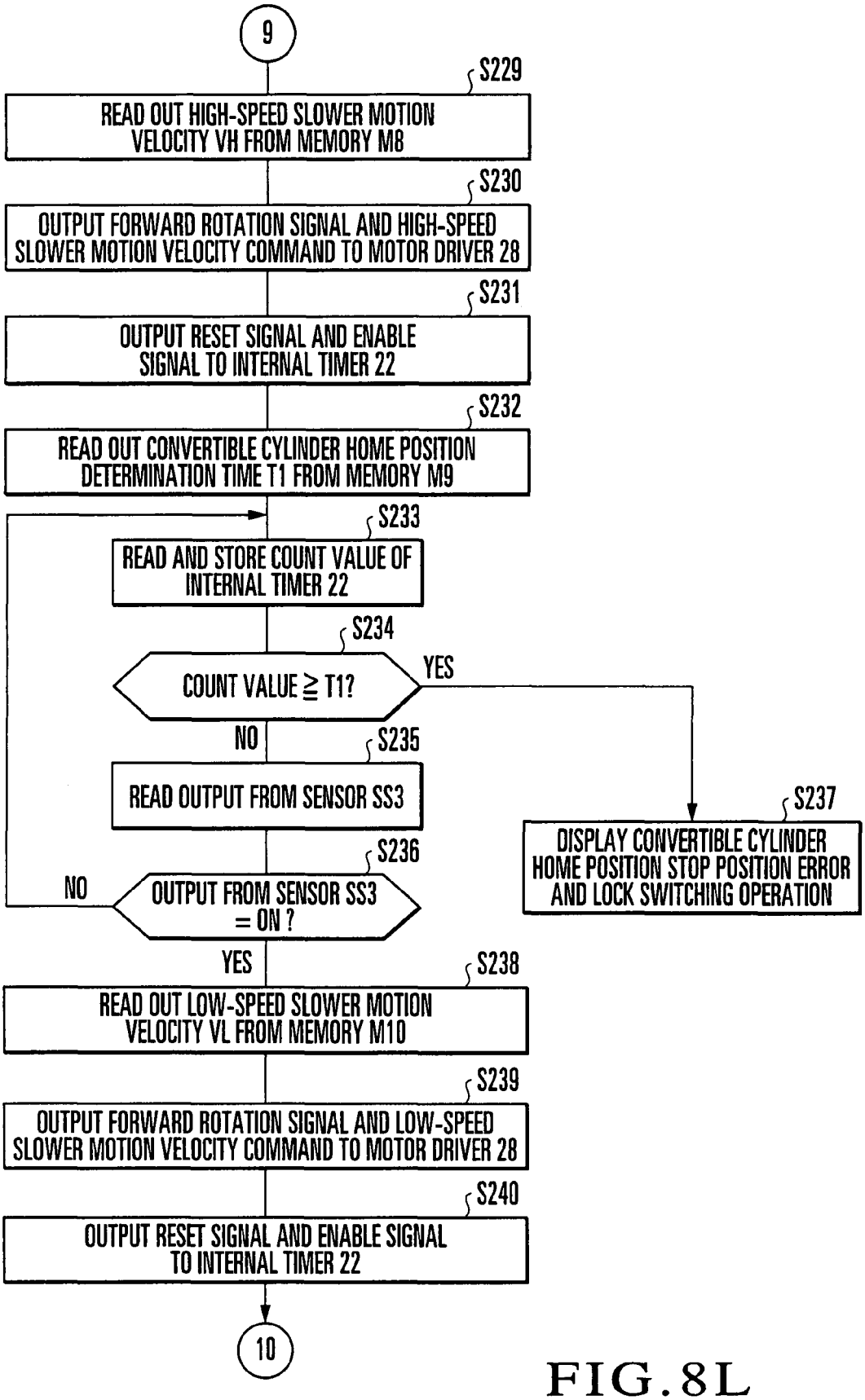
Figure 8M:
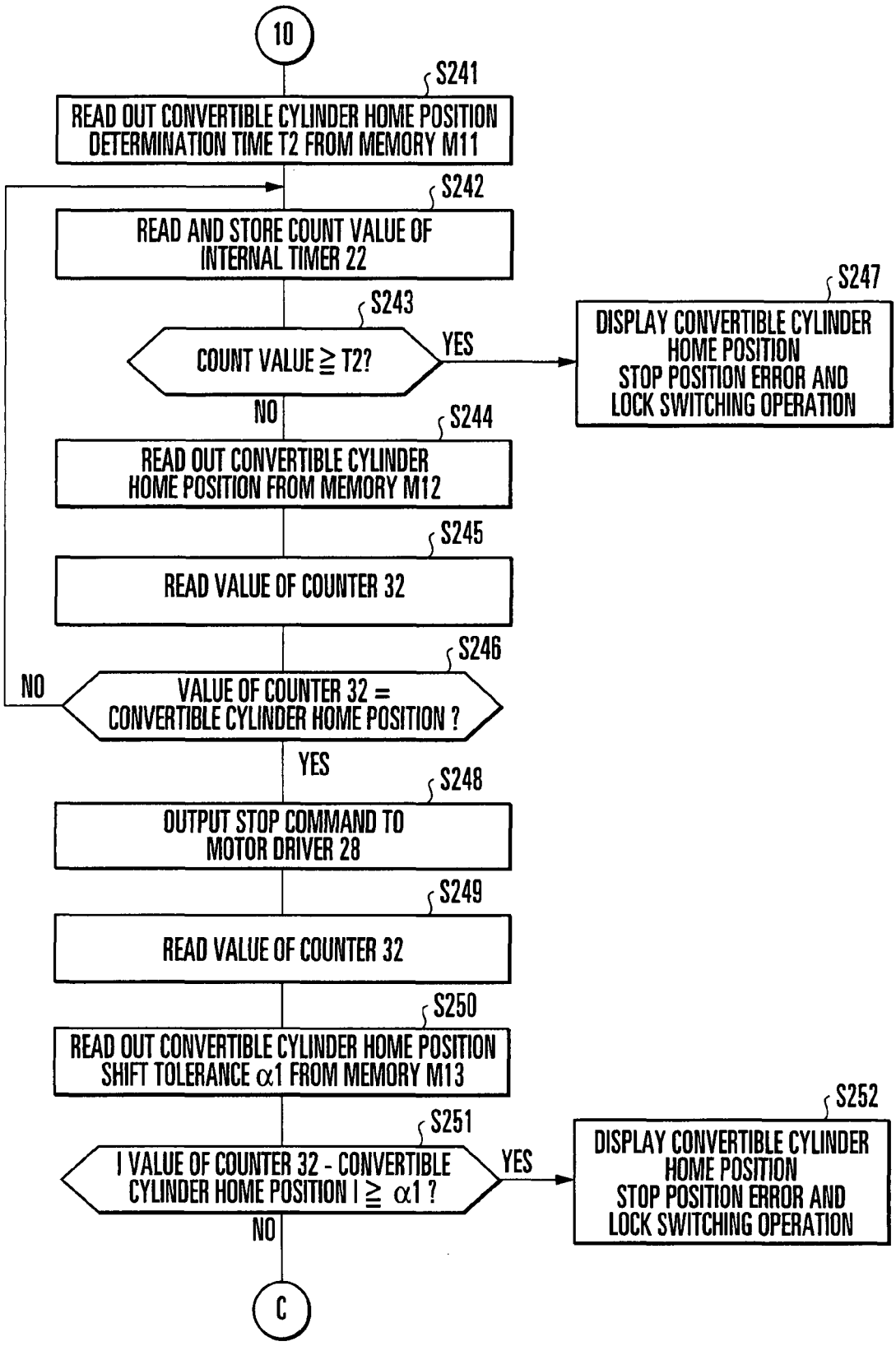

If the memory M25 stores "11" (YES in step S465), automatic switching restarts from step S213 in the flowchart in FIG. 8J. If the memory M25 stores "10" (YES in step S466), automatic switching restarts from step S217 in the flowchart in FIG. 8K. If the memory M25 stores "9" (YES in step S467), automatic switching restarts from step S221 in the flowchart in FIG. 8K. If the memory M25 stores "8" (YES in step S468), automatic switching restarts from step S253 in the flowchart in FIG. 8N.

Figure 8N:
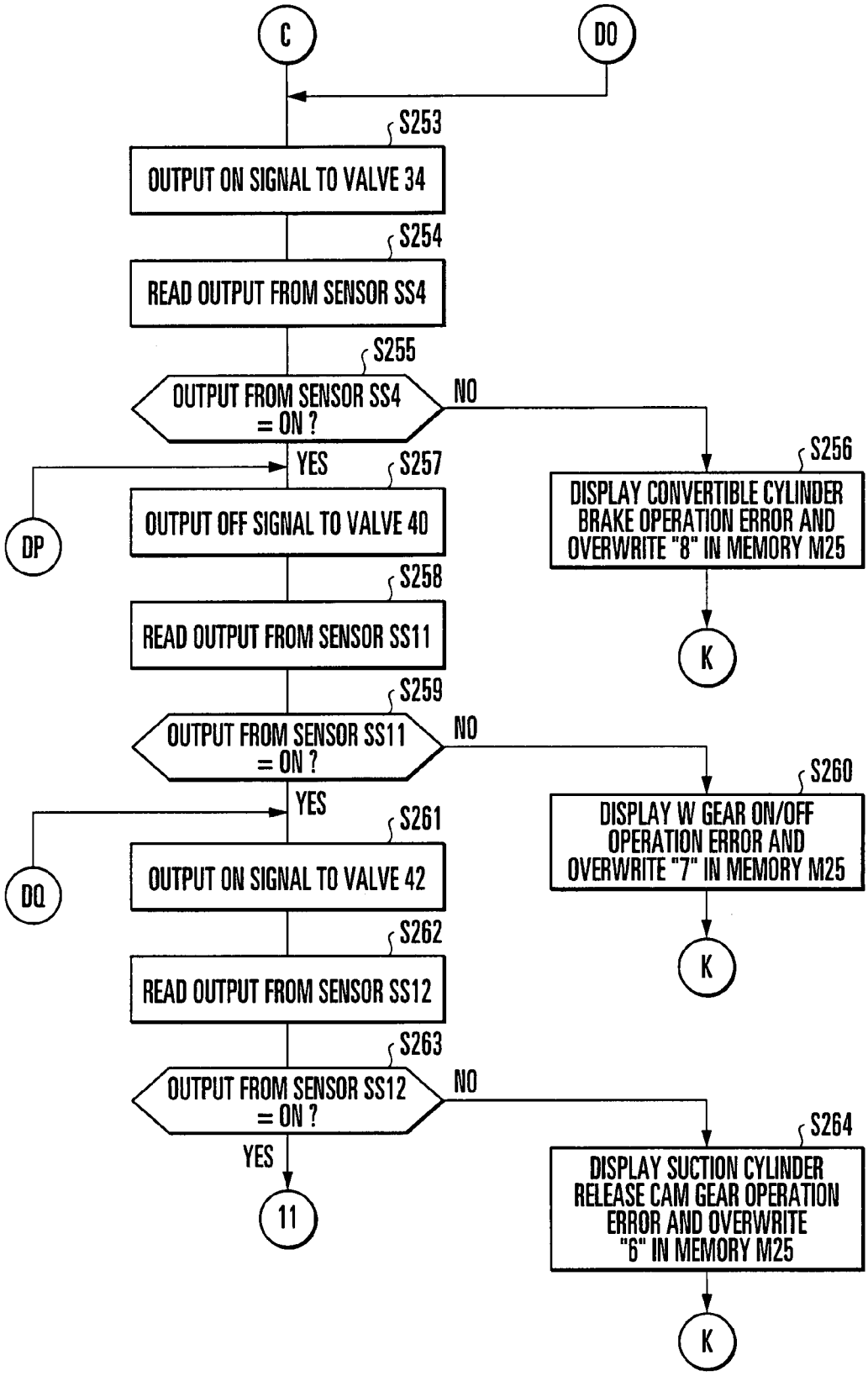
Figure 8O:
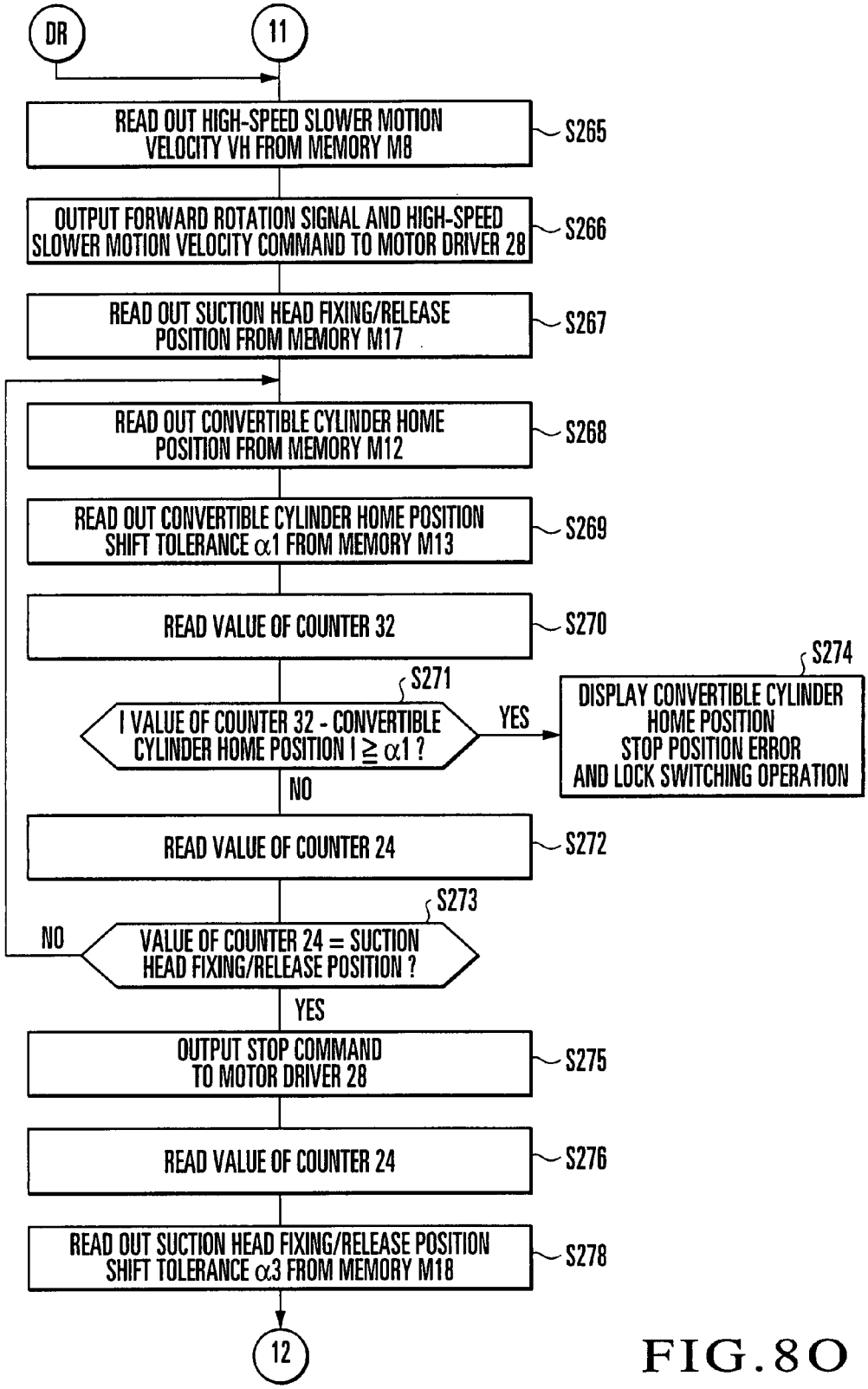

If the memory M25 stores "7" (YES in step S469), automatic switching restarts from step S257 in the flowchart in FIG. 8N. If the memory M25 stores "6" (YES in step S470), automatic switching restarts from step S261 in the flowchart in FIG. 8N. If the memory M25 stores "5" (YES in step S471), automatic switching restarts from step S265 in the flowchart in FIG. 8O. If the memory M25 stores "4" (YES in step S472), automatic switching restarts from step S281 in the flowchart in FIG. 8P.

Figure 8P:
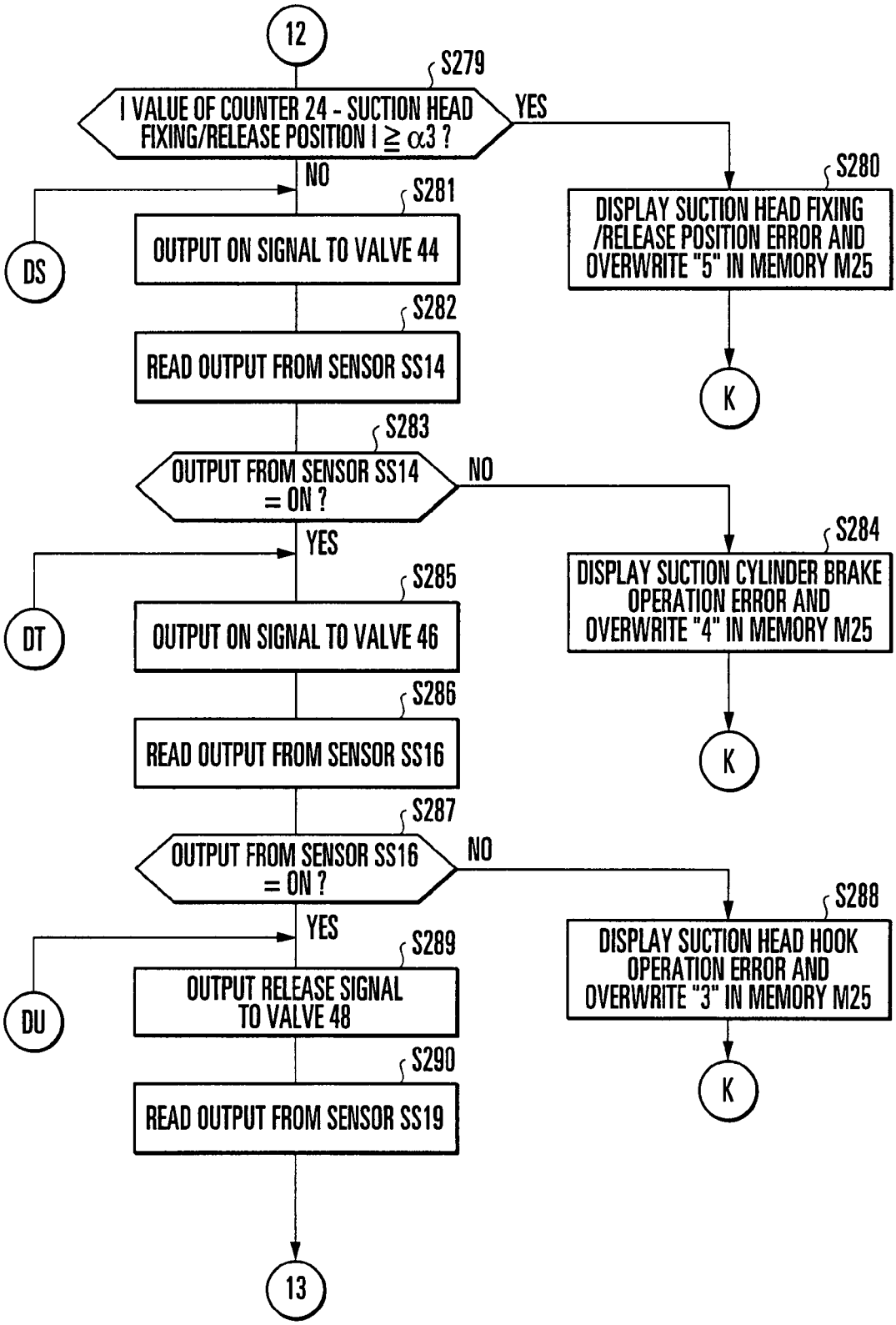

If the memory M25 stores "3" (YES in step S473), automatic switching restarts from step S285 in the flowchart in FIG. 8P. If the memory M25 stores "2" (YES in step S474), automatic switching restarts from step S289 in the flowchart in FIG. 8P. If the memory M25 stores "1", automatic switching restarts from step S299 in the flowchart in FIG. 8Q.

[Automatic Return]

Upon determining that there is no probability that the switching step will normally finish even in retry, the operator turns on the return operation start switch 21. Since YES in step S428 in FIG. 9G, the CPU 10 advances to step S430 to read out the contents (error number) of the error step memory M25. On the basis of the error number written in the memory M25, the CPU 10 starts automatic return from single-side return operation steps "R1-1 to R1-25" and "R1-F" (Tables 1, 2, and 3) corresponding to the error number to the printing state (single-sided printing state) before the start of automatic switching.

When the single-side return operation step corresponding to the error number written in the memory M25 is "R1-F", automatic switching to the double-sided printing state is forcedly terminated through the steps of "W gear ON", "release cam gear OFF", "suction head fixing", "suction head hook OFF", "convertible cylinder brake OFF", and "auxiliary drive gear OFF", instead of automatic return to the single-sided printing state.

[Automatic Return from Single-Side Return Operation Step [R1-1]]

If the memory M25 stores, e.g., "1", the CPU 10 sets the single-side return operation step "R1-1" as the single-side return starting step and starts automatic return from the single-side return operation step "R1-1" to the single-sided printing state. In this case, since NO in step S452 in FIG. 9H, the process advances to step S501 in FIG. 10A to read out the high-speed slower motion velocity VH of the auxiliary drive motor from the memory M8 and rotate the auxiliary drive motor 26 in the reverse direction at the high-speed slower motion velocity VH (step S502).

The CPU 10 reads out the suction head fixing/release position from the memory M17 (step S503). The CPU 10 keeps confirming that the convertible cylinder 3 is at the home position (steps S504 to S508). When the value of the upstream cylinder position detection counter 24 matches the suction head fixing/release position (YES in step S510), the CPU 10 outputs a stop command to the motor driver 28 for the auxiliary drive motor (step S511) to stop rotating the auxiliary drive motor 26.

After the auxiliary drive motor 26 stops, the CPU 10 reads the value of the upstream cylinder position detection counter 24 (FIG. 10B: step S512) and reads out the suction head fixing/release position shift tolerance α3 from the memory M18 (step S513). If the absolute value of the difference between the value of the upstream cylinder position detection counter 24 and the suction head fixing/release position is smaller than the suction head fixing/release position shift tolerance α3 (NO in step S514), the CPU 10 outputs an ON signal to the suction cylinder brake ON/OFF air cylinder valve 44 (step S516).

Figure 10A:
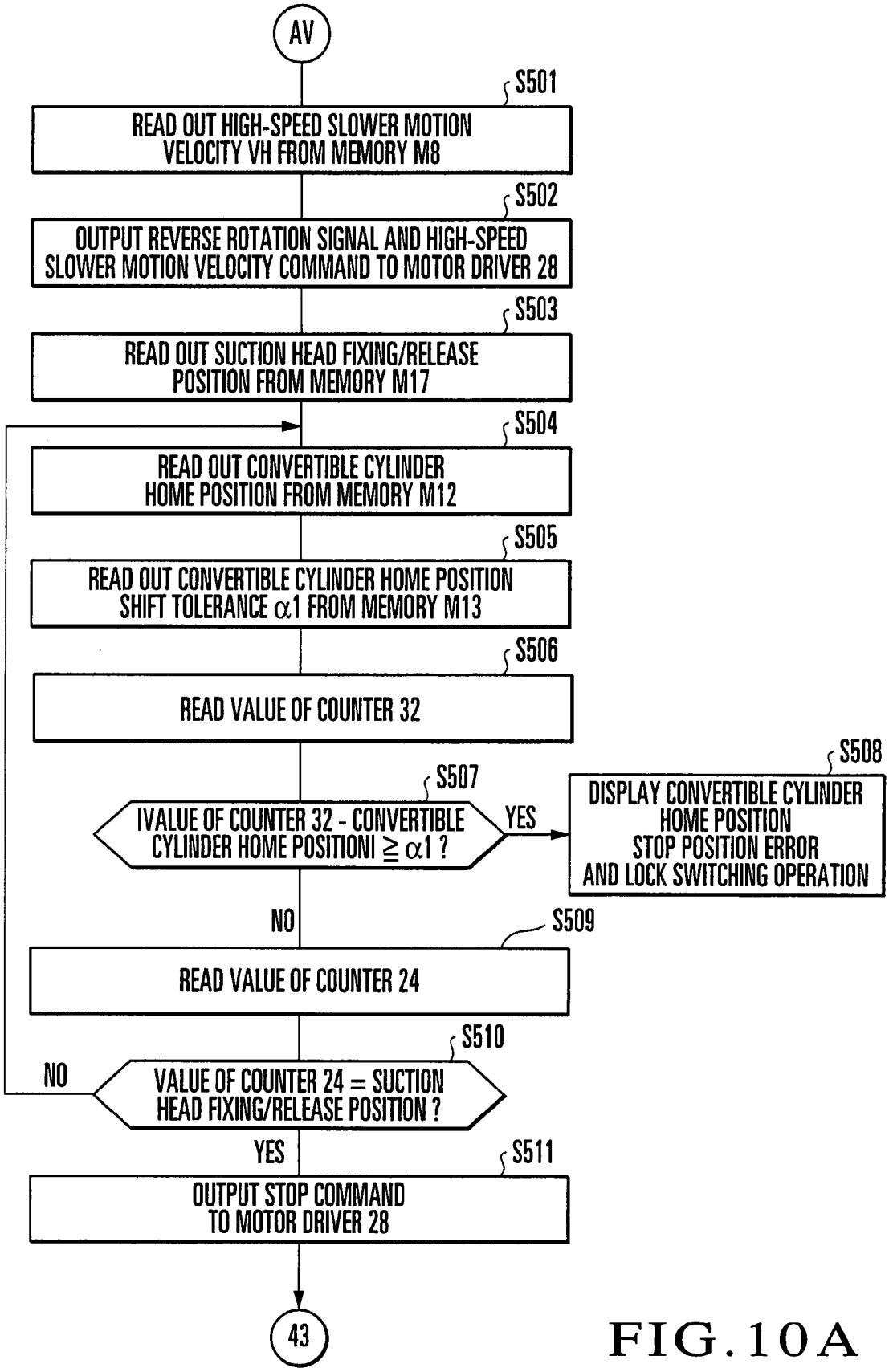
FIGS. 10A to 10M are flowcharts for explaining an automatic return operation to a single-sided printing state.
Figure 10B:
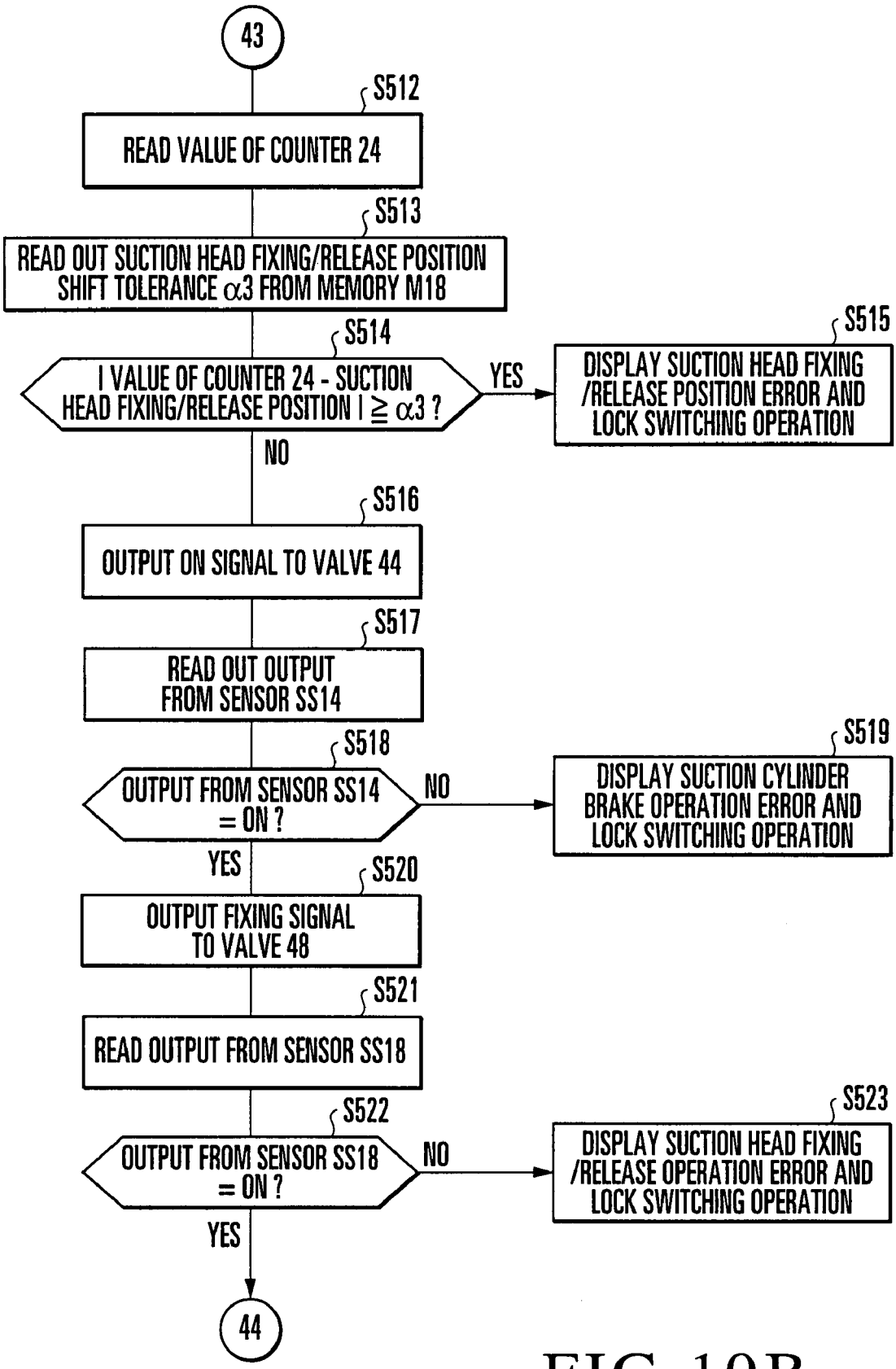
Figure 10C:
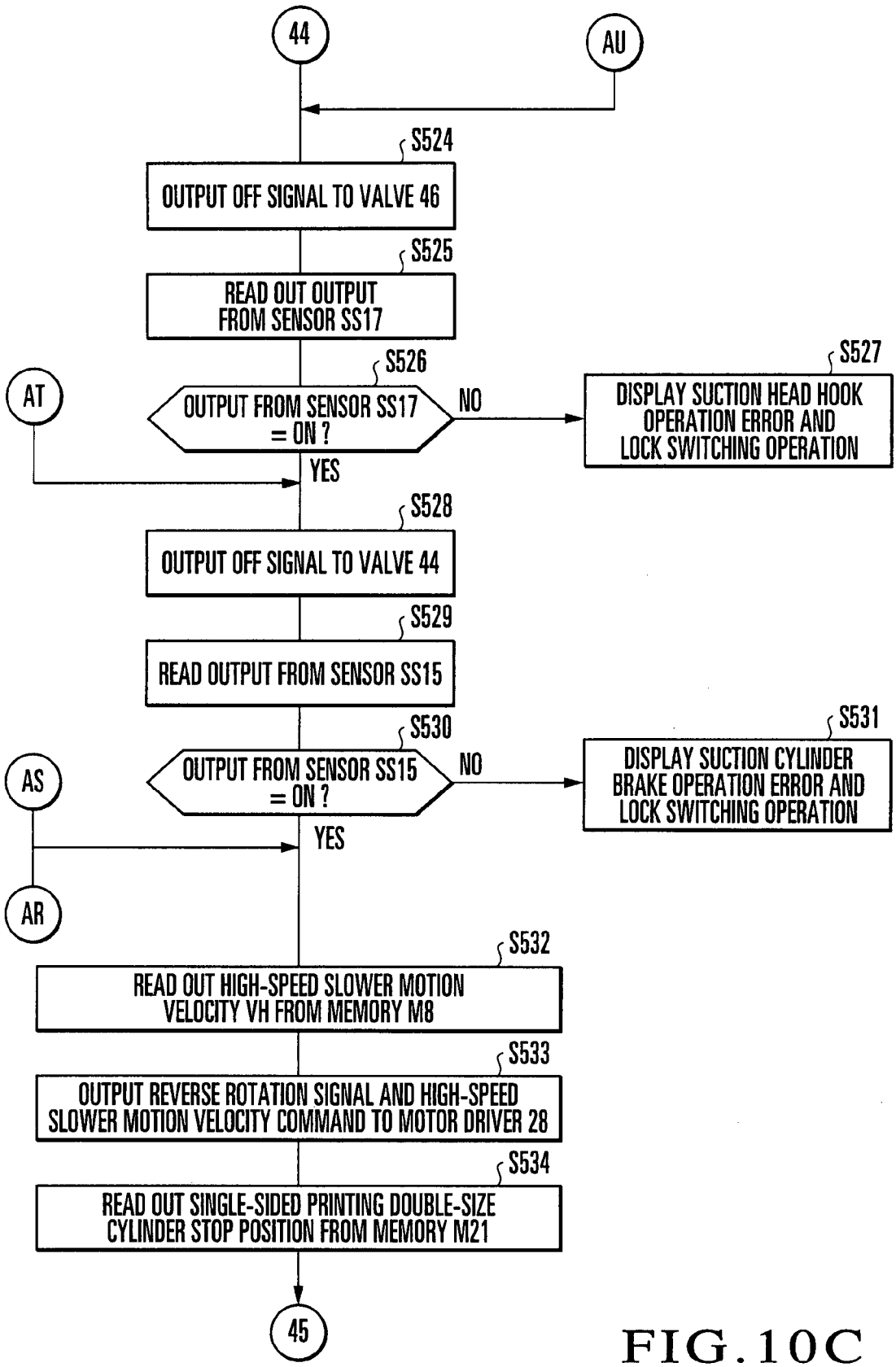

The CPU 10 reads the output from the suction cylinder brake ON sensor SS14 (step S517). If the output from the suction cylinder brake ON sensor SS14 is ON (YES in step S518), the CPU 10 outputs a fixing signal to the suction head fixing/release air cylinder valve 48 (step S520) and reads the output from the suction head fixing sensor SS18 (step S521). If the output from the suction head fixing sensor SS18 is ON (YES in step S522), the CPU 10 outputs an OFF signal to the suction head hook ON/OFF air cylinder valve 46 (FIG. 10C: step S524).

The CPU 10 reads the output from the suction head hook OFF sensor SS17 (step S525). If the output from the suction head hook OFF sensor SS17 is ON (YES in step S526), the CPU 10 outputs an OFF signal to the suction cylinder brake ON/OFF air cylinder valve 44 (step S528) and reads the output from the suction cylinder brake OFF sensor SS15 (step S529). If the output from the suction cylinder brake OFF sensor SS15 is ON (YES in step S530), the CPU 10 rotates the auxiliary drive motor 26 in the reverse direction at the high-speed slower motion velocity VH (steps S532 and S533).

Figure 10D:
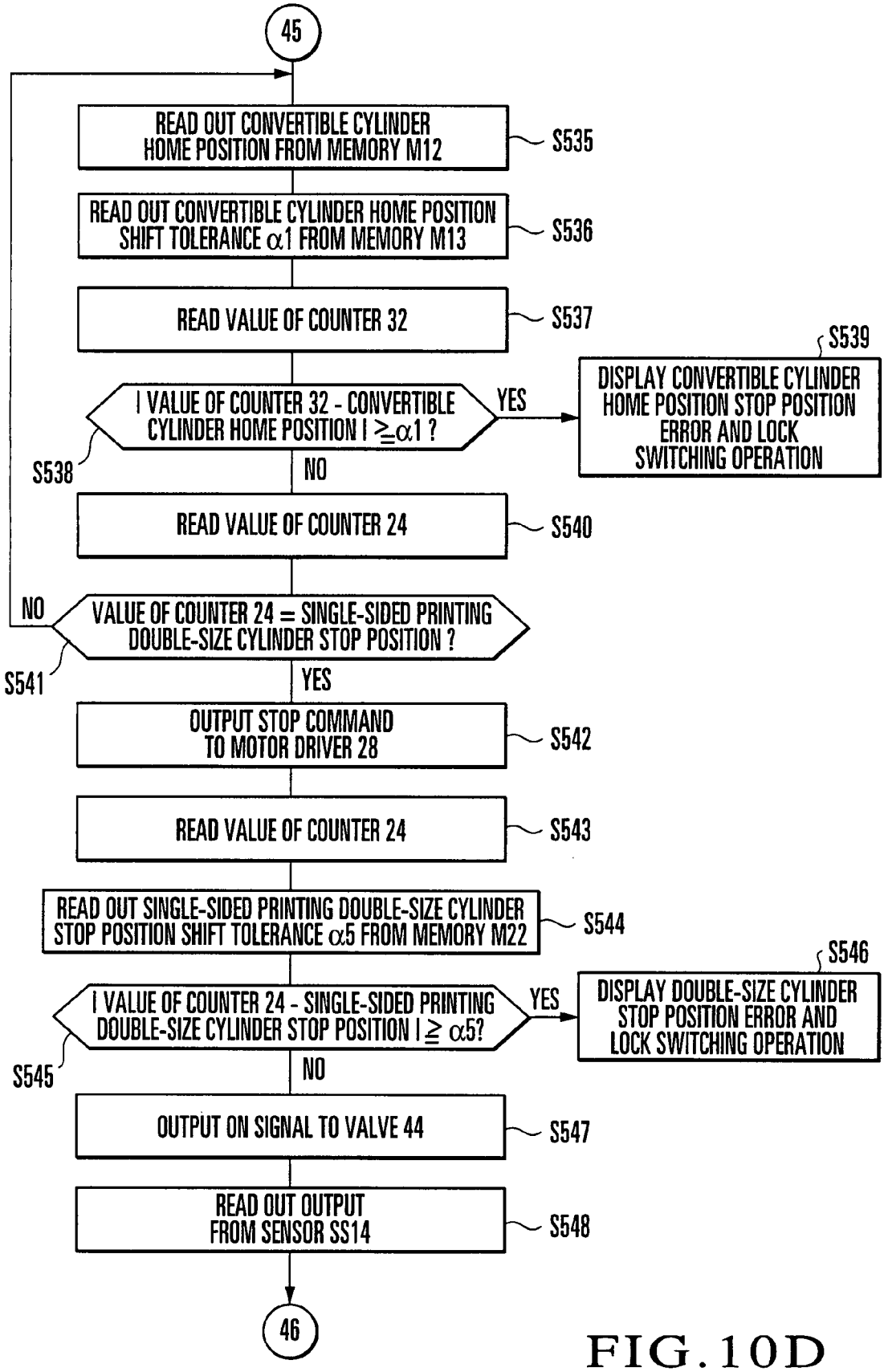
Figure 10E:
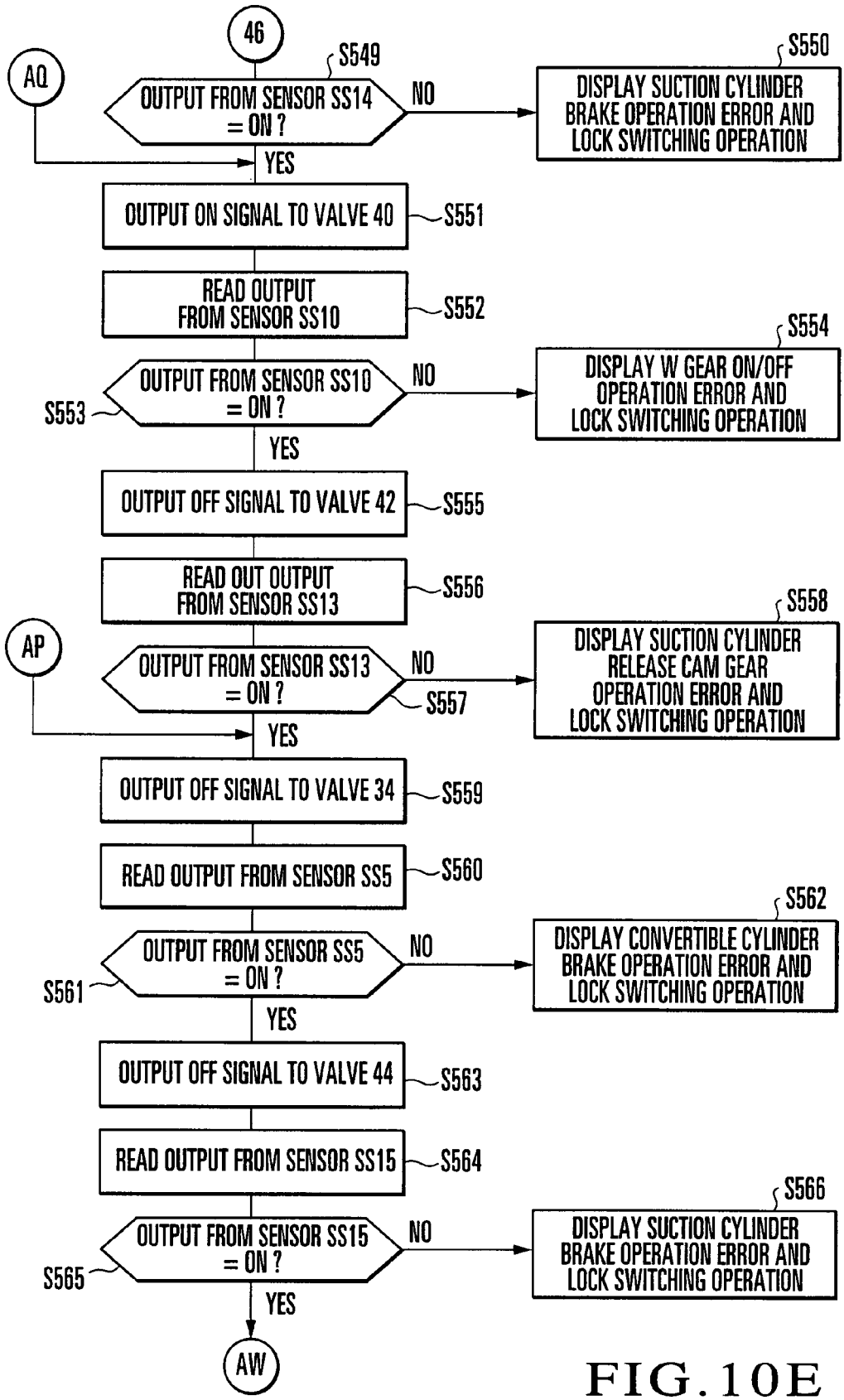

The CPU 10 reads out the single-sided printing double-size cylinder stop position from the memory M21 (step S534) and keeps confirming that the convertible cylinder 3 is at the home position (FIG. 10D: steps S535 to S539). When the value of the upstream cylinder position detection counter 24 matches the single-sided printing double-size cylinder stop position memory (YES in step S541), the CPU 10 outputs a stop command to the motor driver 28 for the auxiliary drive motor (step S542) to stop rotating the auxiliary drive motor 26.

After the auxiliary drive motor 26 stops, the CPU 10 reads the value of the upstream cylinder position detection counter 24 (step S543) and reads out the single-sided printing double-size cylinder stop position shift tolerance α5 from the memory M22 (step S544). If the absolute value of the difference between the value of the upstream cylinder position detection counter 24 and the single-sided printing double-size cylinder stop position is smaller than the single-sided printing double-size cylinder stop position shift tolerance α5 (NO in step S545), the CPU 10 outputs an ON signal to the suction cylinder brake ON/OFF air cylinder valve 44 (step S547).

The CPU 10 reads the output from the suction cylinder brake ON sensor SS14 (step S548). If the output from the suction cylinder brake ON sensor SS14 is ON (FIG. 10E: YES in step S549), the CPU 10 outputs an ON signal to the W gear ON/OFF air cylinder valve 40 (step S551) and reads the output from the W gear ON sensor SS10 (step S552). If the output from the W gear ON sensor SS10 is ON (YES in step S553), the CPU 10 outputs an OFF signal to the suction cylinder release cam gear ON/OFF air cylinder valve 42 (step S555).

Figure 10F:
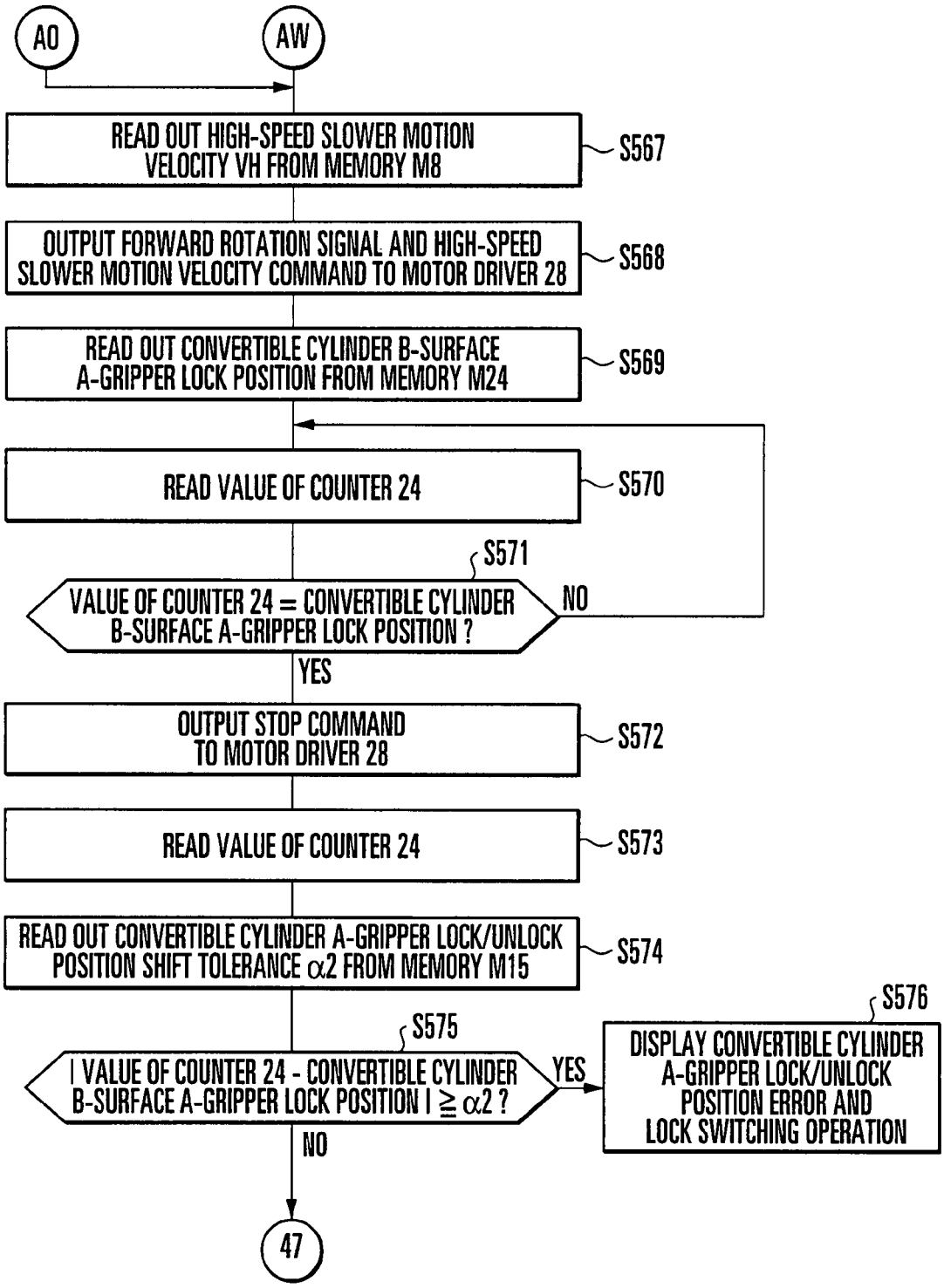
Figure 10G:
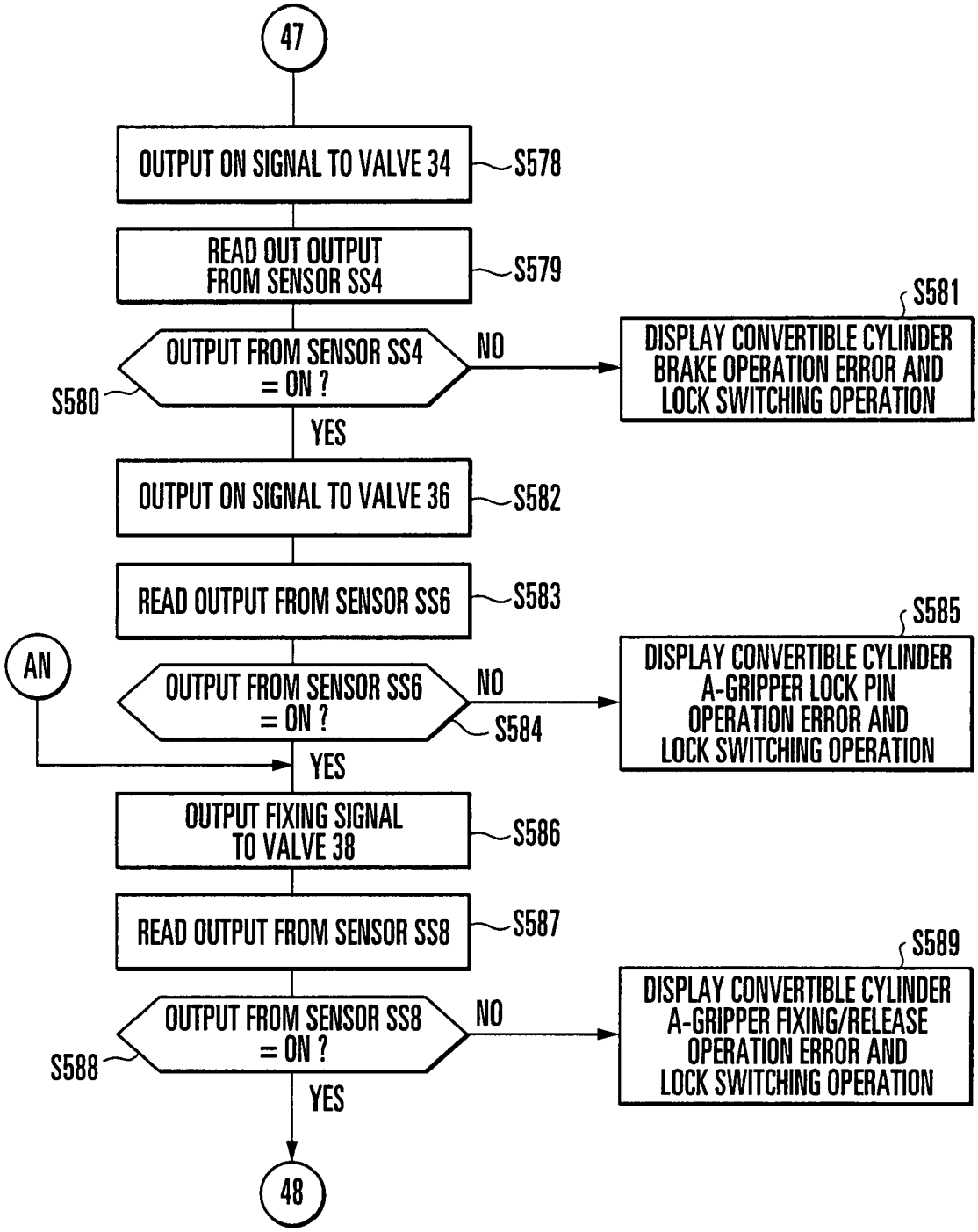

The CPU 10 reads the output from the suction cylinder release cam gear OFF sensor SS13 (step S556). If the output from the suction cylinder release cam gear OFF sensor SS13 is ON (YES in step S557), the CPU 10 outputs an OFF signal to the convertible cylinder brake ON/OFF air cylinder valve 34 (step S559) and reads the output from the convertible cylinder brake OFF sensor SS5 (step S560). If the output from the convertible cylinder brake OFF sensor SS5 is ON (YES in step S561), the CPU 10 outputs an OFF signal to the suction cylinder brake ON/OFF air cylinder valve 44 (step S563) and reads the output from the suction cylinder brake OFF sensor SS15 (step S564). If the output from the suction cylinder brake OFF sensor SS15 is ON (YES in step S565), the CPU 10 rotates the auxiliary drive motor 26 in the forward direction at the high-speed slower motion velocity VH (FIG. 10F: steps S567 and 568).

The CPU 10 reads out the convertible cylinder B-surface A-gripper lock position from the memory M24 (step S569). The auxiliary drive motor 26 continues to rotate until the value of the upstream cylinder position detection counter 24 equals the convertible cylinder B-surface A-gripper lock position (steps S570 and S571). If the value of the upstream cylinder position detection counter 24 equals the convertible cylinder B-surface A-gripper lock position (YES in step S571), the CPU 10 outputs a stop command to the motor driver 28 for the auxiliary drive motor (step S572) to stop rotating the auxiliary drive motor 26.

After the auxiliary drive motor 26 stops, the CPU 10 reads the value of the upstream cylinder position detection counter 24 (step S573) and reads out the convertible cylinder A-gripper lock/unlock position shift tolerance α2 from the memory M15 (step S574). If the absolute value of the difference between the value of the upstream cylinder position detection counter 24 and the convertible cylinder B-surface A-gripper lock position is smaller than the convertible cylinder A-gripper lock/unlock position shift tolerance α2 (NO in step S575), the CPU 10 outputs an ON signal to the convertible cylinder brake ON/OFF air cylinder valve 34 (FIG. 10G: step S578) and reads the output from the convertible cylinder brake ON sensor SS4 (step S579).

Figure 10H:
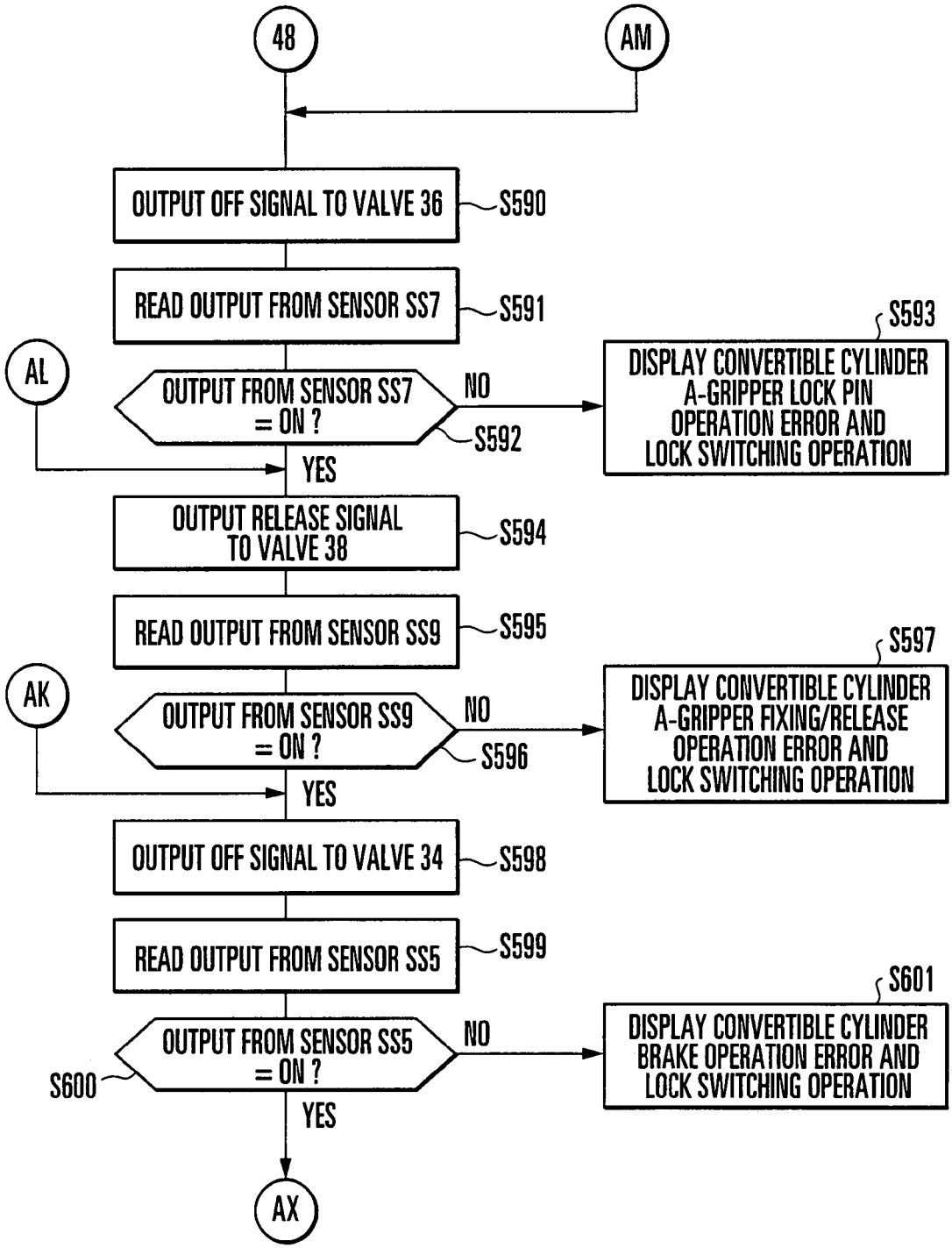

If the output from the convertible cylinder brake ON sensor SS4 is ON (YES in step S580), the CPU 10 outputs an ON signal to the convertible cylinder A-gripper lock pin ON/OFF air cylinder valve 36 (step S582) and reads the output from the convertible cylinder A-gripper lock pin ON sensor SS6 (step S583). If the output from the convertible cylinder A-gripper lock pin ON sensor SS6 is ON (YES in step S584), the CPU 10 outputs a fixing signal to the convertible cylinder A-gripper fixing/release air cylinder valve 38 (step S586) and reads the output from the convertible cylinder A-gripper fixing sensor SS8 (step S587). If the output from the convertible cylinder A-gripper fixing sensor SS8 is ON (YES in step S588), the CPU 10 outputs an OFF signal to the convertible cylinder A-gripper lock pin ON/OFF air cylinder valve 36 (FIG. 10H: step S590).

Figure 10I:
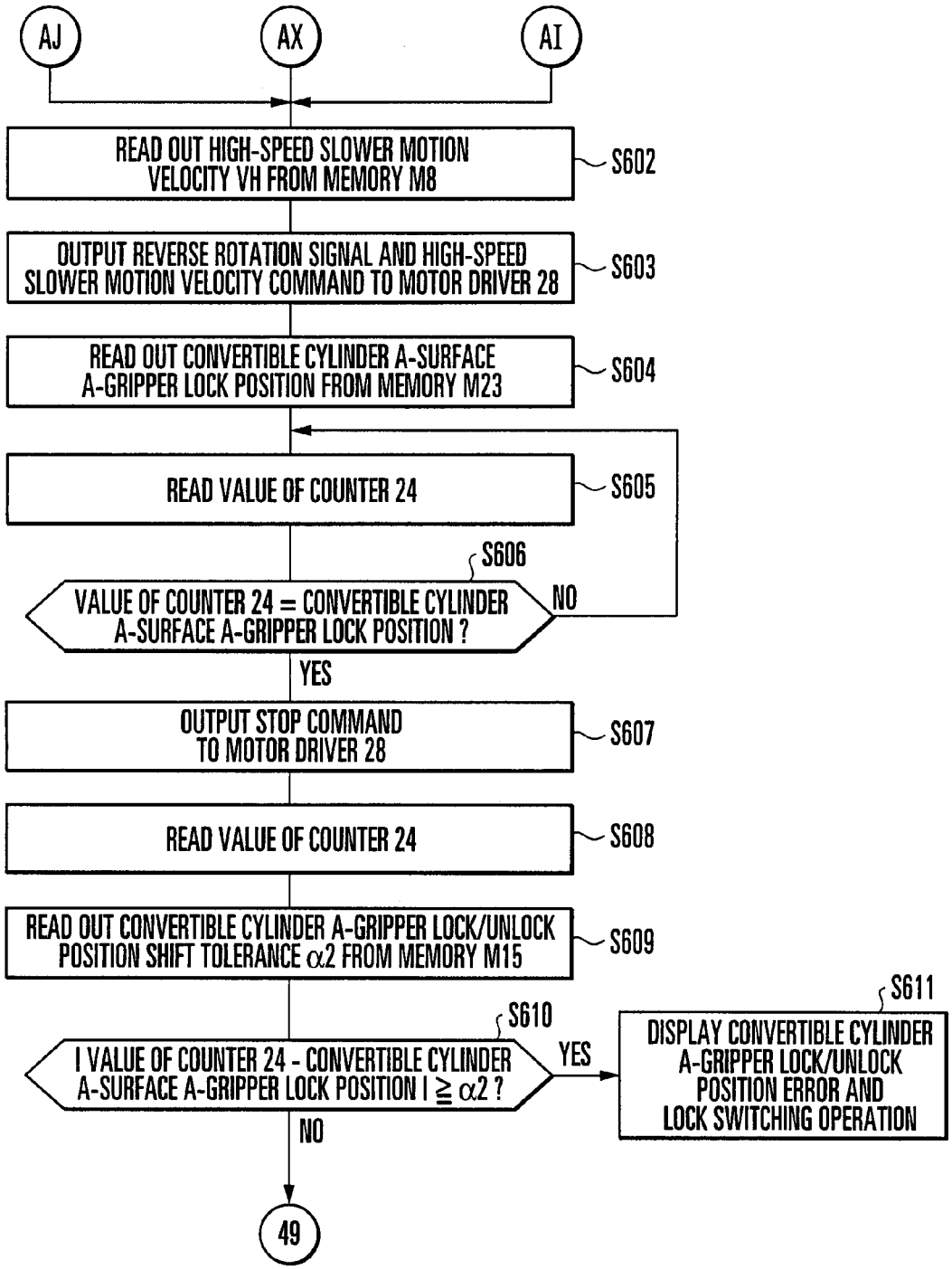
Figure 10J:
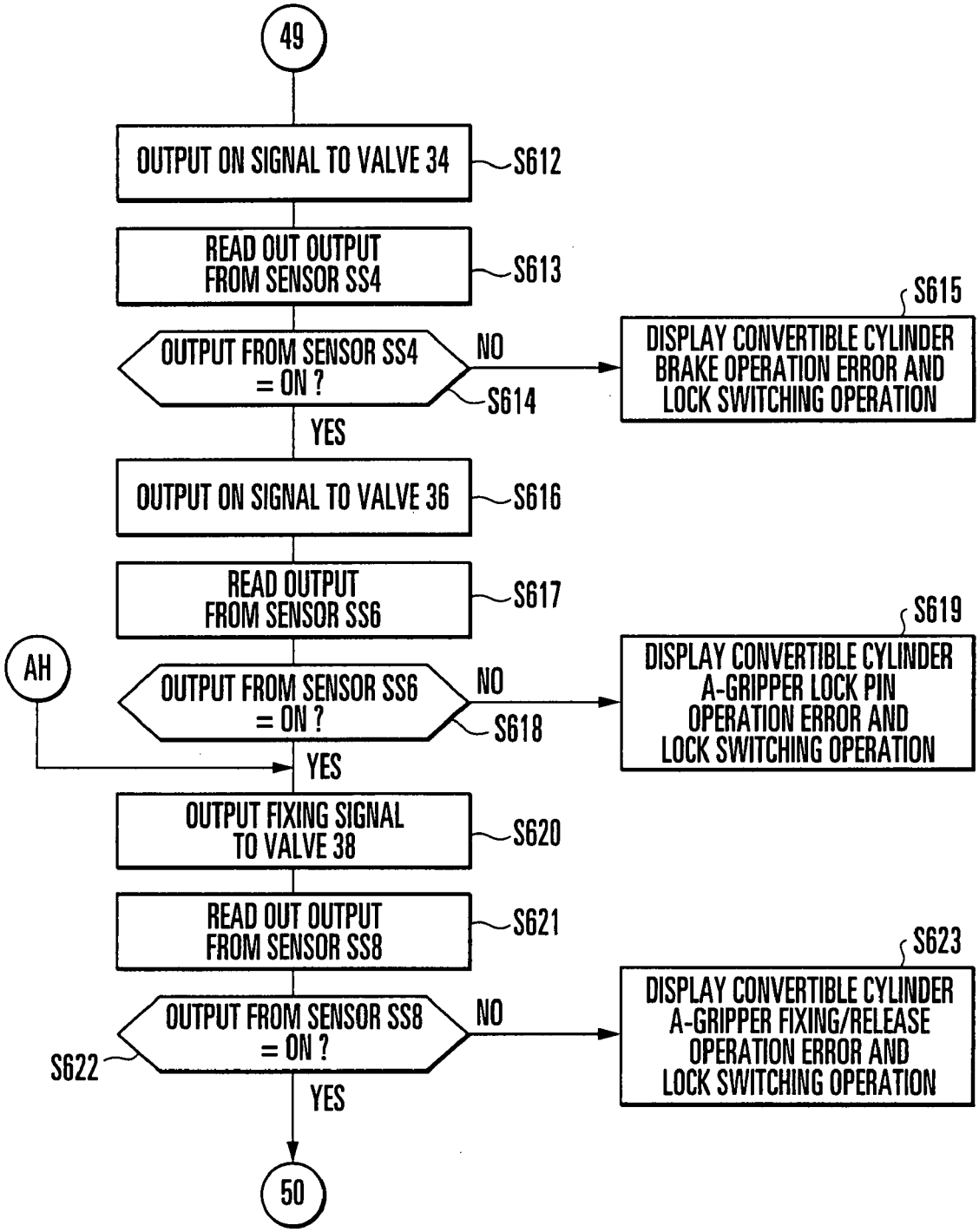

The CPU 10 reads the output from the convertible cylinder A-gripper lock pin OFF sensor SS7 (step S591). If the output from the convertible cylinder A-gripper lock pin OFF sensor SS7 is ON (YES in step S592), the CPU 10 outputs a release signal to the convertible cylinder A-gripper fixing/release air cylinder valve 38 (step S594) and reads the output from the convertible cylinder A-gripper release sensor SS9 (step S595). If the output from the convertible cylinder A-gripper release sensor SS9 is ON (YES in step S596), the CPU 10 outputs an OFF signal to the convertible cylinder brake ON/OFF air cylinder valve 34 (step S598) and reads the output from the convertible cylinder brake OFF sensor SS5 (step S599). If the output from the convertible cylinder brake OFF sensor SS5 is ON (YES in step S600), the CPU 10 rotates the auxiliary drive motor 26 in the reverse direction at the high-speed slower motion velocity VH (FIG. 10I: steps S602 and S603).

The CPU 10 reads out the convertible cylinder A-surface A-gripper lock position from the memory M23 (step S604). The auxiliary drive motor 26 continues to rotate until the value of the upstream cylinder position detection counter 24 equals the convertible cylinder A-surface A-gripper lock position (steps S605 and S606). If the value of the upstream cylinder position detection counter 24 equals the convertible cylinder A-surface A-gripper lock position (YES in step S606), the CPU 10 outputs a stop command to the motor driver 28 for the auxiliary drive motor (step S607) to stop rotating the auxiliary drive motor 26.

After the auxiliary drive motor 26 stops, the CPU 10 reads the value of the upstream cylinder position detection counter 24 (step S608) and reads out the convertible cylinder A-gripper lock/unlock position shift tolerance $\alpha 2$ from the memory M15 (step S609). If the absolute value of the difference between the value of the upstream cylinder position detection counter 24 and the convertible cylinder A-surface A-gripper lock position is smaller than the convertible cylinder A-gripper lock/unlock position shift tolerance $\alpha 2$ (NO in step S610), the CPU 10 outputs an ON signal to the convertible cylinder brake ON/OFF air cylinder valve 34 (FIG. 10J: step S612) and reads the output from the convertible cylinder brake ON sensor SS4 (step S613).

Figure 10K:
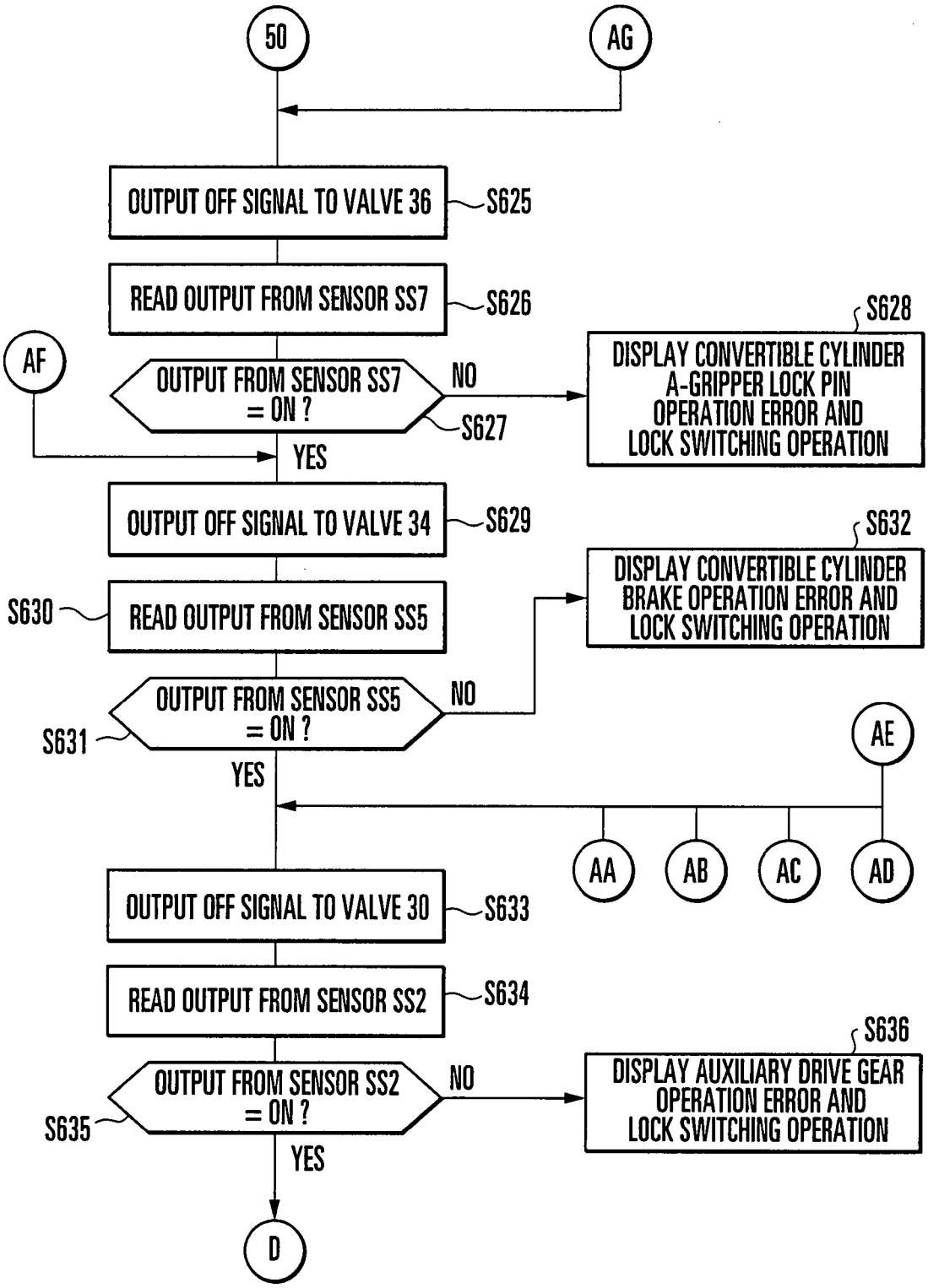

If the output from the convertible cylinder brake ON sensor SS4 is ON (YES in step S614), the CPU 10 outputs an ON signal to the convertible cylinder A-gripper lock pin ON/OFF air cylinder valve 36 (step S616) and reads the output from the convertible cylinder A-gripper lock pin ON sensor SS6 (step S617). If the output from the convertible cylinder A-gripper lock pin ON sensor SS6 is ON (YES in step S618), the CPU 10 outputs a fixing signal to the convertible cylinder A-gripper fixing/release air cylinder valve 38 (step S620) and reads the output from the convertible cylinder A-gripper fixing sensor SS8 (step S621). If the output from the convertible cylinder A-gripper fixing sensor SS8 is ON (YES in step S622), the CPU 10 outputs an OFF signal to the convertible cylinder A-gripper lock pin ON/OFF air cylinder valve 36 (FIG. 10K: step S625).

The CPU 10 reads the output from the convertible cylinder A-gripper lock pin OFF sensor SS7 (step S626). If the output from the convertible cylinder A-gripper lock pin OFF sensor SS7 is ON (YES in step S627), the CPU 10 outputs an OFF signal to the convertible cylinder brake ON/OFF air cylinder valve 34 (step S629) and reads the output from the convertible cylinder brake OFF sensor SS5 (step S630).

If the output from the convertible cylinder brake OFF sensor SS5 is ON (YES in step S631), the CPU 10 outputs an OFF signal to the auxiliary drive gear ON/OFF air cylinder valve 30 (step S633) and reads the output from the auxiliary drive gear OFF sensor SS2 (step S634). If the output from the auxiliary drive gear OFF sensor SS2 is ON (YES in step S635), the process returns to step S102 in the flowchart in FIG. 8A. The printing state of the printing press returns to the single-sided printing state (the state before the start of automatic switching).

In the above-described operation, if the absolute value of the difference between the value of the convertible cylinder position detection counter 32 and the convertible cylinder home position is equal to or larger than the convertible cylinder home position shift tolerance $\alpha 1$ in step S507 (FIG. 10A), the CPU 10 determines it as a convertible cylinder home position stop position error, displays it, and locks the switching operation (step S508). Similarly, upon determining an error in any other step, the CPU 10 displays it and locks the switching operation. In this case, the operator manually returns the mode to the single-sided printing state.

[Automatic Return from Other Single-Side Return Operation Steps]

A case wherein the memory M25 stores "1" has been described above. When the memory M25 stores "2", the CPU 10 starts automatic return from the single-side return operation step "R1-4" (FIG. 10C: step S524) to the single-sided printing state. When the memory M25 stores "3", the CPU 10 starts automatic return from the single-side return operation step "R1-5" (FIG. 10C: step S528) to the single-sided printing state. When the memory M25 stores "4" or "5", the CPU 10 starts automatic return from the single-side return operation step "R1-6" (FIG. 10C: step S532) to the single-sided printing state.

When the memory M25 stores "6", the CPU 10 starts automatic return from the single-side return operation step "R1-8" (FIG. 10E: step S551) to the single-sided printing state. When the memory M25 stores "7", the CPU 10 starts automatic return from the single-side return operation step "R1-10" (FIG. 10E: step S559) to the single-sided printing state. When the memory M25 stores "8", the CPU 10 starts automatic return from the single-side return operation step "R1-12" (FIG. 10F: step S567) to the single-sided printing state. When the memory M25 stores "9", the CPU 10 starts automatic return from the single-side return operation step "R1-15" (FIG. 10G: step S586) to the single-sided printing state. When the memory M25 stores "10", the CPU 10 starts automatic return from the single-side return operation step "R1-16" (FIG. 10H: step S590) to the single-sided printing state. When the memory M25 stores "11", the CPU 10 starts automatic return from the single-side return operation step "R1-17" (FIG. 10H: step S594) to the single-sided printing state.

When the memory M25 stores "12", the CPU 10 starts automatic return from the single-side return operation step "R1-18" (FIG. 10H: step S598) to the single-sided printing state. When the memory M25 stores "13" or "14", the CPU 10 starts automatic return from the single-side return operation step "R1-19" (FIG. 10I: step S602) to the single-sided printing state. When the memory M25 stores "15", the CPU 10 starts automatic return from the single-side return operation step "R1-22" (FIG. 10J: step S620) to the single-sided printing state. When the memory M25 stores "16", the CPU 10 starts automatic return from the single-side return operation step "R1-23" (FIG. 10K: step S625) to the single-sided printing state. When the memory M25 stores "17", the CPU 10 starts automatic return from the single-side return operation step "R1-24" (FIG. 10K: step S629) to the single-sided printing state. When the memory M25 stores "18", "19", "20", "21", or "22", the CPU 10 starts automatic return from the single-side return operation step "R1-25" (FIG. 10K: step S633) to the single-sided printing state.

When the memory M25 stores "101", "102", "103", "104", "105", or "106", the CPU 10 sets the single-side return operation step "R1-F" as the single-side return starting step and forcedly terminates automatic switching to the double-sided printing state in the order of "W gear ON", "release cam gear OFF", "suction head fixing", "suction head hook OFF", "convertible cylinder brake OFF", and "auxiliary drive gear OFF", instead of automatic return to the single-sided printing state.

Figure 10L:
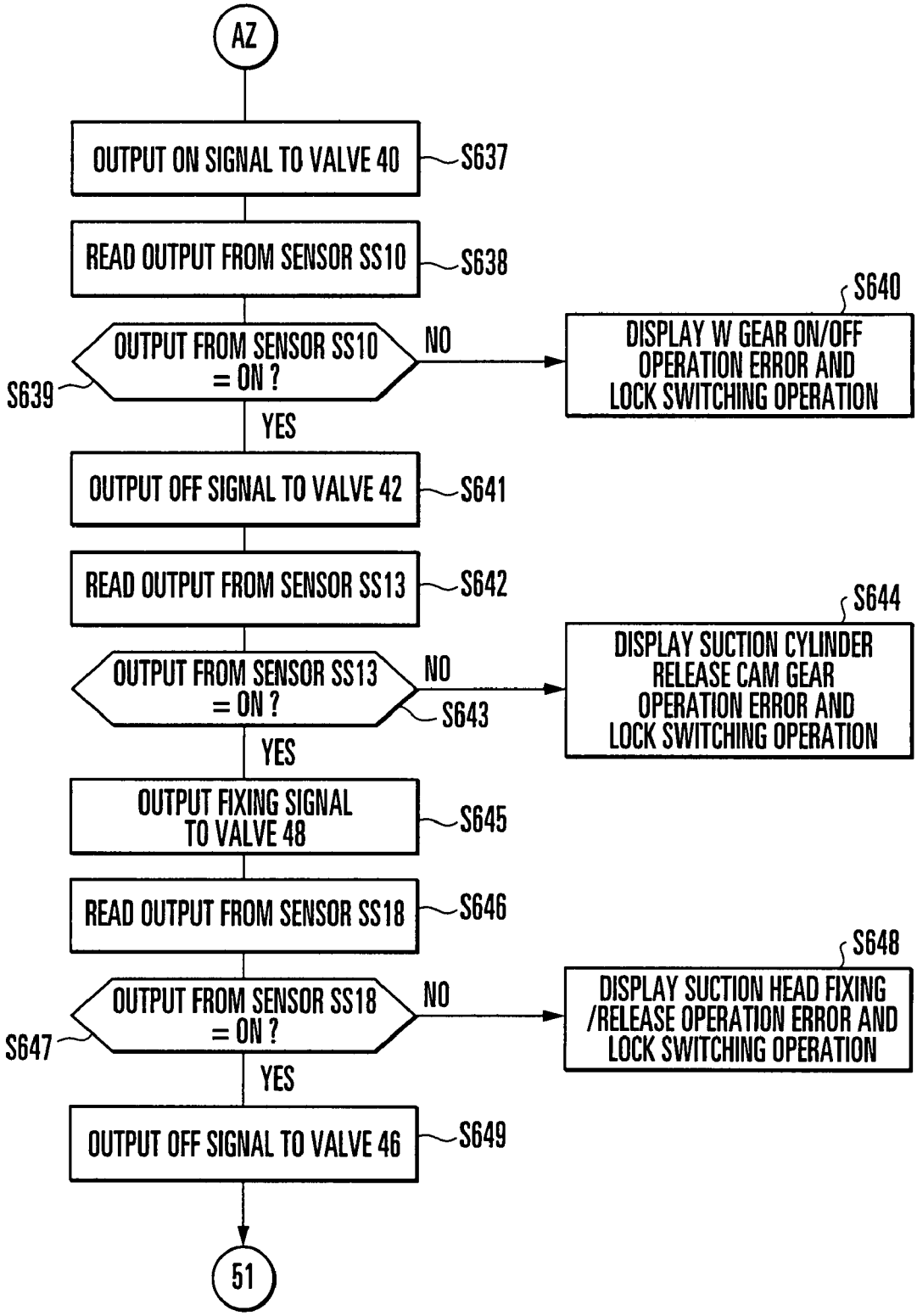
Figure 10M:
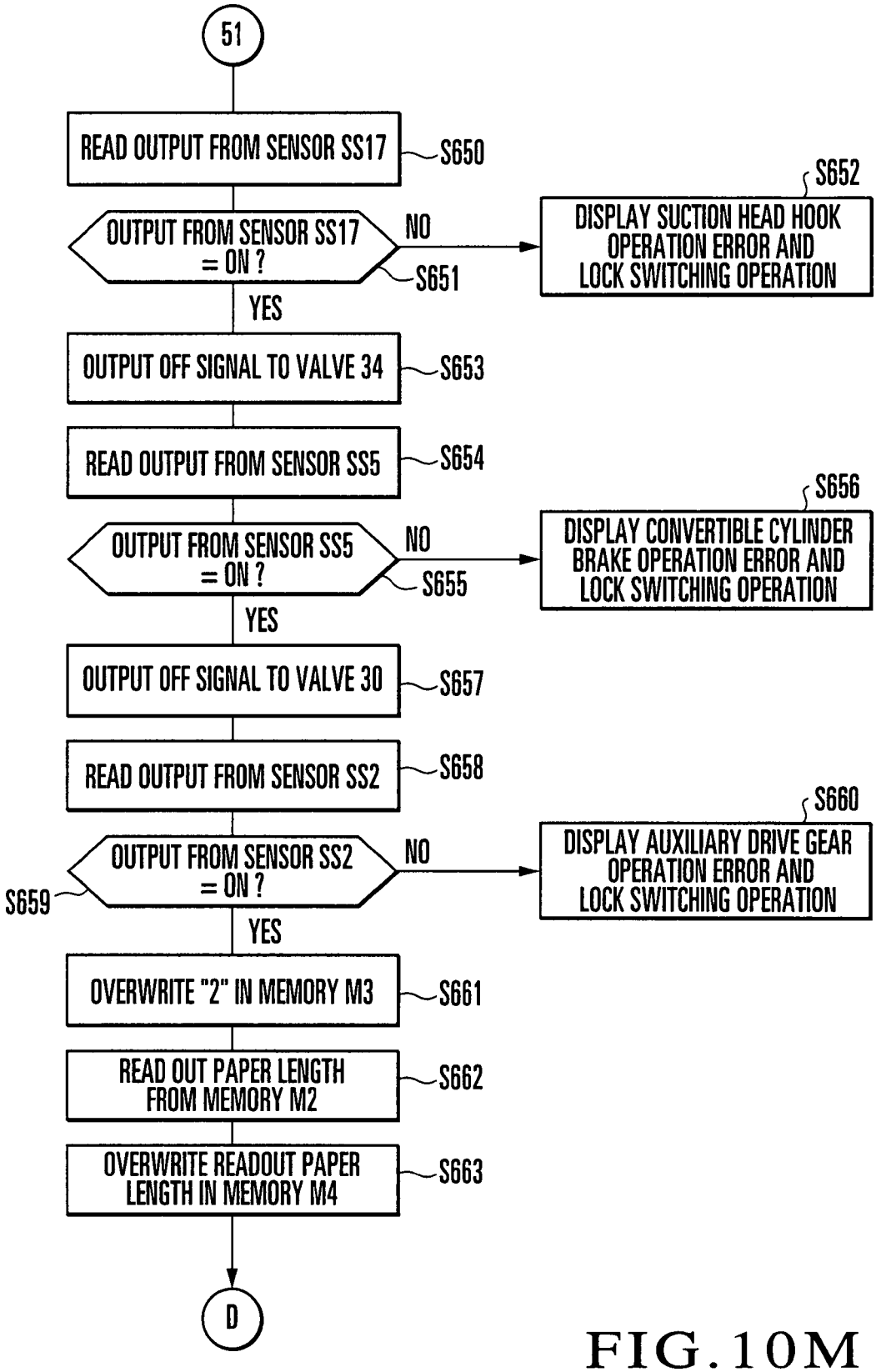

FIGS. 10L and 10M divisionally show the forced termination process during automatic switching from the single-side return operation step "R1-F" to the double-sided printing state. When the memory M25 stores "101", "102", "103", "104", "105", or "106", the CPU 10 advances to step S637 in the flowchart in FIG. 10L.

In this case, the CPU 10 outputs an ON signal to the W gear ON/OFF air cylinder valve 40 (step S637) and reads the output from the W gear ON sensor SS10 (step S638). If the output from the W gear ON sensor SS10 is ON (YES in step S639), the CPU 10 outputs an OFF signal to the suction cylinder release cam gear ON/OFF air cylinder valve 42 (step S641).

The CPU 10 reads the output from the suction cylinder release cam gear OFF sensor SS13 (step S642). If the output from the suction cylinder release cam gear OFF sensor SS13 is ON (YES in step S643), the CPU 10 outputs a fixing signal to the suction head fixing/release air cylinder valve 48 (step S645) and reads the output from the suction head fixing sensor SS18 (step S646). If the output from the suction head fixing sensor SS18 is ON (YES in step S647), the CPU 10 outputs an OFF signal to the suction head hook ON/OFF air cylinder valve 46 (step S649) and reads the output from the suction head hook OFF sensor SS17 (FIG. 10M: step S650).

If the output from the suction head hook OFF sensor SS17 is ON (YES in step S651), the CPU 10 outputs an OFF signal to the convertible cylinder brake ON/OFF air cylinder valve 34 (step S653) and reads the output from the convertible cylinder brake OFF sensor SS5 (step S645). If the output from the convertible cylinder brake OFF sensor SS5 is ON (YES in step S655), the CPU 10 outputs an OFF signal to the auxiliary drive gear ON/OFF air cylinder valve 30 (step S657) and reads the output from the auxiliary drive gear OFF sensor SS2 (step S658). If the output from the auxiliary drive gear OFF sensor SS2 is ON (YES in step S659), the CPU 10 rewrites the contents of the previous single-sided printing/double-sided printing memory M3 to "2" (step S661). The CPU 10 reads out the paper length L from the memory M2 (step S662) and rewrites the contents of the previous paper length memory M4 to the readout paper length L (step S663).

[Automatic Switching from Double-Sided Printing State to Single-Sided Printing State]

Assume that the current double-sided printing state should automatically switch to single-sided printing. In this case, the operator turns on the single-sided printing button 17 and then turns on the switching start switch 18. In this example, the length L of the paper sheet to be printed in single-sided printing is the same as in double-sided printing and is already written in the paper length memory M2.

When the operator turns on the switching start switch 18 (FIG. 8A: YES in step S108), the CPU 10 reads out the contents of the memory M1 (step S109). In this case, the CPU 10 reads out, from the memory M1, "1" written in step S107. Since NO in step S110 and YES in step S111, the CPU 10 advances to step S701 (FIG. 11A).

Automatic switching from the double-sided printing state to the single-sided printing state is done as in automatic switching from the single-sided printing state to the double-sided printing state. FIGS. 11A to 11Q show flowcharts corresponding to FIGS. 8B to 8T. Table 4 shows the relationship between switching steps in automatic switching from the double-sided printing state to the single-sided printing state and the error contents and error numbers in the switching operation. Table 5 shows the steps of a double-side return operation in automatic switching from the double-sided printing state to the single-sided printing state. Table 6 shows the termination sequence from the double-side return starting step to do single-side forced termination during automatic switching from the double-sided printing state to the single-sided printing state.

Figure 11A:
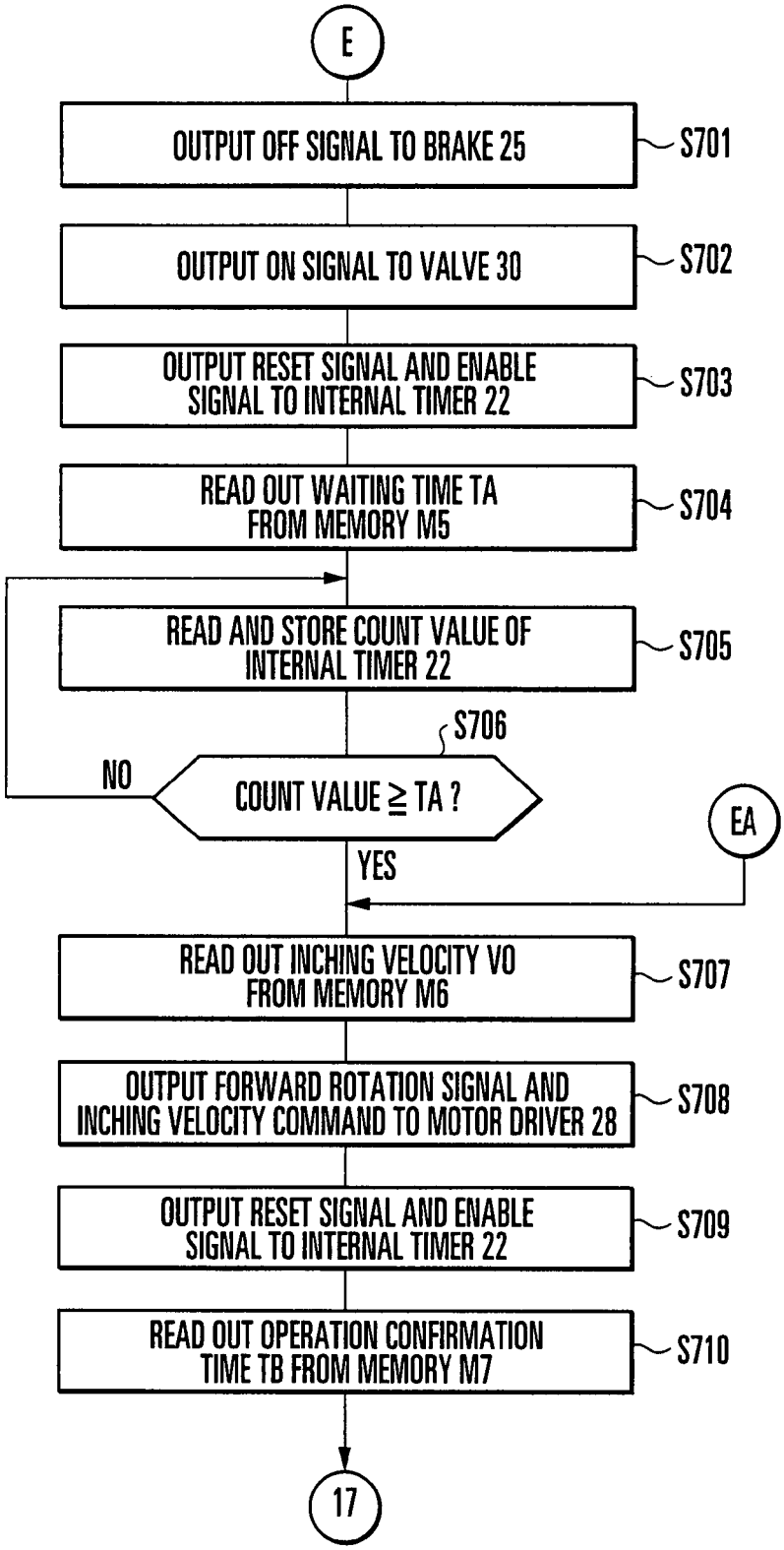
FIGS. 11A to 11Q are flowcharts for explaining an automatic switching operation from a double-sided printing state to a single-sided printing state and an abnormal end detection operation following FIG. 8A.
Figure 11B:
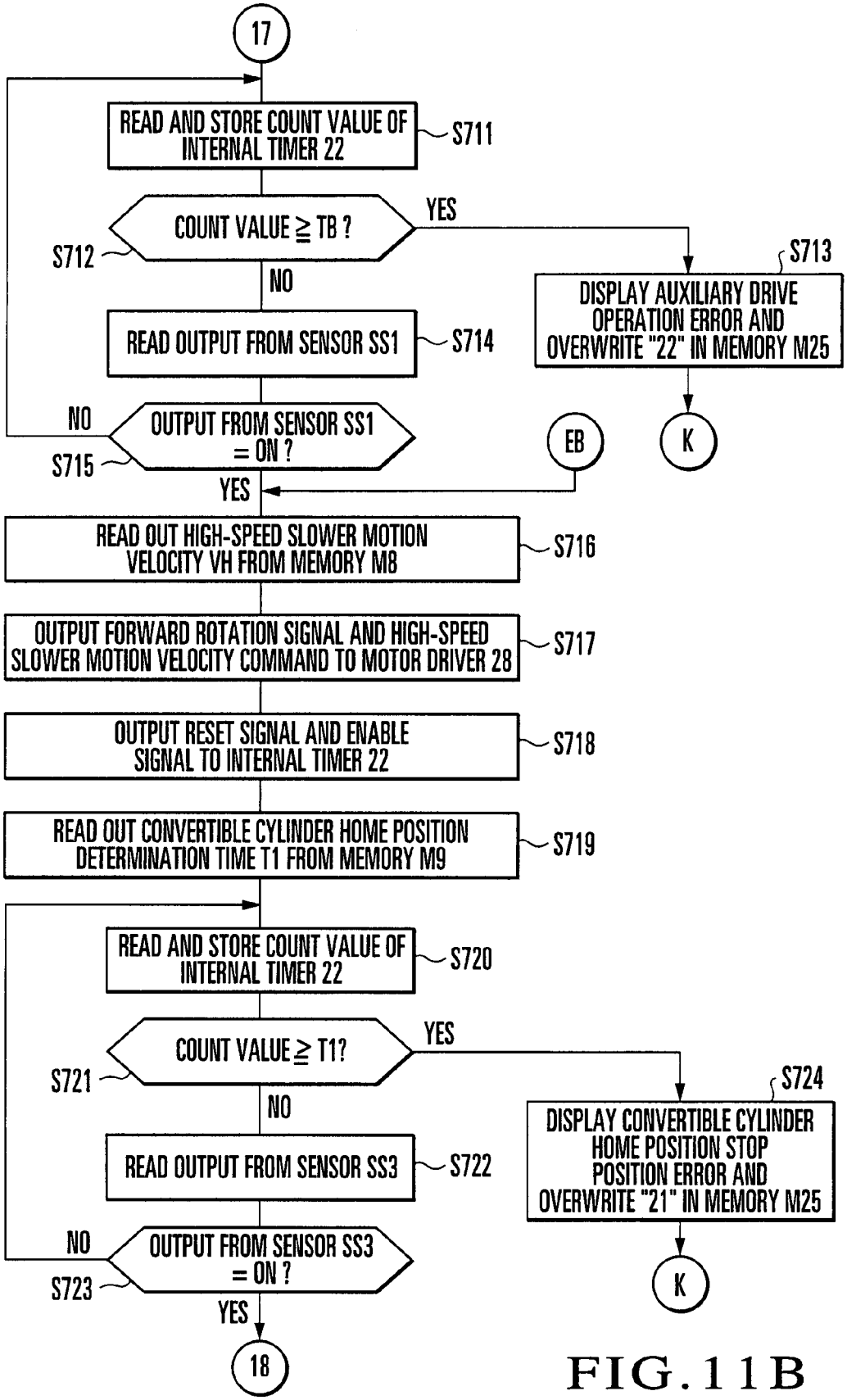
Figure 11C:
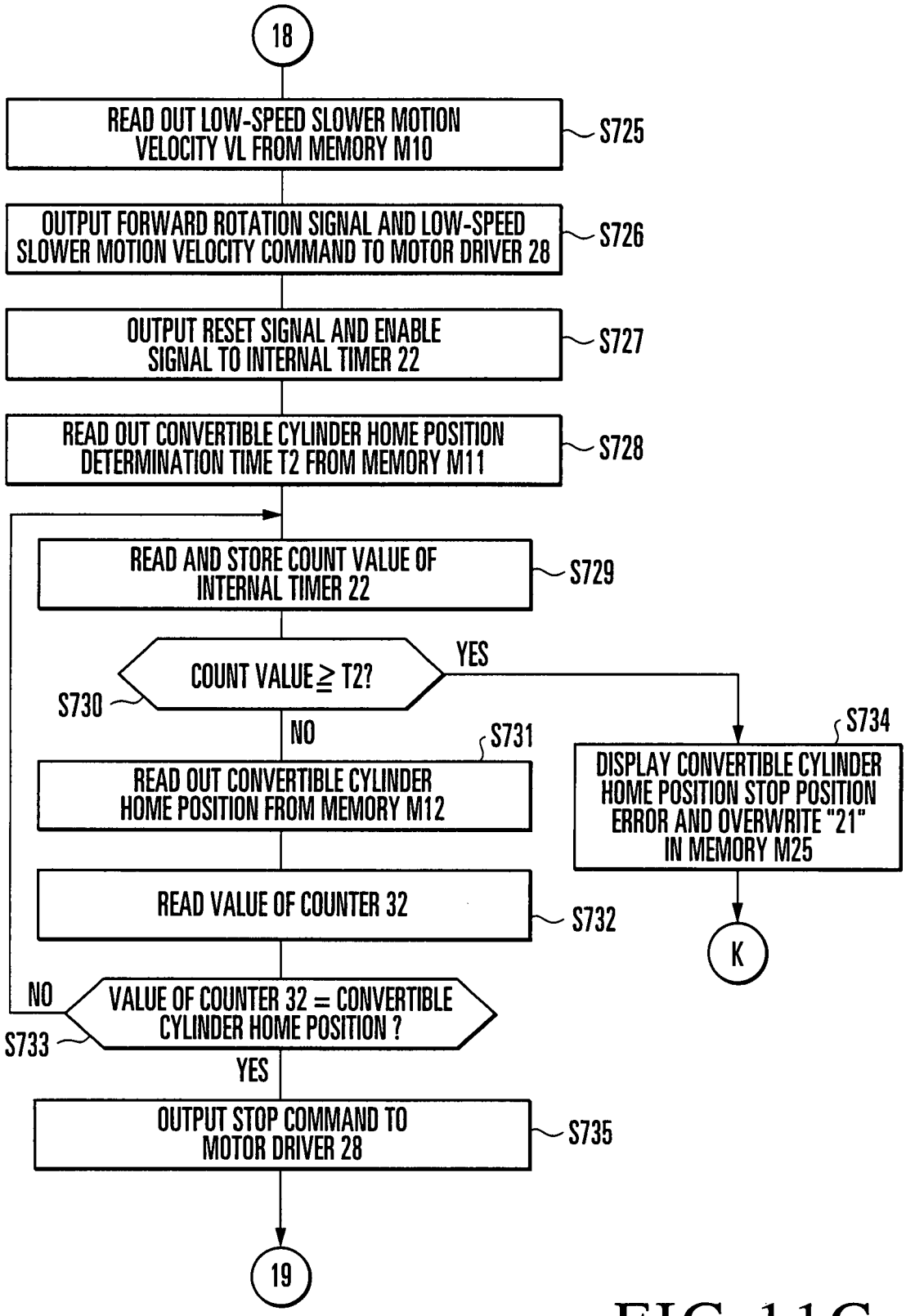

The process operation in steps S701 to S710 in FIG. 11A corresponds to the process operation in steps S118 to S127 in FIG. 8C. The process operation in steps S711 to S724 in FIG. 11B corresponds to the process operation in steps S128 to S141 in FIGS. 8C and 8D. The process operation in steps S725 to S735 in FIG. 11C corresponds to the process operation in steps S142 to S152 in FIGS. 8D and 8E. The process operation in steps S736 to S743 in FIG. 11D corresponds to the process operation in steps S153 to S160 in FIGS. 8E and 8F.

Figure 11D:
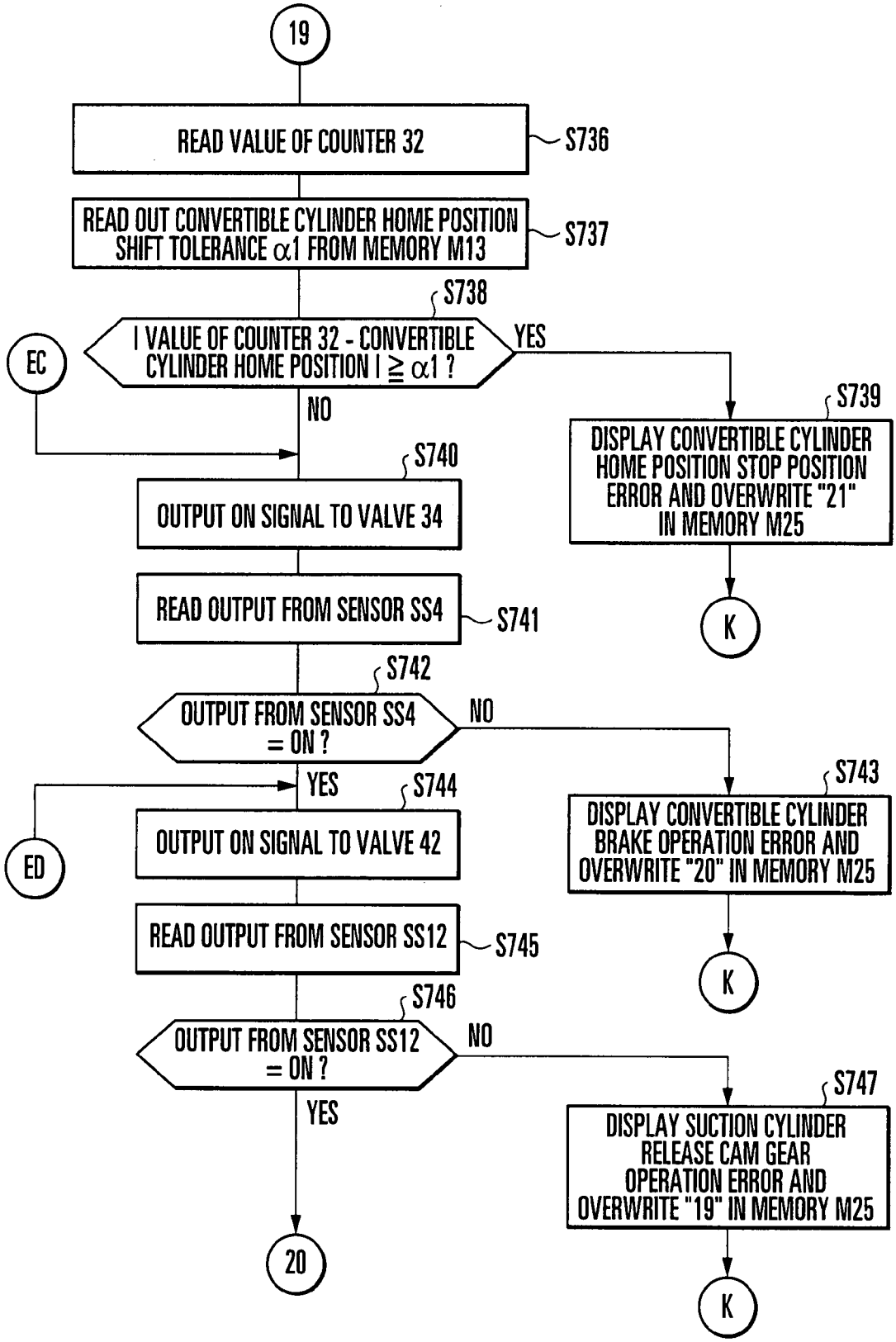
Figure 11E:
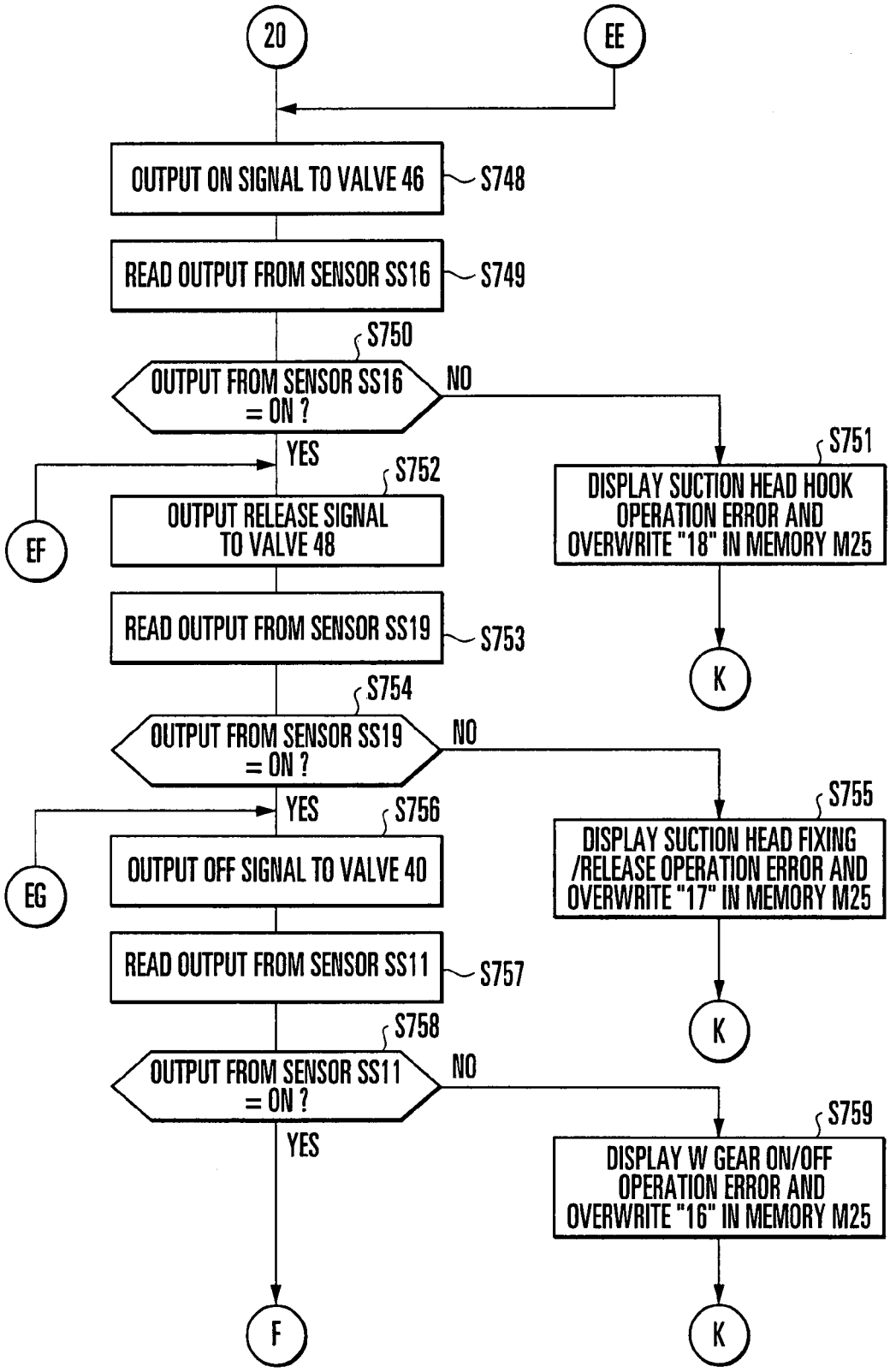
Figure 11F:
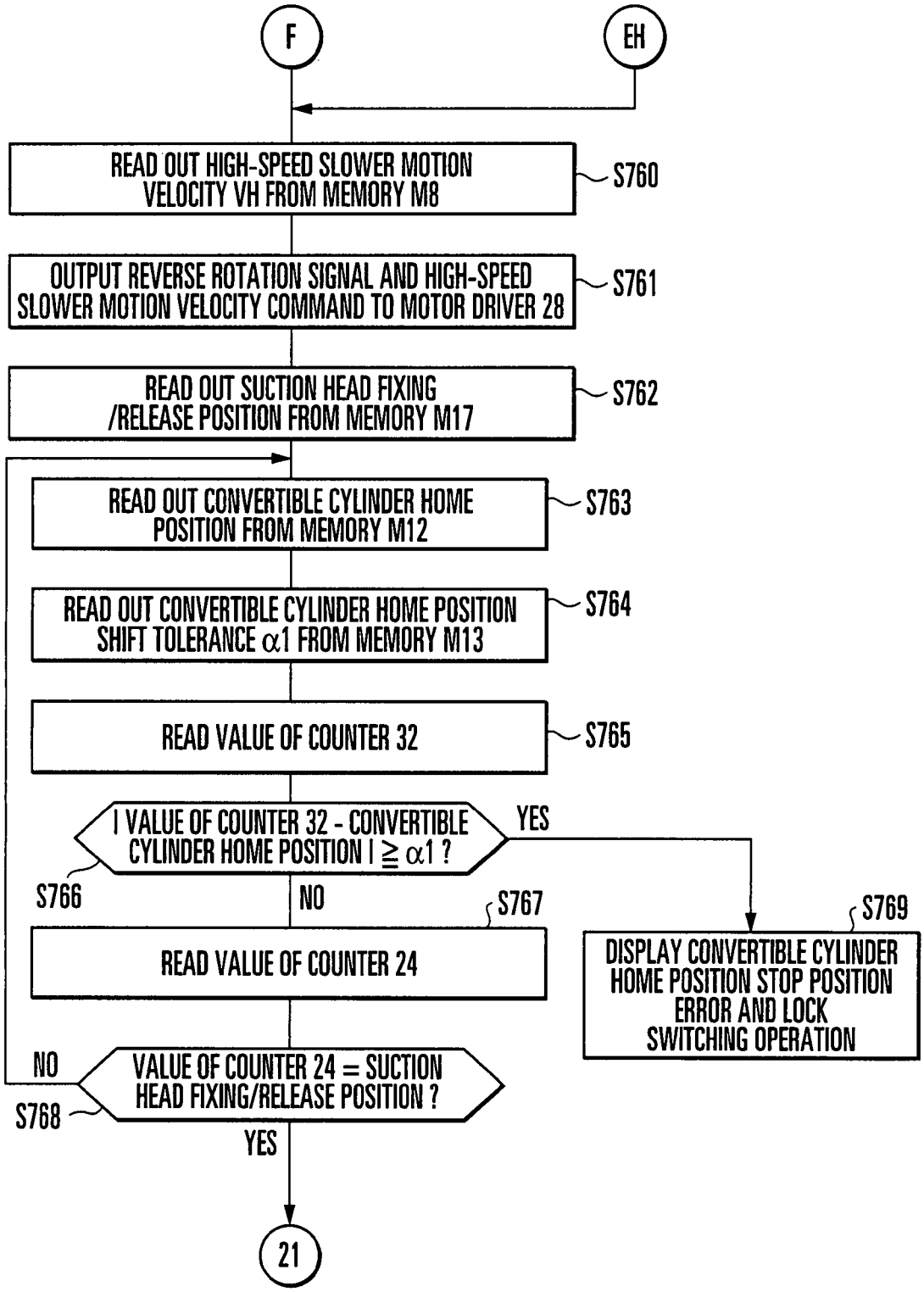

The process operation in steps S744 to S747 in FIG. 11D corresponds to the process operation in steps S261 to S264 in FIG. 8N. The process operation in steps S748 to S755 in FIG. 11E corresponds to the process operation in steps S285 to S292 in FIGS. 8P and 8Q. The process operation in steps S756 to S759 in FIG. 11E corresponds to the process operation in steps S257 to S260 in FIG. 8N. The process operation in steps S760 to S769 in FIG. 11F corresponds to the process operation in steps S265 to S274 in FIG. 8O.

Figure 11G:
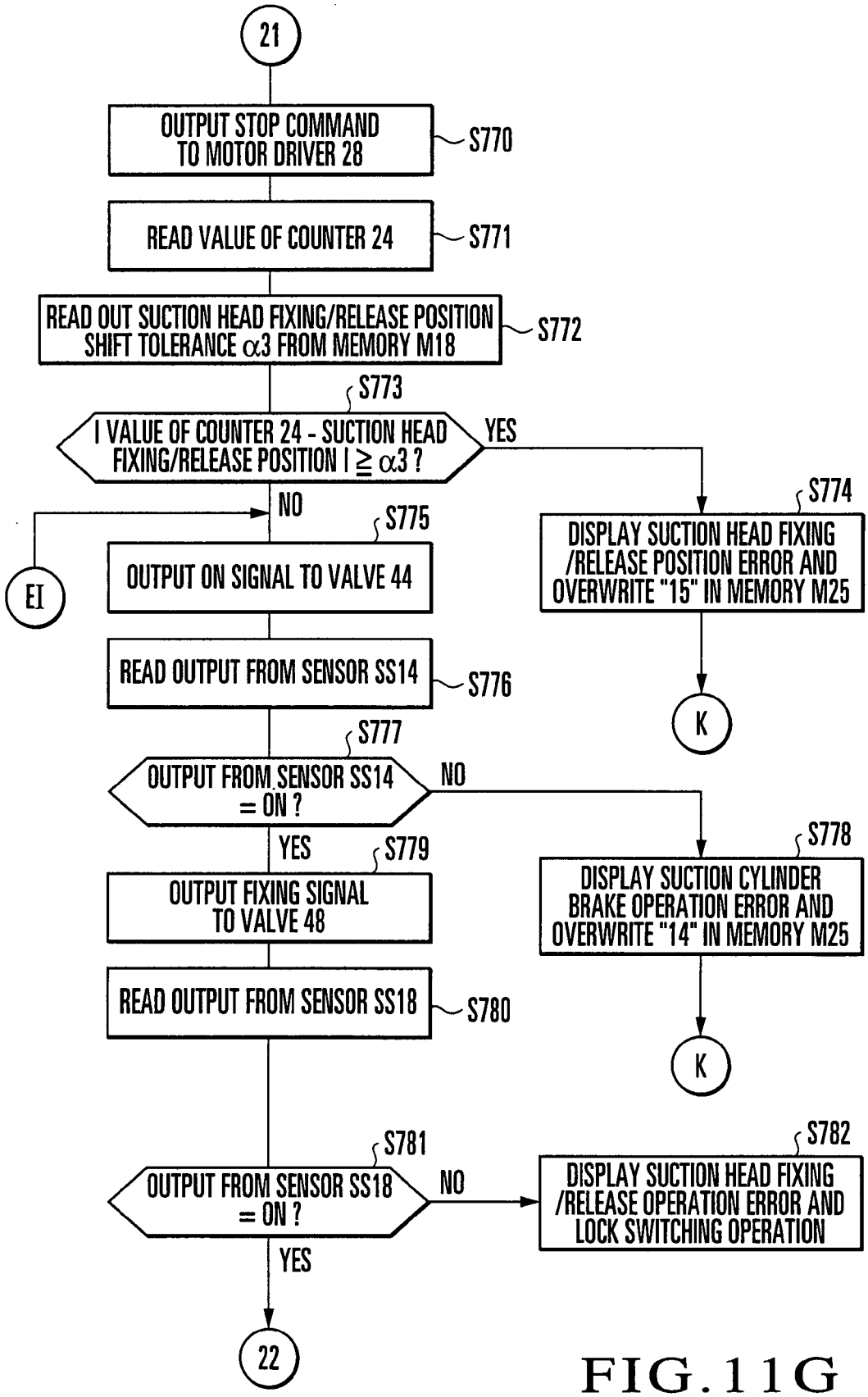

The process operation in steps S770 to S778 in FIG. 11G corresponds to the process operation in steps S275 to S284 in FIGS. 8O and 8P. The process operation in steps S779 to S782 in FIG. 11G corresponds to the process operation in steps S322 to S325 in FIG. 8S. In step S782, the CPU 10 locks the switching operation. The process operation in steps S783 to S786 in FIG. 11H corresponds to the process operation in steps S326 to S329 in FIG. 8T. In step S786, the CPU 10 locks the switching operation.

Figure 8Q:
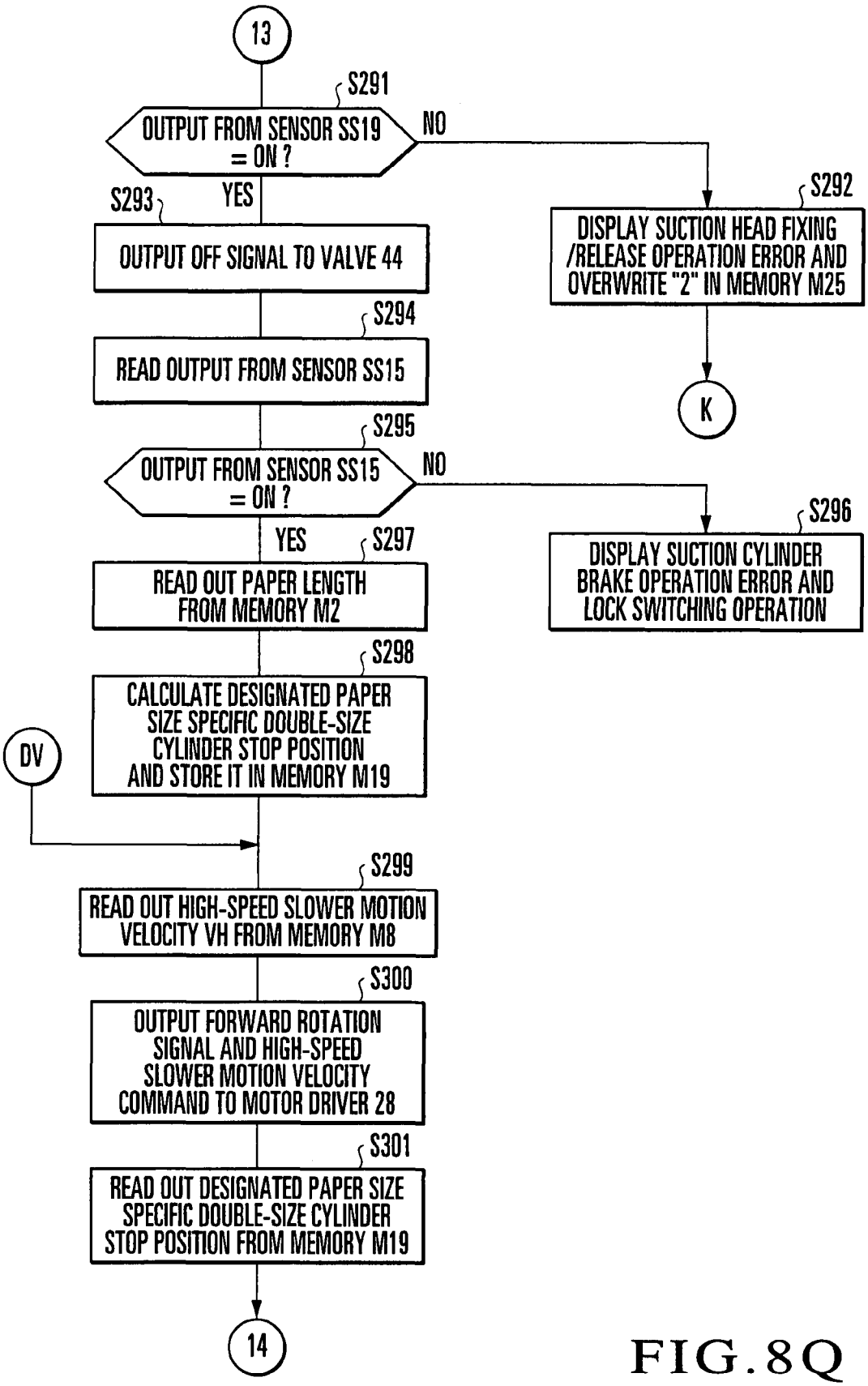
Figure 8R:
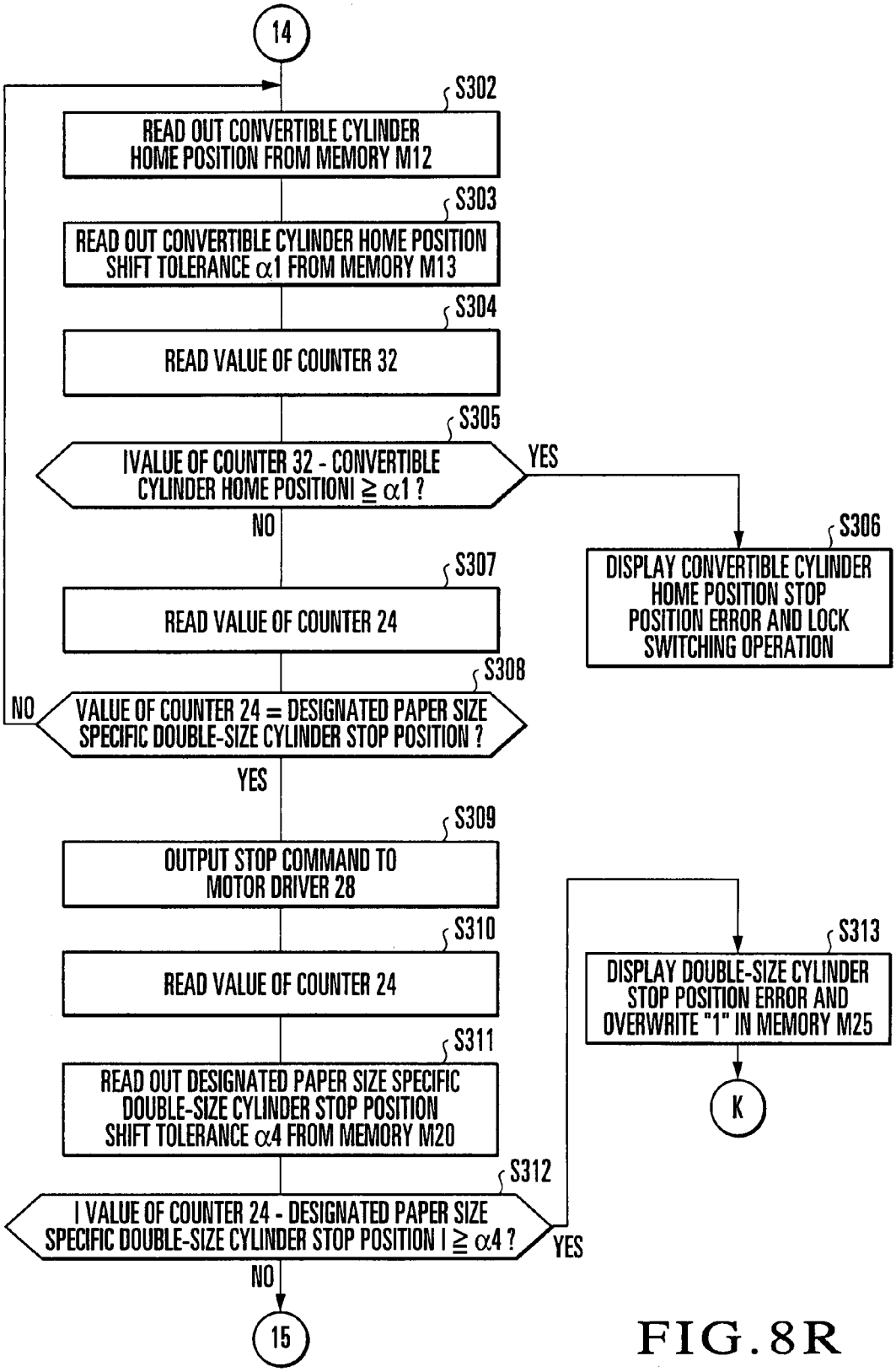
Figure 11H:
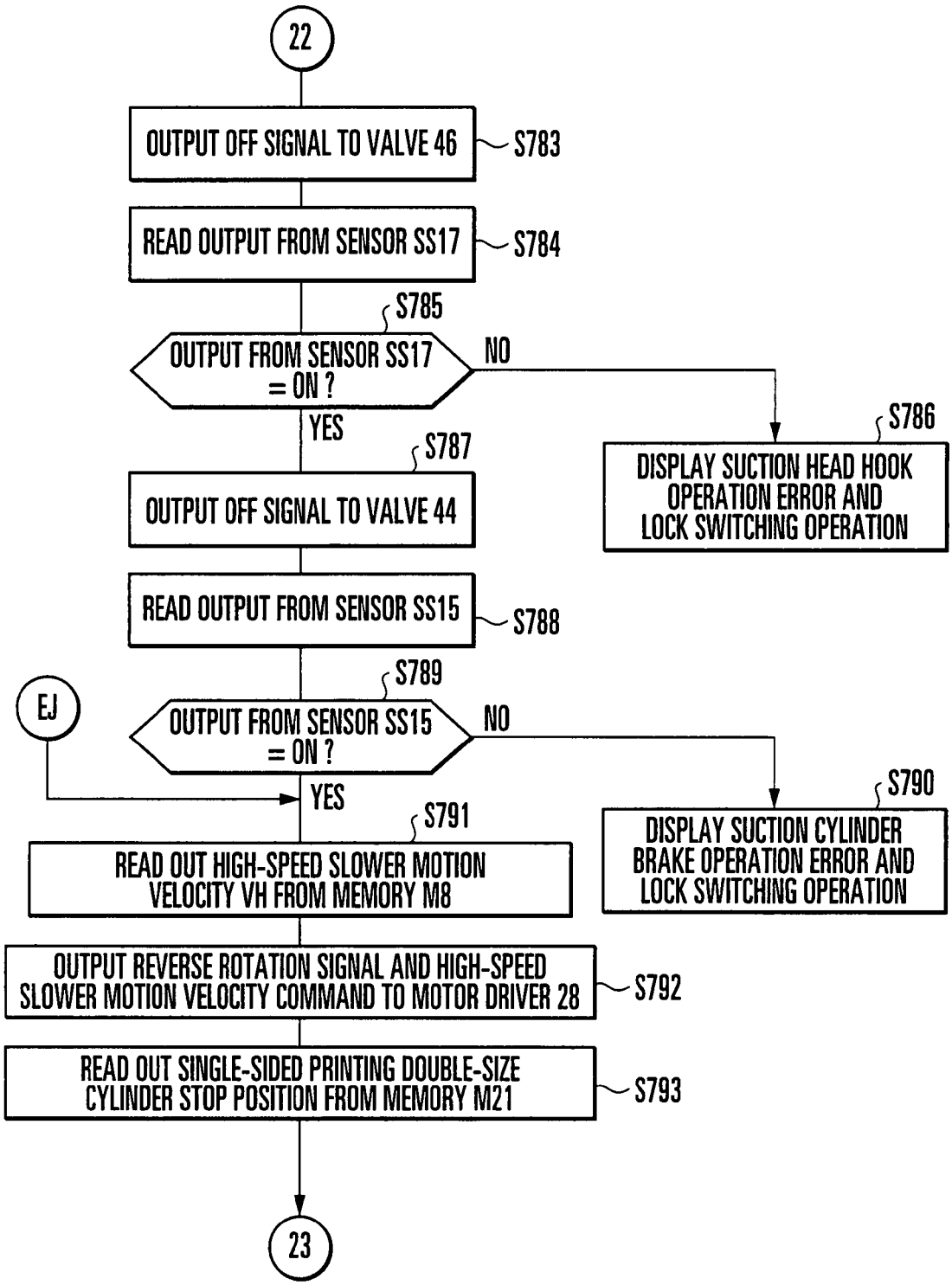

The process operation in steps S787 to S790 in FIG. 11H corresponds to the process operation in steps S293 to S296 in FIG. 8Q. The process operation in steps S791 to S809 in FIGS. 11H to 11J corresponds to the process operation in steps S265 to S284 in FIGS. 8O and 8P. In step S793, the CPU 10 reads out the single-sided printing double-size cylinder stop position from the memory M21. In step S800, the CPU 10 compares the value of the upstream cylinder position detection counter 24 with the single-sided printing double-size cylinder stop position. In step S803, the CPU 10 reads out the single-sided printing double-size cylinder stop position shift tolerance $\alpha 5$ from the memory M22. In step S804, the CPU 10 compares the absolute value of the difference between the value of the upstream cylinder position detection counter 24 and the single-sided printing double-size cylinder stop position with the single-sided printing double-size cylinder stop position shift tolerance $\alpha 5$.

Figure 8S:
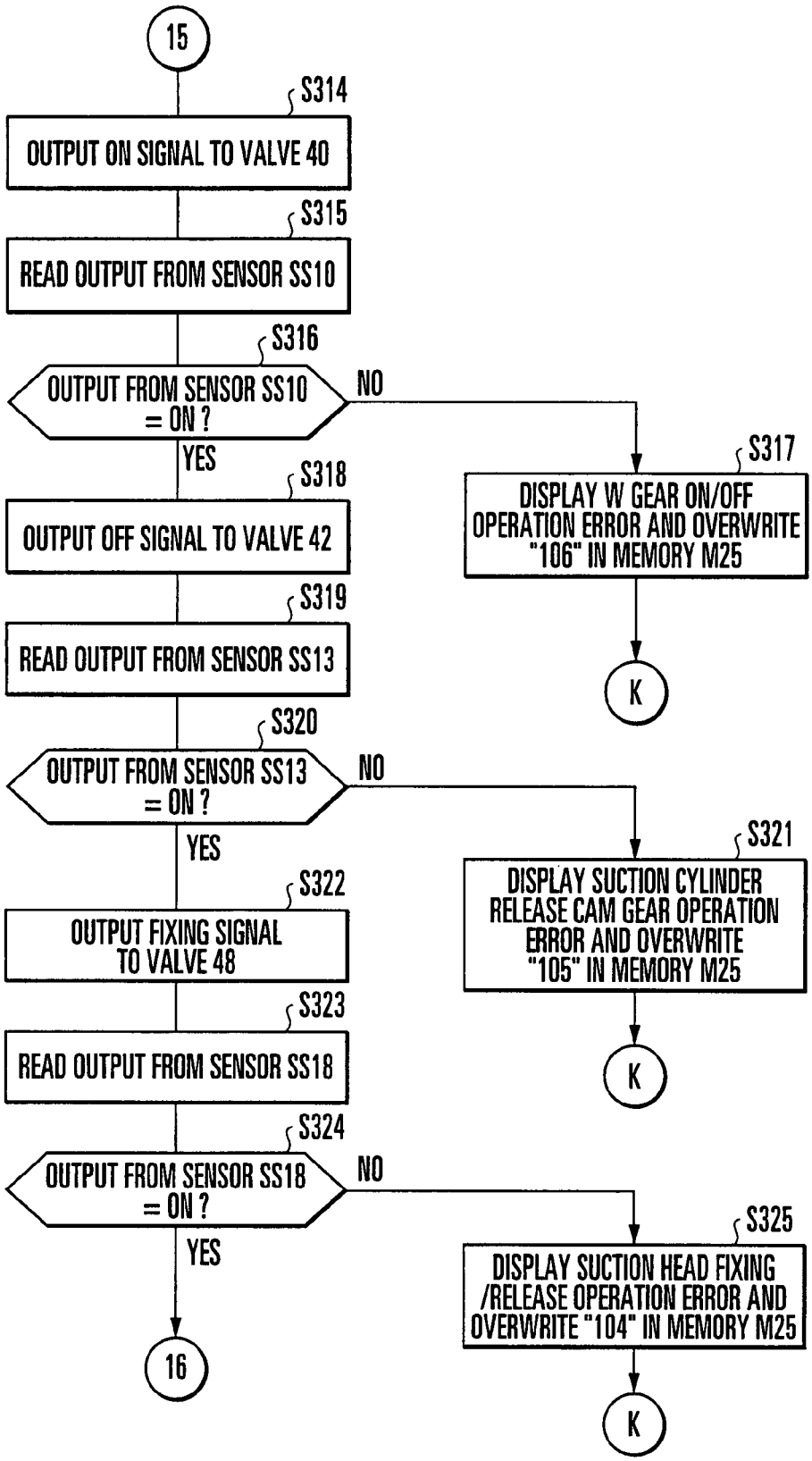
Figure 8T:
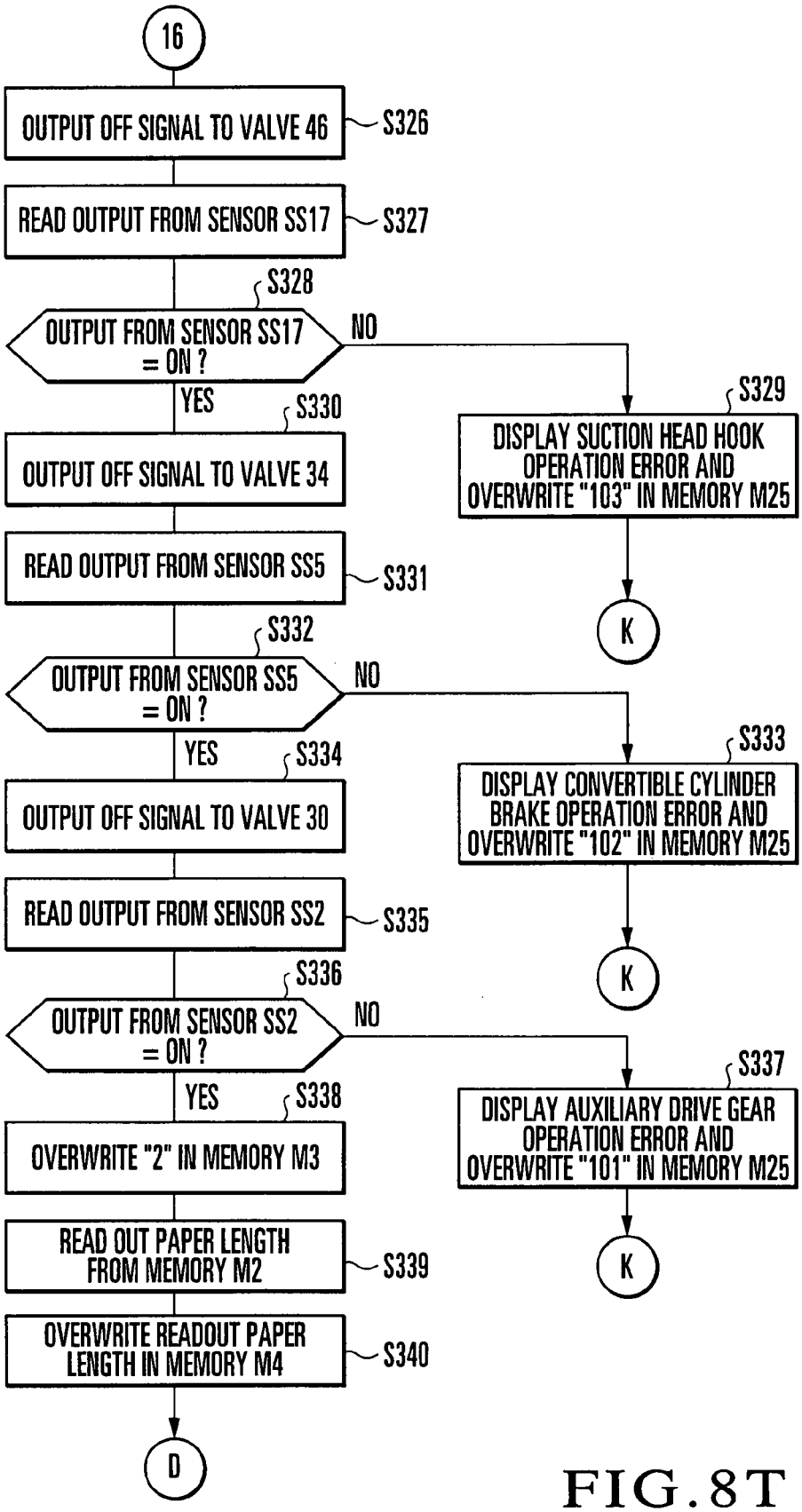
Figure 11I:
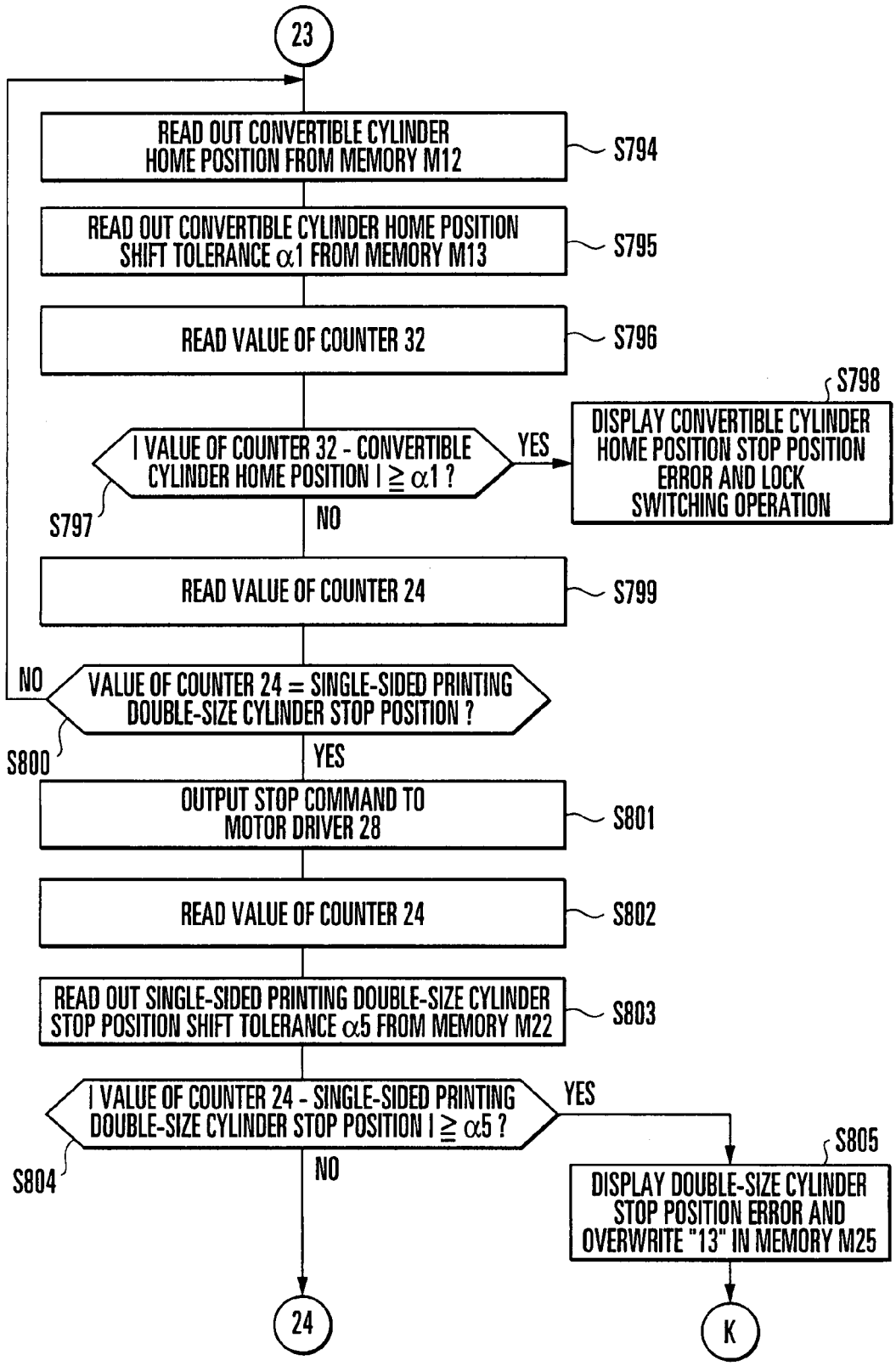
Figure 11J:
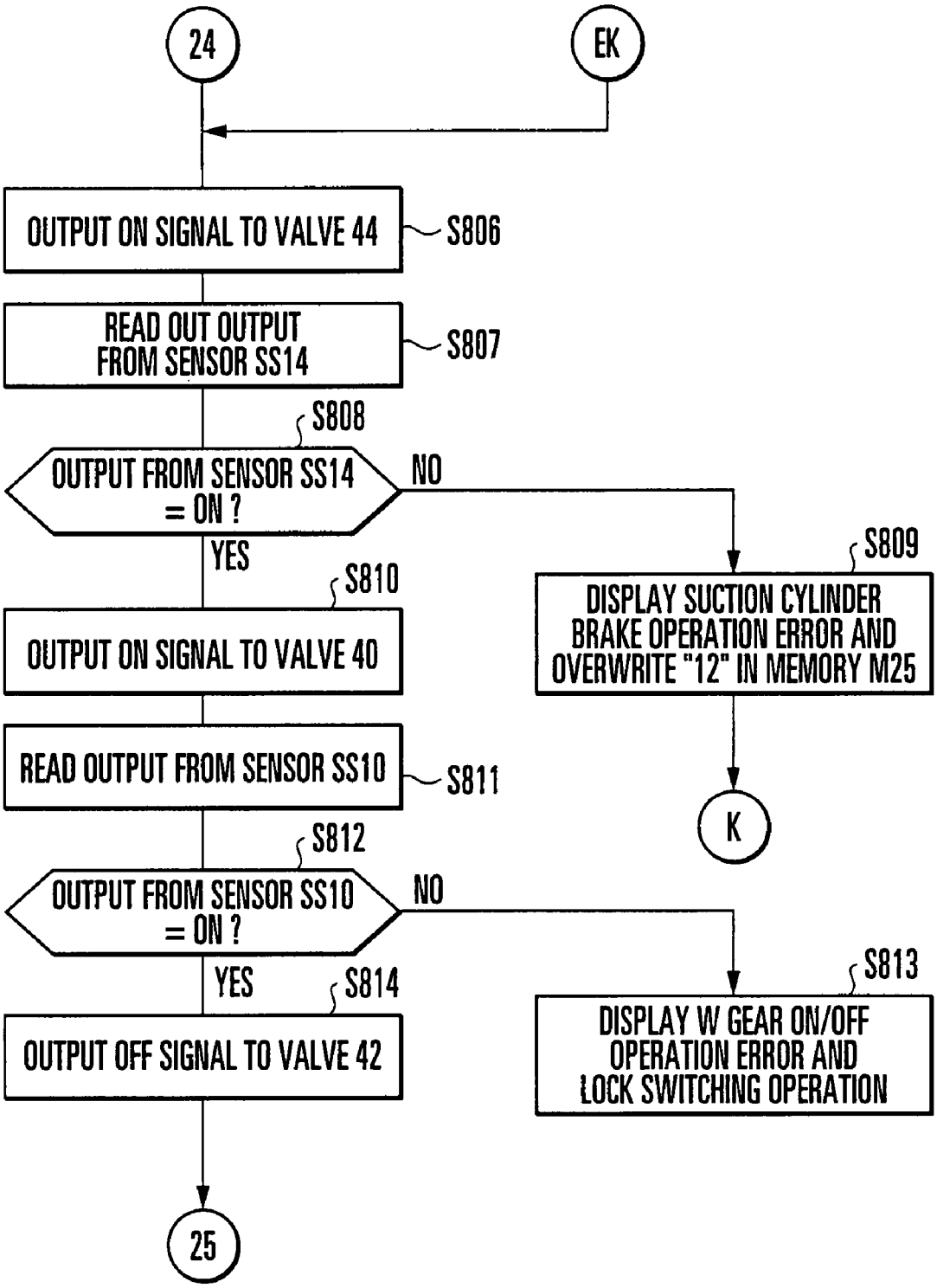
Figure 11K:
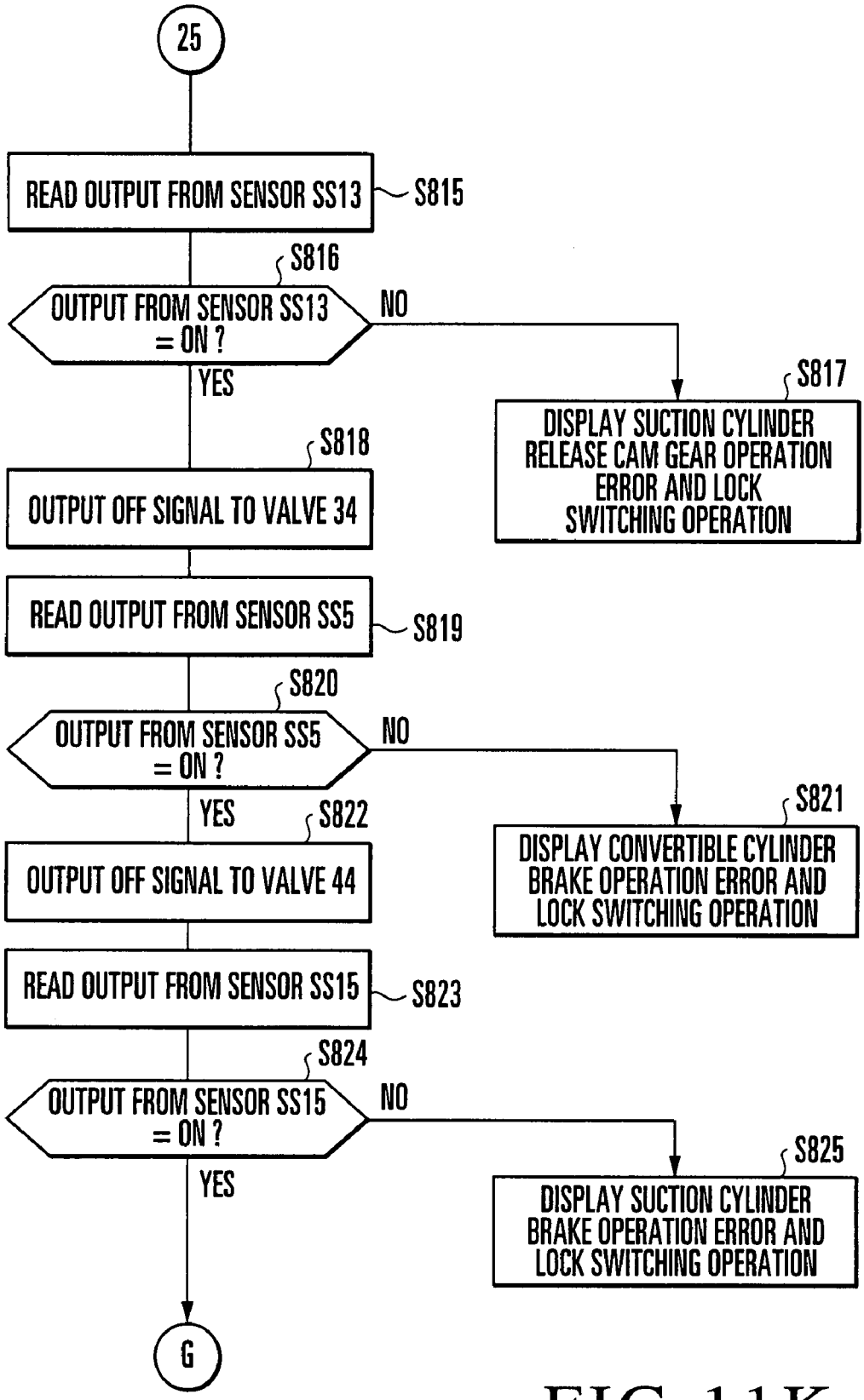

The process operation in steps S810 to S817 in FIGS. 11I and 11K corresponds to the process operation in steps S314 to S321 in FIGS. 8S and 8T. In steps S813 and S817, the switching operation is locked. The process operation in steps S818 to S821 in FIG. 11K corresponds to the process operation in steps S330 to S333 in FIG. 8T. In step S821, the switching operation is locked. The process operation in steps S822 to S825 in FIG. 11K corresponds to the process operation in steps S293 to S296 in FIG. 8Q.

The process operation in steps S826 to S889 in FIGS. 11L to 11Q corresponds to the process operation in steps S165 to S228 in FIGS. 8F to 8K. In step S828, the CPU 10 reads out the convertible cylinder A-surface A-gripper lock position from the memory M23. In step S830, the CPU 10 compares the value of the upstream cylinder position detection counter 24 with the convertible cylinder A-surface A-gripper lock position. In step S834, the CPU 10 compares the absolute value of the difference between the value of the upstream cylinder position detection counter 24 and the convertible cylinder A-surface A-gripper lock position with the convertible cylinder A-gripper lock/unlock position shift tolerance $\alpha 2$. In step S844, the CPU 10 outputs a fixing signal to the convertible cylinder A-gripper fixing/release air cylinder valve 38. In step S845, the CPU 10 reads the output from the convertible cylinder A-gripper fixing sensor SS8. In step S846, the CPU 10 confirms the output from the convertible cylinder A-gripper fixing sensor SS8.

In step S858, the CPU 10 reads out the convertible cylinder B-surface A-gripper lock position from the memory M24. In step S860, the CPU 10 compares the value of the upstream cylinder position detection counter 24 with the convertible cylinder B-surface A-gripper lock position. In step S864, the CPU 10 compares the absolute value of the difference between the value of the upstream cylinder position detection counter 24 and the convertible cylinder B-surface A-gripper lock position with the convertible cylinder A-gripper lock/unlock position shift tolerance a2. In step S870, the CPU 10 outputs a release signal to the convertible cylinder A-gripper fixing/release air cylinder valve 38. In step S871, the CPU 10 reads the output from the convertible cylinder A-gripper release sensor SS9. In step S872, the CPU 10 confirms the output from the convertible cylinder A-gripper release sensor SS9. In step S878, the CPU 10 outputs a fixing signal to the convertible cylinder A-gripper fixing/release air cylinder valve 38. In step S879, the CPU 10 reads the output from the convertible cylinder A-gripper fixing sensor SS8. In step S880, the CPU 10 confirms the output from the convertible cylinder A-gripper fixing sensor SS8.

The process operation in steps S890 to S893 in FIG. 11Q corresponds to the process operation in steps S334 to S338 in FIG. 8T. In step S894, the CPU 10 overwrites "1" in the previous single-sided printing/double-sided printing memory M3.

[Error Recovery During Automatic Switching from Double-Sided Printing State to Single-Sided Printing State]

If an error is displayed during the automatic switching from the double-sided printing state to the single-sided printing state, the operator turns on the error recovery switch 19. When the error recovery switch 19 is turned on (FIG. 9A: YES in step S341), the CPU 10 turns off the error display (step S342), reads out the contents of the single-sided printing/double-sided printing memory M1 (step S343), and checks the contents of the memory M1 (step S344).

In this case, the memory M1 stores "1". Since NO in step S344, the process advances to step S900A (FIG. 12A) to read out the contents of the error step memory M25.

[Error in Switching Step 31 and Switching Step 24]

If the memory M25 stores "1" (YES in step S900), indicating an abnormal end of "switching step 31", the CPU 10 outputs an ON signal to the convertible cylinder A-gripper lock pin ON/OFF air cylinder valve 36 (step S901) to eliminate the error in "switching step 31". If the memory M25 stores "7", indicating an abnormal end of "switching step 24", the CPU 10 eliminates the error in "switching step 24" in a similar way.

[Error in Switching Step 30 and Switching Step 23]

If the memory M25 stores "2" (YES in step S905), indicating an abnormal end of "switching step 30", the CPU 10 outputs a release signal to the convertible cylinder A-gripper fixing/release air cylinder valve 38 (step S906) to eliminate the error in "switching step 30". If the memory M25 stores "8", indicating an abnormal end of "switching step 23", the CPU 10 eliminates the error in "switching step 23" in a similar way.

[Error in Switching Step 29 and Switching Step 22]

Figure 12A:
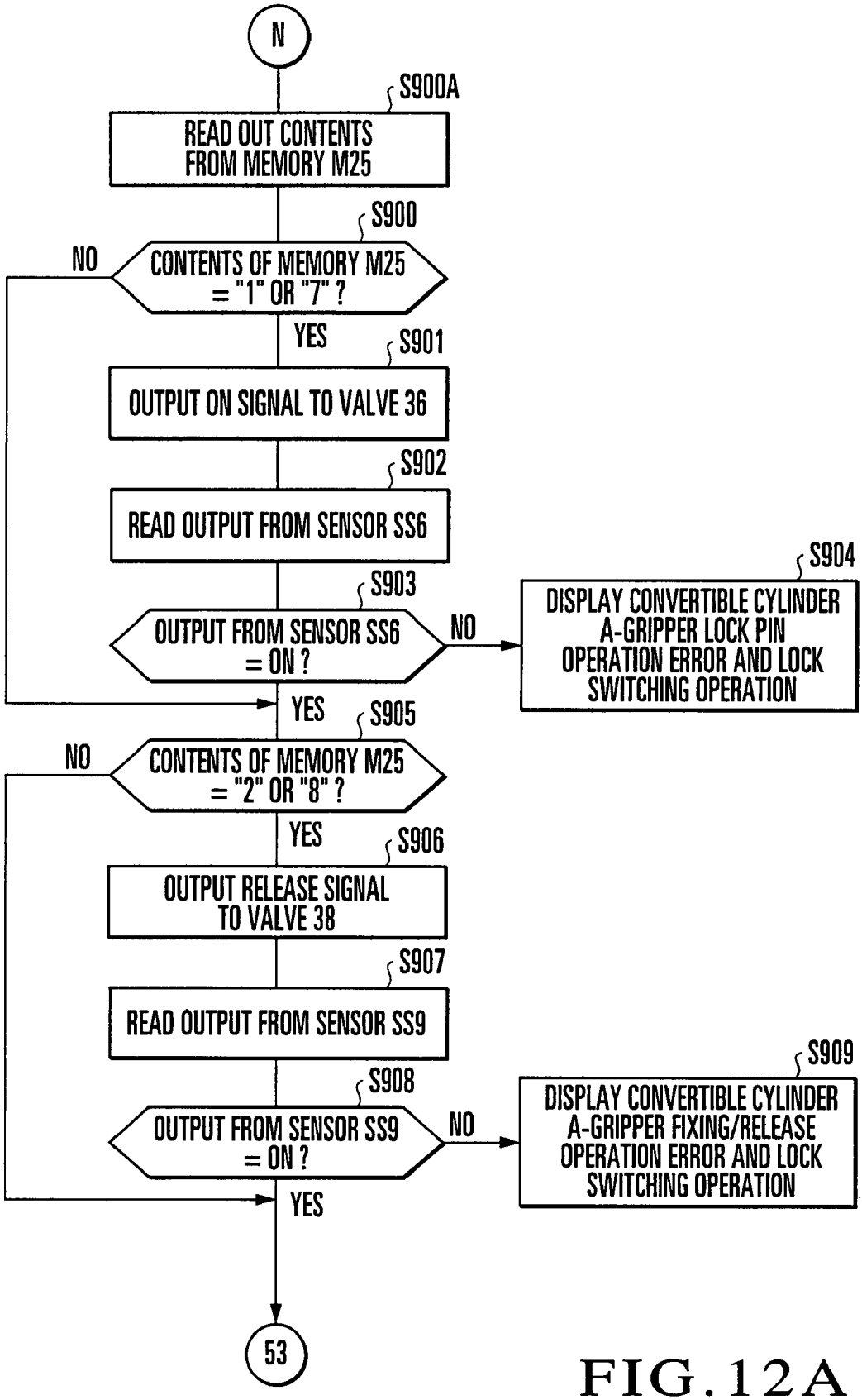
FIGS. 12A to 12I are flowcharts for explaining an error recovery operation (including part of retry and automatic return) during automatic switching from a double-sided printing state to a single-sided printing state.
Figure 12B:
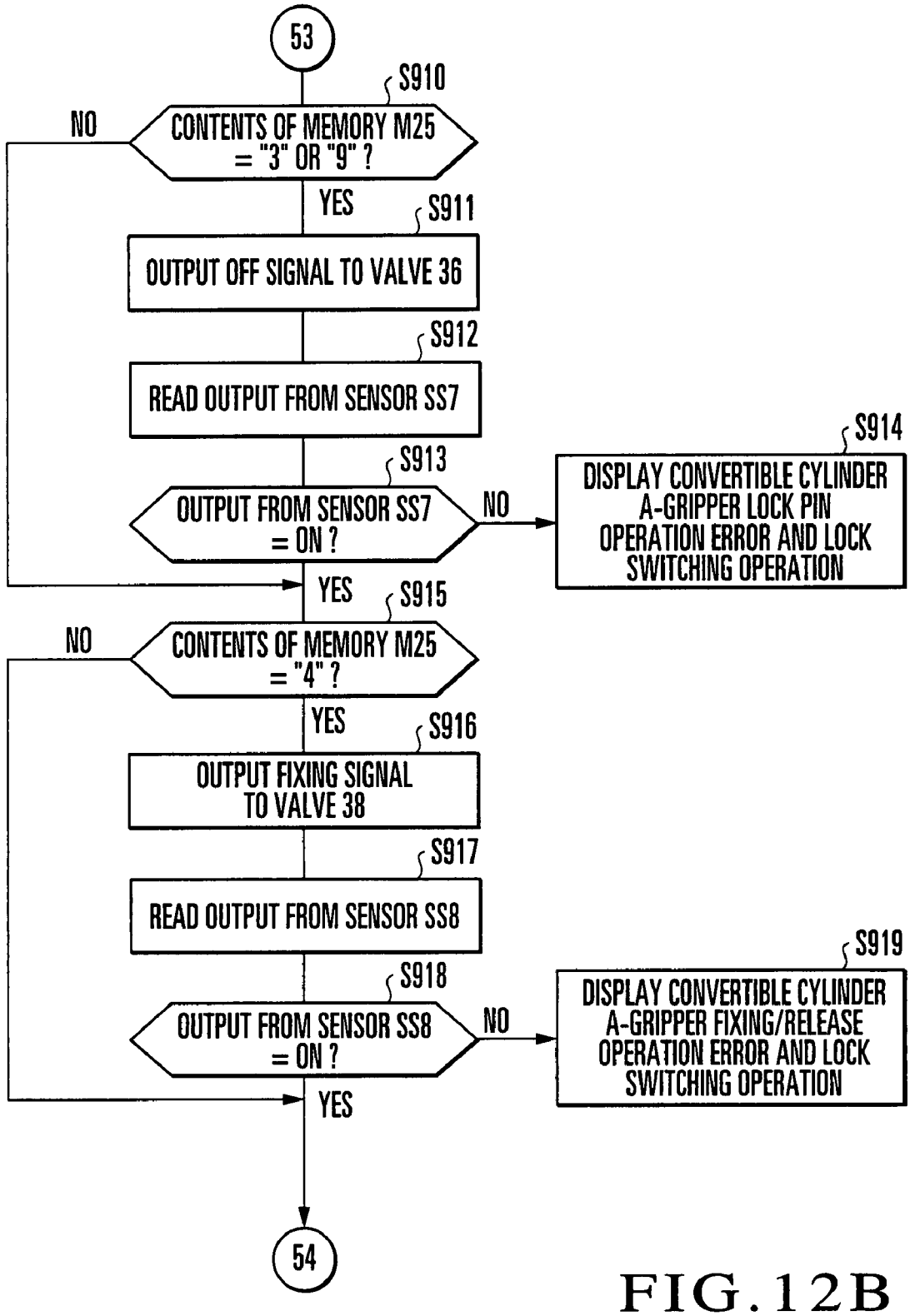

If the memory M25 stores "3" (FIG. 12B: YES in step S910), indicating an abnormal end of "switching step 29", the CPU 10 outputs an OFF signal to the convertible cylinder A-gripper lock pin ON/OFF air cylinder valve 36 (step S911) to eliminate the error in "switching step 29". If the memory M25 stores "9", indicating an abnormal end of "switching step 22", the CPU 10 eliminates the error in "switching step 22" in a similar way.

[Error in Switching Step 28]

If the memory M25 stores "4" (YES in step S915), indicating an abnormal end of "switching step 28", the CPU 10 outputs a fixing signal to the convertible cylinder A-gripper fixing/release air cylinder valve 38 (step S916) to eliminate the error in "switching step 28".

[Error in Switching Step 27, Switching Step 21, and Switching Step 4]

Figure 12C:
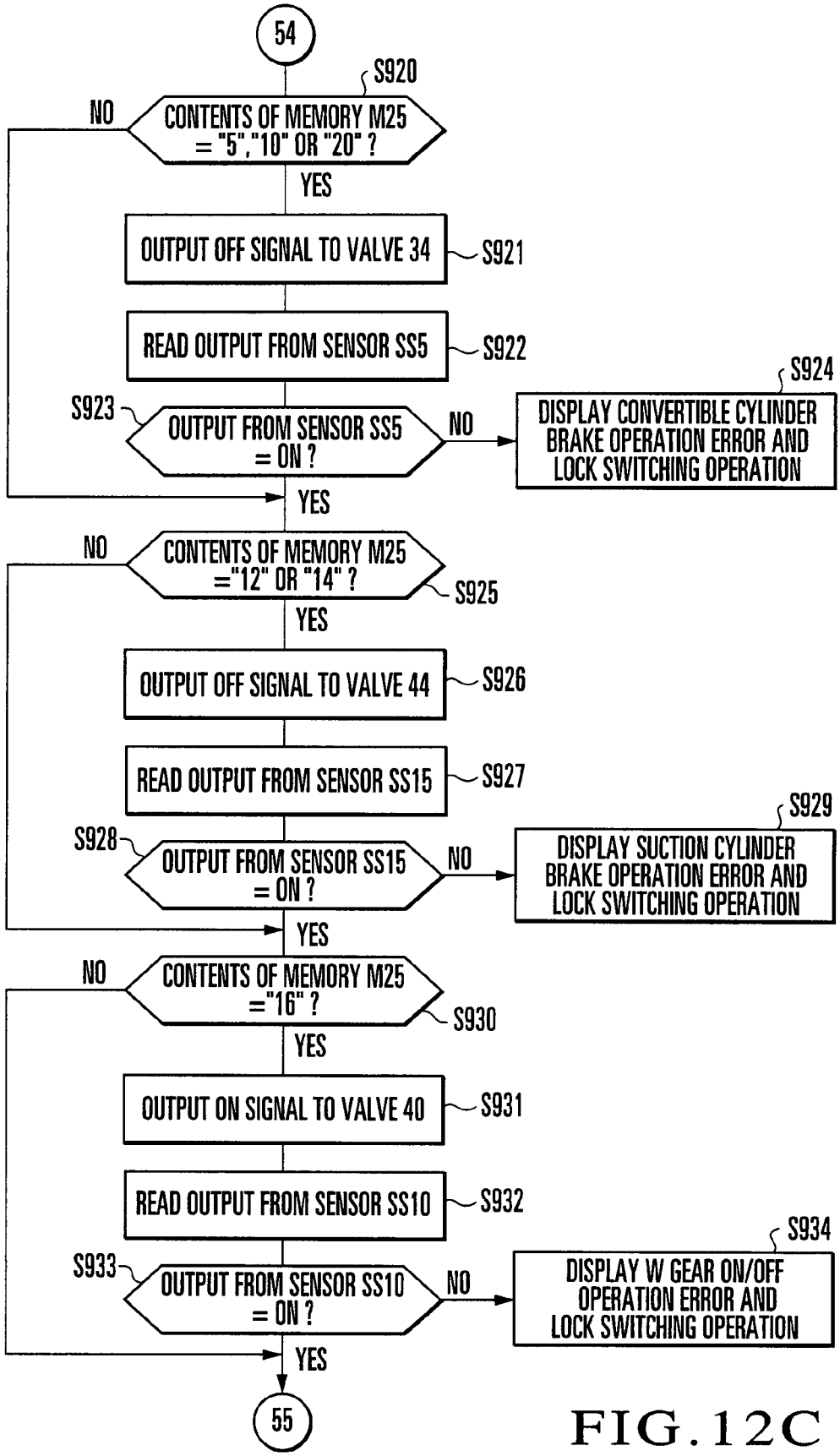

If the memory M25 stores "5" (FIG. 12C: YES in step S920), indicating an abnormal end of "switching step 27", the CPU 10 outputs an OFF signal to the convertible cylinder brake ON/OFF air cylinder valve 34 (step S921) to eliminate the error in "switching step 27". If the memory M25 stores "10", indicating an abnormal end of "switching step 21", the CPU 10 eliminates the error in "switching step 21" in a similar way. If the memory M25 stores "20", indicating an abnormal end of "switching step 4", the CPU 10 eliminates the error in "switching step 4" in a similar way.

[Error in Switching Step 15 and Switching Step 10]

If the memory M25 stores "12" (YES in step S925), indicating an abnormal end of "switching step 15", the CPU 10 outputs an OFF signal to the suction cylinder brake ON/OFF air cylinder valve 44 (step S926) to eliminate the error in "switching step 15". If the memory M25 stores "14", indicating an abnormal end of "switching step 10", the CPU 10 eliminates the error in "switching step 10" in a similar way.

[Error in Switching Step 8]

If the memory M25 stores "16" (YES in step S930), indicating an abnormal end of "switching step 8", the CPU 10 outputs an ON signal to the W gear ON/OFF air cylinder valve 40 (step S931) to eliminate the error in "switching step 8".

[Error in Switching Step 7]

Figure 12D:
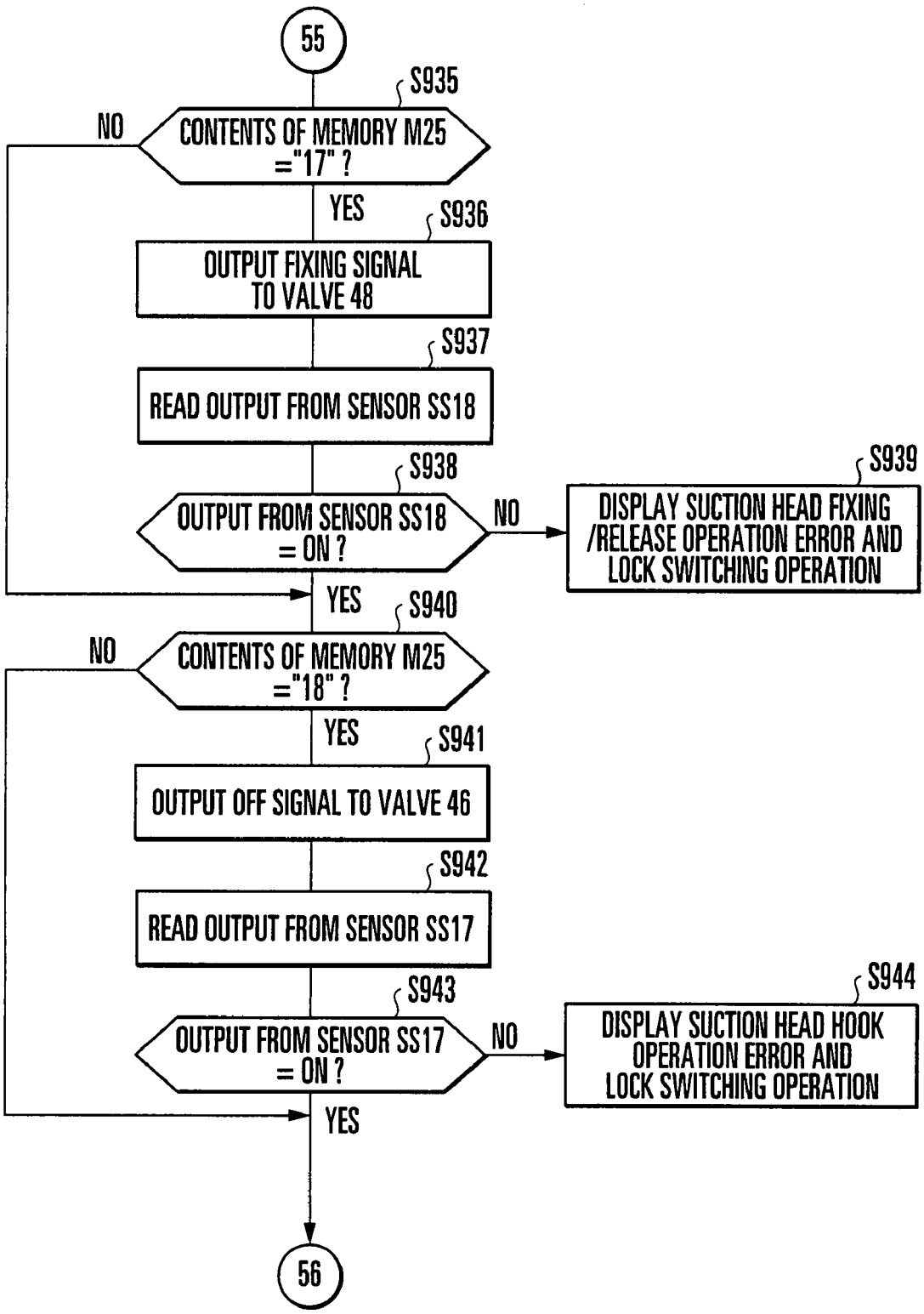

If the memory M25 stores "17" (FIG. 12D: YES in step S935), indicating an abnormal end of "switching step 7", the CPU 10 outputs a fixing signal to the suction head fixing/release air cylinder valve 48 (step S936) to eliminate the error in "switching step 7".

[Error in Switching Step 6]

If the memory M25 stores "18" (YES in step S940), indicating an abnormal end of "switching step 6", the CPU 10 outputs an OFF signal to the suction head hook ON/OFF air cylinder valve 46 (step S941) to eliminate the error in "switching step 6".

[Error in Switching Step 5]

Figure 12E:
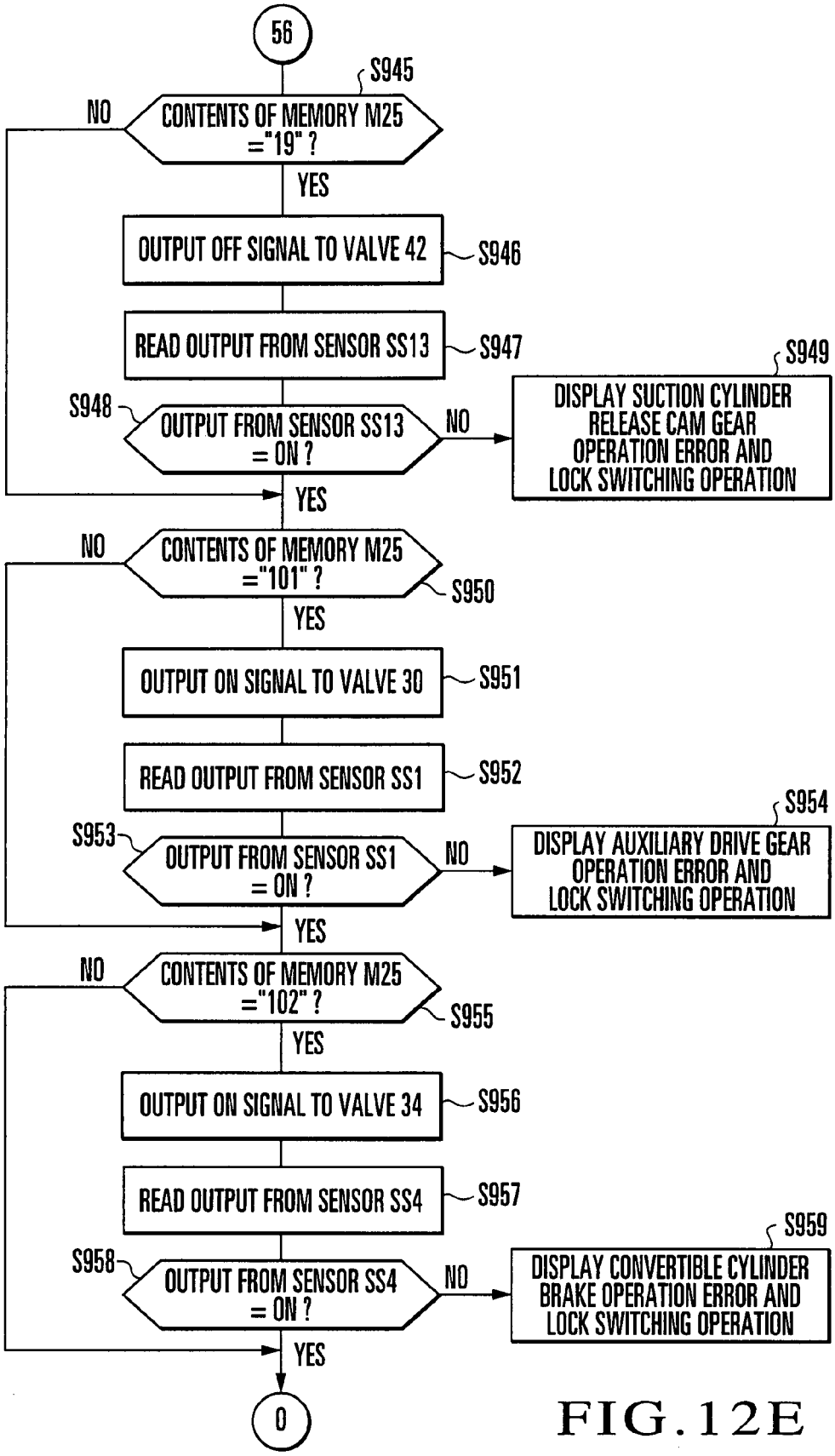
Figure 12F:
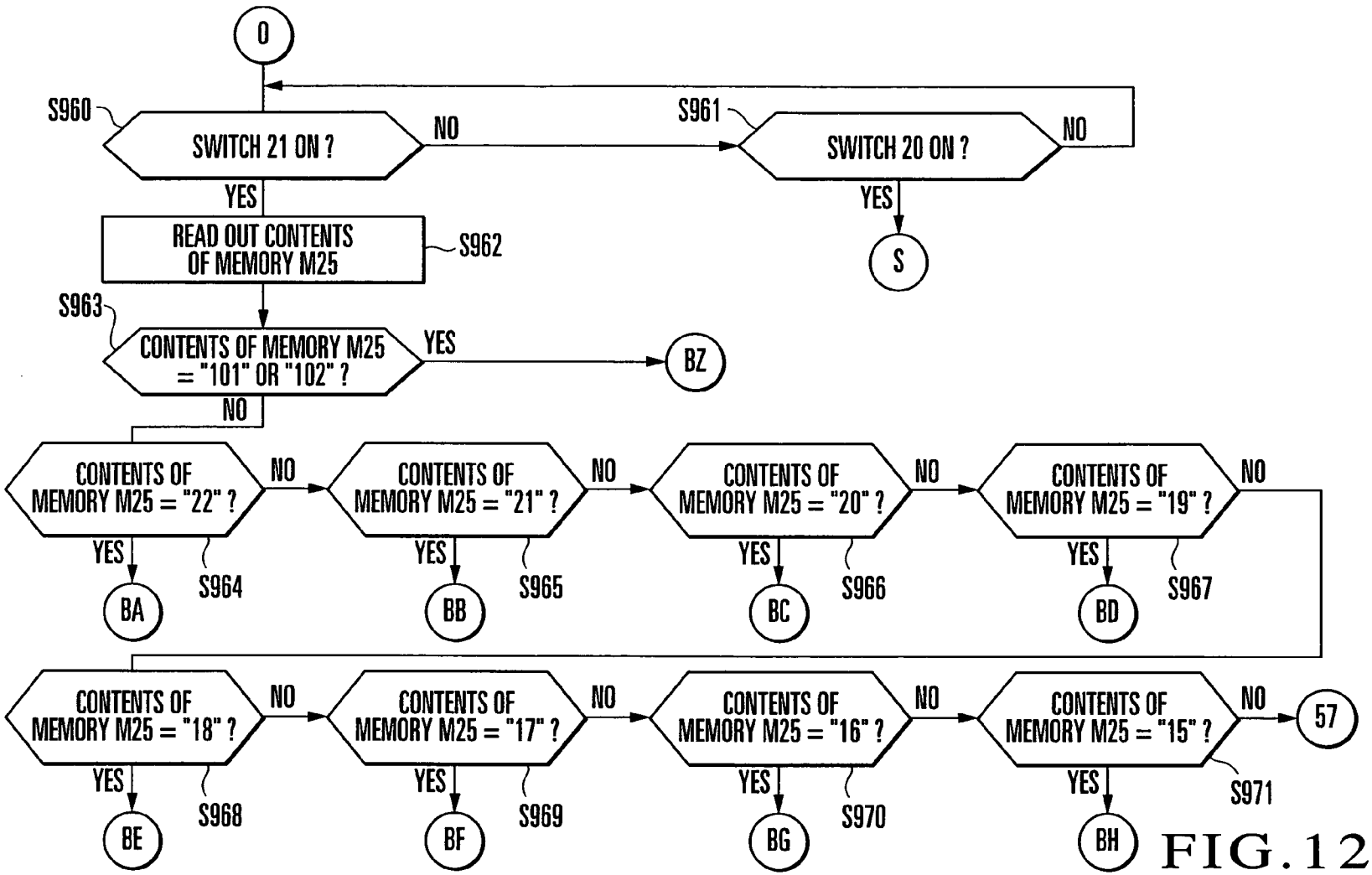
Figure 12G:
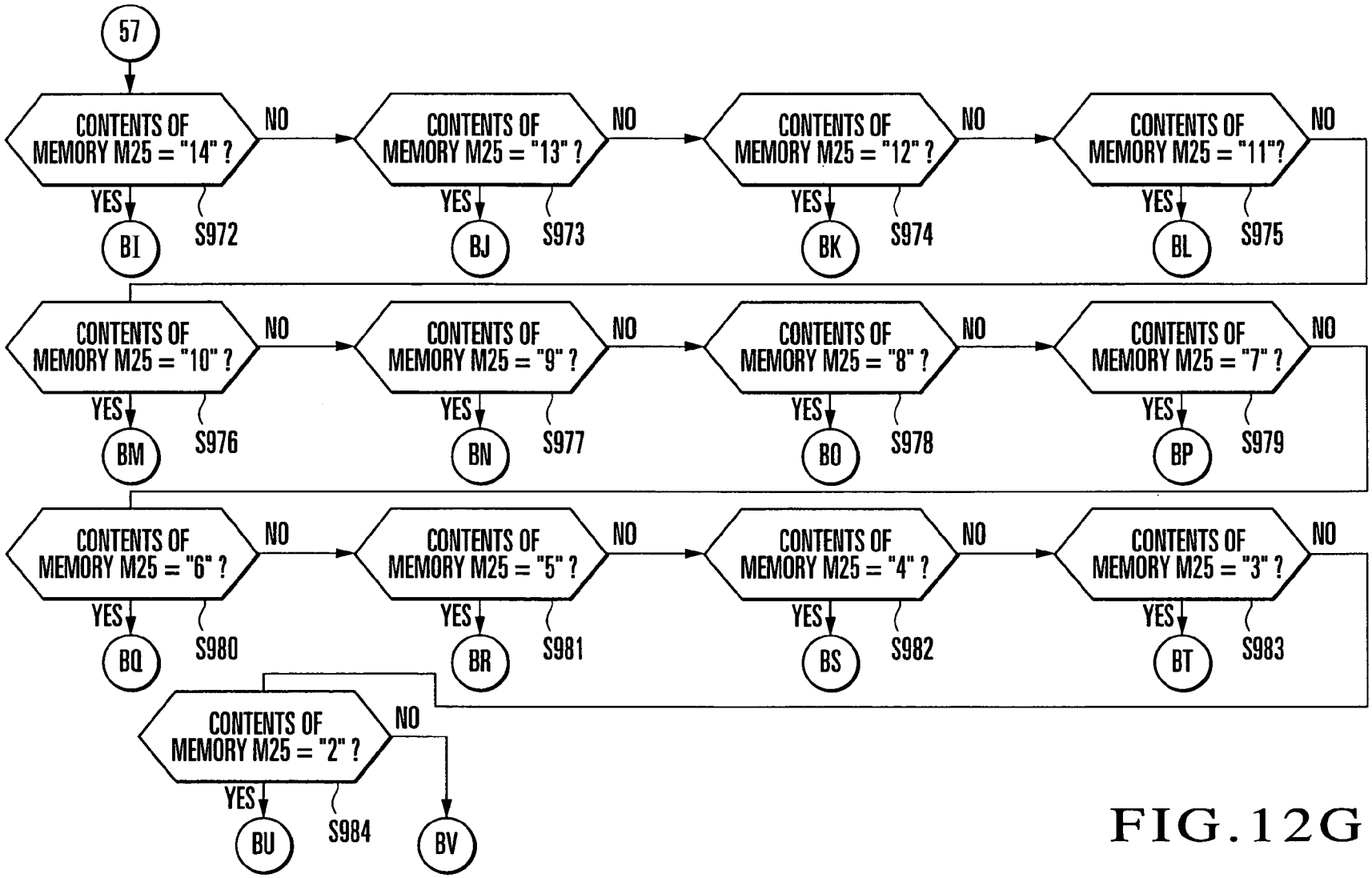
Figure 12H:
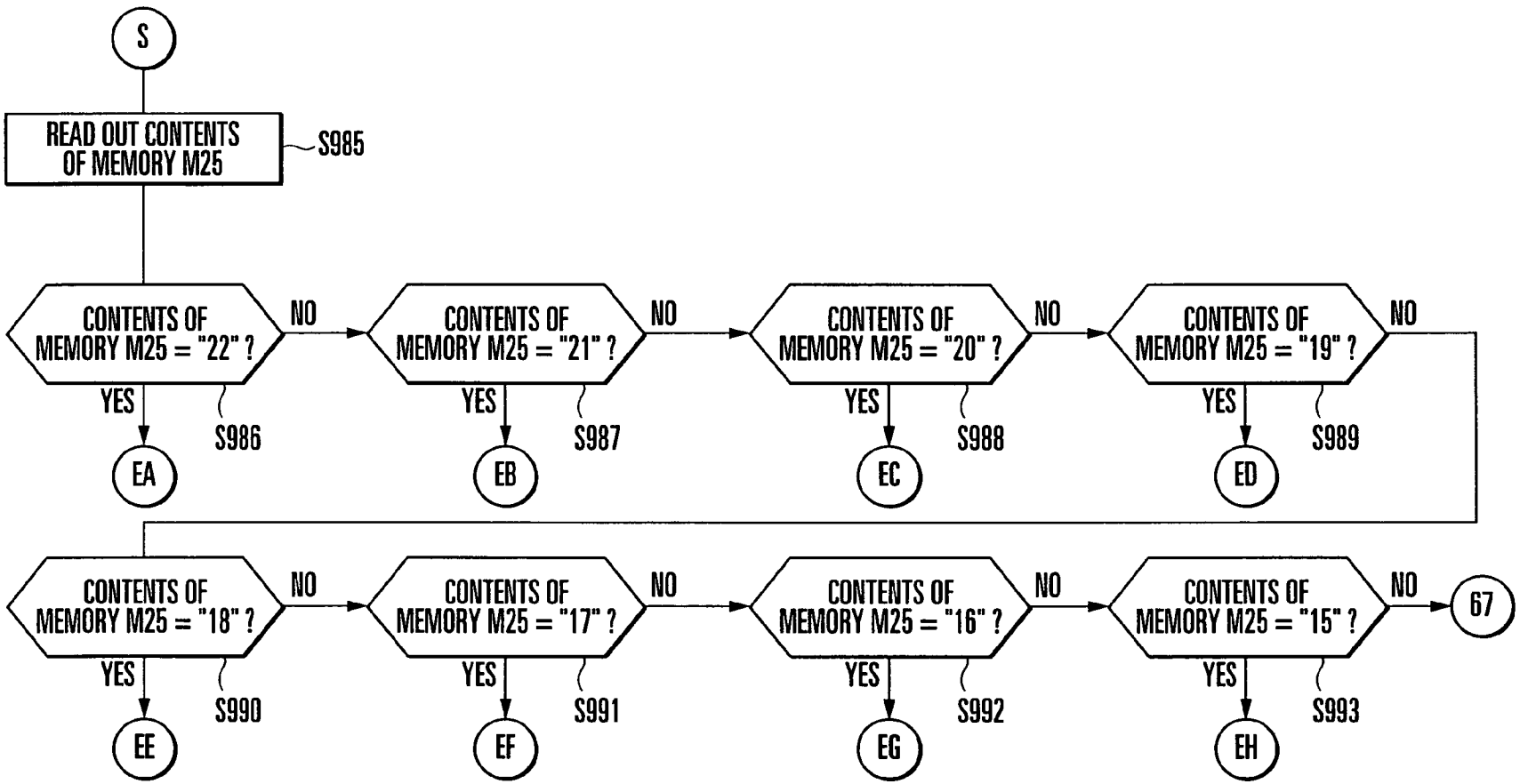
Figure 12I:
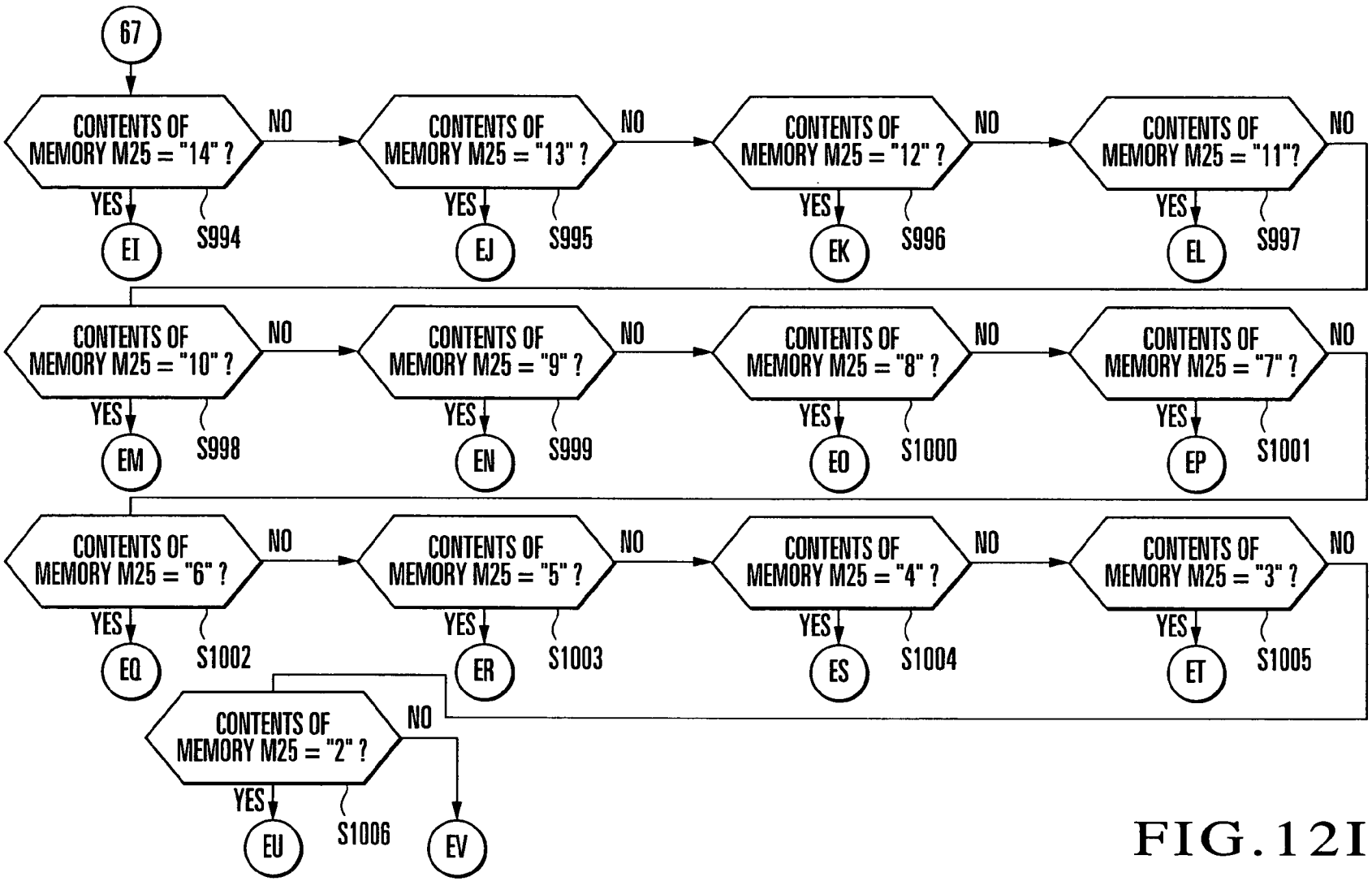

If the memory M25 stores "19" (FIG. 12E: YES in step S945), indicating an abnormal end of "switching step 5", the CPU 10 outputs an OFF signal to the suction cylinder release cam gear ON/OFF air cylinder valve 42 (step S946) to eliminate the error in "switching step 5".

[Error in Switching Step 33]

If the memory M25 stores "101" (YES in step S950), indicating an abnormal end of "switching step 33", the CPU 10 outputs an ON signal to the auxiliary drive gear ON/OFF air cylinder valve 30 (step S951) to eliminate the error in "switching step 33".

[Error in Switching Step 32]

If the memory M25 stores "102" (YES in step S955), indicating an abnormal end of "switching step 32", the CPU 10 outputs an ON signal to the convertible cylinder brake ON/OFF air cylinder valve 34 (step S956) to eliminate the error in "switching step 32".

In the above-described operation, if the ON state of the output from the convertible cylinder A-gripper lock pin ON sensor SS6 is not confirmed, i.e., if error recovery has failed even though an ON signal is output to the convertible cylinder A-gripper lock pin ON/OFF air cylinder valve 36 in step S903 (FIG. 12A), the CPU 10 displays it and locks the switching operation (step S904). Similarly, if error recovery has failed in any other step, the CPU 10 displays it and locks the switching operation. In this case, the operator manually returns the mode to the single-sided printing state.

[Retry after Error Recovery]

If error recovery has succeeded, the operator turns on the retry switch 20. Since YES in step S961 (FIG. 12F), the CPU 10 advances to step S985 (FIG. 12H) to read out the contents of the error step memory M25. On the basis of the error number written in the memory M25, the CPU 10 restarts automatic switching to the single-sided printing state from the switching step that has undergone error recovery and restored the initial state.

If the memory M25 stores, e.g., "22" (YES in step S986), automatic switching restarts from step S707 in the flowchart in FIG. 11A. If the memory M25 stores "21" (YES in step S987), automatic switching restarts from step S716 in the flowchart in FIG. 11B. If the memory M25 stores "20" (YES in step S988), automatic switching restarts from step S740 in the flowchart in FIG. 11D.

If the memory M25 stores "19" (YES in step S989), automatic switching restarts from step S744 in the flowchart in FIG. 11D. If the memory M25 stores "18" (YES in step S990), automatic switching restarts from step S748 in the flowchart in FIG. 11E. If the memory M25 stores "17" (YES in step S991), automatic switching restarts from step S752 in the flowchart in FIG. 11E. If the memory M25 stores "16" (YES in step S992), automatic switching restarts from step S756 in the flowchart in FIG. 11E.

If the memory M25 stores "15" (YES in step S993), automatic switching restarts from step S760 in the flowchart in FIG. 11F. If the memory M25 stores "14" (FIG. 12I: YES in step S994), automatic switching restarts from step S775 in the flowchart in FIG. 11G. If the memory M25 stores "13" (YES in step S995), automatic switching restarts from step S791 in the flowchart in FIG. 11H. If the memory M25 stores "12" (YES in step S996), automatic switching restarts from step S806 in the flowchart in FIG. 11J.

Figure 11L:
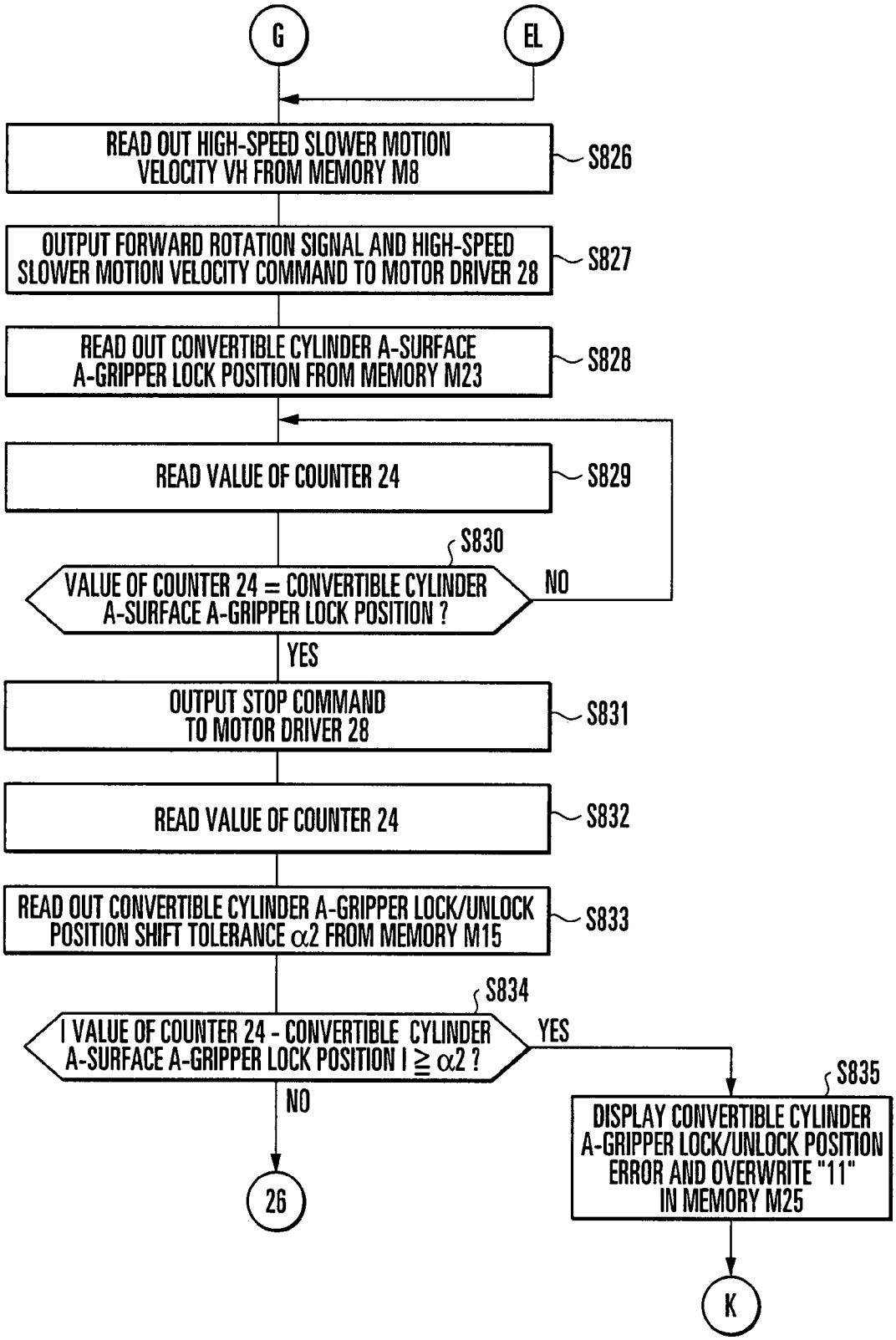
Figure 11M:
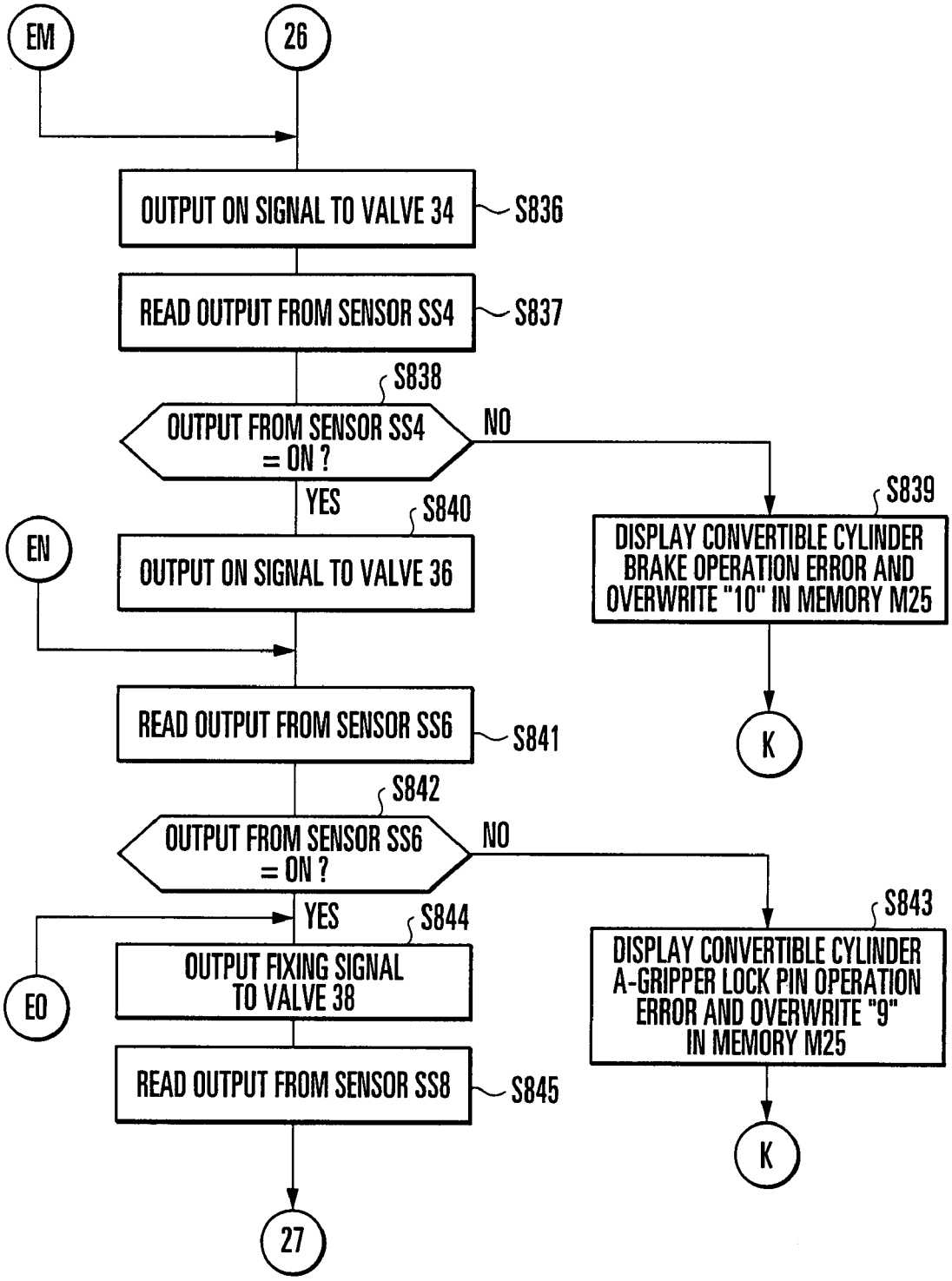

If the memory M25 stores "11" (YES in step S997), automatic switching restarts from step S826 in the flowchart in FIG. 11L. If the memory M25 stores "10" (YES in step S998), automatic switching restarts from step S836 in the flowchart in FIG. 11M. If the memory M25 stores "9" (YES in step S999), automatic switching restarts from step S841 in the flowchart in FIG. 11M. If the memory M25 stores "8" (YES in step S1000), automatic switching restarts from step S844 in the flowchart in FIG. 11M.

Figure 11N:
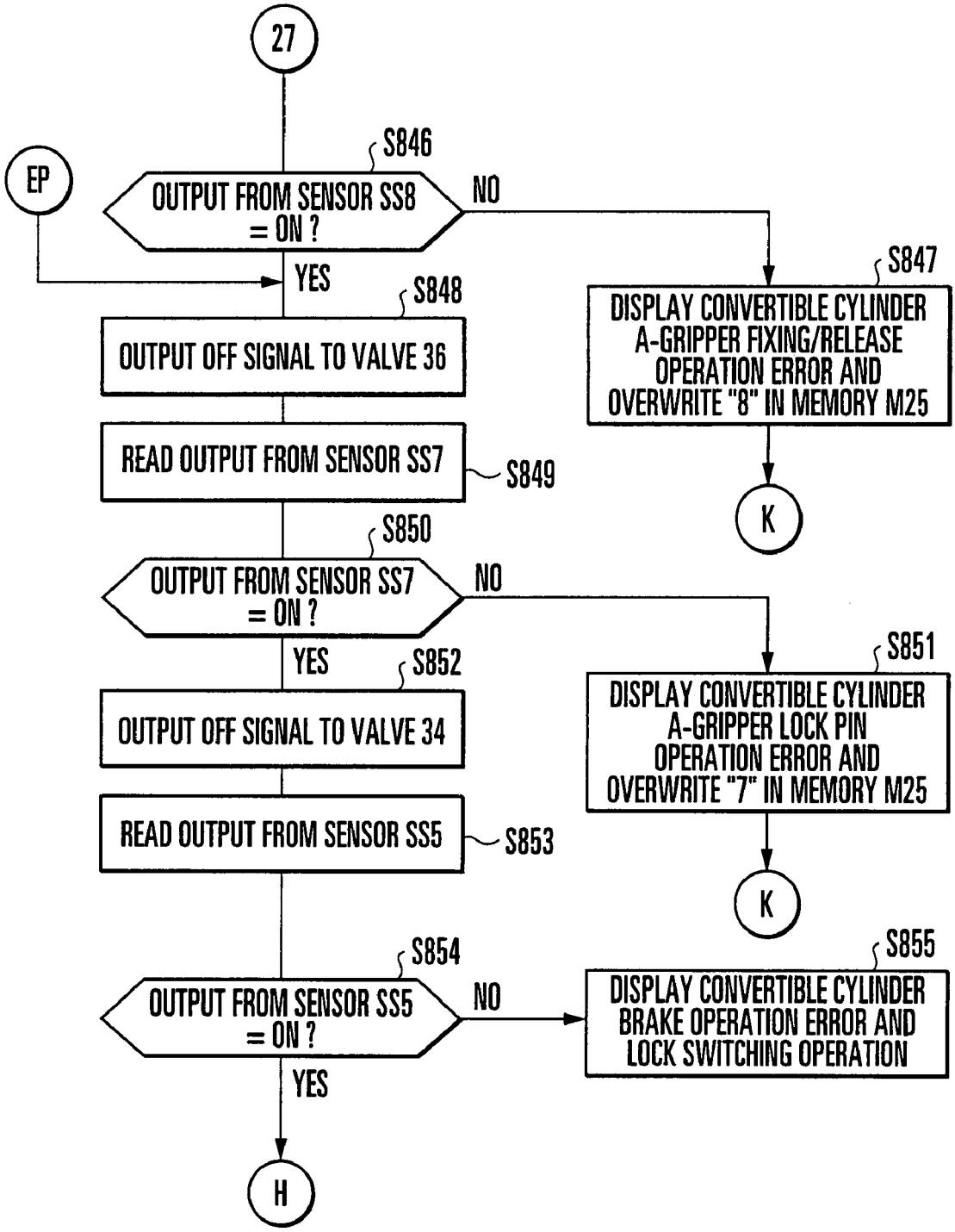
Figure 11O:
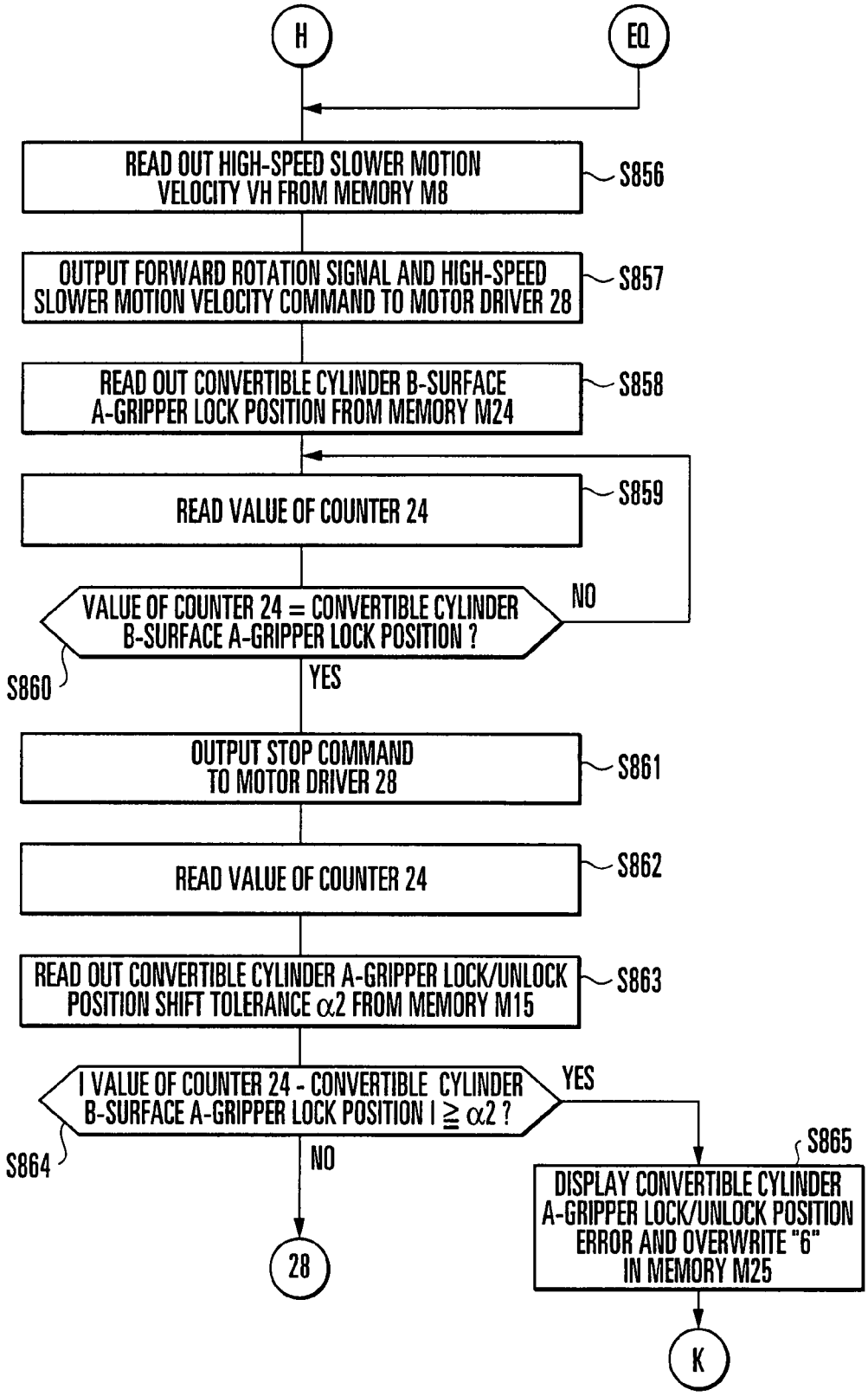

If the memory M25 stores "7" (YES in step S1001), automatic switching restarts from step S848 in the flowchart in FIG. 11N. If the memory M25 stores "6" (YES in step S1002), automatic switching restarts from step S886 in the flowchart in FIG. 11O. If the memory M25 stores "5" (YES in step S1003), automatic switching restarts from step S866 in the flowchart in FIG. 11P. If the memory M25 stores "4" (YES in step S1004), automatic switching restarts from step S870 in the flowchart in FIG. 11P.

Figure 11P:
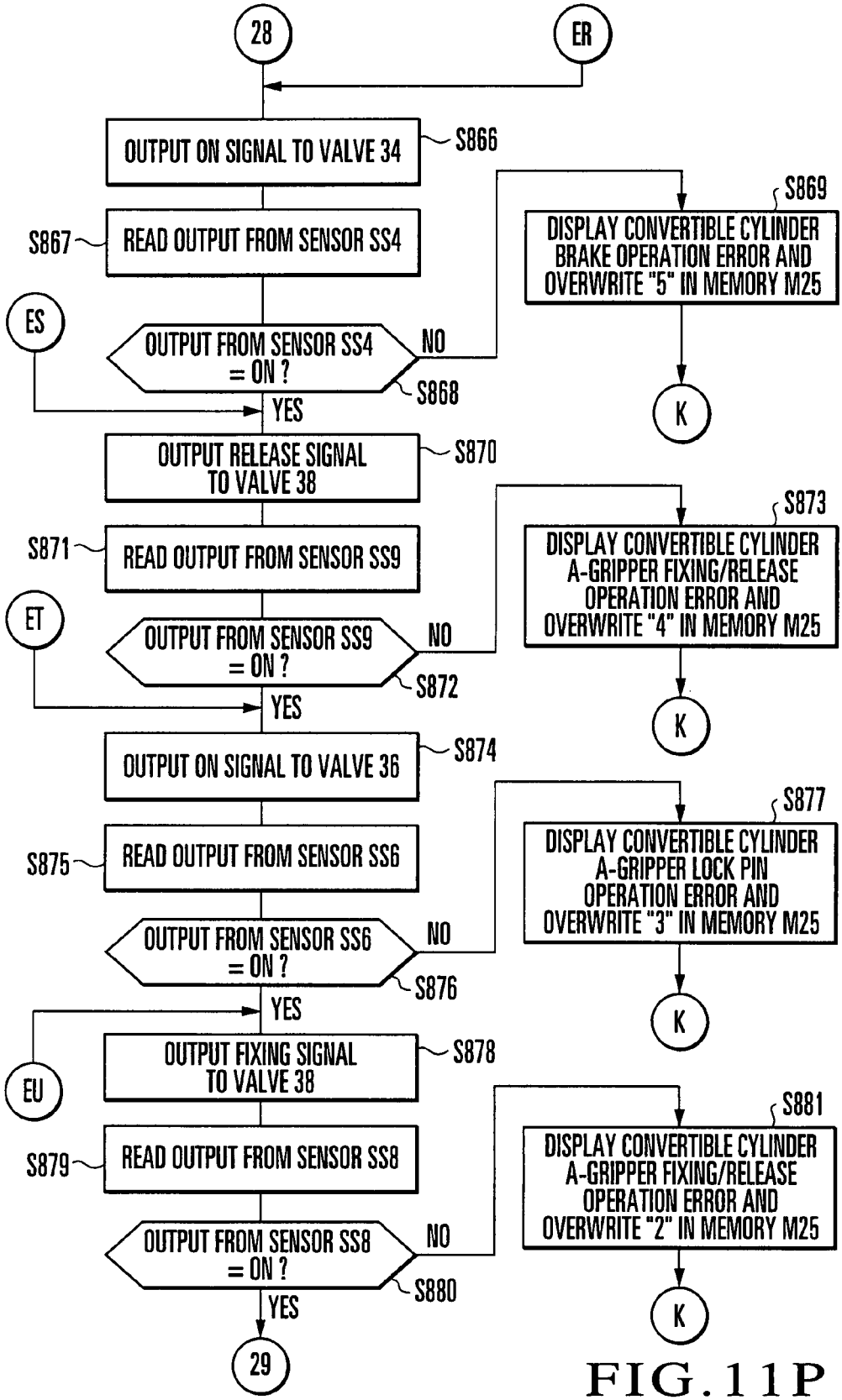
Figure 11Q:
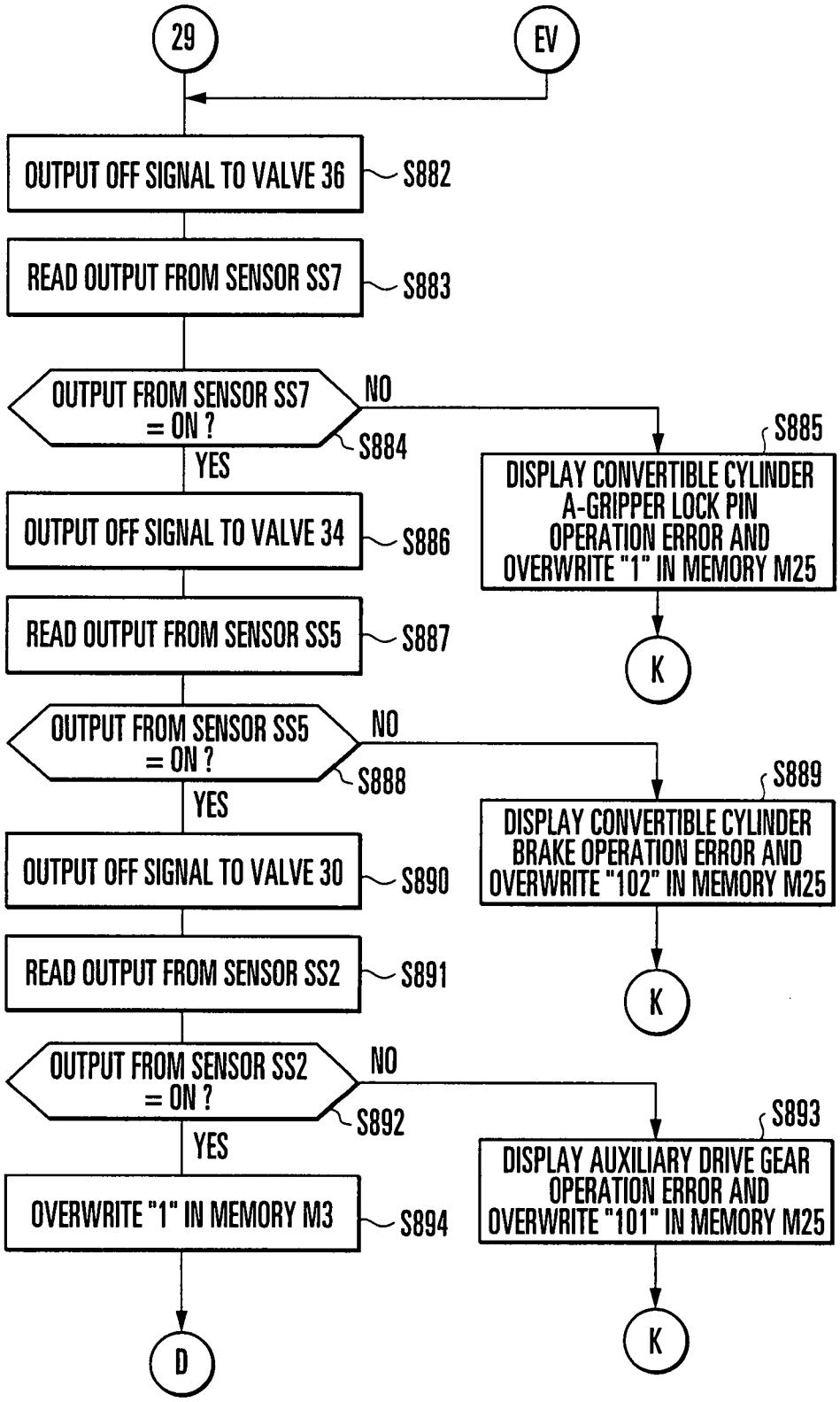

If the memory M25 stores "3" (YES in step S1005), automatic switching restarts from step S874 in the flowchart in FIG. 11P. If the memory M25 stores "2" (YES in step S1006), automatic switching restarts from step S878 in the flowchart in FIG. 11P. If the memory M25 stores "1", automatic switching restarts from step S882 in the flowchart in FIG. 11Q.

[Automatic Return]

Upon determining that there is no probability that the switching step will normally finish even in retry, the operator turns on the return operation start switch 21. Since YES in step S960 in FIG. 12F, the CPU 10 advances to step S962 to read out the contents of the error step memory M25. On the basis of the error number written in the memory M25, the CPU 10 starts automatic return from double-side return operation steps "R2-1 to R2-27" and "R2-F" (Tables 4, 5, and 6) corresponding to the error number to the printing state (double-sided printing state) before the start of automatic switching.

When the double-side return operation step corresponding to the error number written in the memory M25 is "R2-F", automatic switching to the single-sided printing state is forcedly terminated through the steps of "convertible cylinder brake OFF" and "auxiliary drive gear OFF", instead of automatic return to the double-sided printing state.

[Automatic Return from Double-Side Return Operation Step [R2-1]]

If the memory M25 stores, e.g., "1", the CPU 10 sets the double-side return operation step "R2-1" as the double-side return starting step and starts automatic return from the double-side return operation step "R2-1" to the double-sided printing state. In this case, since NO in step S984 in FIG. 12G, the process advances to step S1101 in FIG. 13A to outputs a release signal to the convertible cylinder A-gripper fixing/release air cylinder valve 38.

The CPU 10 reads the output from the convertible cylinder A-gripper release sensor SS9 (step S1102). If the output from the convertible cylinder A-gripper release sensor SS9 is ON (YES in step S1103), the CPU 10 outputs an OFF signal to the convertible cylinder A-gripper lock pin ON/OFF air cylinder valve 36 (step S1105) and reads the output from the convertible cylinder A-gripper lock pin OFF sensor SS7 (step S1106). If the output from the convertible cylinder A-gripper lock pin OFF sensor SS7 is ON (YES in step S1107), the CPU 10 outputs a fixing signal to the convertible cylinder A-gripper fixing/release air cylinder valve 38 (step S1109) and reads the output from the convertible cylinder A-gripper fixing sensor SS8 (step S1110).

If the output from the convertible cylinder A-gripper fixing sensor SS8 is ON (YES in step S1111), the CPU 10 outputs an OFF signal to the convertible cylinder brake ON/OFF air cylinder valve 34 (step S1113) and reads the output from the convertible cylinder brake OFF sensor SS5 (step S1114). If the output from the convertible cylinder brake OFF sensor SS5 is ON (FIG. 13B: YES in step S1115), the CPU 10 rotates the auxiliary drive motor 26 in the reverse direction at the high-speed slower motion velocity VH (steps S1117 and S1118).

The CPU 10 reads out the convertible cylinder A-surface A-gripper unlock position from the memory M14 (step S1119). The auxiliary drive motor 26 continues to rotate until the value of the upstream cylinder position detection counter 24 equals the convertible cylinder A-surface A-gripper unlock position (steps S1120 and S1121). If the value of the upstream cylinder position detection counter 24 equals the convertible cylinder A-surface A-gripper unlock position (YES in step S1121), the CPU 10 outputs a stop command to the motor driver 28 for the auxiliary drive motor (step S1122) to stop rotating the auxiliary drive motor 26.

After the auxiliary drive motor 26 stops, the CPU 10 reads the value of the upstream cylinder position detection counter 24 (step S1123) and reads out the convertible cylinder A-gripper lock/unlock position shift tolerance $\alpha$2 from the memory M15 (step S1124). If the absolute value of the difference between the value of the upstream cylinder position detection counter 24 and the convertible cylinder A-surface A-gripper unlock position is smaller than the convertible cylinder A-gripper lock/unlock position shift tolerance $\alpha$2 (NO in step S1125), the CPU 10 outputs an ON signal to the convertible cylinder brake ON/OFF air cylinder valve 34 (FIG. 13C: step S1127) and reads the output from the convertible cylinder brake ON sensor SS4 (step S1128).

If the output from the convertible cylinder brake ON sensor SS4 is ON (YES in step S1129), the CPU 10 outputs an ON signal to the convertible cylinder A-gripper lock pin ON/OFF air cylinder valve 36 (step S1131) and reads the output from the convertible cylinder A-gripper lock pin ON sensor SS6 (step S1132). If the output from the convertible cylinder A-gripper lock pin ON sensor SS6 is ON (YES in step S1133), the CPU 10 outputs a release signal to the convertible cylinder A-gripper fixing/release air cylinder valve 38 (step S1135) and reads the output from the convertible cylinder A-gripper release sensor SS9 (step S1136).

Figure 13A:
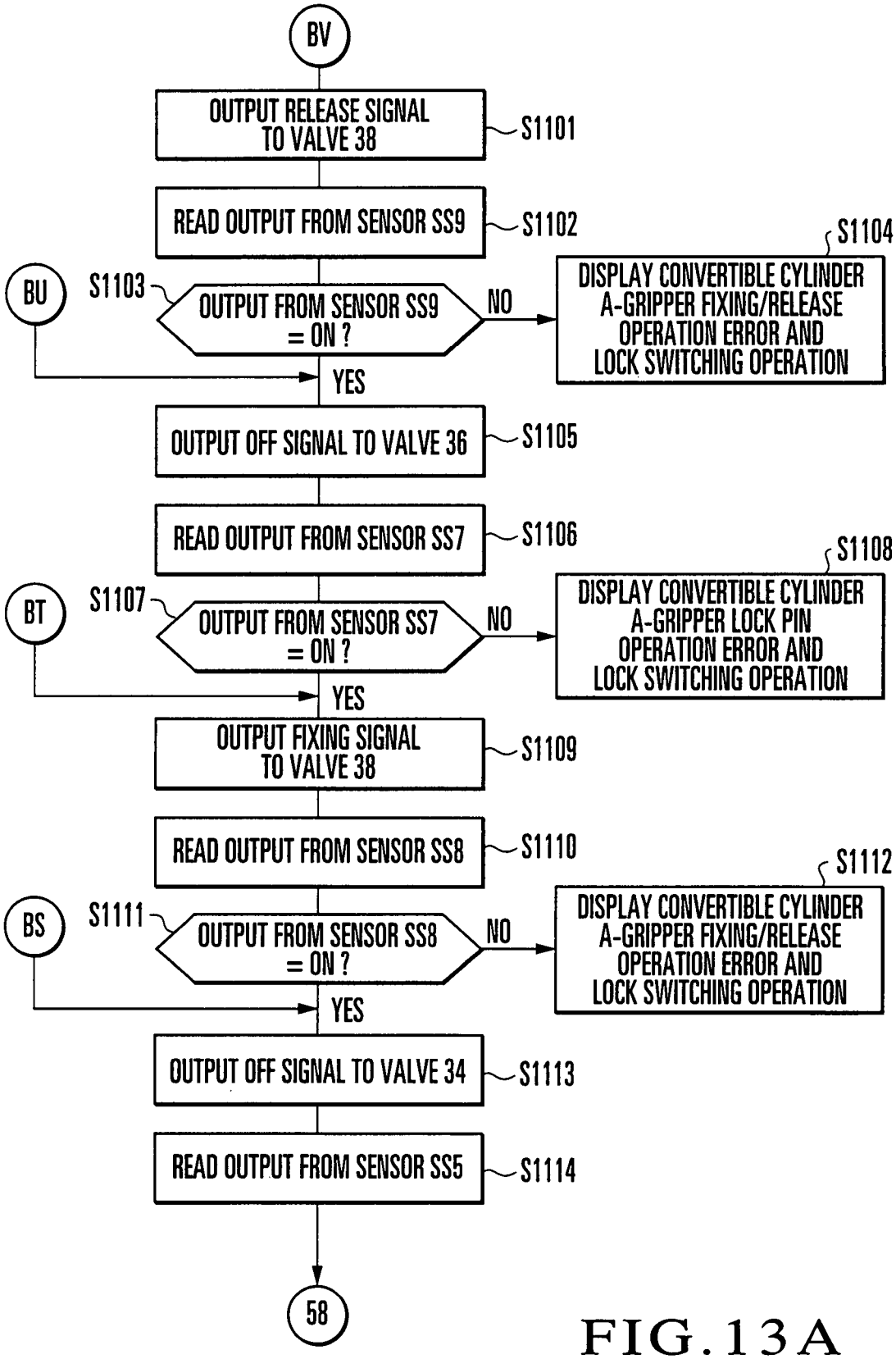
FIGS. 13A to 13L are flowcharts for explaining an automatic return operation to a double-sided printing state.
Figure 13B:
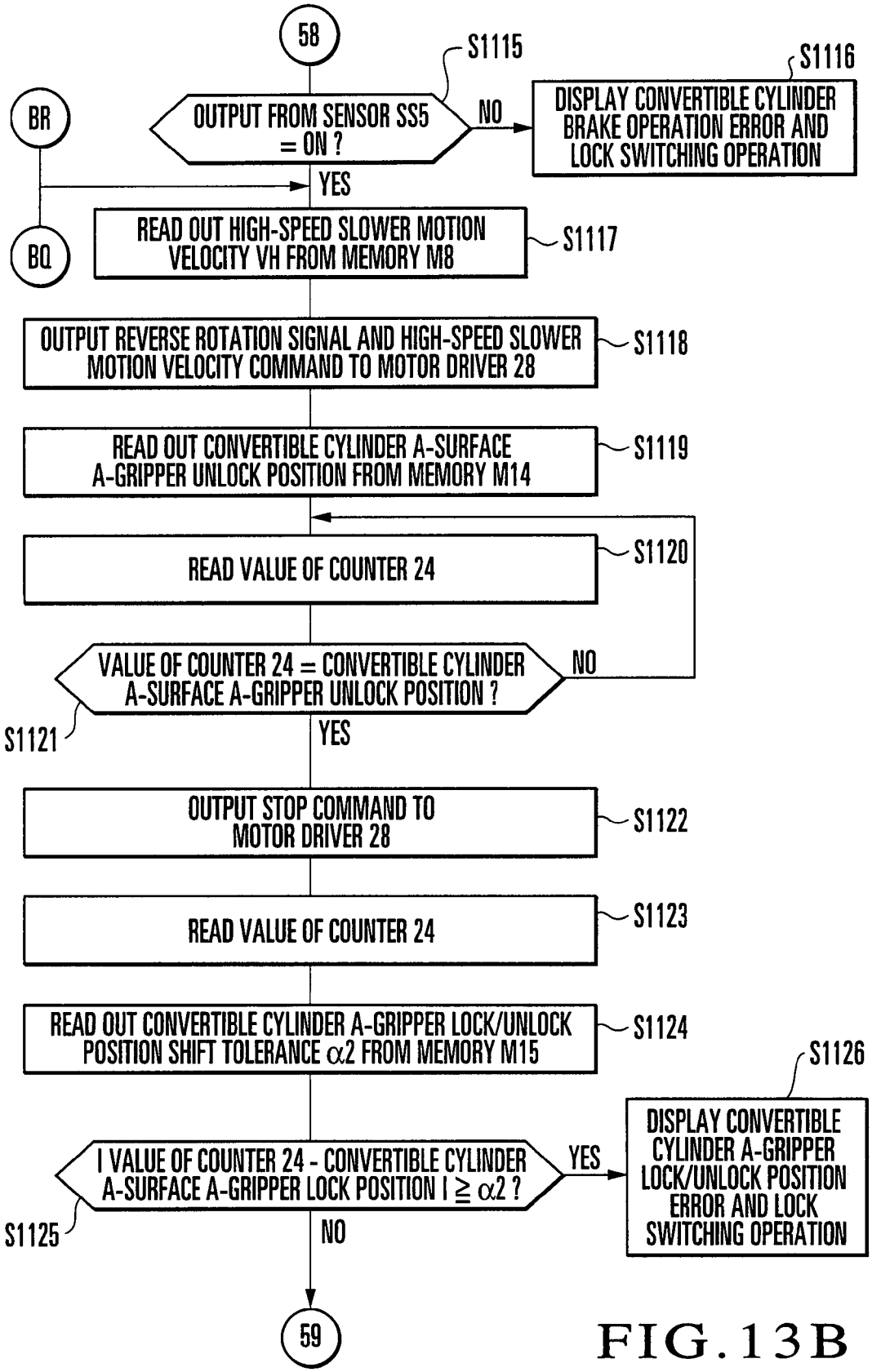
Figure 13C:
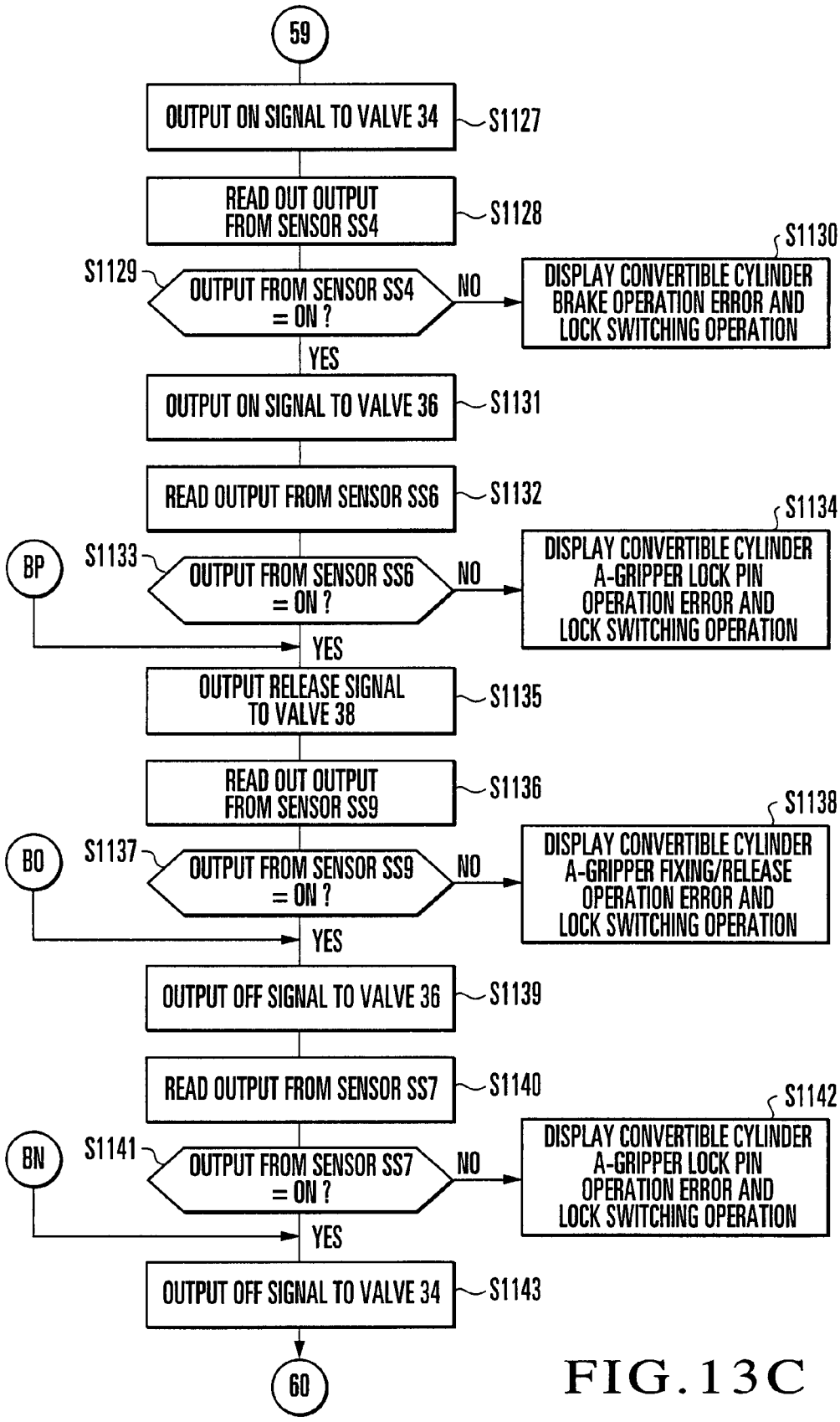
Figure 13D:
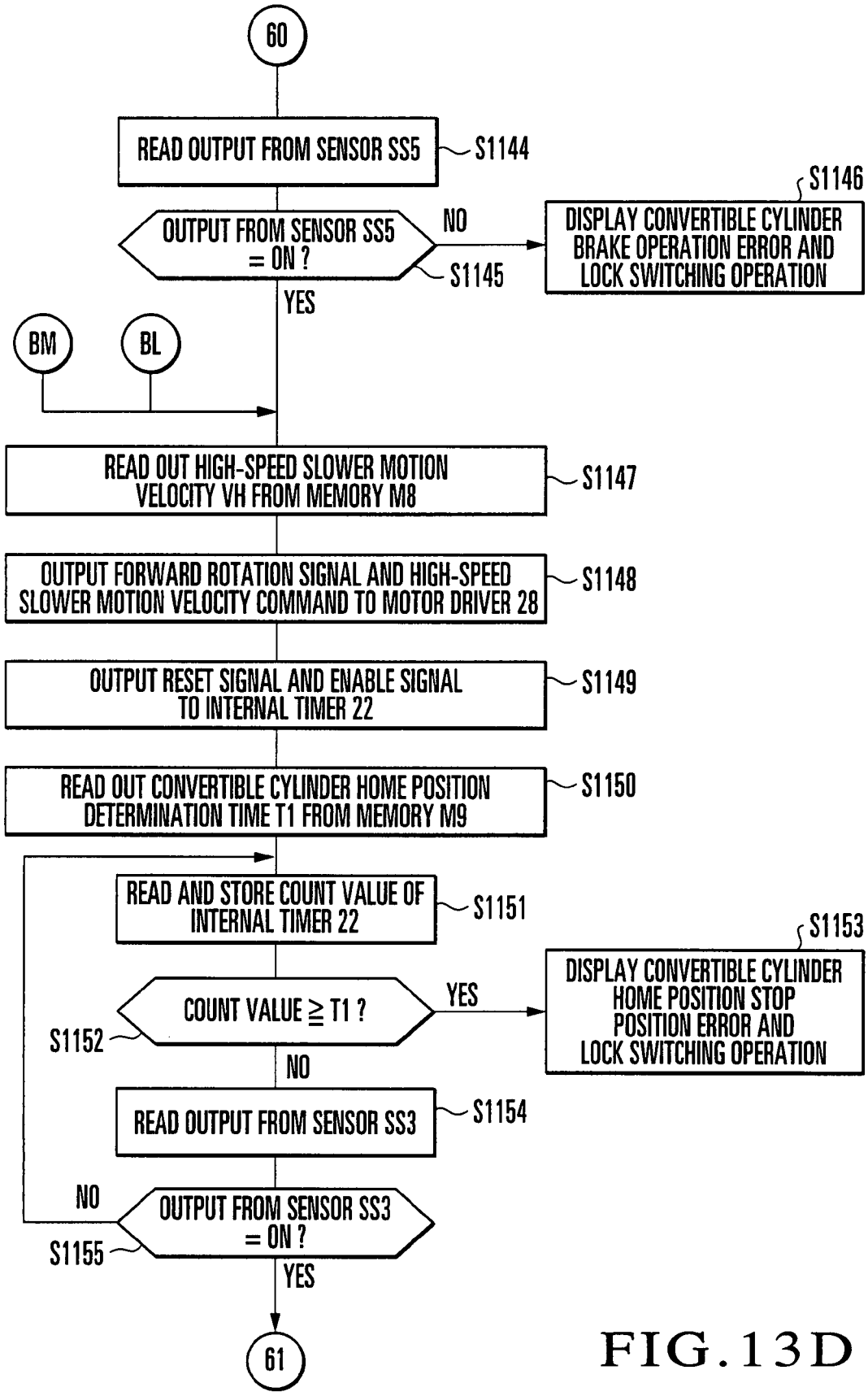

If the output from the convertible cylinder A-gripper release sensor SS9 is ON (YES in step S1137), the CPU 10 outputs an OFF signal to the convertible cylinder A-gripper lock pin ON/OFF air cylinder valve 36 (step S1139) and reads the output from the convertible cylinder A-gripper lock pin OFF sensor SS7 (step S1140). If the output from the convertible cylinder A-gripper lock pin OFF sensor SS7 is ON (YES in step S1141), the CPU 10 outputs an OFF signal to the convertible cylinder brake ON/OFF air cylinder valve 34 (step S1143) and reads the output from the convertible cylinder brake OFF sensor SS5 (FIG. 13D: step S1144).

If the output from the convertible cylinder brake OFF sensor SS5 is ON (YES in step S1145), the CPU 10 rotates the auxiliary drive motor 26 in the forward direction at the high-speed slower motion velocity VH (steps S1147 and S1148). Simultaneously, the CPU 10 outputs a reset signal and an enable signal to the internal timer 22 (step S1149) to start time counting from zero.

Figure 13E:
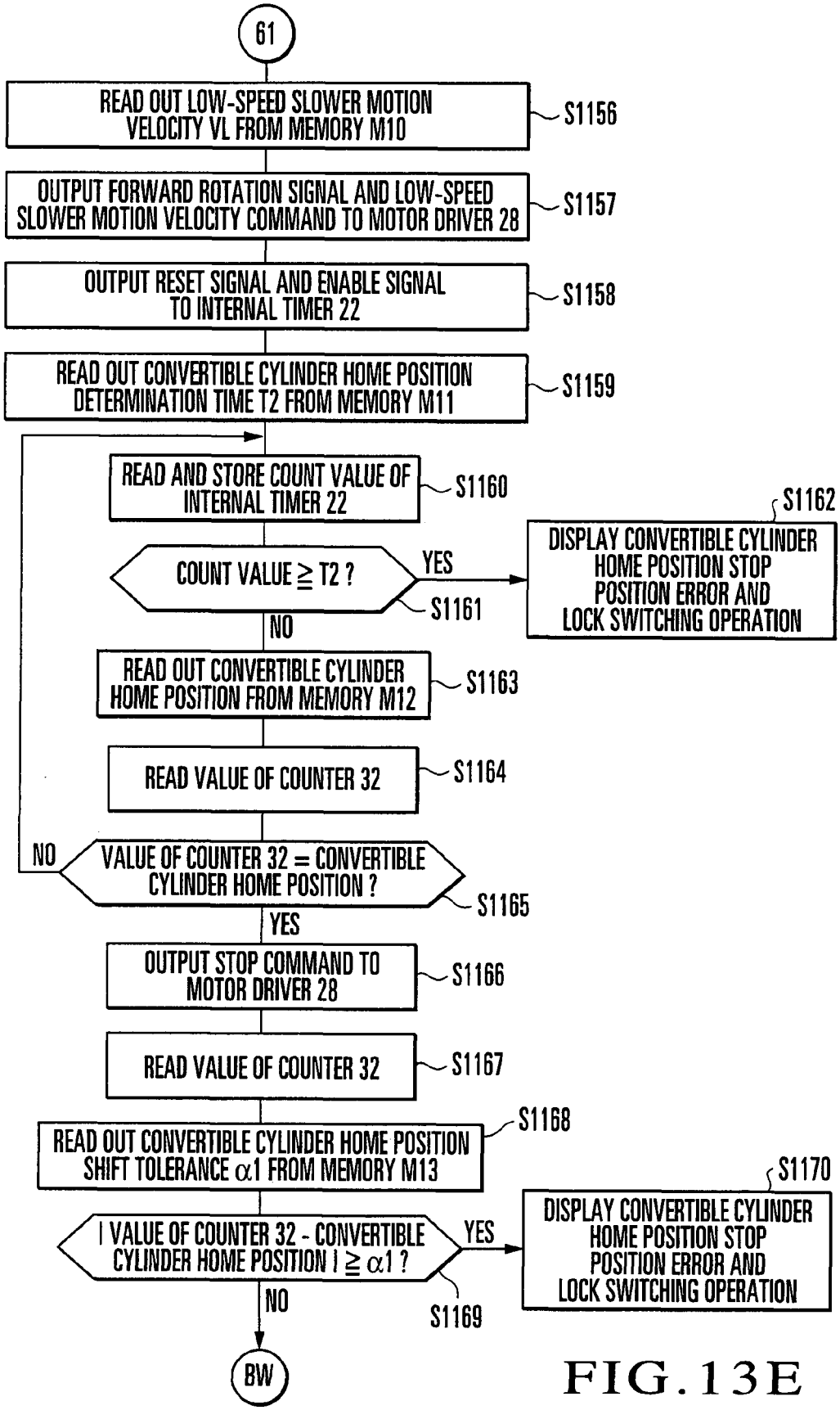

The CPU 10 reads out the convertible cylinder home position determination time T1 from the memory M9 (step S1150). If the ON state of the convertible cylinder home position determination deceleration sensor SS3 is confirmed before the count value of the internal timer 22 reaches the convertible cylinder home position determination time T1 (YES in step S1155), the CPU 10 switches the velocity of the auxiliary drive motor 26 to the low-speed slower motion velocity VL (FIG. 13E: steps S1156 and S1157). Simultaneously, the CPU 10 outputs a reset signal and an enable signal to the internal timer 22 (step S1158) to start time counting from zero.

The CPU 10 reads out the convertible cylinder home position determination time T2 from the memory M11 (step S1159). If the value of the convertible cylinder position detection counter 32 reaches the convertible cylinder home position before the count value of the internal timer 22 reaches the convertible cylinder home position determination time T2 (YES in step S1165), the CPU 10 outputs a stop command to the motor driver 28 for the auxiliary drive motor (step S1166) to stop rotating the auxiliary drive motor 26.

Figure 13F:
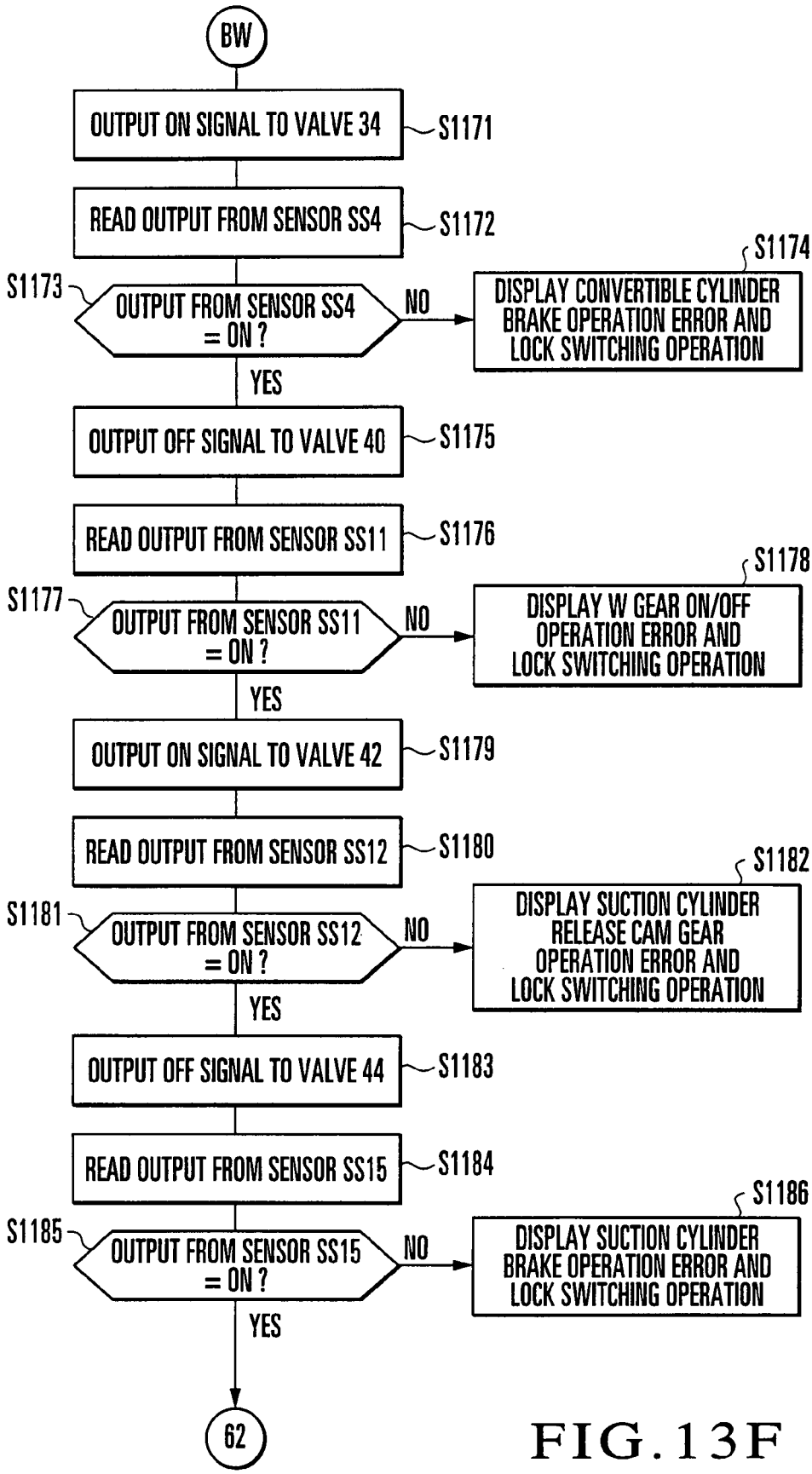

After the auxiliary drive motor 26 stops, the CPU 10 reads the value of the convertible cylinder position detection counter 32 (step S1167) and reads out the convertible cylinder home position shift tolerance $\alpha$1 from the memory M13 (step S1168). If the absolute value of the difference between the value of the convertible cylinder position detection counter 32 and the convertible cylinder home position is smaller than the convertible cylinder home position shift tolerance $\alpha$1 (NO in step S1169), the CPU 10 outputs an ON signal to the convertible cylinder brake ON/OFF air cylinder valve 34 (FIG. 13F: step S1171).

The CPU 10 reads the output from the convertible cylinder brake ON sensor SS4 (step S1172). If the output from the convertible cylinder brake ON sensor SS4 is ON (YES in step S1173), the CPU 10 outputs an OFF signal to the W gear ON/OFF air cylinder valve 40 (step S1175) and reads the output from the W gear OFF sensor SS11 (step S1176). If the output from the W gear OFF sensor SS11 is ON (YES in step S1177), the CPU 10 outputs an ON signal to the suction cylinder release cam gear ON/OFF air cylinder valve 42 (step S1179) and reads the output from the suction cylinder release cam gear ON sensor SS12 (step S1180).

Figure 13G:
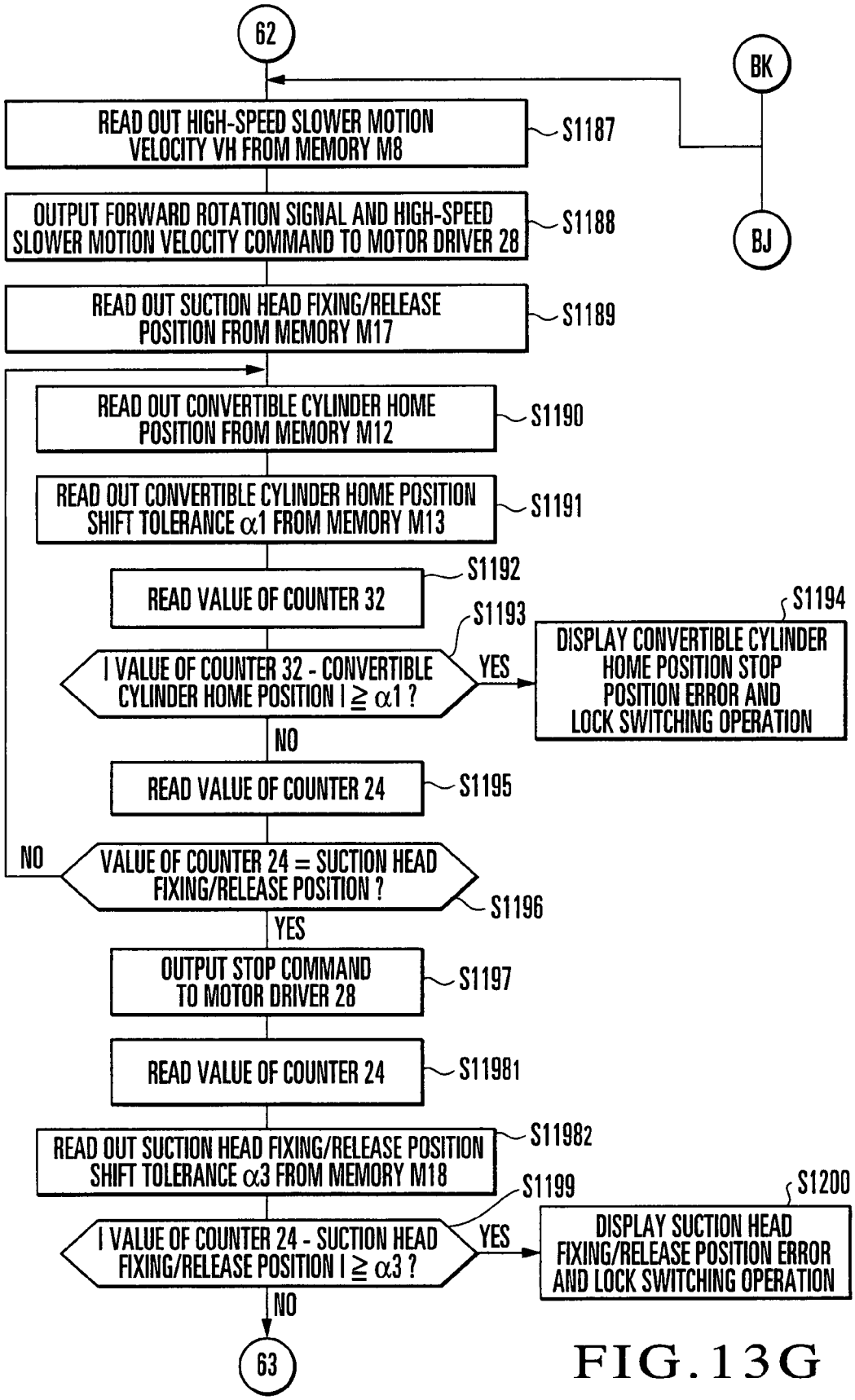

If the output from the suction cylinder release cam gear ON sensor SS12 is ON (YES in step S1181), the CPU 10 outputs an OFF signal to the suction cylinder brake ON/OFF air cylinder valve 44 (step S1183) and reads the output from the suction cylinder brake OFF sensor SS15 (step S1184). If the output from the suction cylinder brake OFF sensor SS15 is ON (YES in step S1185), the CPU 10 rotates the auxiliary drive motor 26 in the forward direction at the high-speed slower motion velocity VH (FIG. 13G: steps S1187 and S1188).

The CPU 10 reads out the suction head fixing/release position from the memory M17 (step S1189), the convertible cylinder home position from the memory M12 (step S1190), and the convertible cylinder home position shift tolerance $\alpha$1 from the memory M13 (step S1191). The CPU 10 keeps confirming that the convertible cylinder 3 is at the home position. When the value of the upstream cylinder position detection counter 24 matches the suction head fixing/release position (YES in step S1196), the CPU 10 outputs a stop command to the motor driver 28 for the auxiliary drive motor (step S1197) to stop rotating the auxiliary drive motor 26.

Figure 13H:
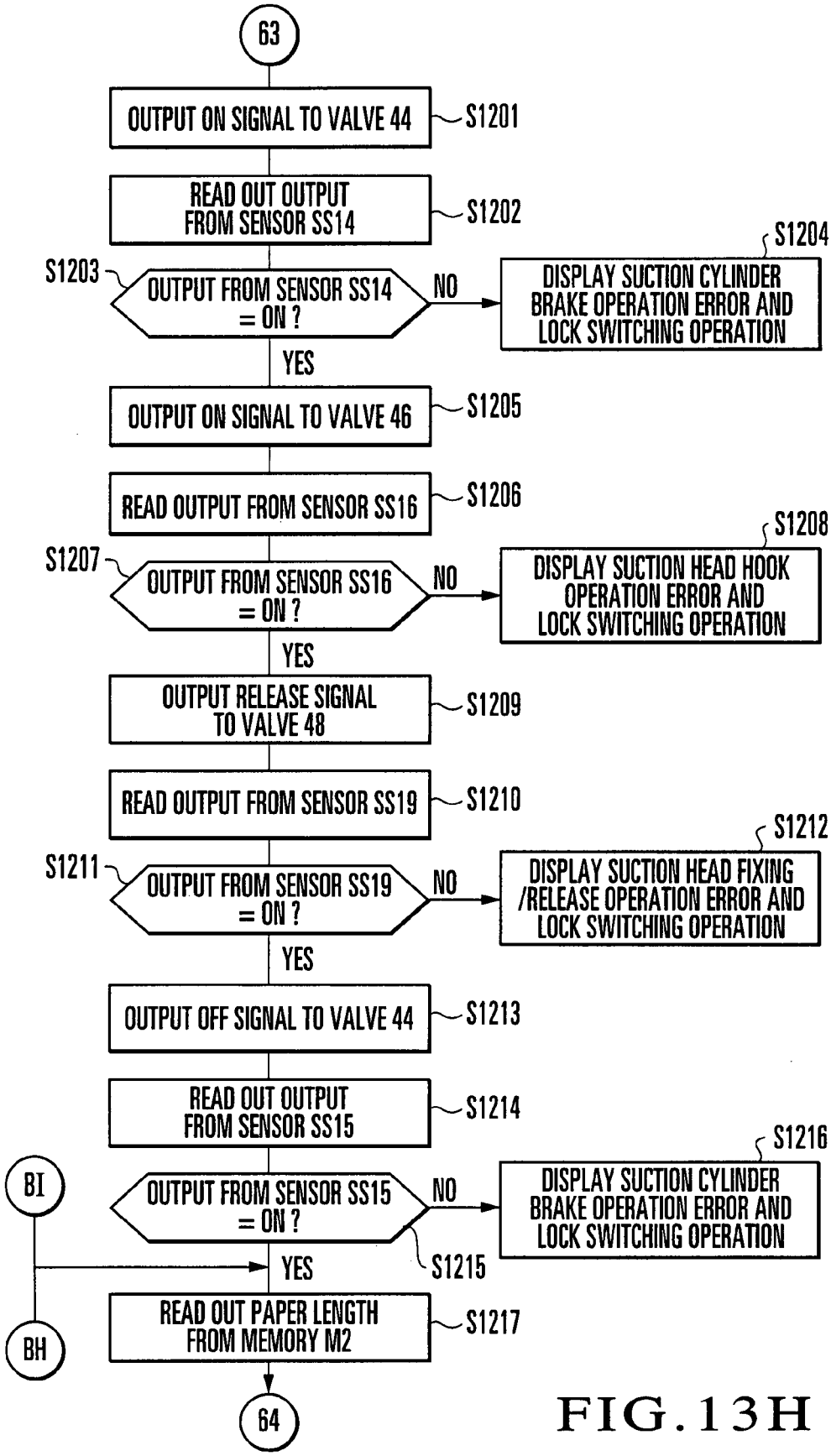
Figure 13I:
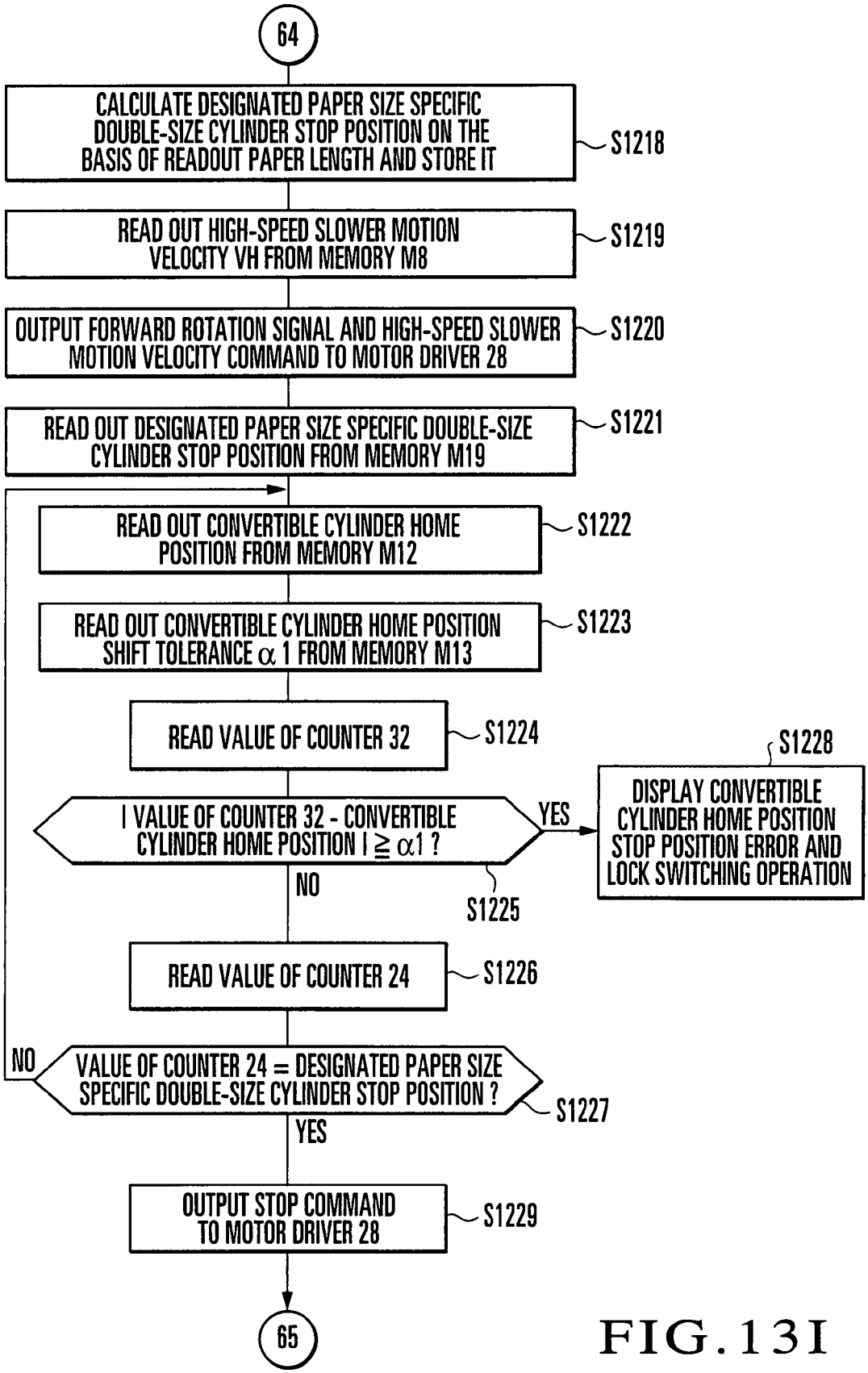
Figure 13J:
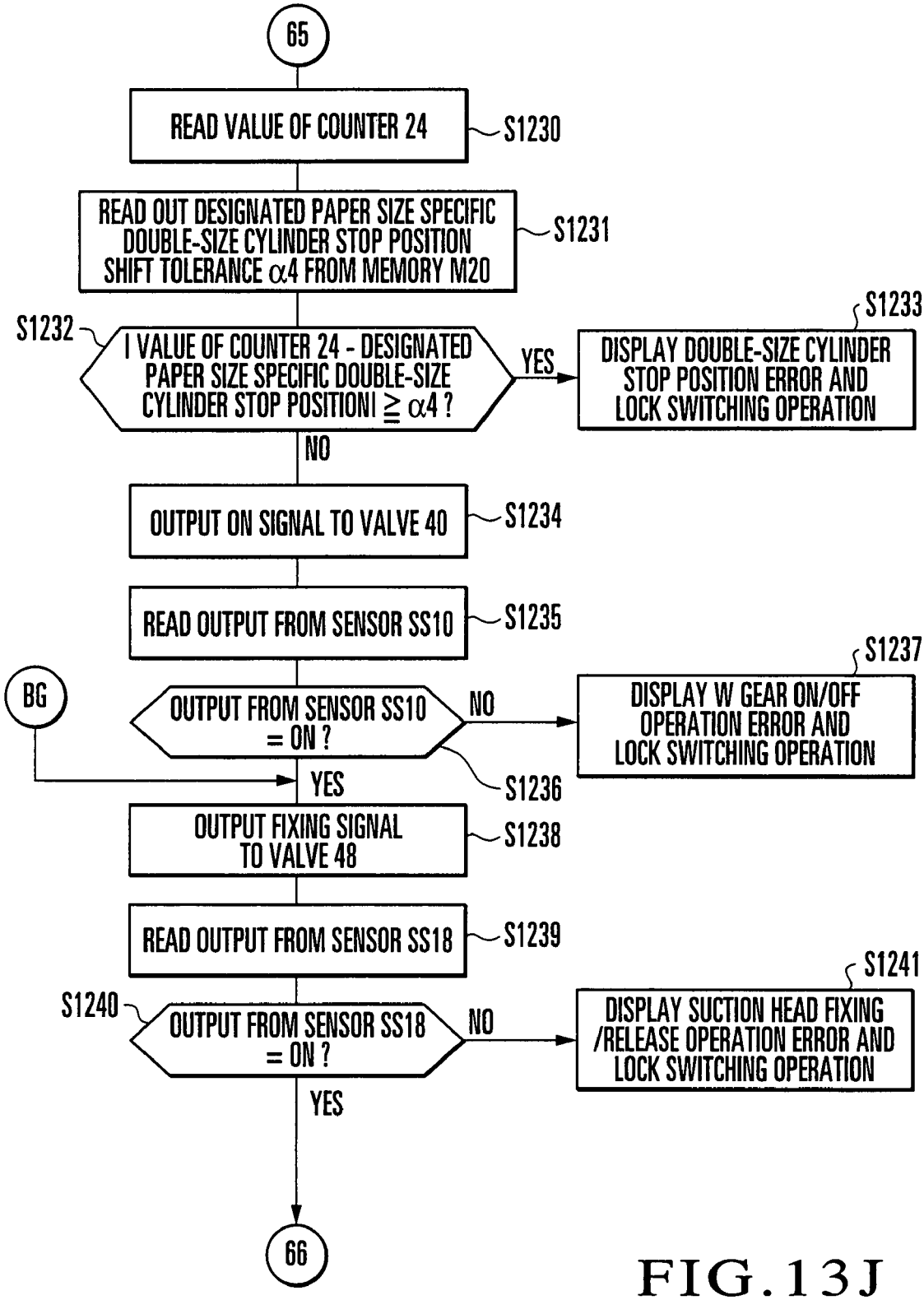
Figure 13K:
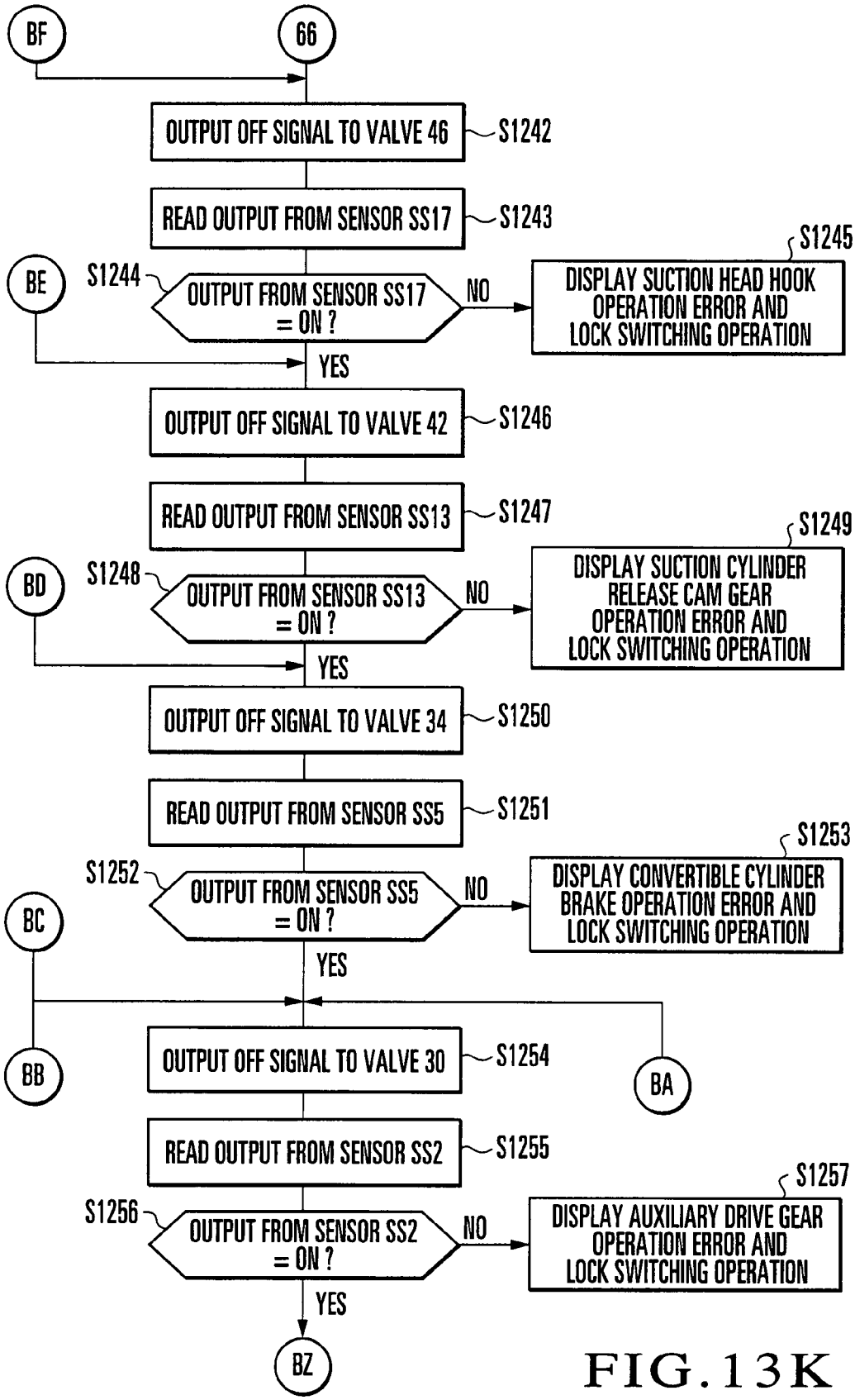

After the auxiliary drive motor 26 stops, the CPU 10 reads the value of the upstream cylinder position detection counter 24 (step S1198$_1$) and reads out the suction head fixing/release position shift tolerance a3 from the memory M18 (step S1198$_2$). If the absolute value of the difference between the value of the upstream cylinder position detection counter 24 and the suction head fixing/release position is smaller than the suction head fixing/release position shift tolerance a3 (NO in step S1199), the CPU 10 outputs an ON signal to the suction cylinder brake ON/OFF air cylinder valve 44 (FIG. 13H: step S1201).

The CPU 10 reads the output from the suction cylinder brake ON sensor SS14 (step S1202). If the output from the suction cylinder brake ON sensor SS14 is ON (YES in step S1203), the CPU 10 outputs an ON signal to the suction head hook ON/OFF air cylinder valve 46 (step S1205) and reads the output from the suction head hook ON sensor SS16 (step S1206). If the output from the suction head hook ON sensor SS16 is ON (YES in step S1207), the CPU 10 outputs a release signal to suction head fixing/release air cylinder valve 48 (step S1209) and reads the output from the suction head release sensor SS19 (step S1210).

If the output from the suction head release sensor SS19 is ON (YES in step S1211), the CPU 10 outputs an OFF signal to the suction cylinder brake ON/OFF air cylinder valve 44 (step S1213) and reads the output from the suction cylinder brake OFF sensor SS15 (step S1214). If the output from the suction cylinder brake OFF sensor SS15 is ON (YES in step S1215), the CPU 10 reads out the paper length L from the memory M12 (step S1217).

The CPU 10 calculates a designated paper size specific double-size cylinder stop position on the basis of the paper length L read out from the memory M12, writes it in the memory M19 (FIG. 13I: step S1218), and rotates the auxiliary drive motor 26 in the forward direction at the high-speed slower motion velocity VH (steps S1219 and S1220). The CPU 10 keeps confirming that the convertible cylinder 3 is at the home position. When the value of the upstream cylinder position detection counter 24 matches the designated paper size specific double-size cylinder stop position (YES in step S1227), the CPU 10 outputs a stop command to the motor driver 28 for the auxiliary drive motor (step S1229) to stop rotating the auxiliary drive motor 26.

After the auxiliary drive motor 26 stops, the CPU 10 reads the value of the upstream cylinder position detection counter 24 (FIG. 13J: step S1230) and reads out the designated paper size specific double-size cylinder stop position shift tolerance a4 from the memory M20 (step S1231). If the absolute value of the difference between the value of the upstream cylinder position detection counter 24 and the designated paper size specific double-size cylinder stop position is smaller than the designated paper size specific double-size cylinder stop position shift tolerance $\alpha$4 (NO in step S1232), the CPU 10 outputs an ON signal to the W gear ON/OFF air cylinder valve 40 (step S1234).

The CPU 10 reads the output from the W gear ON sensor SS10 (step S1235). If the output from the W gear ON sensor SS10 is ON (YES in step S1236), the CPU 10 outputs a fixing signal to the suction head fixing/release air cylinder valve 48 (step S1238) and reads the output from the suction head fixing sensor SS18 (step S1239). If the output from the suction head fixing sensor SS18 is ON (YES in step S1240), the CPU 10 outputs an OFF signal to the suction head hook ON/OFF air cylinder valve 46 (FIG. 13K: step S1242) and reads the output from the suction head hook OFF sensor SS17 (step S1243).

If the output from the suction head hook OFF sensor SS17 is ON (YES in step S1244), the CPU 10 outputs an OFF signal to the suction cylinder release cam gear ON/OFF air cylinder valve 42 (step S1246) and reads the output from the suction cylinder release cam gear OFF sensor SS13 (step S1247). If the output from the suction cylinder release cam gear OFF sensor SS13 is ON (YES in step S1248), the CPU 10 outputs an OFF signal to the convertible cylinder brake ON/OFF air cylinder valve 34 (step S1250) and reads the output from the convertible cylinder brake OFF sensor SS5 (step S1251).

If the output from the convertible cylinder brake OFF sensor SS5 is ON (YES in step S1252), the CPU 10 outputs an OFF signal to the auxiliary drive gear ON/OFF air cylinder valve 30 (step S1254) and reads the output from the auxiliary drive gear OFF sensor SS2 (step S1255). If the output from the auxiliary drive gear OFF sensor SS2 is ON (YES in step S1256), the process returns to step S102 in the flowchart in FIG. 8A. The printing state of the printing press returns to the state (double-sided printing state) before the start of automatic switching.

In the above-described operation, if the ON state of the output from the convertible cylinder A-gripper release sensor SS9 is not confirmed in step S1103 (FIG. 13A), the CPU 10 determines it as a convertible cylinder A-gripper fixing/release operation error, displays it, and locks the switching operation (step S1104). Similarly, upon determining an error in any other step, the CPU 10 displays it and locks the switching operation. In this case, the operator manually returns the mode to the single-sided printing state.

[Automatic Return from Other Double-Side Return Operation Steps]

A case wherein the memory M25 stores "1" has been described above. When the memory M25 stores "2", the CPU 10 starts automatic return from the double-side return operation step "R2-2" (FIG. 13A: step S1105) to the double-sided printing state. When the memory M25 stores "3", the CPU 10 starts automatic return from the double-side return operation step "R2-3" (FIG. 13A: step S1109) to the double-sided printing state. When the memory M25 stores "4", the CPU 10 starts automatic return from the double-side return operation step "R2-4" (FIG. 13A: step S1113) to the double-sided printing state.

When the memory M25 stores "5" or "6", the CPU 10 starts automatic return from the double-side return operation step "R2-5" (FIG. 13B: step S1117) to the double-sided printing state. When the memory M25 stores "7", the CPU 10 starts automatic return from the double-side return operation step "R2-8" (FIG. 13C: step S1135) to the double-sided printing state. When the memory M25 stores "8", the CPU 10 starts automatic return from the double-side return operation step "R2-9" (FIG. 13C: step S1139) to the double-sided printing state. When the memory M25 stores "9", the CPU 10 starts automatic return from the double-side return operation step "R2-10" (FIG. 13C: step S1143) to the double-sided printing state. When the memory M25 stores "10" or "11", the CPU 10 starts automatic return from the double-side return operation step "R2-11" (FIG. 13D: step S1147) to the double-sided printing state. When the memory M25 stores "12" or "13", the CPU 10 starts automatic return from the double-side return operation step "R2-16" (FIG. 13G: step S1187) to the double-sided printing state.

When the memory M25 stores "14" or "15", the CPU 10 starts automatic return from the double-side return operation step "R2-21" (FIG. 13H: step S1217) to the double-sided printing state. When the memory M25 stores "16", the CPU 10 starts automatic return from the double-side return operation step "R2-23" (FIG. 13J: step S1238) to the double-sided printing state. When the memory M25 stores "17", the CPU 10 starts automatic return from the double-side return operation step "R2-24" (FIG. 13K: step S1242) to the double-sided printing state. When the memory M25 stores "18", the CPU 10 starts automatic return from the double-side return operation step "R2-25" (FIG. 13K: step S1246) to the double-sided printing state. When the memory M25 stores "19", the CPU 10 starts automatic return from the double-side return operation step "R2-26" (FIG. 13K: step S1250) to the double-sided printing state. When the memory M25 stores "20", "21", or "22", the CPU 10 starts automatic return from the double-side return operation step "R2-27" (FIG. 13K: step S1254) to the double-sided printing state.

When the memory M25 stores "101" or "102", the CPU 10 sets the double-side return operation step "R2-F" as the double-side return starting step and forcedly terminates automatic switching to the single-sided printing state in the order of "convertible cylinder brake OFF" and "auxiliary drive gear OFF", instead of automatic return to the double-sided printing state.

Figure 13L:
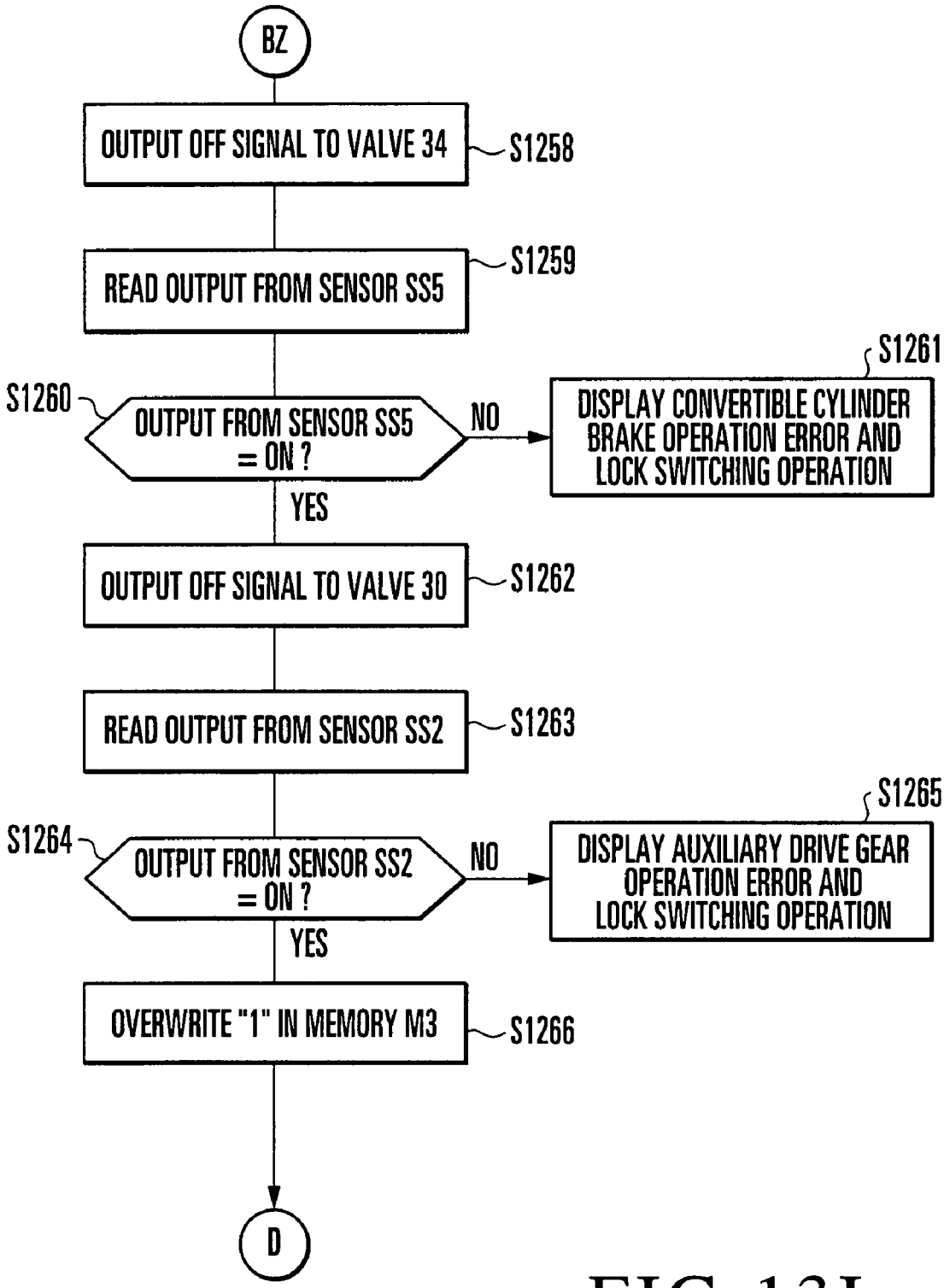

FIG. 13L shows the forced termination process during automatic switching from the double-side return operation step "R2-F" to the single-sided printing state. When the memory M25 stores "101" or "102", the CPU 10 advances to step S1258 in the flowchart in FIG. 13L.

In this case, the CPU 10 outputs an OFF signal to the convertible cylinder brake ON/OFF air cylinder valve 34 (step S1258) and reads the output from the convertible cylinder brake OFF sensor SS5 (step S1259). If the output from the convertible cylinder brake OFF sensor SS5 is ON (YES in step S1260), the CPU 10 outputs an OFF signal to the auxiliary drive gear ON/OFF air cylinder valve 30 (step S1262) and reads the output from the auxiliary drive gear OFF sensor SS2 (step S1263). If the output from the auxiliary drive gear OFF sensor SS2 is ON (YES in step S1264), the CPU 10 rewrites the contents of the previous double-sided printing/double-sided printing memory M3 to "1" (step S1266).

[Automatic Change (Automatic Switching) of Paper Size in Double-Sided Printing State]

Assume that the paper size should change in the current double-sided printing state. In this case, the operator inputs the paper length L after change and turns on the switching start switch 18.

When the operator turns on the switching start switch 18 (FIG. 8A: YES in step S108), the CPU 10 reads out the contents of the single-sided printing/double-sided printing memory M1 (step S109). In this case, the CPU 10 reads out "2" from the memory M1.

Figure 14A:
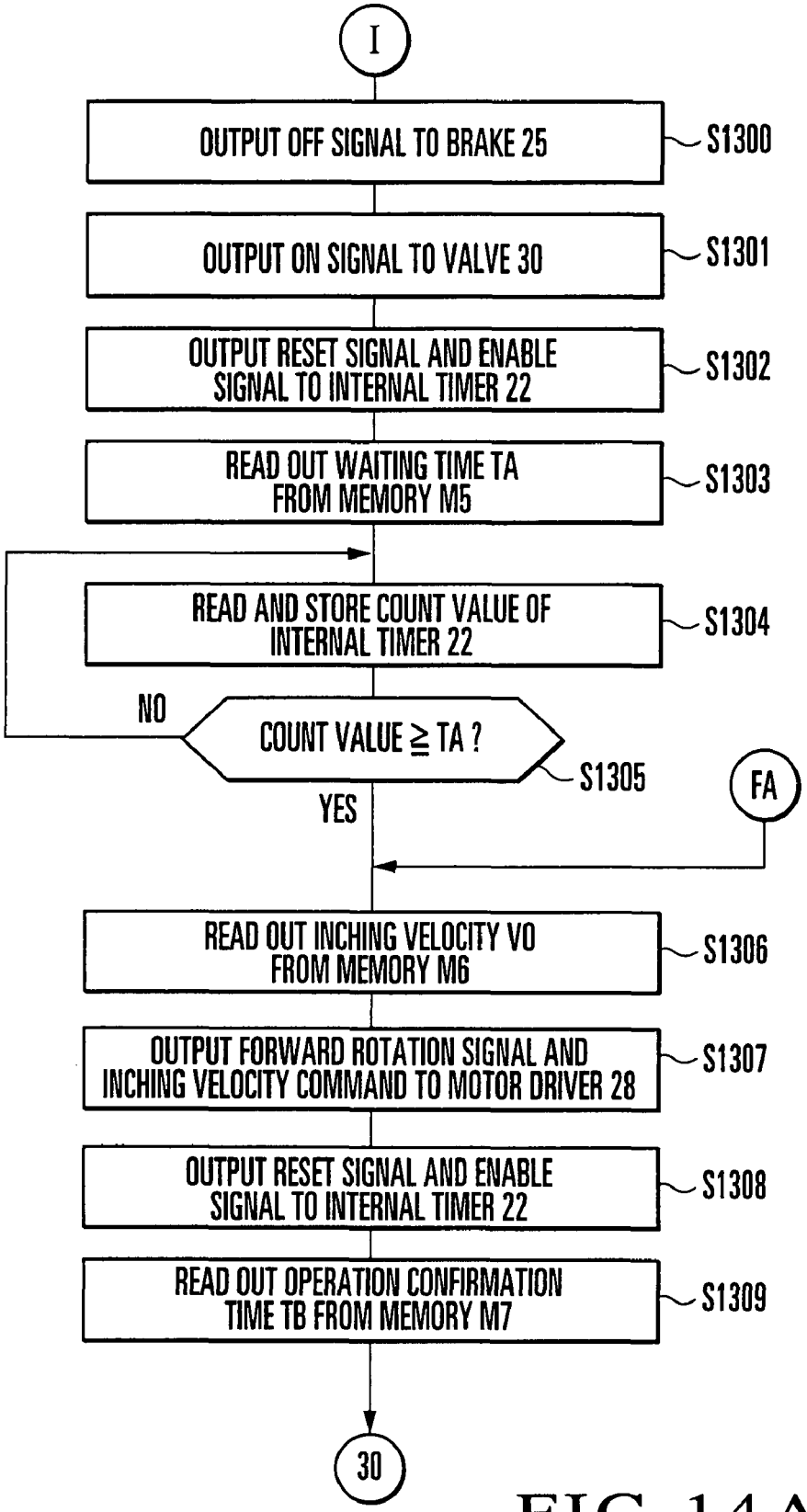
FIGS. 14A to 14J are flowcharts for explaining an automatic change (automatic switching) operation of a paper size in a double-sided printing state following FIG. 8A.
Figure 14B:
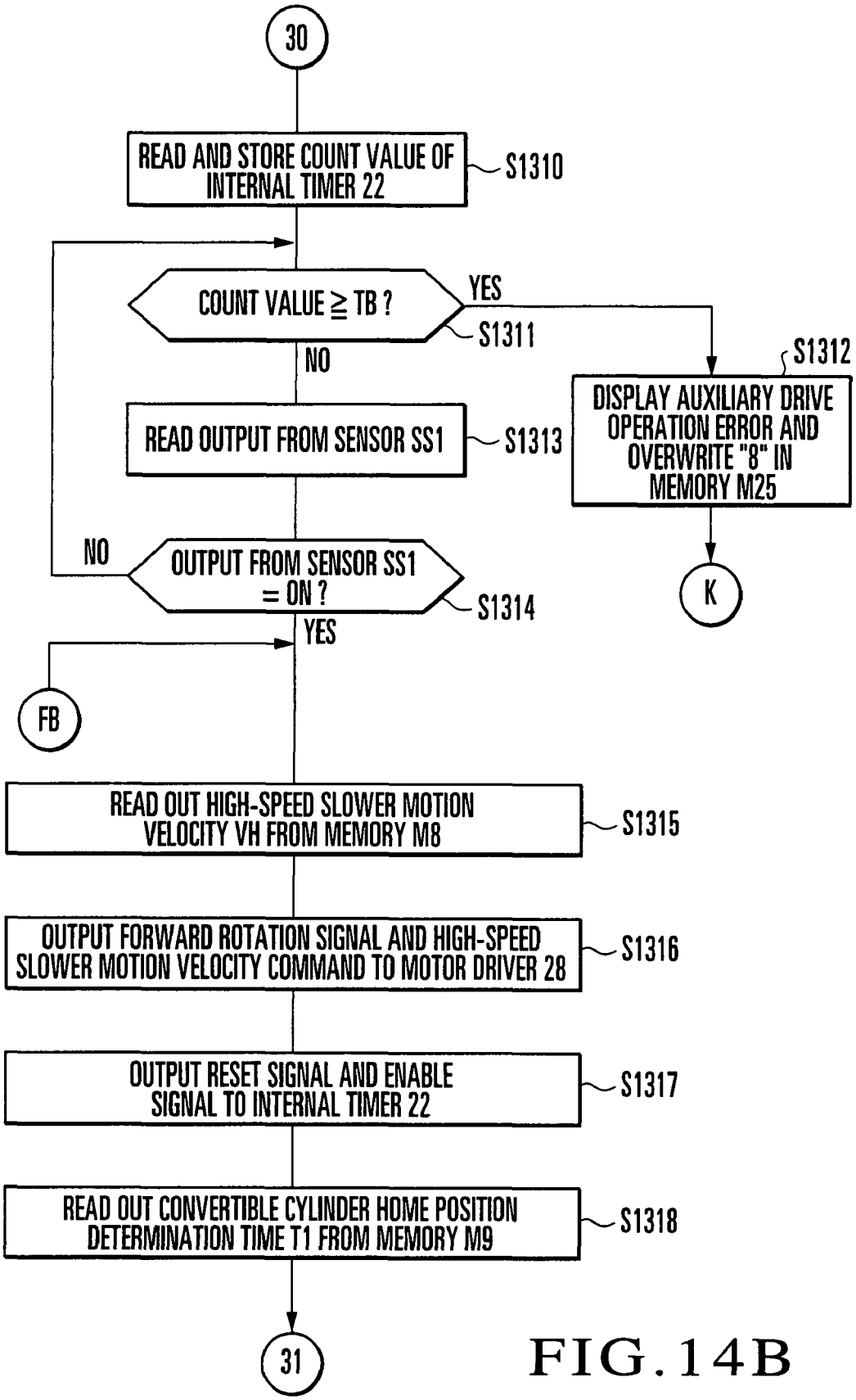
Figure 14C:
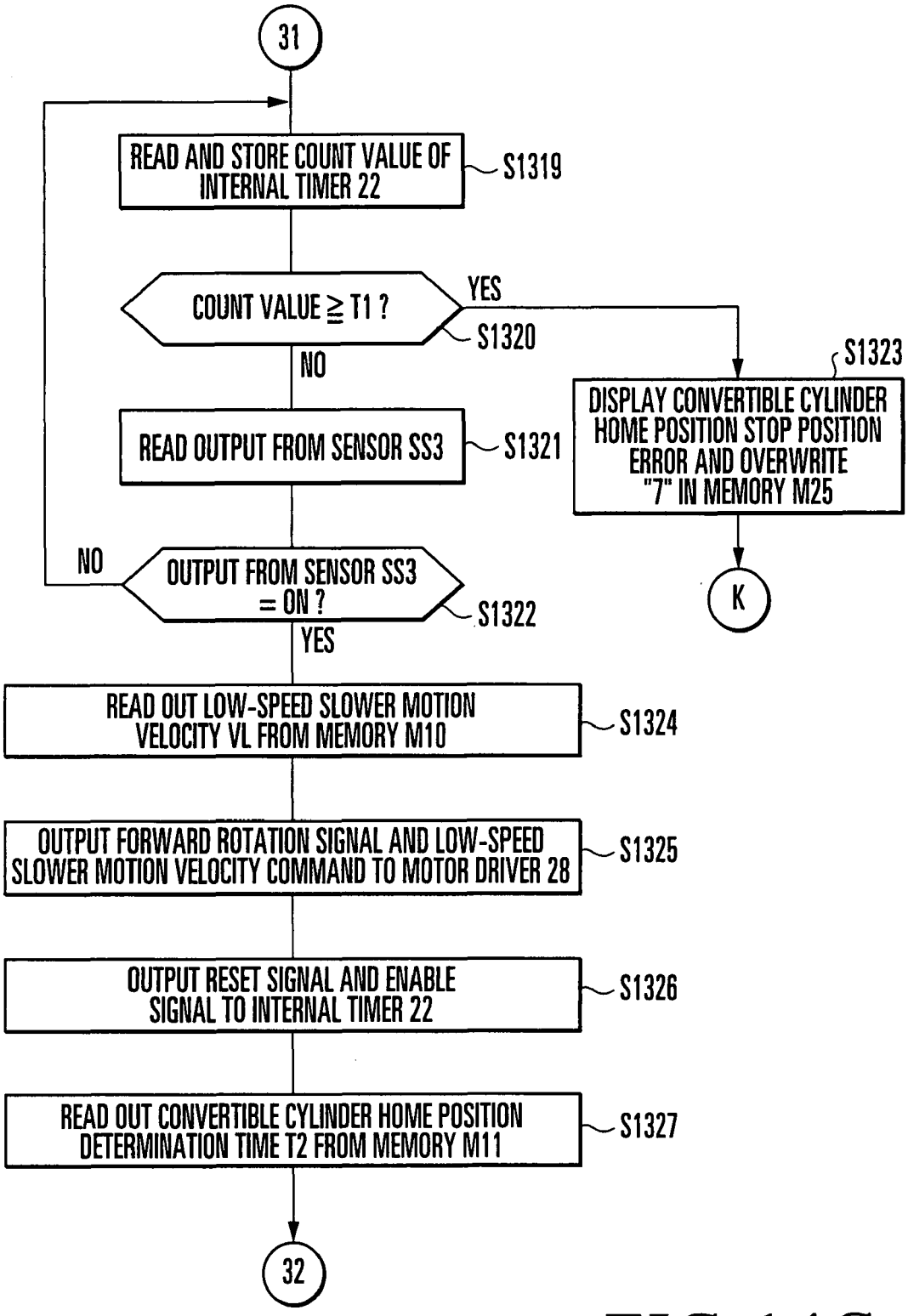
Figure 14D:
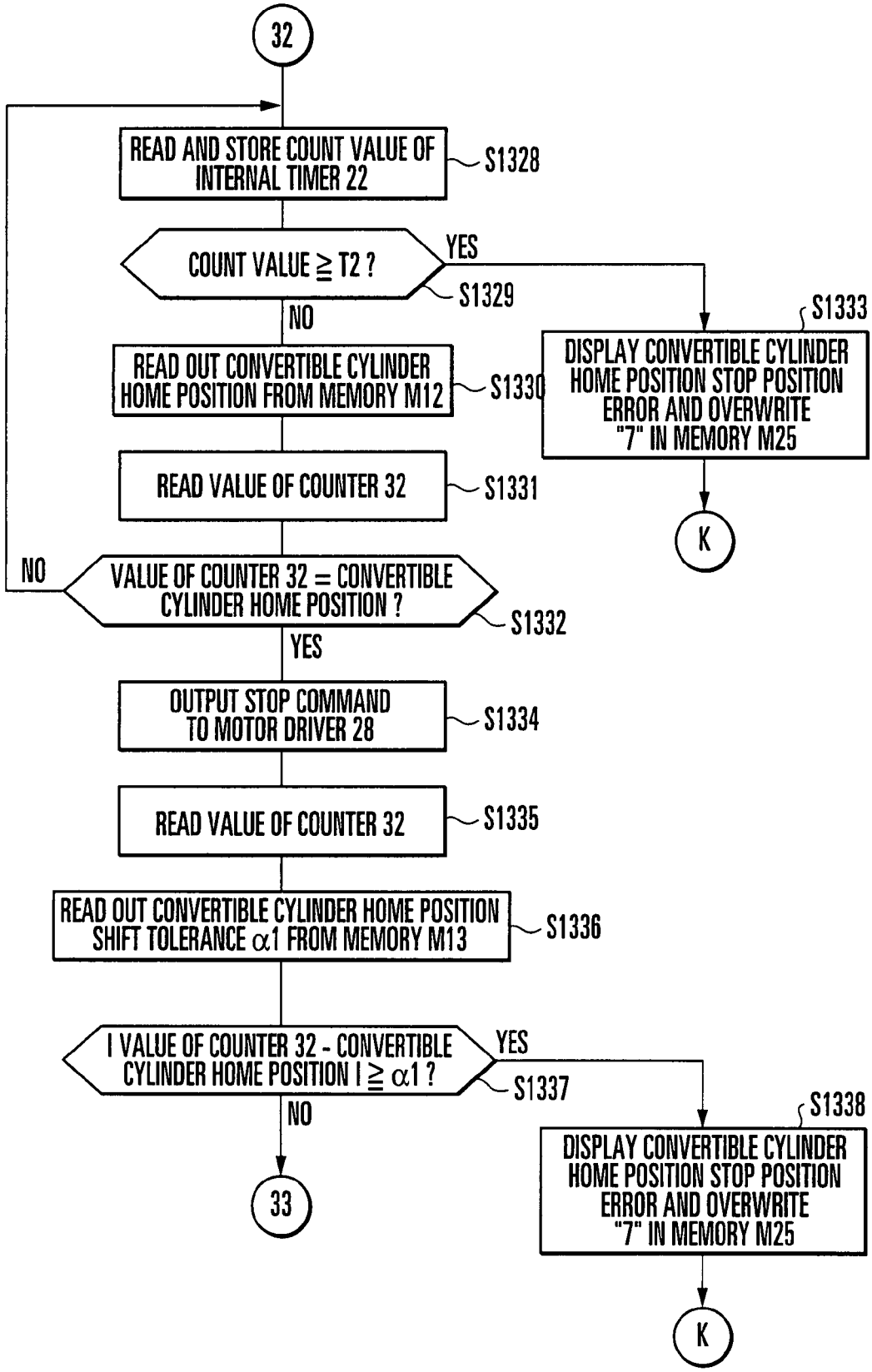

The CPU 10 confirms that the memory M1 stores "2" (YES in step S110), reads out the contents of the previous single-sided printing/double-sided printing memory M3 (step S113), and checks the contents (step S114). In this case, "2" is written in the memory M3 as the previous printing state. Since NO in step S114, the CPU 10 advances to step S1300 (FIG. 14A).

In step S1300, the CPU 10 outputs an OFF signal to the drive motor brake 25 to release the brake on the drive motor. The CPU 10 outputs an ON signal to the auxiliary drive gear ON/OFF air cylinder valve 30 (step S1301) to actuate the auxiliary drive gear ON/OFF air cylinder 29. The operation in step S1302 to S1341 (FIGS. 14A to 14E) is the same as the above-described operation in steps S120 to S159 (FIGS. 8B to 8F) in the automatic switching from the single-sided printing state to the double-sided printing state, and a description thereof will not be repeated. In this operation, in step S1312, "8" is written in the memory M25 as an error number. In steps S1323, S1333, and S1338, "7" is written in the memory M25 as an error number. In step S1342, "6" is written in the memory M25 as an error number.

If the output from the convertible cylinder brake ON sensor SS4 is ON in step S1341 (FIG. 14E), the CPU 10 outputs an OFF signal to the W gear ON/OFF air cylinder valve 40 (step S1343) and reads the output from the W gear OFF sensor SS11 (step S1344). If the ON state of the output from the W gear OFF sensor SS11 is not confirmed (NO in step S1345), the CPU 10 determines it as a W gear ON/OFF operation error, displays it, and writes "5" in the memory M25 as an error number (step S1346).

Figure 14E:
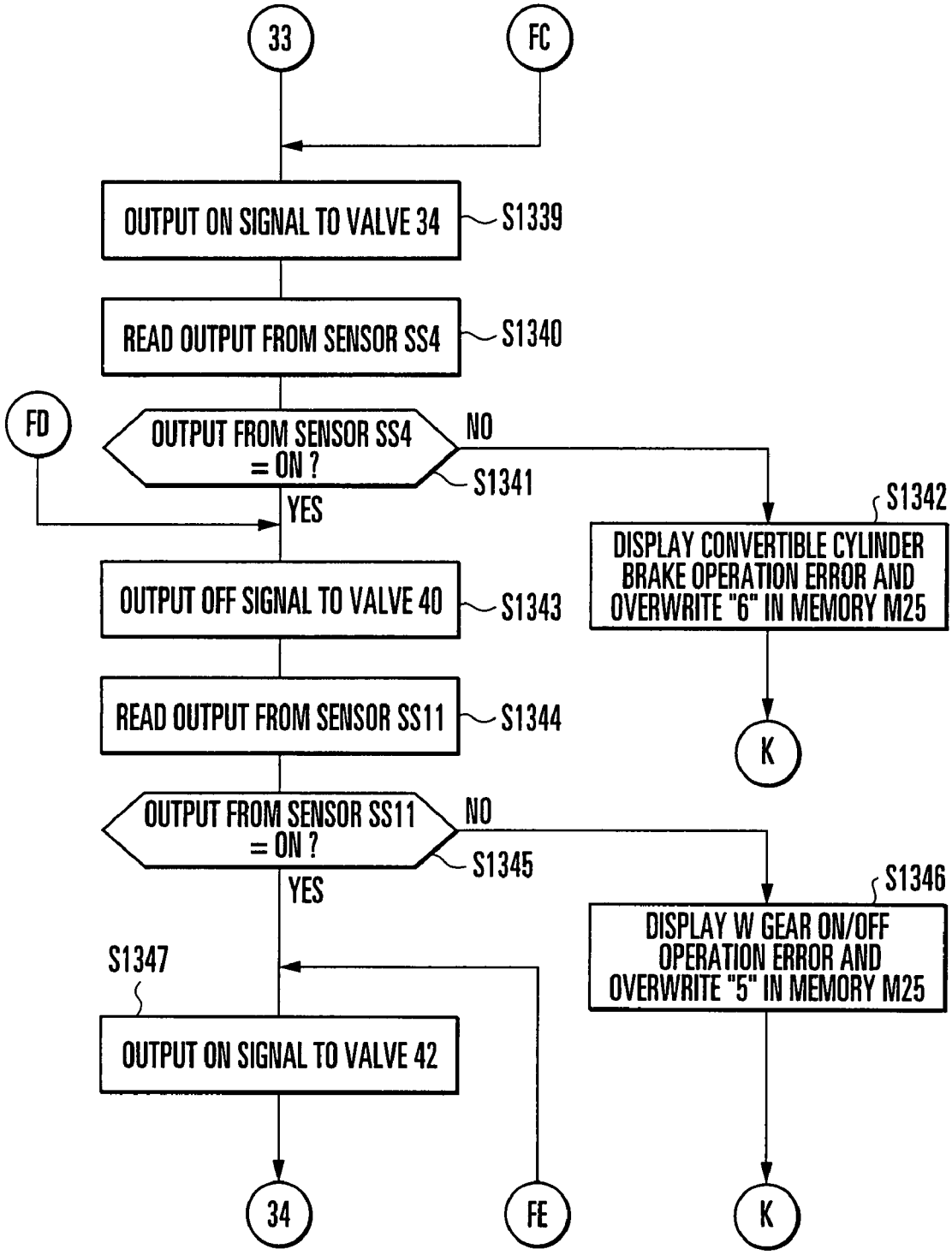
Figure 14F:
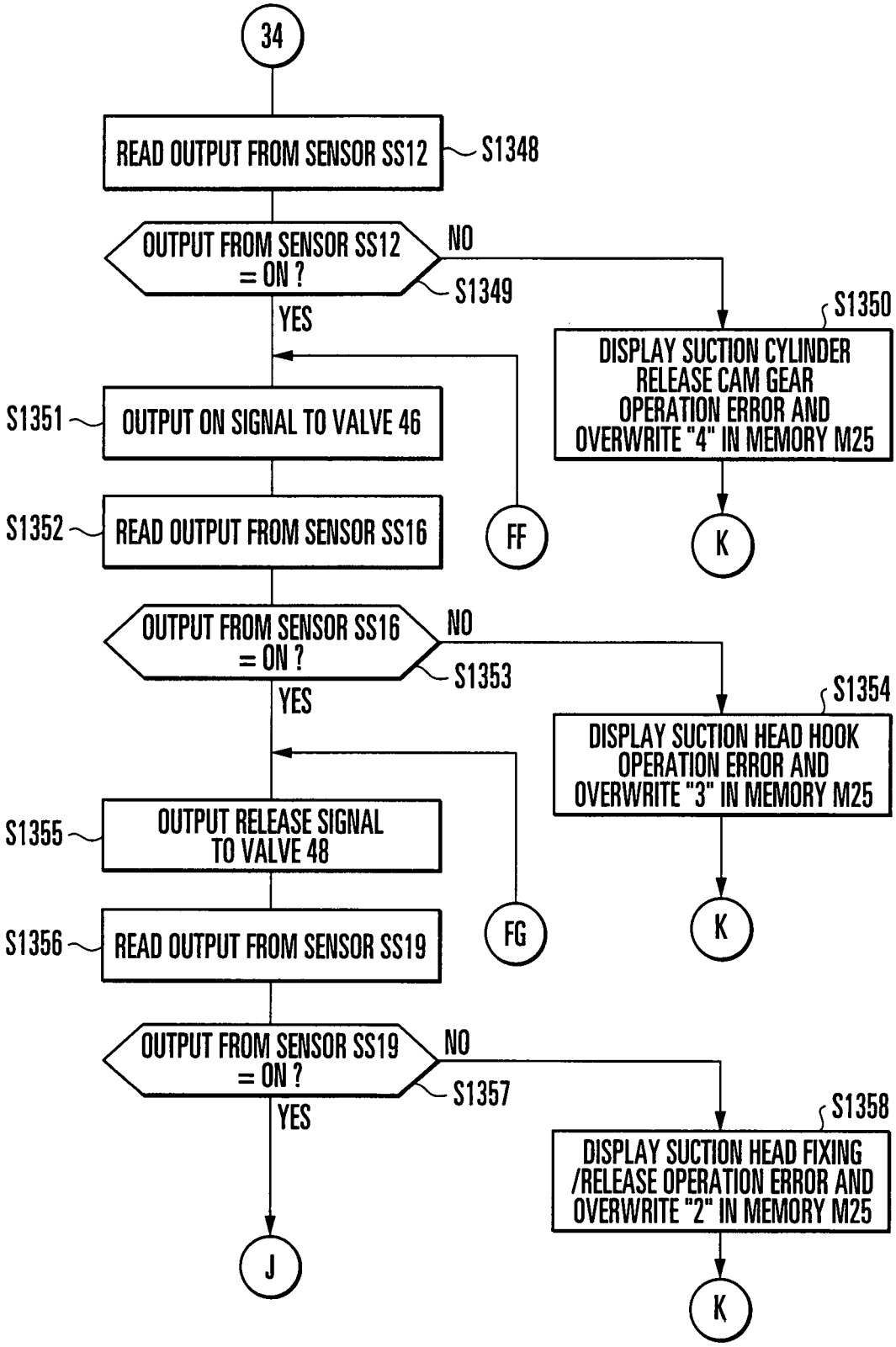
Figure 14G:
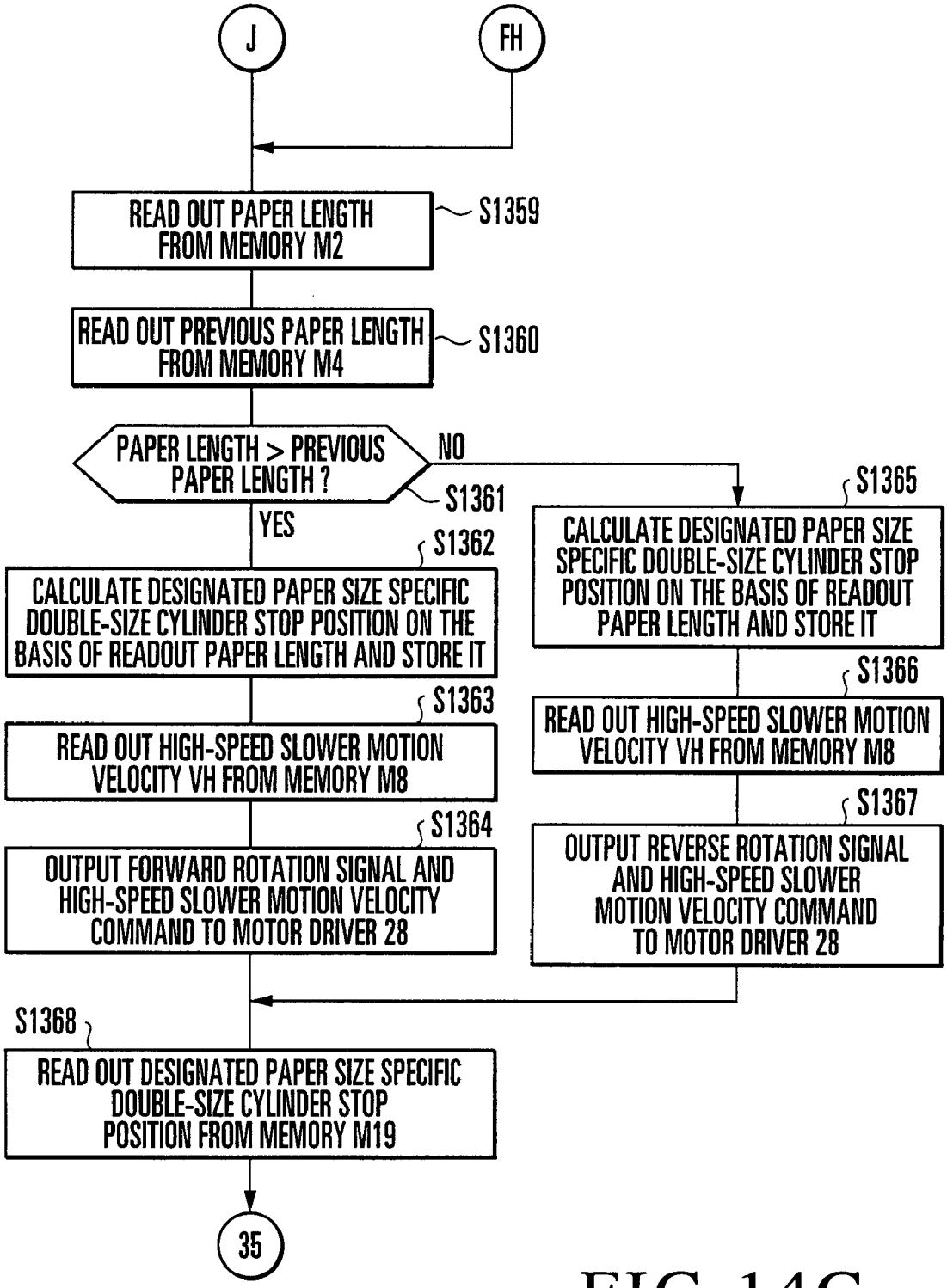
Figure 14H:
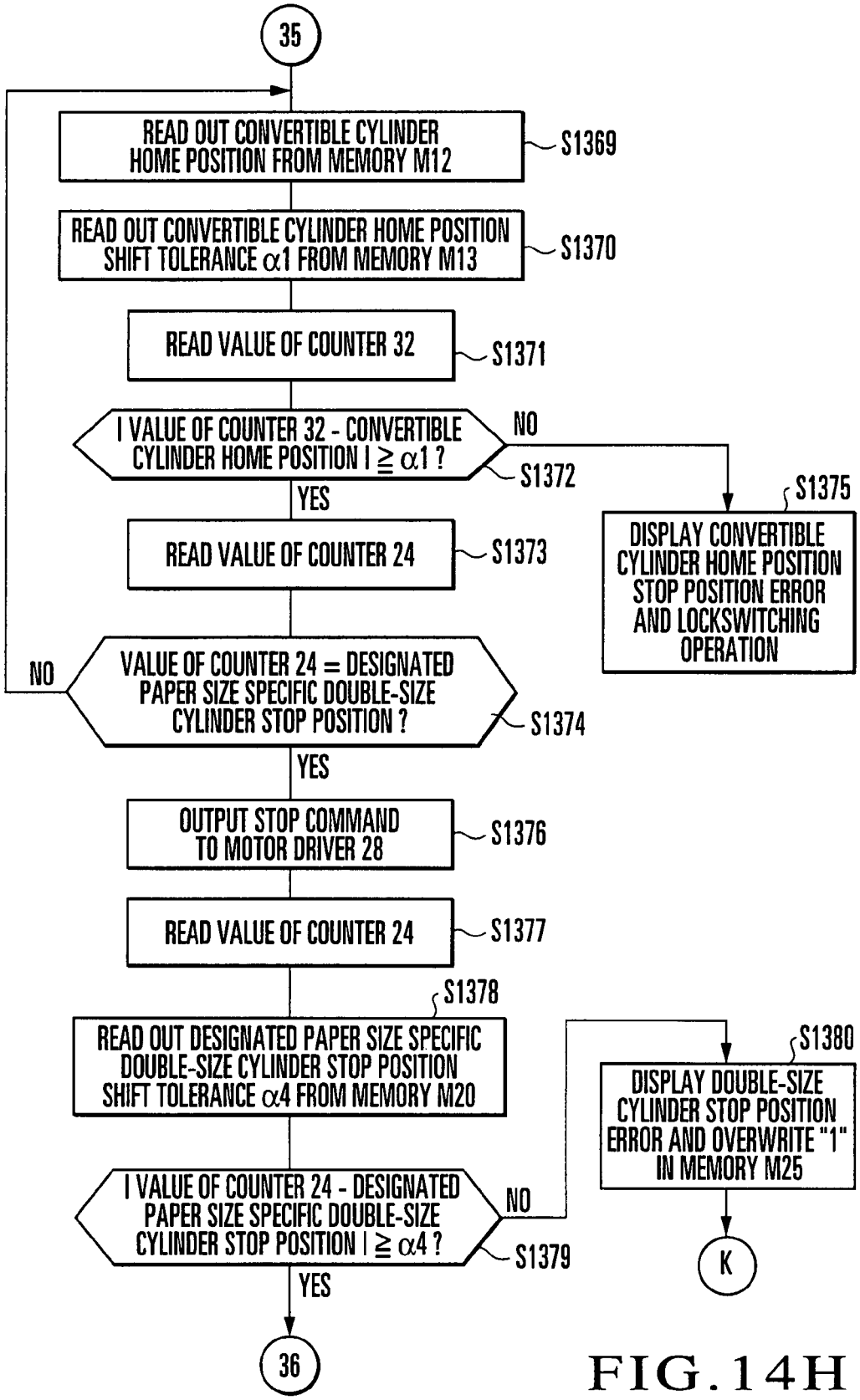
Figure 14I:
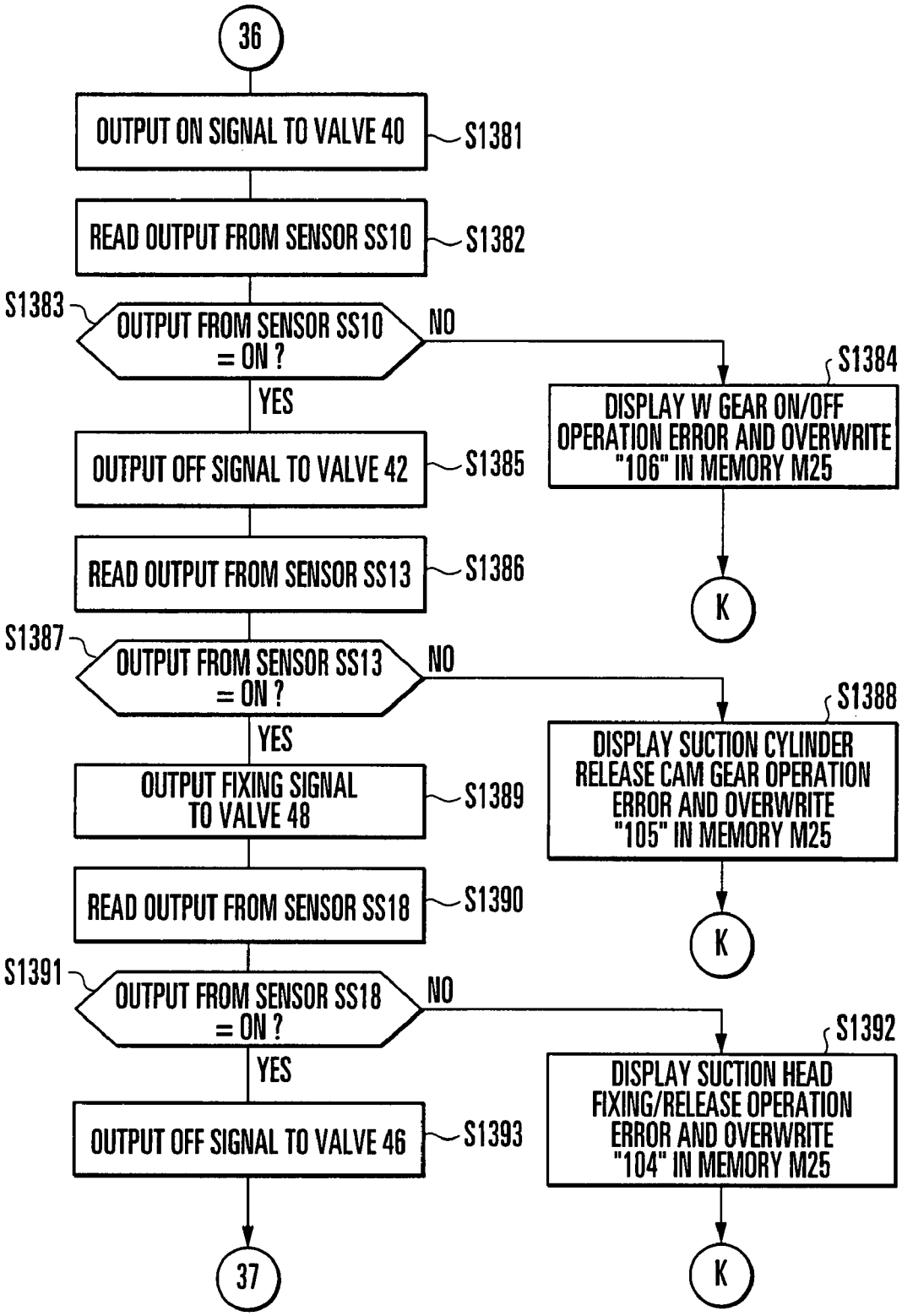
Figure 14J:
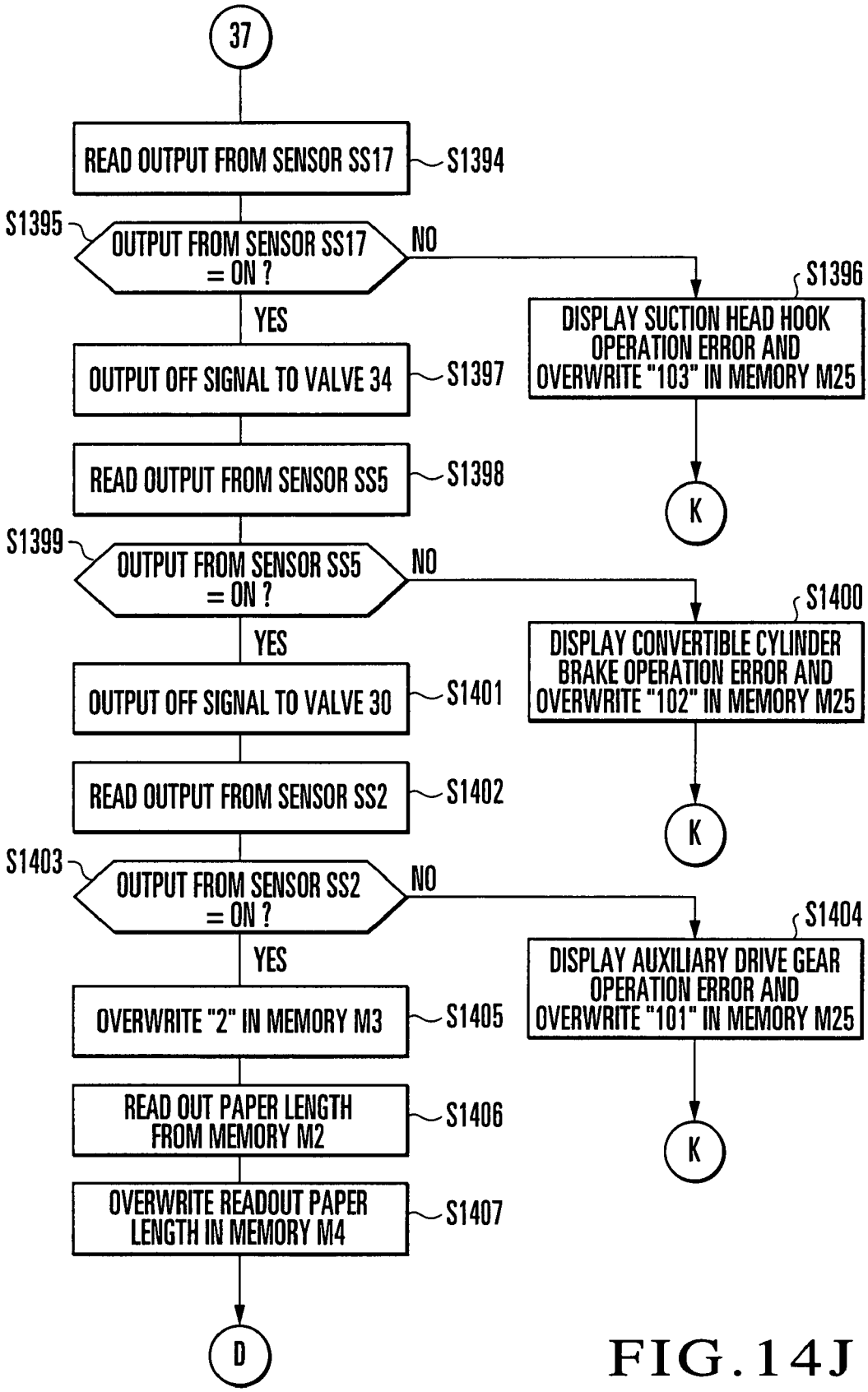

If the output from the W gear OFF sensor SS11 is ON (YES in step S1345), the CPU 10 outputs an ON signal to the suction cylinder release cam gear ON/OFF air cylinder valve 42 (step S1347) and reads the output from the suction cylinder release cam gear ON sensor SS12 (FIG. 14F: step S1348). If the ON state of the output from the suction cylinder release cam gear ON sensor SS12 is not confirmed (NO in step S1349), the CPU 10 determines it as a suction cylinder release cam gear operation error, displays it, and writes "4" in the memory M25 as an error number (step S1350).

If the output from the suction cylinder release cam gear ON sensor SS12 is ON (YES in step S1349), the CPU 10 outputs an ON signal to the suction head hook ON/OFF air cylinder valve 46 (step S1351) and reads the output from the suction head hook ON sensor SS16 (step S1352). If the ON state of the output from the suction head hook ON sensor SS16 is not confirmed (NO in step S1353), the CPU 10 determines it as a suction head hook operation error, displays it, and writes "3" in the memory M25 as an error number (step S1354).

If the output from the suction head hook ON sensor SS16 is ON (YES in step S1353), the CPU 10 outputs a release signal to the suction head fixing/release air cylinder valve 48 (step S1355) and reads the output from the suction head release sensor SS19 (step S1356). If the ON state of the output from the suction head release sensor SS19 is not confirmed (NO in step S1357), the CPU 10 determines it as a suction head fixing/release operation error, displays it, and writes "2" in the memory M25 as an error number (step S1358).

If the output from the suction head release sensor SS19 is ON (YES in step S1357), the CPU 10 reads out the paper length L (current paper length) from the memory M2 (FIG. 14G: step S1359) and the previous paper length L (previous paper length) from the memory M4 (step S1360) and compares the current paper length with the previous paper length (step S1361).

If the current paper length is longer than the previous paper length (YES in step S1361), the CPU 10 calculates the designated paper size specific double-size cylinder stop position on the basis of the current paper length and stores it in the memory M19 (step S1362). The CPU 10 reads out the auxiliary drive motor high-speed slower motion velocity VH from the memory M8 (step S1363) and outputs a forward rotation signal and a high-speed slower motion velocity command to the motor driver 28 for the auxiliary drive motor (step S1364). The auxiliary drive motor 26 starts rotating in the forward direction at the high-speed slower motion velocity VH.

If the current paper length is shorter than the previous paper length (NO in step S1361), the CPU 10 calculates the designated paper size specific double-size cylinder stop position on the basis of the current paper length and stores it in the memory M19 (step S1365). The CPU 10 reads out the auxiliary drive motor high-speed slower motion velocity VH from the memory M8 (step S1366) and outputs a reverse rotation signal and a high-speed slower motion velocity command to the motor driver 28 for the auxiliary drive motor (step S1367). The auxiliary drive motor 26 starts rotating in the reverse direction at the high-speed slower motion velocity VH.

The operation in step S1368 to S1407 (FIGS. 14G to 14J) is the same as the above-described operation in steps S301 to S340 (FIGS. 8Q to 8T) in the automatic switching from the single-sided printing state to the double-sided printing state, and a description thereof will not be repeated. In this operation, in step S1380, "1" is written in the memory M25 as an error number. In step S1384, "106" is written in the memory M25 as an error number. In step S1388, "105" is written in the memory M25 as an error number. In step S1392, "104" is written in the memory M25 as an error number. In step S1396, "103" is written in the memory M25 as an error number. In step S1400, "102" is written in the memory M25 as an error number. In step S1404, "101" is written in the memory M25 as an error number.

Table 7 shows the relationship between switching steps in automatic change of the paper size in the double-sided printing state and the error contents and error numbers in the switching operation. Table 8 shows paper size return operation steps in automatic change of the paper size in the double-sided printing state. Table 9 shows the termination sequence from the paper size return starting step to do double-side forced termination during automatic change of the paper size in the double-sided printing state.

[Error Recovery]

If an error is displayed during the paper size change, the operator turns on the error recovery switch 19. When the error recovery switch 19 is turned on (FIG. 9A: YES in step S341), the CPU 10 turns off the error display (step S342), reads out the contents of the single-sided printing/double-sided printing memory M1 (step S343), and checks the contents of the memory M1 (step S344).

In this case, the memory M1 stores "2". Since YES in step S344, the process advances to step S345 to read out the contents of the previous single-sided printing/double-sided printing memory M3. In this case, the memory M3 also stores "2". Since NO in step S346, the process advances to step S1500A (FIG. 15A) to read out the contents of the error step memory M25.

[Error in Switching Step 8]

If the memory M25 stores "2" (YES in step S1500), indicating an abnormal end of "switching step 8", the CPU 10 outputs a fixing signal to the suction head fixing/release air cylinder valve 48 (step S1501) to eliminate the error in "switching step 8".

[Error in Switching Step 7]

If the memory M25 stores "3" (YES in step S1505), indicating an abnormal end of "switching step 7", the CPU 10 outputs an OFF signal to the suction head hook ON/OFF air cylinder valve 46 (step S1506) to eliminate the error in "switching step 7".

[Error in Switching Step 6]

If the memory M25 stores "4" (YES in step S1510), indicating an abnormal end of "switching step 6", the CPU 10 outputs an OFF signal to the suction cylinder release cam gear ON/OFF air cylinder valve 42 (step S1511) to eliminate the error in "switching step 6".

[Error in Switching Step 5]

Figure 15A:
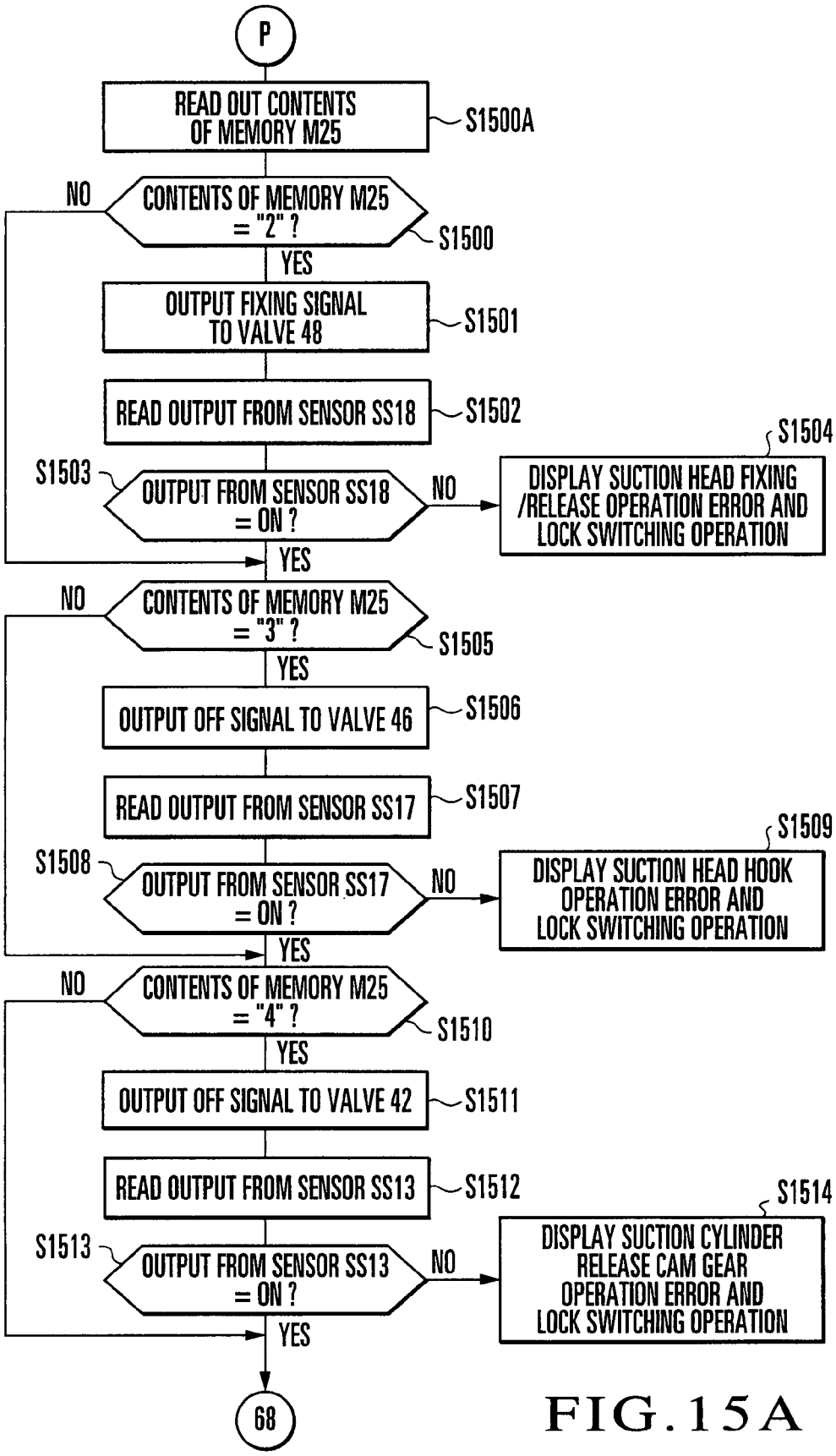
FIGS. 15A to 15F are flowcharts for explaining an error recovery operation (including part of retry and automatic return) during automatic change of the paper size in a double-sided printing state.
Figure 15B:
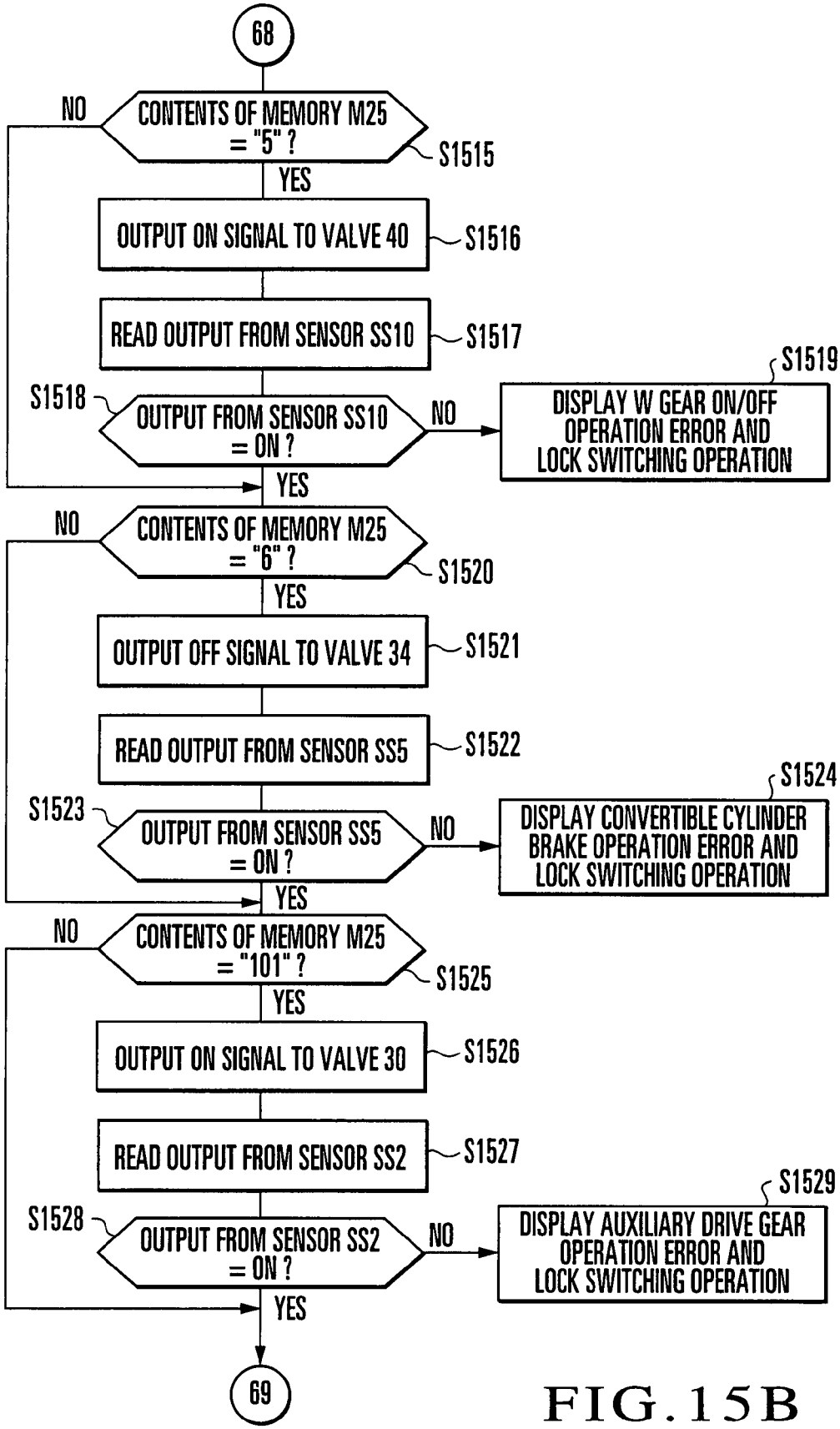

If the memory M25 stores "5" (FIG. 15B: YES in step S1515), indicating an abnormal end of "switching step 5", the CPU 10 outputs an ON signal to the W gear ON/OFF air cylinder valve 40 (step S1516) to eliminate the error in "switching step 5".

[Error in Switching Step 4]

If the memory M25 stores "6" (YES in step S1520), indicating an abnormal end of "switching step 4", the CPU 10 outputs an OFF signal to the convertible cylinder brake ON/OFF air cylinder valve 34 (step S1521) to eliminate the error in "switching step 4".

[Error in Switching Step 15]

If the memory M25 stores "101" (YES in step S1525), indicating an abnormal end of "switching step 15", the CPU 10 outputs an ON signal to the auxiliary drive gear ON/OFF air cylinder valve 30 (step S1526) to eliminate the error in "switching step 15".

[Error in Switching Step 14]

Figure 15C:
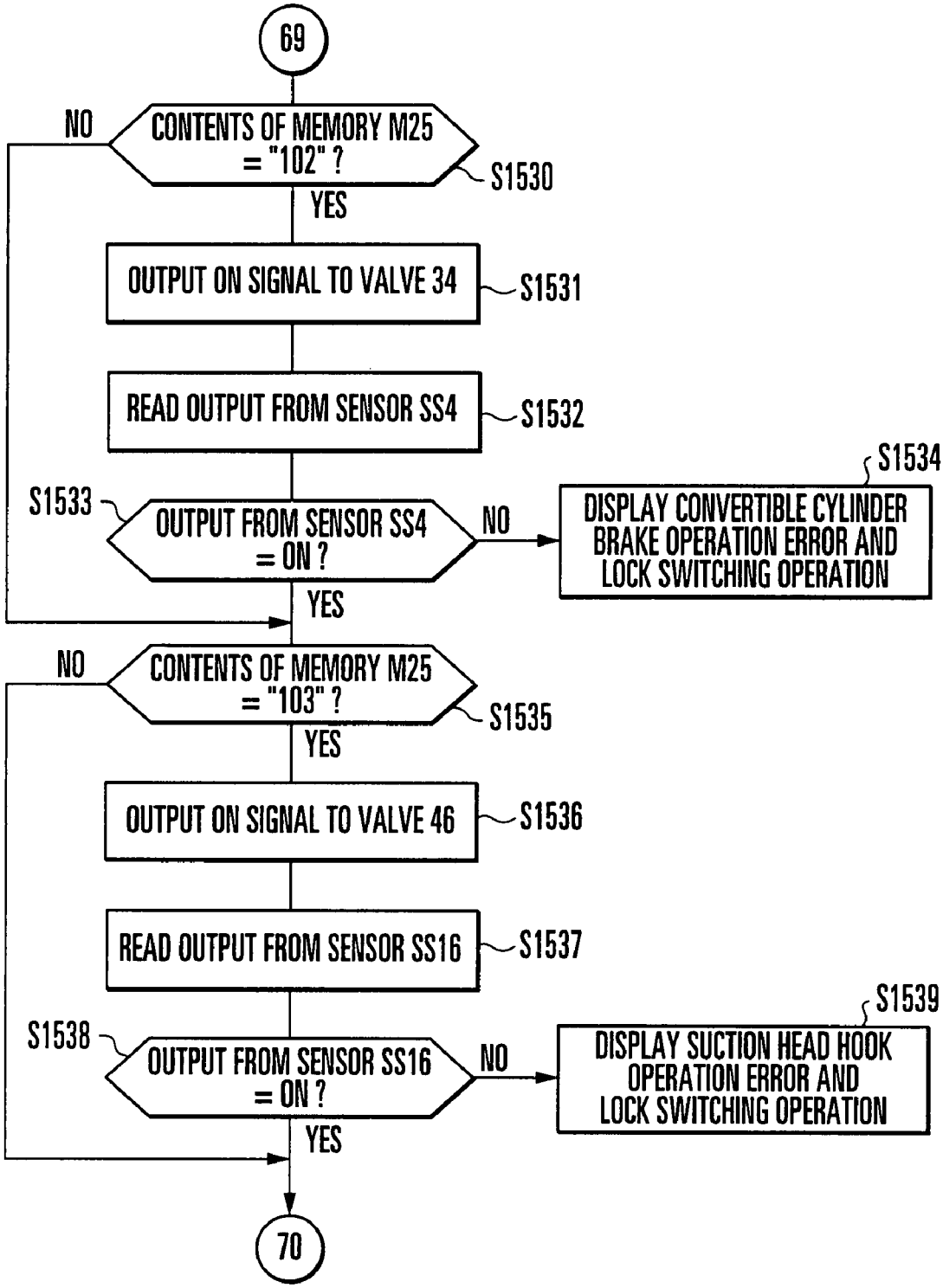

If the memory M25 stores "102" (FIG. 15C: YES in step S1530), indicating an abnormal end of "switching step 14", the CPU 10 outputs an ON signal to the convertible cylinder brake ON/OFF air cylinder valve 34 (step S1531) to eliminate the error in "switching step 14".

[Error in Switching Step 13]

If the memory M25 stores "103" (YES in step S1535), indicating an abnormal end of "switching step 13", the CPU 10 outputs an ON signal to the suction head hook ON/OFF air cylinder valve 46 (step S1536) to eliminate the error in "switching step 13".

[Error in Switching Step 12]

Figure 15D:
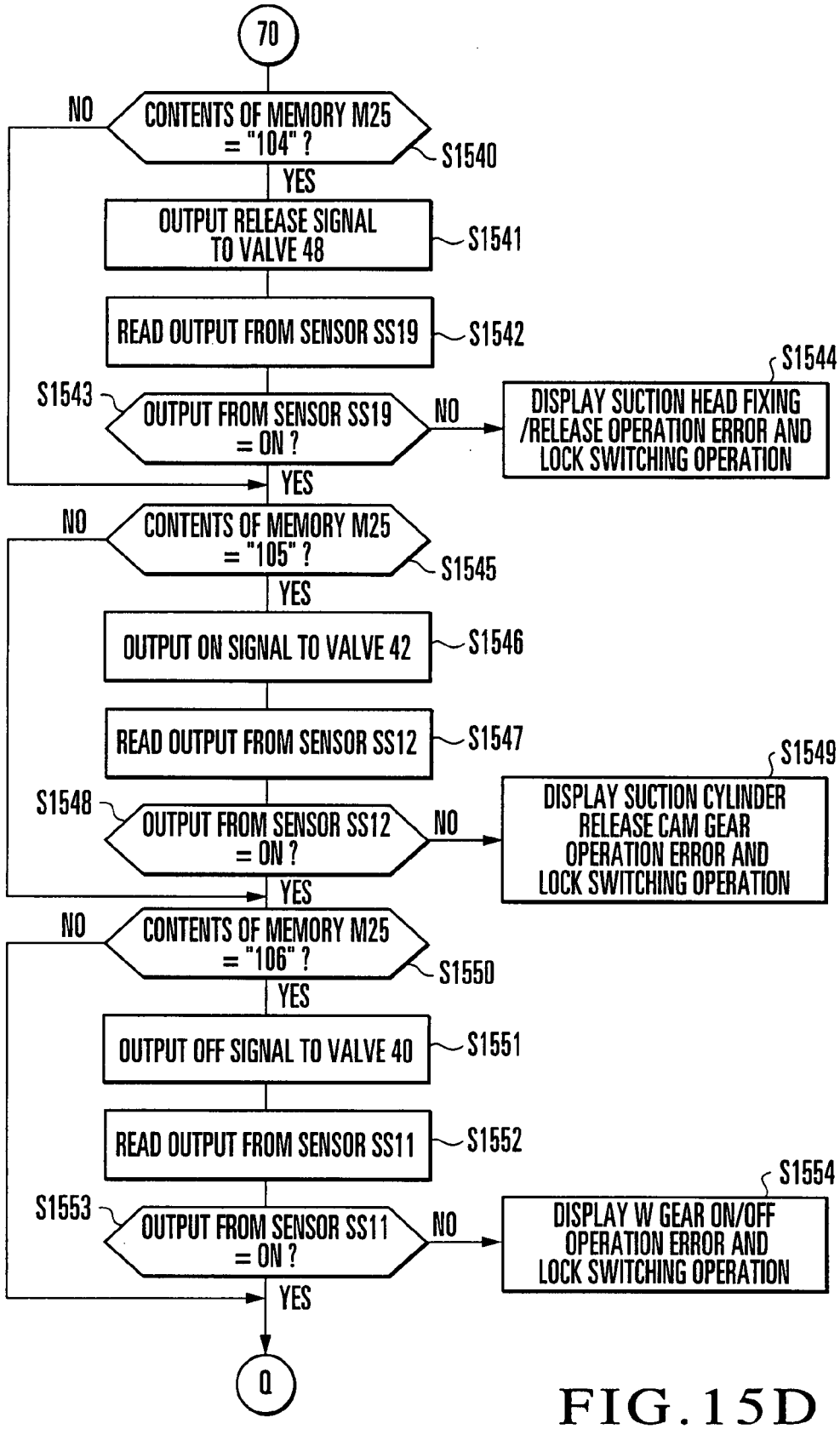
Figure 15E:
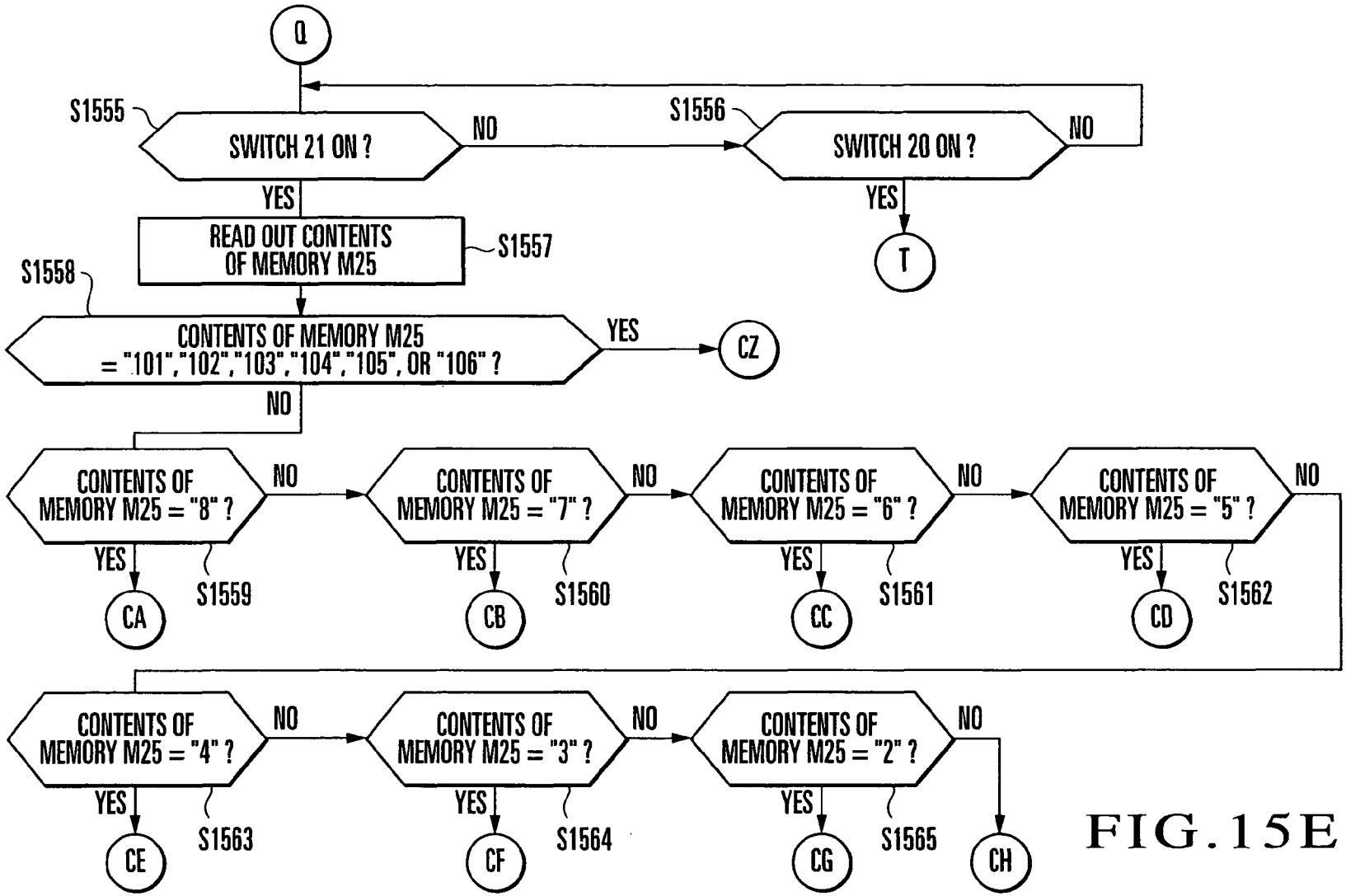
Figure 15F:
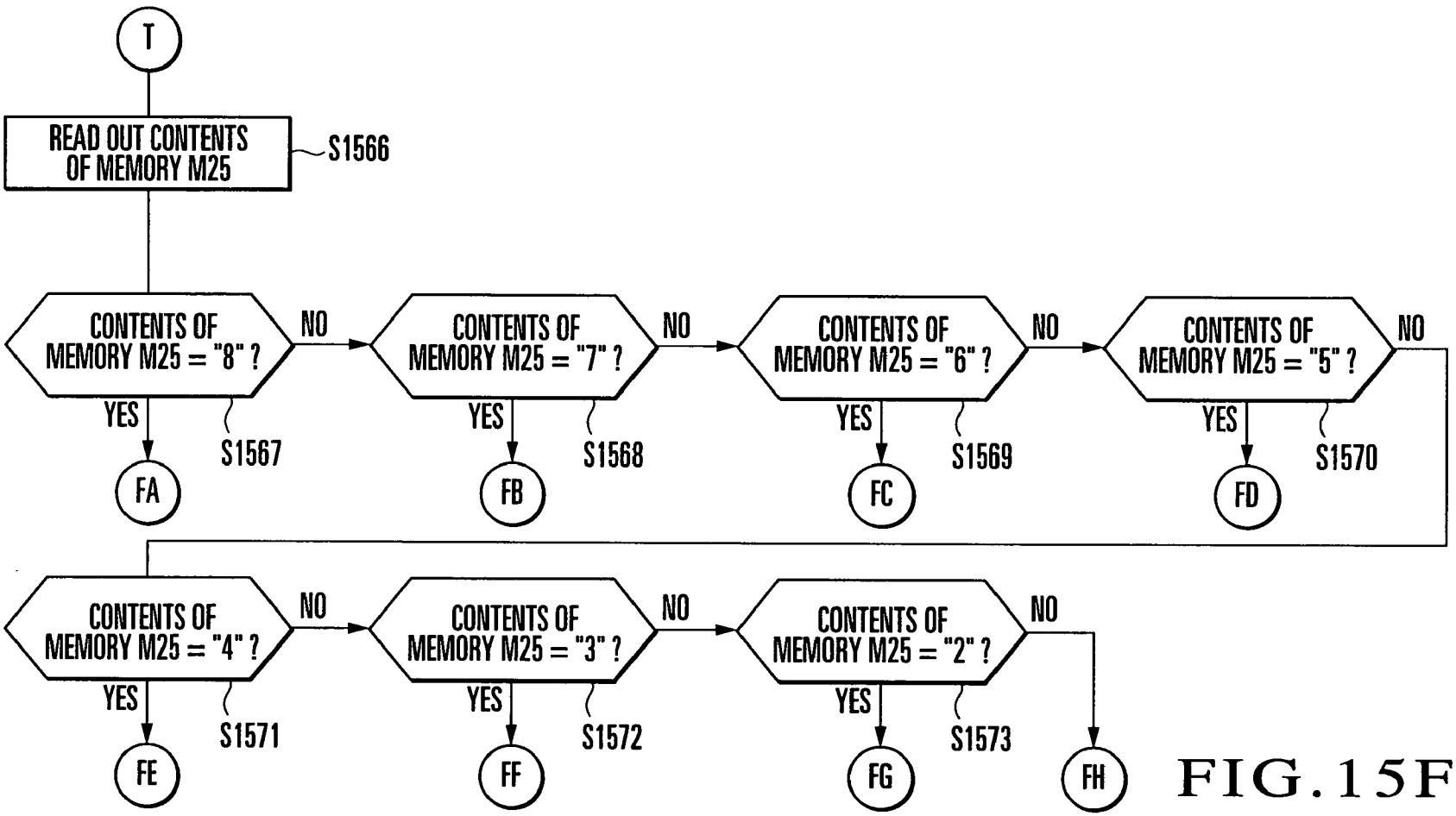

If the memory M25 stores "104" (FIG. 15D: YES in step S1540), indicating an abnormal end of "switching step 12", the CPU 10 outputs a release signal to the suction head fixing/release air cylinder valve 48 (step S1541) to eliminate the error in "switching step 12".

[Error in Switching Step 11]

If the memory M25 stores "105" (YES in step S1545), indicating an abnormal end of "switching step 11", the CPU 10 outputs an ON signal to the suction cylinder release cam gear ON/OFF air cylinder valve 42 (step S1546) to eliminate the error in "switching step 11".

[Error in Switching Step 10]

If the memory M25 stores "106" (YES in step S1550), indicating an abnormal end of "switching step 10", the CPU 10 outputs an OFF signal to the W gear ON/OFF air cylinder valve 40 (step S1551) to eliminate the error in "switching step 10".

In the above-described operation, if the ON state of the output from the suction head fixing sensor SS18 is not confirmed, i.e., if error recovery has failed even though a fixing signal is output to the suction head fixing/release air cylinder valve 48 in step S1503 (FIG. 15A), the CPU 10 displays it and locks the switching operation (step S1504). Similarly, if error recovery has failed in any other step, the CPU 10 displays it and locks the switching operation. In this case, the operator manually returns the mode to the single-sided printing state.

[Retry after Error Recovery]

If error recovery has succeeded, the operator turns on the retry switch 20. Since YES in step S1556 (FIG. 15E), the CPU 10 advances to step S1566 (FIG. 15F) to read out the contents of the error step memory M25. On the basis of the error number written in the memory M25, the CPU 10 restarts automatic change of the paper size from the switching step that has undergone error recovery and restored the initial state.

If the memory M25 stores, e.g., "8" (YES in step S1567), automatic switching restarts from step S1306 in the flowchart in FIG. 14A. If the memory M25 stores "7" (YES in step S1568), automatic switching restarts from step S1315 in the flowchart in FIG. 14B. If the memory M25 stores "6" (YES in step S1569), automatic switching restarts from step S1339 in the flowchart in FIG. 14E. If the memory M25 stores "5" (YES in step S1570), automatic switching restarts from step S1343 in the flowchart in FIG. 14E.

If the memory M25 stores "4" (YES in step S1571), automatic switching restarts from step S1347 in the flowchart in FIG. 14E. If the memory M25 stores "3" (YES in step S1572), automatic switching restarts from step S1351 in the flowchart in FIG. 14F. If the memory M25 stores "2" (YES in step S1573), automatic switching restarts from step S1355 in the flowchart in FIG. 14F. If the memory M25 stores "1", automatic switching restarts from step S1359 in the flowchart in FIG. 14G.

[Automatic Return]

Upon determining that there is no probability that the switching step will normally finish even in retry, the operator turns on the return operation start switch 21. Since YES in step S1555 (FIG. 15E), the CPU 10 advances to step S1557 to read out the contents of the error step memory M25. On the basis of the error number written in the memory M25, the CPU 10 starts automatic return from paper size return operation steps "R3-1 to R3-6" and "R3-F" (Tables 7, 8, and 9) corresponding to the error number to the printing state (initial paper size) before the start of automatic switching.

When the paper size return operation step corresponding to the error number written in the memory M25 is "R3-F", automatic change of the paper size is forcedly terminated through the steps of "W gear ON", "release cam gear OFF", "suction head fixing", "suction head hook OFF", "convertible cylinder brake OFF", and "auxiliary drive gear OFF", instead of automatic return to the paper size state before change.

[Automatic Return from Paper Size Return Operation Step [R3-1]]

If the memory M25 stores, e.g., "1", the CPU 10 sets the paper size return operation step "R3-1" as the paper size return starting step and starts automatic return from the paper size return operation step "R3-1" to the paper size before change. In this case, since NO in step S1565 in FIG. 15E, the process advances to step S1601 in FIG. 16A to outputs an ON signal to the W gear ON/OFF air cylinder valve 40.

The CPU 10 reads the output from the W gear ON sensor SS10 (step S1602). If the output from the W gear ON sensor SS10 is ON (YES in step S1603), the CPU 10 outputs an OFF signal to the suction cylinder release cam gear ON/OFF air cylinder valve 42 (step S1605) and reads the output from the suction cylinder release cam gear OFF sensor SS13 (step S1606).

If the output from the suction cylinder release cam gear OFF sensor SS13 is ON (YES in step S1607), the CPU 10 outputs a fixing signal to the suction head fixing/release air cylinder valve 48 (step S1609) and reads the output from the suction head fixing sensor SS18 (step S1610). If the output from the suction head fixing sensor SS18 is ON (YES in step S1611), the CPU 10 outputs an OFF signal to the suction head hook ON/OFF air cylinder valve 46 (FIG. 16B: step S1613) and reads the output from the suction head hook OFF sensor SS17 (step S1614).

If the output from the suction head hook OFF sensor SS17 is ON (YES in step S1615), the CPU 10 outputs an OFF signal to the convertible cylinder brake ON/OFF air cylinder valve 34 (step S1617) and reads the output from the convertible cylinder brake OFF sensor SS5 (step S1618). If the output from the convertible cylinder brake OFF sensor SS5 is ON (YES in step S1619), the CPU 10 outputs an OFF signal to the auxiliary drive gear ON/OFF air cylinder valve 30 (step S1621) and reads the output from the auxiliary drive gear OFF sensor SS2 (step S1622). If the output from the auxiliary drive gear OFF sensor SS2 is ON (YES in step S1623), the process returns to step S102 in the flowchart in FIG. 8A. The printing state of the printing press returns to the paper size before change (the printing state before the start of automatic switching).

In the above-described operation, if the ON state of the output from the W gear ON sensor SS10 is not confirmed in step S1603 (FIG. 16A), the CPU 10 determines it as a W gear ON/OFF operation error, displays it, and locks the switching operation (step S1604). Similarly, if an error is determined in any other step, the CPU 10 displays it and locks the switching operation. In this case, the operator manually returns the mode to the single-sided printing state.

[Automatic Return from Other Paper Size Return Operation Steps]

A case wherein the memory M25 stores "1" has been described above. When the memory M25 stores "2", "3", or "4", the CPU 10 starts automatic return from the paper size return operation step "R3-1" (FIG. 16A: step S1601) to the paper size before change in the same way. When the memory M25 stores "5", the CPU 10 starts automatic return from the paper size return operation step "R3-5" (FIG. 16B: step S1617) to the paper size before change. When the memory M25 stores "6", "7", or "8", the CPU 10 starts automatic return from the paper size return operation step "R3-6" (FIG. 16B: step S1621) to the paper size before change.

Figure 16A:
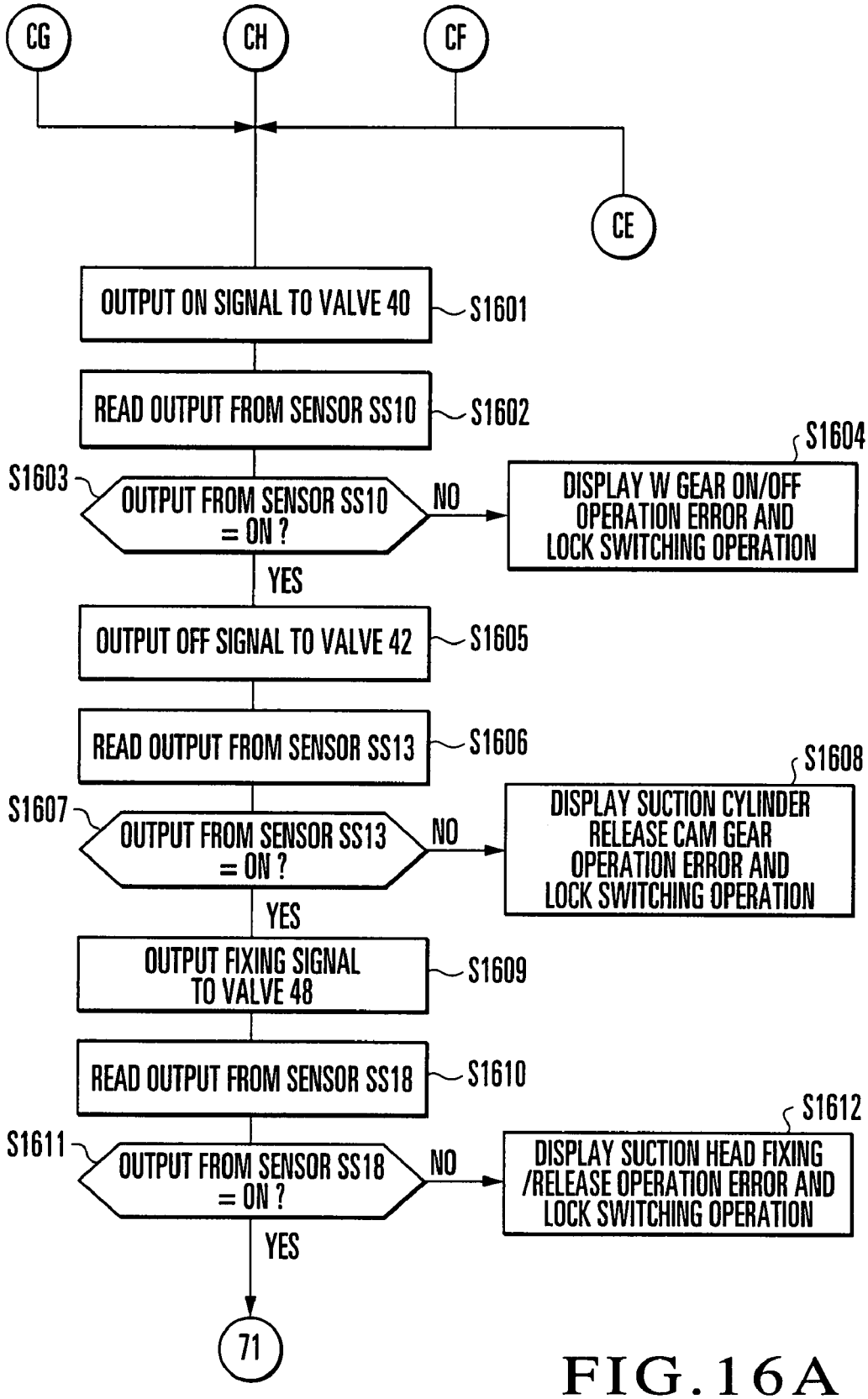
FIGS. 16A to 16D are flowcharts for explaining an automatic return operation to a paper size before the change.
Figure 16B:
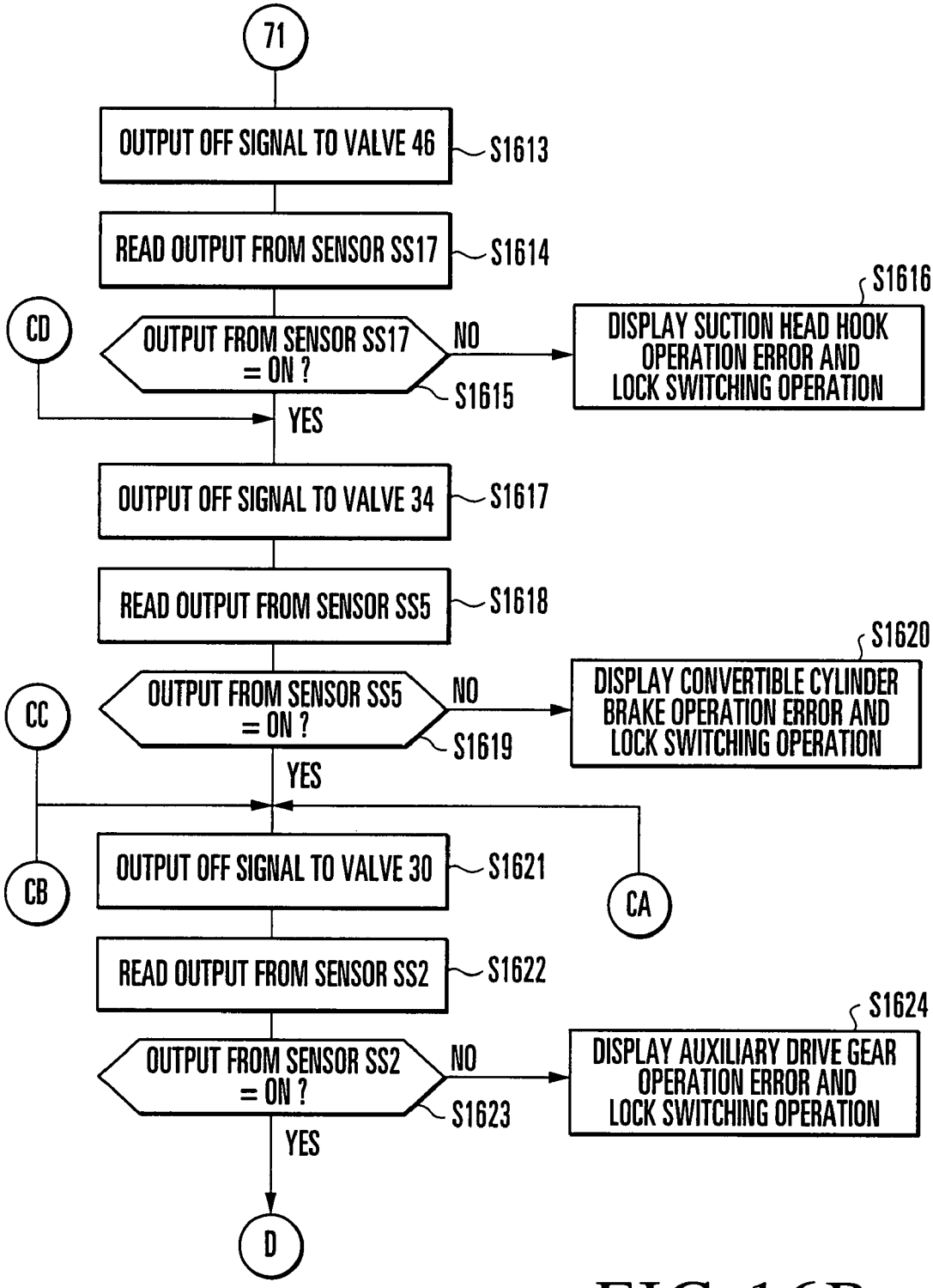
Figure 16C:
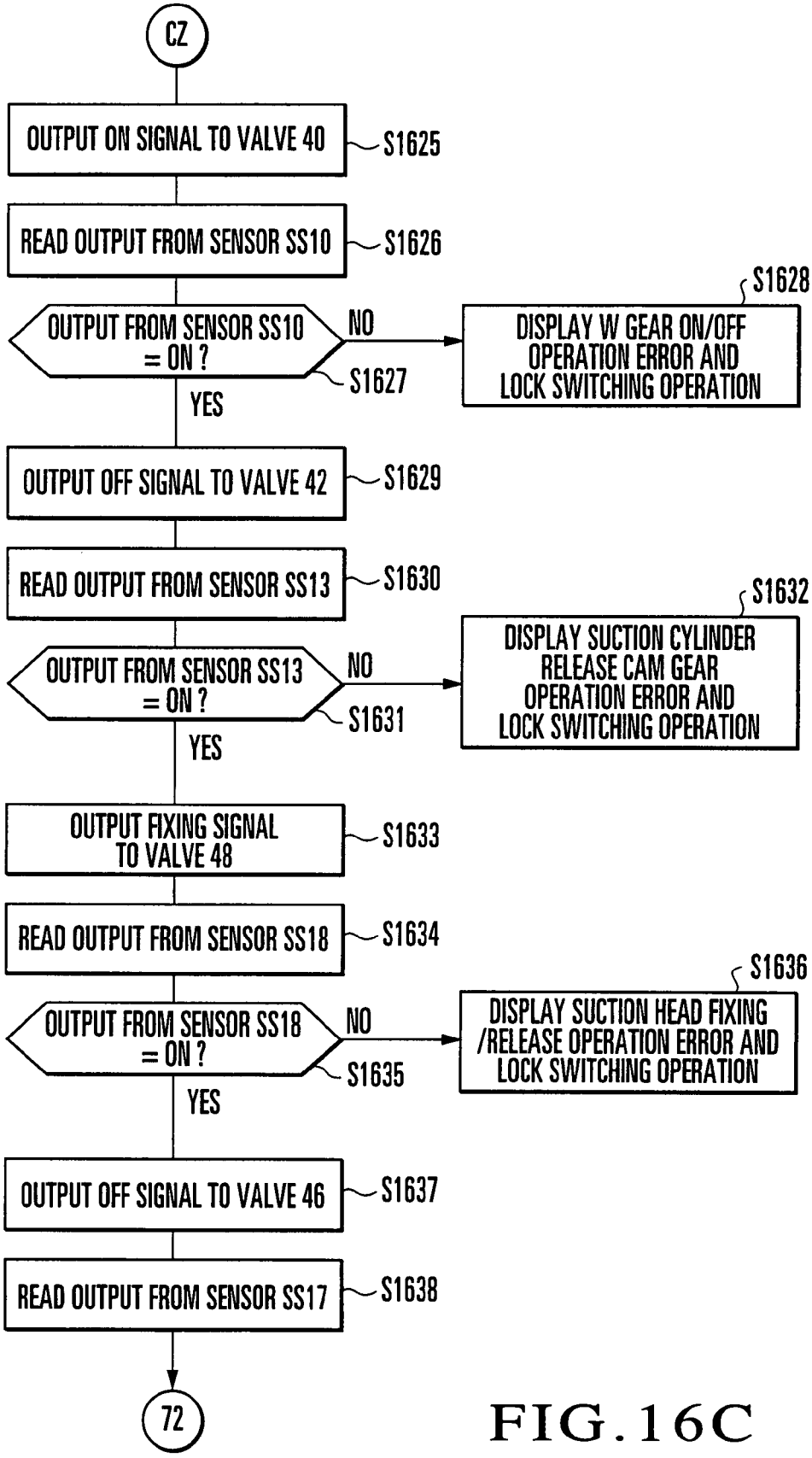
Figure 16D:
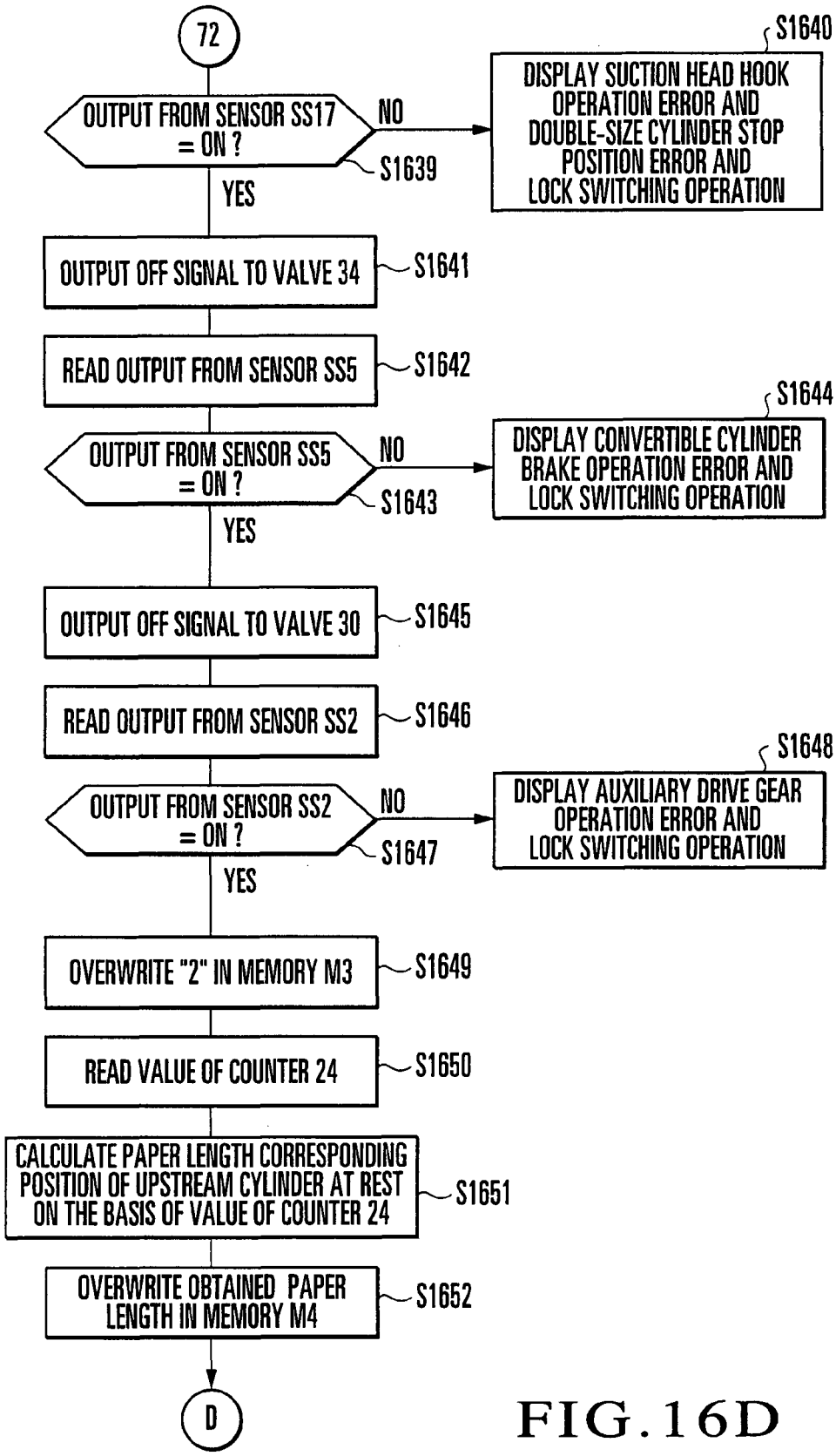

FIGS. 16C and 16D divisionally show the forced termination process during automatic change of the paper size from the paper size return operation step "R3-F". When the memory M25 stores "101", "102", "103", "104", "105", or "106", the CPU 10 advances to step S1625 in the flowchart in FIG. 16C. The operation in steps S1625 to S1649 in this flowchart is the same as the above-described operation in steps S637 to S661 in the flowchart (FIGS. 10L and 10M) of the forced termination process during automatic switching from the single-side return operation step "R1-F" to the double-sided printing state, and a description thereof will not be repeated.

In this case, the CPU 10 rewrites the contents of the previous single-sided printing/double-sided printing memory M3 to "2" (step S1649) and reads the value of the upstream cylinder position detection counter 24 (step S1650). On the basis of the read value of the upstream cylinder position detection counter 24, the CPU 10 calculates a paper length corresponding the position of the upstream cylinder at the rest (step S1651) and overwrites the obtained paper length in the previous paper length memory M4 (step S1652).

In the flowchart of the process operation, when an error has occurred in a switching step, the operator presses the error recovery switch 19, retry switch 20, and return operation start switch 21 at his/her discretion. However, if an error has occurred, the CPU 10 may automatically start the operation from error recovery to return or the operation from error recovery to retry at its discretion. Each of the sensors SS1 and SS2 and SS4 to SS19 is incorporated in a corresponding air cylinder and operates in accordance with the piston position in the air cylinder. However, the sensors may directly detect the completion of the operations of the units.

[Functions Implemented by CPU]

Figure 17:
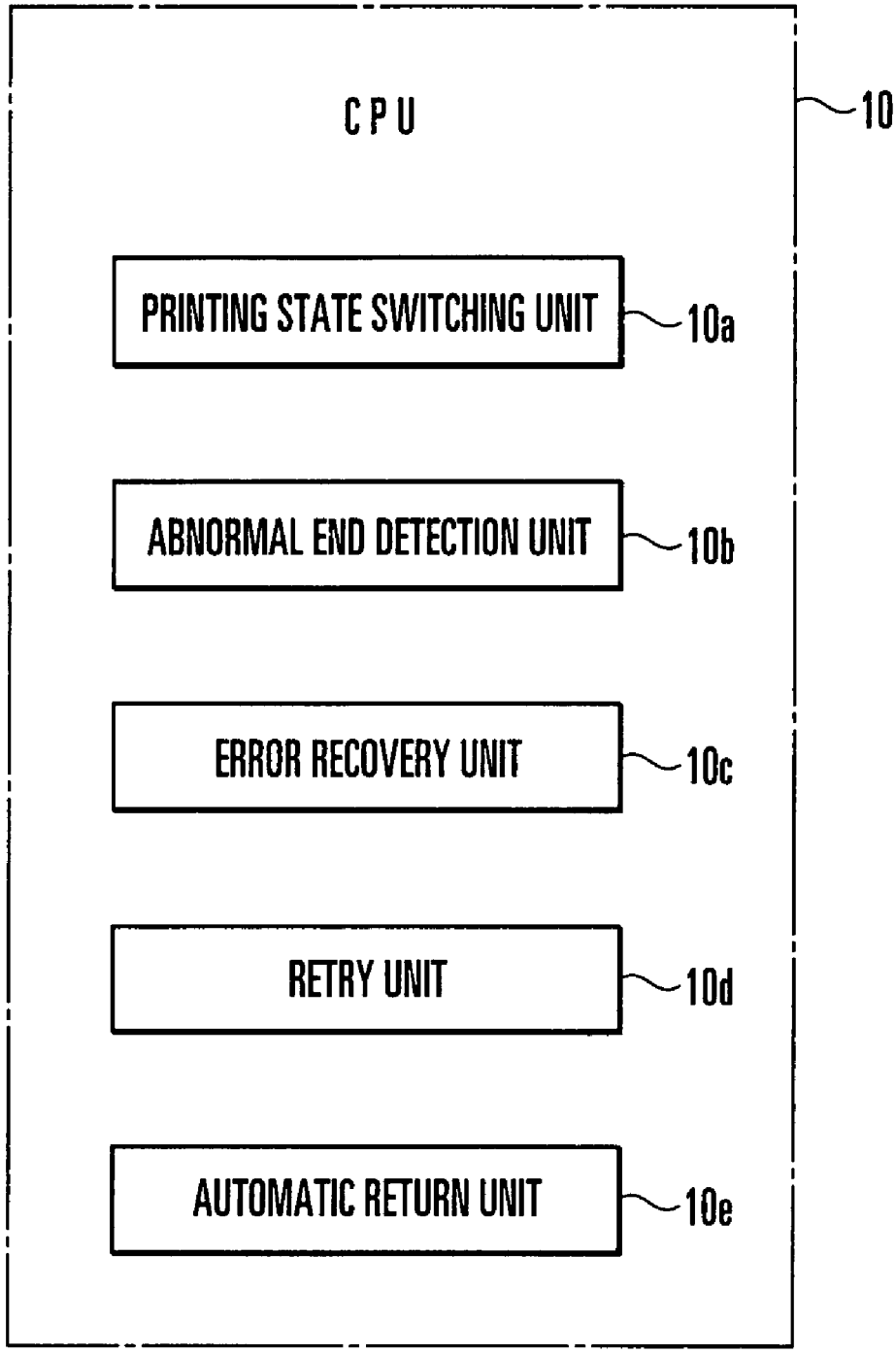
FIG. 17 is a functional block diagram of a CPU in FIG. 4A.

The outline of the functions implemented by the CPU 10 of the printing state automatic switching apparatus 100 will be described next with reference to FIG. 17. The CPU 10 operates in accordance with the printing state automatic switching program stored in the ROM 11, thereby implementing at least a printing state switching unit 10*a*, abnormal end detection unit 10*b*, error recovery unit 10*c*, retry unit 10*d*, and automatic return unit 10*e* shown in FIG. 17.

The printing state switching unit 10*a* automatically switches the printing state of the sheet-fed offset printing press equipped with a convertible press mechanism shown in FIG. 1 from a first printing state to a second printing state through a plurality of switching steps. The abnormal end detection unit 10*b* detects an abnormal end of each switching step of automatic switching from the first printing state to the second printing state. The printing state switching unit 10*a* and abnormal end detection unit 10*b* execute the processes in, e.g., steps S101 to S340. Especially, the abnormal end detection unit 10*b* executes the processes in, e.g., steps S126 to S132, S135 to S141, S144 to S151, S153 to S156, S158 to S160, S171 to S174, S176 to S178, S180 to S182, S184 to S186, S188 to S190, S201 to S204, S206 to S208, S210 to S212, S214 to S216, S218 to S220, S222 to S224, S254 to S256, S258 to S260, S262 to S264, S276 to S280, S282 to S284, S286 to S288, S290 to S292, S310 to S313, S315 to S317, S319 to S321, S323 to S325, S327 to S329, S331 to S333, and S335 to S337.

When an abnormal end of a switching step is detected, the error recovery unit 10*c* receives an error recovery instruction and eliminates the error of the switching step with the detected abnormal end. The error recovery unit 10*c* executes the processes in, e.g., steps S341 to S427.

When an error of a switching step is eliminated, the retry unit 10*d* receives a restart instruction and restarts automatic switching from the switching step that has undergone error recovery to the second printing state. The retry unit 10*d* executes the processes in, e.g., steps S429 and S453 to S474.

When an abnormal end of a switching step is detected, the automatic return unit 10*e* receives a return instruction and automatically returns the printing state of the sheet-fed offset printing press equipped with a convertible press mechanism to the first printing state. The automatic return unit 10*e* executes the processes in, e.g., steps S428, S430 to S452, and S501 to S663.

According to this embodiment, when an error has occurred during automatic switching from the first printing state to the second printing state, an error recovery instruction is issued by, e.g., turning on the error recovery switch. Then, the error of the abnormally ended switching step is eliminated to return the mode to the initial state so that a restartable state is obtained. When a restart instruction is issued by, e.g., turning on the restart switch, automatic switching to the second printing state can restart. Additionally, when a return instruction is issued by, e.g., turning on the return switch, the printing state of the printing press can automatically return to the first printing state. For example, when an error has occurred during automatic switching from the single-sided printing state to the double-sided printing state, the printing state can return to the single-sided printing state. When an error has occurred during automatic switching from the double-sided printing state to the single-sided printing state, the printing state can return to the double-sided printing state. When an error has occurred during automatic change of the paper size in the double-sided printing state, the printing state can return to the paper size before the change (initial paper size). Hence, even an inexperienced operator can easily and quickly deal with an error.

In this embodiment, detection of an abnormal end of a switching step during automatic switching from the first printing state to the second printing state may be done in some or all of the plurality of switching steps executed in automatic switching. That is, detection of an abnormal end of at least one switching step suffices. When an abnormal end of a switching step is detected, the abnormally ended switching step may be unable to return to the initial state depending on the contents of the error. In this case, the operator manually returns the mode to, e.g., the single-sided printing state. The computer may automatically output the return instruction, error recovery instruction, and restart instruction by its discretion.

What is claimed is:

1. A printing state automatic switching apparatus comprising:

printing state switching means for automatically switching a printing state of a printing press from a first printing state to a second printing state through a plurality of switching steps;

abnormal end detection means for detecting an abnormal end of each switching step of automatic switching from the first printing state to the second printing state by said printing state switching means;

switching operation interrupting means for, when said abnormal end detection means has detected an abnormal end of a switching step, interrupting that switching step having undergone the above-detected abnormal end;

error recovery means for, when said abnormal end detection means detects an abnormal end of a switching step, receiving an error recovery instruction and eliminating the error of the switching step with the detected abnormal end;

error recovery detection means for detecting that the error of the switching step has been eliminated by said error recovery means; and switching operation lock means for locking the automatic switching of said printing state switching means without operator intervention when said error recovery detection means has failed to detect that the error of the switching step has been eliminated.

2. An apparatus according to claim 1, further comprising retry means for, when the error of the switching step is eliminated by said error recovery means, receiving a restart instruction and restarting automatic switching from the switching step that has undergone error recovery to the second printing state.

3. An apparatus according to claim 2, further comprising automatic return means for, when the abnormal end of the switching step is detected by said abnormal end detection means, receiving a return instruction and automatically returning the printing state of the printing press to the first printing state.

4. An apparatus according to claim 1, wherein said printing state switching means switches the printing state from a single-sided printing state as the first printing state to a double-sided printing state as the second printing state.

5. An apparatus according to claim 1, wherein said printing state switching means switches the printing state from a double-sided printing state as the first printing state to a single-sided printing state as the second printing state.

6. An apparatus according to claim 1, wherein said printing state switching means changes a paper size in a double-sided printing state as switching of the printing state.

7. A printing state automatic switching method comprising the steps of:

automatically switching a printing state of a printing press from a first printing state to a second printing state through a plurality of switching steps;

detecting an abnormal end of each switching step of automatic switching from the first printing state to the second printing state;

when an abnormal end of a switching step is detected, receiving an error recovery instruction and eliminating the error of the switching step with the detected abnormal end;

detecting that the error of the switching step has been eliminated;

switching operation interrupting for, when said abnormal end detecting has detected an abnormal end of a switching step, interrupting that switching step having undergone the above-detected abnormal end; and locking the automatic switching without operator intervention when the fact that the error of the switching step has been eliminated is not detected.

8. A method according to claim 7, further comprising the step of, when the error of the switching step is eliminated, receiving a restart instruction and restarting automatic switching from the switching step that has undergone error recovery to the second printing state.

9. A method according to claim 8, further comprising the step of, when the abnormal end of the switching step is detected, receiving a return instruction and automatically returning the printing state of the printing press to the first printing state.

10. A method according to claim 7, wherein in the switching step, the printing state is switched from a single-sided printing state as the first printing state to a double-sided printing state as the second printing state.

11. A method according to claim 7, wherein in the switching step, the printing state is switched from a double-sided printing state as the first printing state to a single-sided printing state as the second printing state.

12. A method according to claim 7, wherein in the switching step, a paper size in a double-sided printing state is changed as switching of the printing state.

* * * * *